US006860375B2

(12) United States Patent
Hallowell et al.

(10) Patent No.: US 6,860,375 B2
(45) Date of Patent: Mar. 1, 2005

(54) MULTIPLE POCKET CURRENCY BILL PROCESSING DEVICE AND METHOD

(75) Inventors: Curtis W. Hallowell, Palatine, IL (US); Robert J. Klein, Chicago, IL (US); Mark C. Munro, Park Ridge, IL (US); Bradford T. Graves, Arlington Heights, IL (US)

(73) Assignee: Cummins-Allison Corporation, Mt. Prospect, IL (US)

( * ) Notice: Subject to any disclaimer, the term of this patent is extended or adjusted under 35 U.S.C. 154(b) by 31 days.

(21) Appl. No.: 10/068,977

(22) Filed: Feb. 8, 2002

(65) Prior Publication Data

US 2003/0015395 A1 Jan. 23, 2003

Related U.S. Application Data

(63) Continuation-in-part of application No. 09/635,967, filed on Aug. 10, 2000, which is a continuation of application No. 08/864,423, filed on May 28, 1997, now Pat. No. 6,311,819.

(60) Provisional application No. 60/018,563, filed on May 29, 1996, provisional application No. 60/034,954, filed on Jan. 16, 1997, and provisional application No. 60/038,340, filed on Feb. 27, 1997.

(51) Int. Cl.[7] ..... G07D 5/00

(52) U.S. Cl. ..... 194/328; 209/534; 902/7

(58) Field of Search ..... 209/534; 902/7; 194/328; 700/223, 224, 226

(56) References Cited

U.S. PATENT DOCUMENTS

| | | | |
|---|---|---|---|
| 2,922,893 A | 1/1960 | Ett | 194/207 |
| 3,245,534 A | 4/1966 | Smith et al. | 382/7 |
| 3,246,295 A | 4/1966 | DeClaris et al. | 382/56 |
| 3,280,974 A | 10/1966 | Riddle et al. | 209/111.8 |
| 3,409,109 A | 11/1968 | Lizuka et al. | 194/4 |
| 3,480,785 A | 11/1969 | Aufderheide | 250/219 |
| 3,487,905 A | 1/1970 | James, Sr. | 194/210 |

(List continued on next page.)

FOREIGN PATENT DOCUMENTS

| | | |
|---|---|---|
| DE | 2760269 C2 | 1/1979 |
| DE | 26 59 929 B2 | 1/1980 |
| DE | 29 35 668 C2 | 3/1989 |

(List continued on next page.)

OTHER PUBLICATIONS

Geldinstitute–3, 2 pages (1983).
Translation of Geldinstitute–3, 5 pages (1983).
De La Rue Systems, 3110/3120 Machines, Diagnostics Function, 10 pages (Oct. 1986).
De La Rue Systems, 3110 MK II, International Currency Sorting Machine, 2 pages (1987).

(List continued on next page.)

*Primary Examiner*—Donald P. Walsh
*Assistant Examiner*—Kenneth W Bower
(74) *Attorney, Agent, or Firm*—Jenkens & Gilchrist

(57) ABSTRACT

Methods and devices for dynamically assigning document parameters to output receptacles of multiple output receptacle document evaluating devices. Documents are directed into individual output receptacles based upon their document parameter or parameters. For example, according to one embodiment a currency evaluating device comprises an input receptacle adapted to receive a stack of currency bills, a plurality of output receptacles, a transport mechanism, and a processor adapted to control the operation of the device. The processor is programmed to determine the denomination of a bill and determine if an output receptacle is associated with the denomination of the bill. If an output receptacle is not associated with the denomination of the bill, the processor is programmed to associate an output receptacle with the denomination of the bill and cause the bill to be transported to an output receptacle associated with the denomination of the bill.

34 Claims, 58 Drawing Sheets

U.S. PATENT DOCUMENTS

| | | | | |
|---|---|---|---|---|
| 3,496,370 | A | 2/1970 | Haville et al. | 250/219 |
| 3,509,535 | A | 4/1970 | Berube | 340/149 |
| 3,612,835 | A | 10/1971 | Andrews et al. | 235/61.11 D |
| 3,618,765 | A | 11/1971 | Cooper et al. | 209/534 |
| 3,635,321 | A | 1/1972 | Frazier, Sr. | 194/207 |
| 3,679,314 | A | 7/1972 | Mustert | 356/71 |
| 3,759,382 | A | 9/1973 | Walkley et al. | 209/111.7 |
| 3,764,899 | A | 10/1973 | Peterson et al. | 324/61 R |
| 3,778,628 | A | 12/1973 | Novak et al. | 250/556 |
| 3,815,021 | A | 6/1974 | Kerr | 324/61 R |
| 3,842,281 | A | 10/1974 | Goodrich | 250/461 |
| 3,870,629 | A | 3/1975 | Carter et al. | 209/111.8 |
| 3,906,449 | A | 9/1975 | Marchak | 340/146.3 R |
| 3,952,183 | A | 4/1976 | Abe | 235/92 |
| 3,976,198 | A | 8/1976 | Carnes, Jr. et al. | 209/111.7 T |
| 4,041,456 | A | 8/1977 | Ott et al. | 340/146.3 R |
| 4,081,131 | A | 3/1978 | Sand et al. | 235/419 |
| 4,096,991 | A | 6/1978 | Iguchi | 235/419 |
| 4,114,804 | A | 9/1978 | Jones et al. | 235/476 |
| 4,147,430 | A | 4/1979 | Gorgone et al. | 356/51 |
| 4,164,770 | A | 8/1979 | Jeffers | 360/113 |
| 4,166,945 | A | 9/1979 | Inoyama et al. | 235/379 |
| 4,167,458 | A | 9/1979 | Louzos et al. | 204/14 |
| 4,179,685 | A | 12/1979 | O'Maley | 340/146.3 |
| 4,243,216 | A | 1/1981 | McInerny | 271/263 |
| 4,250,806 | A | 2/1981 | Boyson et al. | 101/2 |
| 4,255,651 | A | 3/1981 | Phillips | 235/92 |
| 4,275,874 | A | 6/1981 | DiBlasio | 271/187 |
| 4,277,774 | A | 7/1981 | Fujii et al. | 340/146.3 |
| 4,283,708 | A | 8/1981 | Lee | 340/146.32 |
| 4,288,781 | A | 9/1981 | Sellner et al. | 340/146.3 |
| 4,302,781 | A | 11/1981 | Ikeda et al. | 358/486 |
| 4,311,914 | A | 1/1982 | Huber | 250/556 |
| 4,313,598 | A | 2/1982 | DiBlasio | 271/124 |
| 4,334,619 | A | 6/1982 | Horino et al. | 209/551 |
| 4,348,656 | A | 9/1982 | Gorgone et al. | 340/146.3 R |
| 4,349,111 | A | 9/1982 | Shah et al. | 209/534 |
| 4,352,988 | A | 10/1982 | Ishida | 250/559 |
| 4,355,300 | A | 10/1982 | Weber | 340/146.3 C |
| 4,356,473 | A | 10/1982 | Freudenthal | 340/146.3 H |
| 4,365,700 | A | 12/1982 | Arimoto et al. | 194/2 |
| 4,381,447 | A | 4/1983 | Horvath et al. | 250/223 |
| 4,386,432 | A | 5/1983 | Nakamura et al. | 382/7 |
| 4,388,662 | A | 6/1983 | Jeffers et al. | 360/113 |
| 4,413,296 | A | 11/1983 | Jeffers | 360/113 |
| 4,416,449 | A | 11/1983 | McInerny | 271/122 |
| 4,420,153 | A | 12/1983 | Winkler et al. | 271/304 |
| 4,442,541 | A | 4/1984 | Finkel et al. | 382/7 |
| 4,461,028 | A | 7/1984 | Okubo | 382/15 |
| 4,464,786 | A | 8/1984 | Nishito et al. | 382/15 |
| 4,464,787 | A | 8/1984 | Fish et al. | 382/7 |
| 4,470,496 | A | 9/1984 | Steiner | 194/4 C |
| RE31,692 | E | 10/1984 | Tyburski et al. | 382/7 |
| 4,479,049 | A | 10/1984 | Hirose | 235/279 |
| 4,480,177 | A | 10/1984 | Allen | 235/379 |
| 4,482,058 | A | 11/1984 | Steiner | 209/534 |
| 4,487,306 | A | 12/1984 | Nao et al. | 382/135 |
| 4,490,846 | A | 12/1984 | Ishida et al. | 382/7 |
| 4,503,963 | A | 3/1985 | Steiner | 194/4 |
| 4,513,439 | A | 4/1985 | Gorgone et al. | 382/7 |
| 4,532,641 | A | 7/1985 | Nishimura | 377/14 |
| 4,539,702 | A | 9/1985 | Oka | 382/7 |
| 4,542,829 | A | 9/1985 | Emery | 209/534 |
| 4,547,896 | A | 10/1985 | Ohtombe et al. | 382/318 |
| 4,553,846 | A | 11/1985 | Hilton et al. | 356/429 |
| 4,556,140 | A | 12/1985 | Okada | 194/4 |
| 4,557,597 | A | 12/1985 | Iwama | 356/71 |
| 4,558,224 | A | 12/1985 | Gober | 250/460.1 |
| 4,559,451 | A | 12/1985 | Curl | 250/560 |
| 4,559,452 | A | 12/1985 | Igaki et al. | 250/560 |
| 4,563,771 | A | 1/1986 | Gorgone et al. | 382/7 |
| 4,567,370 | A | 1/1986 | Falls | 250/461.1 |
| 4,587,412 | A | 5/1986 | Apisdorf | 235/449 |
| 4,587,434 | A | 5/1986 | Roes et al. | 250/556 |
| 4,588,292 | A | 5/1986 | Collins | 356/71 |
| 4,592,090 | A | 5/1986 | Curl et al. | 382/7 |
| 4,593,184 | A | 6/1986 | Bryce et al. | 235/449 |
| 4,611,345 | A | 9/1986 | Ohnishi et al. | 382/7 |
| 4,625,870 | A | 12/1986 | Nao et al. | 209/534 |
| 4,628,194 | A | 12/1986 | Dobbins et al. | 235/379 |
| 4,645,936 | A | 2/1987 | Gorgone | 250/556 |
| 4,653,647 | A | 3/1987 | Hashimoto | 209/534 |
| 4,658,289 | A | 4/1987 | Nagano et al. | 358/75 |
| 4,677,682 | A | 6/1987 | Miyagawa et al. | 382/7 |
| 4,681,229 | A | 7/1987 | Uesaka et al. | 209/534 |
| 4,683,508 | A | 7/1987 | Jeffers et al. | 360/113 |
| 4,690,268 | A | 9/1987 | Ueshin | 198/399 |
| 4,694,963 | A | 9/1987 | Takesako | 209/534 |
| 4,697,071 | A | 9/1987 | Hiraoka et al. | 235/379 |
| 4,700,368 | A | 10/1987 | Munn et al. | 377/8 |
| 4,707,843 | A | 11/1987 | McDonald et al. | 377/8 |
| 4,716,456 | A | 12/1987 | Hosaka | 358/75 |
| 4,733,308 | A | 3/1988 | Nakamura et al. | 358/496 |
| 4,747,492 | A | 5/1988 | Saito et al. | 209/534 |
| 4,749,076 | A | 6/1988 | Akagawa et al. | 194/207 |
| 4,749,087 | A | 6/1988 | Buttifant | 382/7 |
| 4,761,002 | A | 8/1988 | Reed et al. | 271/111 |
| 4,764,725 | A | 8/1988 | Bryce | 324/334 |
| 4,764,976 | A | 8/1988 | Kallin et al. | 382/65 |
| 4,784,274 | A | 11/1988 | Mori et al. | |
| 4,787,518 | A | 11/1988 | Yuge et al. | 209/534 |
| 4,817,176 | A | 3/1989 | Marshall et al. | 382/43 |
| 4,820,909 | A | 4/1989 | Kawauchi et al. | 235/379 |
| 4,823,393 | A | 4/1989 | Kawakami | 382/7 |
| 4,825,246 | A | 4/1989 | Fukuchi et al. | 355/4 |
| 4,827,531 | A | 5/1989 | Milford | 382/7 |
| 4,841,358 | A | 6/1989 | Kammato et al. | 358/75 |
| 4,850,468 | A | 7/1989 | Kobayashi et al. | 194/207 |
| 4,881,268 | A | 11/1989 | Uchida et al. | 382/7 |
| 4,905,516 | A | 3/1990 | Wolfl | 250/556 |
| 4,905,840 | A | 3/1990 | Yuge et al. | 209/534 |
| 4,906,988 | A | 3/1990 | Copella | 340/825 |
| 4,922,109 | A | 5/1990 | Bercovitz et al. | |
| 4,963,118 | A | * 10/1990 | Gunn et al. | 453/3 |
| 4,973,851 | A | 11/1990 | Lee | 250/556 |
| 4,984,280 | A | 1/1991 | Abe | 382/7 |
| 4,984,692 | A | 1/1991 | Obara | 209/583 |
| 4,985,614 | A | 1/1991 | Pease et al. | 235/440 |
| 4,992,860 | A | 2/1991 | Hamaguchi et al. | 358/75 |
| 4,996,604 | A | 2/1991 | Ogawa et al. | 358/486 |
| 5,012,932 | A | 5/1991 | Omura et al. | 209/534 |
| 5,020,787 | A | 6/1991 | Arikawa | 271/3 |
| 5,027,415 | A | 6/1991 | Hara et al. | 382/135 |
| 5,047,871 | A | 9/1991 | Meyer et al. | 358/486 |
| 5,051,900 | A | 9/1991 | Ito et al. | 364/408 |
| 5,054,621 | A | 10/1991 | Murphy et al. | 209/534 |
| 5,055,834 | A | 10/1991 | Chiba | 382/135 |
| 5,068,519 | A | 11/1991 | Bryce | 235/449 |
| 5,076,441 | A | 12/1991 | Gerlier | 209/534 |
| 5,105,364 | A | 4/1992 | Kawamura et al. | 364/478 |
| 5,119,025 | A | 6/1992 | Smith et al. | 324/252 |
| 5,122,754 | A | 6/1992 | Gotaas | 324/676 |
| 5,146,067 | A | 9/1992 | Sloan et al. | 235/381 |
| 5,151,607 | A | 9/1992 | Crane et al. | 250/556 |
| 5,163,672 | A | 11/1992 | Mennie | 271/187 |
| 5,167,313 | A | 12/1992 | Dobbins et al. | 194/317 |
| 5,167,411 | A | 12/1992 | Isobe | 271/273 |
| 5,172,907 | A | 12/1992 | Kalisiak | 271/227 |
| 5,183,142 | A | 2/1993 | Latchinian et al. | 194/206 |
| 5,199,543 | A | 4/1993 | Kamagami et al. | 194/207 |
| 5,201,395 | A | 4/1993 | Takizawa et al. | 194/206 |

| | | | | | |
|---|---|---|---|---|---|
| 5,207,788 | A | | 5/1993 | Geib et al. | 271/122 |
| 5,220,395 | A | | 6/1993 | Yamashita et al. | 355/313 |
| 5,230,653 | A | | 7/1993 | Shinozaki et al. | 453/4 |
| 5,236,072 | A | | 8/1993 | Cargill | 194/207 |
| 5,240,116 | A | | 8/1993 | Stevens et al. | 209/534 |
| 5,242,041 | A | | 9/1993 | Isobe | 194/207 |
| 5,259,490 | A | | 11/1993 | Gardellini | 194/203 |
| 5,261,518 | A | | 11/1993 | Bryce | 194/206 |
| 5,295,196 | A | | 3/1994 | Raterman et al. | 382/7 |
| 5,297,030 | A | | 3/1994 | Vassigh et al. | 364/405 |
| 5,301,786 | A | | 4/1994 | Yoshihara | 194/207 |
| 5,304,813 | A | | 4/1994 | DeMan | 250/556 |
| 5,308,992 | A | | 5/1994 | Crane et al. | 250/556 |
| 5,309,515 | A | | 5/1994 | Troung et al. | 382/7 |
| 5,341,408 | A | | 8/1994 | Melcher et al. | 377/8 |
| 5,358,088 | A | | 10/1994 | Barnes et al. | 194/206 |
| 5,363,949 | A | | 11/1994 | Matsubayashi | 194/206 |
| 5,367,577 | A | | 11/1994 | Gotaas | 382/135 |
| 5,394,992 | A | | 3/1995 | Winkler | 209/552 |
| 5,397,003 | A | | 3/1995 | Stevens et al. | 209/534 |
| 5,402,895 | A | | 4/1995 | Mikkelsen et al. | |
| 5,408,417 | A | | 4/1995 | Wilder | 364/479 |
| 5,418,458 | A | | 5/1995 | Jeffers | 324/235 |
| 5,419,423 | A | | 5/1995 | Ishida et al. | 194/206 |
| 5,421,443 | A | | 6/1995 | Hatamachi et al. | 194/206 |
| 5,430,664 | A | | 7/1995 | Cargill et al. | 364/550 |
| 5,437,357 | A | | 8/1995 | Ota et al. | 365/135 |
| 5,465,821 | A | | 11/1995 | Akioka | 194/207 |
| 5,467,405 | A | | 11/1995 | Raterman et al. | 382/135 |
| 5,467,406 | A | | 11/1995 | Graves et al. | 382/135 |
| 5,478,992 | A | | 12/1995 | Hamada et al. | 235/379 |
| D369,984 | S | | 5/1996 | Larsen | D10/97 |
| 5,547,062 | A | | 8/1996 | Mays et al. | 194/206 |
| 5,553,320 | A | | 9/1996 | Matsuura et al. | 235/379 |
| 5,603,492 | A | * | 2/1997 | Mandel et al. | 270/58.09 |
| 5,607,040 | A | | 3/1997 | Mathurin, Sr. | 194/207 |
| 5,616,915 | A | | 4/1997 | Simpkins et al. | 250/221 |
| 5,633,949 | A | | 5/1997 | Graves et al. | 382/135 |
| 5,639,081 | A | | 6/1997 | Hatamachi et al. | 271/177 |
| 5,640,463 | A | | 6/1997 | Csulits | 382/135 |
| 5,652,802 | A | | 7/1997 | Graves et al. | 382/135 |
| 5,657,846 | A | | 8/1997 | Schwartz | 194/206 |
| 5,680,472 | A | | 10/1997 | Conant | 382/135 |
| 5,687,963 | A | | 11/1997 | Mennie | 271/119 |
| 5,692,067 | A | | 11/1997 | Raterman et al. | 382/135 |
| 5,697,483 | A | * | 12/1997 | Ishida et al. | 194/217 |
| 5,704,491 | A | | 1/1998 | Graves | 209/534 |
| 5,724,438 | A | | 3/1998 | Graves | 382/135 |
| 5,751,840 | A | | 5/1998 | Raterman et al. | 382/135 |
| 5,761,089 | A | | 6/1998 | McInerny | 364/550 |
| 5,777,882 | A | * | 7/1998 | Salgado | 700/214 |
| 5,790,693 | A | | 8/1998 | Graves et al. | 382/135 |
| 5,790,697 | A | | 8/1998 | Jones et al. | 382/135 |
| 5,806,650 | A | | 9/1998 | Mennie et al. | 194/206 |
| 5,815,592 | A | | 9/1998 | Mennie et al. | 382/135 |
| 5,822,448 | A | | 10/1998 | Graves et al. | 382/135 |
| 5,832,104 | A | | 11/1998 | Graves et al. | 382/135 |
| 5,867,589 | A | | 2/1999 | Graves et al. | 382/135 |
| 5,870,487 | A | | 2/1999 | Graves et al. | 382/135 |
| 5,875,259 | A | | 2/1999 | Mennie et al. | 382/135 |
| 5,905,810 | A | | 5/1999 | Jones et al. | 382/135 |
| 5,912,982 | A | | 6/1999 | Munro et al. | 382/135 |
| 5,915,518 | A | | 6/1999 | Hopwood et al. | 194/207 |
| 5,938,044 | A | * | 8/1999 | Weggesser | 209/534 |
| 5,966,456 | A | | 10/1999 | Jones et al. | 382/135 |
| 5,975,273 | A | | 11/1999 | Zwahlen et al. | 194/206 |
| 5,992,600 | A | | 11/1999 | Baudat | 194/207 |
| 5,992,601 | A | | 11/1999 | Mennie et al. | 194/207 |
| 6,012,565 | A | | 1/2000 | Mazur | 194/207 |
| 6,021,883 | A | | 2/2000 | Casanova et al. | 194/217 |
| 6,028,951 | A | | 2/2000 | Raterman et al. | 382/135 |
| 6,073,744 | A | | 6/2000 | Raterman et al. | 194/207 |
| 6,074,334 | A | | 6/2000 | Mennie et al. | 493/438 |
| 6,128,402 | A | | 10/2000 | Jones et al. | 382/135 |
| 6,162,122 | A | | 12/2000 | Acres et al. | 463/29 |
| 6,220,419 | B1 | | 4/2001 | Mennie | 194/207 |
| 6,237,739 | B1 | | 5/2001 | Mazur et al. | 194/207 |
| 6,241,069 | B1 | | 6/2001 | Mazur et al. | 194/207 |
| 6,256,407 | B1 | | 7/2001 | Mennie et al. | 382/135 |
| 6,278,795 | B1 | | 8/2001 | Anderson et al. | 382/135 |
| 6,311,819 | B1 | | 11/2001 | Stromme et al. | 194/207 |
| 6,318,537 | B1 | | 11/2001 | Jones et al. | 194/346 |
| 6,351,551 | B1 | | 2/2002 | Munro et al. | 382/135 |
| 6,363,164 | B1 | | 3/2002 | Jones et al. | 382/135 |
| 6,371,303 | B1 | | 4/2002 | Klein et al. | 209/534 |
| 6,378,683 | B2 | | 4/2002 | Mennie | 194/207 |
| 6,381,354 | B1 | | 4/2002 | Mennie et al. | 382/135 |
| 6,398,000 | B1 | | 6/2002 | Jenrick et al. | 194/200 |
| 6,459,806 | B1 | | 10/2002 | Raterman et al. | 382/135 |
| 6,460,705 | B1 | | 10/2002 | Hallowell | 209/534 |
| 6,493,461 | B1 | | 12/2002 | Mennie et al. | 382/135 |
| 6,539,104 | B1 | | 3/2003 | Raterman et al. | 382/135 |
| 6,560,355 | B2 | | 5/2003 | Graves et al. | 382/135 |

FOREIGN PATENT DOCUMENTS

| | | | | | |
|---|---|---|---|---|---|
| EP | 0077464 | | | 4/1983 | |
| EP | 0130824 | A2 | | 6/1984 | |
| EP | 0130825 | A2 | | 6/1984 | |
| EP | 0132329 | A2 | | 6/1984 | |
| EP | 0253935 | A2 | | 1/1988 | |
| EP | 0264125 | A1 | | 4/1988 | |
| EP | 0325364 | | | 7/1989 | |
| EP | 0338123 | | | 10/1989 | |
| EP | 0342647 | | | 11/1989 | |
| EP | 0206675 | B1 | | 8/1992 | |
| EP | 0 706 156 | A2 | | 4/1996 | |
| GB | 2 038 063 | A | | 7/1980 | |
| GB | 2 061 232 | A | | 5/1981 | |
| GB | 2 088 832 | A | | 6/1982 | |
| GB | 2 119 138 | A | | 11/1983 | |
| GB | 2 190 996 | A | | 12/1987 | |
| GB | 2204166 | A | | 11/1988 | |
| JP | 54-71673 | | | 6/1979 | |
| JP | 54-71674 | | | 6/1979 | |
| JP | 56-16287 | | | 2/1981 | |
| JP | 56-136689 | | | 10/1981 | |
| JP | 0360093580 | A | * | 5/1985 | G06M/1/00 |
| JP | 61-14557 | | | 4/1986 | |
| JP | 61-41439 | | | 9/1986 | |
| JP | 63-271687 | | | 11/1988 | |
| WO | WO 81/01211 | | | 4/1981 | |
| WO | WO 87/06041 | | | 10/1987 | |
| WO | WO 90/07165 | | | 6/1990 | |
| WO | WO 91/11778 | | | 8/1991 | |
| WO | WO 92/17394 | | | 10/1992 | |
| WO | WO 93/23824 | | | 11/1993 | |
| WO | WO 94/19773 | | | 9/1994 | |
| WO | WO 95/24691 | | | 9/1995 | |
| WO | WO 96/10800 | | | 4/1996 | |

OTHER PUBLICATIONS

De La Rue Systems, 3120 Currency Sorting Machines with Pattern Recognition, 2 pages (1987).

De La Rue Systems, 3100 Series Operation Instructions, 52 pages (Oct. 1986).

Glory: GSA–500 Sortmaster brochure, 4 pages (est. Jan. 14, 1994).

Glory: Sale of Glory GSA–500 Sortmaster, 1 page (1986).

Glory: GSA–500—Instruction Manual, 40 pages (prior to 7/98).

Glory: GSA–500—Operating Procedures, 9 pages (prior to 7/98).
Mosler Inc. brochure "The Mosler/Toshiba CF–420", 1989.
AFB Currency Recognition System (1982).
"Sale of Doubles Detection 7/91" (8/91).
"Sale of Magnetic Detection 7/91" 8/91.
"Sale of Doubles Detection 6/92".
"Sale of Multiple Density Sensitivity Setting 4/93".
"Sale of Multiple Magnetic Sensitivity Setting 4/93".
"Offer for Sale of Optical/Magnetic Detection 9/92".
Mosler CF–420 Cash Management System Operator's Manual, cover, copyright page, and chapter 5 pp. 5–1 through 5–16, copyrighted 1989.
JetScan Currency Scanner/Counter, Model 4060, Operator's Manual by Cummins–Allison (8/91).
Sale of JetScan Currency Scanner/Counter, Model 4060 (8/91).
JetScan Currency Scanner/Counter, Model 4061, Operating Instructions by Cummins–Allison (Apr. 20, 1993).
Sale of JetScan Currency Scanner/Counter, Model 4061 (Apr. 20, 1993).
JetScan Currency Scanner/Counter, Model 4062, Operating Instructions by Cummins–Allison Nov. 28, 1994).
Sale of Jet Scan Currency Scanner/Counter, Model 4062 (Nov. 28, 1994).
Glory Instruction Manual for GFR–100 Currency Reader Counter (Aug. 15, 1995).
Description of Toshiba–Mosler CF–420 Device; estimated 1989.
Currency Systems International, Medium Speed Currency Sorting Family, CPS 600 and CPS 900; 4 pages; date: copyr. 1994.
Currency System Intl'l, Mr. W. Kranister in Conversation With Richard Haycock; pp. 1–5; dated: estimated 1994.
Description of Currency Systems International's CPS 600 and CPS 900 devices; date: estimated 1994.
Glory GSA–500 Sortmaster brochure; 2 pages; date: Jan. 14, 1994.
Glory UF–ID brochure; 2 pages; date:estimated before Aug. 9, 1994.
Currency Systems International/Currency Processing Systems, CPS 300; 4 pages; date: copyr. 1992.
Glory GFB–200/210/220/230, Desk–Top Bank Note Counter; 2 pages; date: estimated before Aug. 9, 1994.
News Product News by Toyocom, "Toyocom Currency Counter Now Reads Denominations" (Sep. 26, 1994) (1 page.
Toyocom Currency Counter, Model NS–100, "Operation Guide (Preliminary)" (Jun. 13, 1995).
Brochure of Mosler Model CS 6600 Optical Currency Counter/Sorter, 4 pages, copyr. 1992.
Toshiba–Mosler Operator's Manual for CF–420 Cash Settlement System; pp. 1 to C–3; copyr. 1989 (See eg. pp. 3–10; 4–10; and 5–.
Currency Systems International, CPS 1200; 4 pages; date: copyr. 1992.
Brochure "DeLa Rue Systems, The processing of money and documents;" date: copyr. 1987 (See e.g. 3120 Currency Sorting Machine, p.3).
Chp. 7 of Mosler CF–420 Cash Management System, Operator's Manual© 1989.
Drawings of portions of Mosler CF–420 Cash Management System (FIGs. A–C)/description of the same (1989.
Glory GFR–X Banknote Counter With Denomination Recognition; 3 pages; date: estimated Jan. 14, 1994.
Mosler–Toshiba Currency Sorter CF–400 Series; 4 pages, date: copr. 1983.
Translation of EP 0 077 464.
Translation of EP 0 342 647.
Translation of JP 63–271687.
Translation of JP 56–16287.
First Translation of JP 61–14557.
Second Translation of 61–14557 (Glory).
Translation of JP 54–71673.
Translation of JP 54–71674.
Translation of JP 61–41439.
First Translation of JP 56–136689.
Second Translation of JP 56–136689 (Glory).
Billcon D–202/204 Service Manual (cover marked 630229) (Japanese).
Translation of Billcon D–202/204 Service Manual.
Billcon D–202, D204 Operator's Manual (cover marked 611215) (Japanese).
First Translation of Billcon D–202, D204 Operator's Manual.
Second Translation of Billcon D–202, D204 Operator's Manual (Glory).
Banking Machine Digest No. 31 (last page of H19 translation has a date of Dec. 5, 1988) (Japanese).
First Translation of Banking Machine Digest No. 31.
Second Translation of Banking Machine Digest No. 31 (Glory).
Third Translation of Banking Machine Digest No. 31.
Declaration of Per Torling, 6 pages (Mar. 18, 1999).
Glory UW–200 Multipurpose Compact Currency Sorter, 4 pages, ©1999.
Glory UW–100 Compact Currency Fitness Sorter, 2 pages, 201 1999.
Glory GFRT–1 Currency Scanner, 12/94.
Glory GFR–100 Currency Reader Counter Instruction Manual, 32 pages, Aug. 20, 1998.
Glory Brochure "Unstoppable" GFR–100 ReadMaster Currency Discriminator, 2 pages, 8/9.
Glory Brochure "Tank Tough Currency Discriminators" GFR–100 & GFB–700, 2 pages, Aug. 6, 1998.
Glory Brochure "Tank Tough Currency Discriminators" GFR–110 & GFR–S80, 2 pages, Dec. 7, 1999.

* cited by examiner

MODE: _____

| | C1 | C2 SELECTION | C3 OPTIONS |
|---|---|---|---|
| | TARGET 1 (POCKET 1) | | |
| R1 | DENOM. ? | | OFF / 1st BILL / US / ALL<br>$1 / $2 / $5 / $10 / $20 / $50 / $100 |
| R2 | FACE ? | | OFF / 1st BILL / FACE UP / FACE DOWN / US |
| R3 | ORIENTATION ? | | OFF / 1st BILL / FORWARD / REVERSE / US |
| R4 | SERIES ? | | OFF / 1st BILL / DEFINED - GROUPS / US |
| R5 | UPDATE ? | | YES / NO |
| | TARGET 2 (POCKET 2) | | |
| R6 | DENOM. ? | | OFF / 1st BILL / US / ALL<br>$1 / $2 / $5 / $10 / $20 / $50 / $100 |
| R7 | FACE ? | | OFF / 1st BILL / FACE UP / FACE DOWN / US |
| R8 | ORIENTATION ? | | OFF / 1st BILL / FORWARD / REVERSE / US |
| R9 | SERIES ? | | OFF / 1st BILL / DEFINED - GROUPS / US |
| R10 | UPDATE ? | | YES / NO |
| | | | |
| R11 | STRANGER (S) | | P1 / P2 / CONT - 2 / ST |
| R12 | DENOM CHANGE (DC) | | P1 / P2 / CONT - 2 / ST |
| R13 | NO CALL (NC) | | P1 / P2 / CONT - 2 |
| R14 | SUSPECT DOC. (SD) | | P1 / P2 / CONT - 2 |
| R15 | IMPROPER SIZE (SZ) | | P1 / P2 / CONT - 2 |
| R16 | UNFIT DOC. (UD) | | P1 / P2 / CONT - 2 |
| R17 | REVERSE FACED (RF) | | P1 / P2 / CONT - 2 |
| R18 | REV. ORIENTED (RO) | | P1 / P2 / CONT - 2 |
| R19 | SEP. SERIES (SS) | | P1 / P2 / CONT - 2 / ST |
| | | | |
| R20 | STACKER FULL (SF) | | STOP / SWITCH |
| R21 | STRAP LIMIT (SL) | | STOP / SWITCH / COMBINE P1 + P2 |
| R22 | CHAIN (C) | | STOP - 1 / STOP - 2 |
| R23 | DOUBLE (D) | | STOP - 1 / STOP - 2 |

FIG. 32

MODE: STRANGER FACING

| | C1 | C2 SELECTION | C3 OPTIONS |
|---|---|---|---|
| | TARGET 1 (POCKET 1) | | |
| R1 | DENOM. ? | 1st BILL | ~~OFF~~ / 1st BILL / US / ALL<br>$1 / $2 / $5 / $10 / $20 / $50 / $100 |
| R2 | FACE ? | 1st BILL | ~~OFF~~ / 1st BILL / FACE UP / FACE DOWN / US |
| R3 | ORIENTATION ? | OFF | OFF / 1st BILL / FORWARD / REVERSE / US |
| R4 | SERIES ? | OFF | OFF / 1st BILL / DEFINED - GROUPS / US |
| R5 | UPDATE ? | NO | YES / NO |
| | TARGET 2 (POCKET 2) | | |
| R6 | DENOM. ? | —— | ~~OFF / 1st BILL / US / ALL~~<br>~~$1 / $2 / $5 / $10 / $20 / $50 / $100~~ |
| R7 | FACE ? | —— | ~~OFF / 1st BILL / FACE UP / FACE DOWN / US~~ |
| R8 | ORIENTATION ? | —— | ~~OFF / 1st BILL / FORWARD / REVERSE / US~~ |
| R9 | SERIES ? | —— | ~~OFF / 1st BILL / DEFINED - GROUPS / US~~ |
| R10 | UPDATE ? | —— | ~~YES / NO~~ |
| | | | |
| R11 | STRANGER (S) | P2 | P1 / P2 / CONT - 2 / ST |
| R12 | DENOM CHANGE (DC) | —— | ~~P1 / P2 / CONT - 2 / ST~~ |
| R13 | NO CALL (NC) | P2 | P1 / P2 / CONT - 2 |
| R14 | SUSPECT DOC. (SD) | P2 | P1 / P2 / CONT - 2 |
| R15 | IMPROPER SIZE (SZ) | P2 | P1 / P2 / CONT - 2 |
| R16 | UNFIT DOC. (UD) | P2 | P1 / P2 / CONT - 2 |
| R17 | REVERSE FACED (RF) | C2 | P1 / P2 / CONT - 2 |
| R18 | REV. ORIENTED (RO) | —— | ~~P1 / P2 / CONT - 2~~ |
| R19 | SEP. SERIES (SS) | —— | ~~P1 / P2 / CONT - 2 / ST~~ |
| | | | |
| R20 | STACKER FULL (SF) | STOP | STOP / SWITCH |
| R21 | STRAP LIMIT (SL) | COMBINE | STOP / SWITCH / COMBINE P1 + P2 |
| R22 | CHAIN (C) | STOP - 2 | STOP - 1 / STOP - 2 |
| R23 | DOUBLE (D) | STOP - 2 | STOP - 1 / STOP - 2 |

FIG. 33

MODE: SORT 3

| | C1 | C2 SELECTION | C3 OPTIONS |
|---|---|---|---|
| | TARGET 1 (POCKET 1) | | |
| R1 | DENOM. ? | $5 | ~~OFF~~ / 1st BILL / US / ALL<br>$1 / $2 / $5 / $10 / $20 / $50 / $100 |
| R2 | FACE ? | OFF | OFF / 1st BILL / FACE UP / FACE DOWN / US |
| R3 | ORIENTATION ? | OFF | OFF / 1st BILL / FORWARD / REVERSE / US |
| R4 | SERIES ? | OFF | OFF / 1st BILL / DEFINED - GROUPS / US |
| R5 | UPDATE ? | NO | YES / NO |
| | TARGET 2 (POCKET 2) | | |
| R6 | DENOM. ? | 1st BILL | OFF / 1st BILL / US / ALL<br>$1 / $2 / $5 / $10 / $20 / $50 / $100 |
| R7 | FACE ? | OFF | OFF / 1st BILL / FACE UP / FACE DOWN / US |
| R8 | ORIENTATION ? | OFF | OFF / 1st BILL / FORWARD / REVERSE / US |
| R9 | SERIES ? | OFF | OFF / 1st BILL / DEFINED - GROUPS / US |
| R10 | UPDATE ? | YES | YES / NO |
| | | | |
| R11 | STRANGER (S) | —— | ~~P1 / P2 / CONT - 2 / ST~~ |
| R12 | DENOM CHANGE (DC) | P2 | P1 / P2 / CONT - 2 / ST |
| R13 | NO CALL (NC) | P2 | P1 / P2 / CONT - 2 |
| R14 | SUSPECT DOC. (SD) | P2 | P1 / P2 / CONT - 2 |
| R15 | IMPROPER SIZE (SZ) | P2 | P1 / P2 / CONT - 2 |
| R16 | UNFIT DOC. (UD) | P2 | P1 / P2 / CONT - 2 |
| R17 | REVERSE FACED (RF) | —— | ~~P1 / P2 / CONT - 2~~ |
| R18 | REV. ORIENTED (RO) | —— | ~~P1 / P2 / CONT - 2~~ |
| R19 | SEP. SERIES (SS) | —— | ~~P1 / P2 / CONT - 2 / ST~~ |
| | | | |
| R20 | STACKER FULL (SF) | STOP | STOP / SWITCH |
| R21 | STRAP LIMIT (SL) | STOP | STOP / SWITCH / COMBINE P1 + P2 |
| R22 | CHAIN (C) | STOP - 2 | STOP - 1 / STOP - 2 |
| R23 | DOUBLE (D) | STOP - 2 | STOP - 1 / STOP - 2 |

FIG. 34

MODE: USER - DEFINED 1

| | C1 | C2 SELECTION | C3 OPTIONS |
|---|---|---|---|
| | TARGET 1 (POCKET 1) | | |
| R1 | DENOM. ? | $100 | OFF / 1st BILL / ALL<br>$1 / $2 / $5 / $10 / $20 / $50 / $100 |
| R2 | FACE ? | FACE UP | OFF / 1st BILL / FACE UP / FACE DOWN / US |
| R3 | ORIENTATION ? | OFF | OFF / 1st BILL / FORWARD / REVERSE / US |
| R4 | SERIES ? | 1996 + | OFF / 1st BILL / DEFINED - GROUPS / US |
| R5 | UPDATE ? | NO | YES / NO |
| | TARGET 2 (POCKET 2) | | |
| R6 | DENOM. ? | $100 | OFF / 1st BILL / ALL<br>$1 / $2 / $5 / $10 / $20 / $50 / $100 |
| R7 | FACE ? | FACE DOWN | OFF / 1st BILL / FACE UP / FACE DOWN / US |
| R8 | ORIENTATION ? | OFF | OFF / 1st BILL / FORWARD / REVERSE / US |
| R9 | SERIES ? | 1995 | OFF / 1st BILL / DEFINED - GROUPS / US |
| R10 | UPDATE ? | NO | YES / NO |
| | | | |
| R11 | STRANGER (S) | P2 | P1 / P2 / CONT - 2 / ST |
| R12 | DENOM CHANGE (DC) | ——— | ~~P1 / P2 / CONT - 2 / ST~~ |
| R13 | NO CALL (NC) | P2 | P1 / P2 / CONT - 2 |
| R14 | SUSPECT DOC. (SD) | P2 | P1 / P2 / CONT - 2 |
| R15 | IMPROPER SIZE (SZ) | P2 | P1 / P2 / CONT - 2 |
| R16 | UNFIT DOC. (UD) | P2 | P1 / P2 / CONT - 2 |
| R17 | REVERSE FACED (RF) | P2 | P1 / P2 / CONT - 2 |
| R18 | REV. ORIENTED (RO) | ——— | ~~P1 / P2 / CONT - 2~~ |
| R19 | SEP. SERIES (SS) | P2 | P1 / P2 / CONT - 2 / ST |
| | | | |
| R20 | STACKER FULL (SF) | STOP | STOP / SWITCH |
| R21 | STRAP LIMIT (SL) | STOP | STOP / SWITCH / COMBINE P1 + P2 |
| R22 | CHAIN (C) | STOP - 2 | STOP - 1 / STOP - 2 |
| R23 | DOUBLE (D) | STOP - 2 | STOP - 1 / STOP - 2 |

FIG. 35

MODE: USER - DEFINED 2

| | C1 | C2 SELECTION | C3 OPTIONS |
|---|---|---|---|
| | TARGET 1 (POCKET 1) | | |
| R1 | DENOM. ? | ALL | OFF / 1st BILL / US / ALL<br>$1 / $2 / $5 / $10 / $20 / $50 / $100 |
| R2 | FACE ? | OFF | OFF / 1st BILL / FACE UP / FACE DOWN / US |
| R3 | ORIENTATION ? | OFF | OFF / 1st BILL / FORWARD / REVERSE / US |
| R4 | SERIES ? | OFF | OFF / 1st BILL / DEFINED - GROUPS / US |
| R5 | UPDATE ? | —— | ~~YES / NO~~ |
| | TARGET 2 (POCKET 2) | | |
| R6 | DENOM. ? | OFF | OFF / 1st BILL / US / ALL<br>$1 / $2 / $5 / $10 / $20 / $50 / $100 |
| R7 | FACE ? | OFF | OFF / 1st BILL / FACE UP / FACE DOWN / US |
| R8 | ORIENTATION ? | OFF | OFF / 1st BILL / FORWARD / REVERSE / US |
| R9 | SERIES ? | OFF | OFF / 1st BILL / DEFINED - GROUPS / US |
| R10 | UPDATE ? | —— | ~~YES / NO~~ |
| | | | |
| R11 | STRANGER (S) | —— | ~~P1 / P2 / CONT - 2 / ST~~ |
| R12 | DENOM CHANGE (DC) | —— | ~~P1 / P2 / CONT - 2 / ST~~ |
| R13 | NO CALL (NC) | P1 | P1 / P2 / CONT - 2 |
| R14 | SUSPECT DOC. (SD) | P2 | P1 / P2 / CONT - 2 |
| R15 | IMPROPER SIZE (SZ) | P2 | P1 / P2 / CONT - 2 |
| R16 | UNFIT DOC. (UD) | P2 | P1 / P2 / CONT - 2 |
| R17 | REVERSE FACED (RF) | —— | ~~P1 / P2 / CONT - 2~~ |
| R18 | REV. ORIENTED (RO) | —— | ~~P1 / P2 / CONT - 2~~ |
| R19 | SEP. SERIES (SS) | —— | ~~P1 / P2 / CONT - 2 / ST~~ |
| | | | |
| R20 | STACKER FULL (SF) | STOP | STOP / SWITCH |
| R21 | STRAP LIMIT (SL) | STOP | STOP / SWITCH / COMBINE P1 + P2 |
| R22 | CHAIN (C) | STOP-1 | STOP - 1 / STOP - 2 |
| R23 | DOUBLE (D) | STOP-1 | STOP - 1 / STOP - 2 |

FIG. 36

MODE: USER - DEFINED 3

| | C1 | C2 SELECTION | C3 OPTIONS |
|---|---|---|---|
| | TARGET 1 (POCKET 1) | | |
| R1 | DENOM. ? | OFF | OFF / 1st BILL / US / ALL<br>$1 / $2 / $5 / $10 / $20 / $50 / $100 |
| R2 | FACE ? | OFF | OFF / 1st BILL / FACE UP / FACE DOWN / US |
| R3 | ORIENTATION ? | OFF | OFF / 1st BILL / FORWARD / REVERSE / US |
| R4 | SERIES ? | OFF | OFF / 1st BILL / DEFINED - GROUPS / US |
| R5 | UPDATE ? | —— | ~~YES / NO~~ |
| | TARGET 2 (POCKET 2) | | |
| R6 | DENOM. ? | ALL | OFF / 1st BILL / US / ALL<br>$1 / $2 / $5 / $10 / $20 / $50 / $100 |
| R7 | FACE ? | OFF | OFF / 1st BILL / FACE UP / FACE DOWN / US |
| R8 | ORIENTATION ? | OFF | OFF / 1st BILL / FORWARD / REVERSE / US |
| R9 | SERIES ? | OFF | OFF / 1st BILL / DEFINED - GROUPS / US |
| R10 | UPDATE ? | —— | ~~YES / NO~~ |
| | | | |
| R11 | STRANGER (S) | —— | ~~P1 / P2 / CONT - 2 / ST~~ |
| R12 | DENOM CHANGE (DC) | —— | ~~P1 / P2 / CONT - 2 / ST~~ |
| R13 | NO CALL (NC) | P2 | P1 / P2 / CONT - 2 |
| R14 | SUSPECT DOC. (SD) | P1 | P1 / P2 / CONT - 2 |
| R15 | IMPROPER SIZE (SZ) | P1 | P1 / P2 / CONT - 2 |
| R16 | UNFIT DOC. (UD) | P1 | P1 / P2 / CONT - 2 |
| R17 | REVERSE FACED (RF) | —— | ~~P1 / P2 / CONT - 2~~ |
| R18 | REV. ORIENTED (RO) | —— | ~~P1 / P2 / CONT - 2~~ |
| R19 | SEP. SERIES (SS) | —— | ~~P1 / P2 / CONT - 2 / ST~~ |
| | | | |
| R20 | STACKER FULL (SF) | STOP | STOP / SWITCH |
| R21 | STRAP LIMIT (SL) | STOP | STOP / SWITCH / COMBINE P1 + P2 |
| R22 | CHAIN (C) | STOP-1 | STOP - 1 / STOP - 2 |
| R23 | DOUBLE (D) | STOP-1 | STOP - 1 / STOP - 2 |

FIG. 37

| 2-POCKET POCKET DELIVERY / STOPPING CONDITIONS | | | | | | | | |
|---|---|---|---|---|---|---|---|---|
| | | STR 1 | STR 2 | STR FO | SRT 1 | SRT 2 | SRT 3 | SRT FO |
| POCKET 1 | NOTE | TARGET NOTE | TARGET NOTE | TARGET NOTE FACE / ORIENT | TARGET NOTE 1 WITH AUTOMATIC DENOMINATION CHANGE | TARGET NOTE | TARGET NOTE 1 | TARGET NOTE FACE / ORIENT |
| | STOP CONDITION | C, SL, D, SF, J; OPTIONAL: S, NC, SS, SD | C, SL, D, SF, S, NC, J, SD; OPTIONAL: SS | C, SF, J, D, SD, NC, S; SL COMBINE POCKETS; OPTIONAL: SS | C, SF, SL, J, D, NC, SD, DC; OPTIONAL: SS | C, SF, J, D, DC; OPTIONAL: NC, SS, SD | C, SF, J, SL, D, NC, SD; OPTIONAL: SS | C, SF, J, D, SD, NC, DC; SL COMBINE POCKETS; OPTIONAL: SS |
| POCKET 2 | NOTE | NONE | TARGET NOTE | TARGET NOTE UNFACED / NON-ORIENTED | TARGET NOTE 2 WITH AUTOMATIC DENOMINATION CHANGE | NONE | NONE | TARGET NOTE UNFACED / NON-ORIENTED |
| | STOP CONDITION | OPTIONAL: S, NC, SS, SD | C, SL, D, SF, S, NC, J, SD; OPTIONAL: SS | C, SF, J, D, SD, NC, S; SL COMBINE POCKETS; OPTIONAL: SS | C, SF, SL, J, D, NC, SD, DC; OPTIONAL: SS | OPTIONAL: NC, SS, SD | C, SF, SL, J, D, NC, SD, DC; OPTIONAL: SS | C, SF, J, D, SD, NC, DC; SL COMBINE POCKETS; OPTIONAL: SS |

FIG. 38

| 2 -POCKET POCKET DELIVERY / STOPPING CONDITIONS | | | | | |
|---|---|---|---|---|---|
| | | MIX 1 | MIX 2 | MIX FO | CNT |
| POCKET 1 | NOTE | MIXED NOTES | MIXED NOTES | FACE / ORIENT | NOTES |
| | STOP CONDITION | C, D, SF, J<br>OPTIONAL: NC, SD | C, D, SF, J, NC, SD | C, SF, J, D, SD, NC | SF, J, SL, C, D, SD |
| POCKET 2 | NOTE | NONE | MIXED NOTES | UNFACED / NON-ORIENTED | NOTES |
| | STOP CONDITION | OPTIONAL: NC, SD | C, D, SF, J, NC, SD | C, SF, J, D, SD, NC | SF, J, SL, C, D, SD |

FIG. 39

| | $1 | $2 | $5 | $10 | $20 | $50 | $100 |
|---|---|---|---|---|---|---|---|
| STACK LIMIT | 100 | 10 | 100 | NONE | 200 | 100 | 100 |

FIG. 43

| | POCKET #1 | POCKET #2 | POCKET #3 | POCKET #4 | POCKET #5 | POCKET #6 |
|---|---|---|---|---|---|---|
| ASSGMT. STATUS | FIXED | DYNAMIC | DYNAMIC | DYNAMIC | DYNAMIC | NO BILLS |
| CURRENT DENOM. ASSGMT. | $20 | NONE | $1 | $5 | $1 | — |
| CURRENT STACK LIMIT | 200 | — | 100 | 100 | 100 | — |
| OPEN STATUS | NO | YES | NO | NO | NO | NO |
| FULL STATUS | NO | NO | YES | NO | NO | YES |

FIG. 44

MULTIPLE POCKET CURRENCY BILL PROCESSING DEVICE AND METHOD

CROSS-REFERENCE TO RELATED APPLICATIONS

This application claims the benefit of:

1) U.S. patent application Ser. No. 09/635,967 filed Aug. 10, 2000 and entitled "Method and Apparatus for Document Processing," pending;

2) U.S. patent application Ser. No. 08/864,432, filed May 28, 1997 entitled "Method and Apparatus for Document Processing," now issued as U.S. Pat. No. 6,311,819.

3) Provisional Patent Application Ser. No. 60/018,563 filed May 29, 1996 entitled "Method and Apparatus for Document Identification and Authentication," now abandoned;

4) Provisional Patent Application Ser. No. 60/034,954 filed Jan. 16, 1997 entitled "Method and Apparatus for Document Processing," now abandoned; and 5) Provisional Patent Application Ser. No. 60/038,340 filed Feb. 27, 1997 entitled "Method and Apparatus for Document Processing," now abandoned.

This application is a continuation-in-part of U.S. patent application Ser. No. 09/635,967 filed Aug. 8, 2000 and entitled "Method and Apparatus for Document Processing."

U.S. patent application Ser. No. 09/635,967 is a continuation of U.S. patent application Ser. No. 08/864,423, filed May 28, 1997 entitled "Method and Apparatus for Document Processing," now issued as U.S. Pat. No. 6,311,819.

U.S. patent application Ser. No. 08/864,423 claimed the benefit of Provisional Patent Application Ser. No. 60/018,563 filed May 29, 1996 entitled "Method and Apparatus for Document Identification and Authentication", No. 60/034,954 filed Jan. 16, 1997 entitled "Method and Apparatus for Document Processing", and No. 60/038,340 filed Feb. 27, 1997 entitled "Method and Apparatus for Document Processing," all now abandoned. All of the above patents and patent applications referred to in this Cross-Reference to Related Applications section are incorporated herein by reference in their entirety.

The present invention relates generally to the field of currency handling systems and, more particularly, to a method and apparatus for processing currency bills using dynamic pocket assignment.

BACKGROUND OF THE INVENTION

A variety of techniques and apparatuses have been used to satisfy the requirements of automated currency handling machines. As businesses and banks grow, these businesses are experiencing a greater volume of paper currency. These businesses are continually requiring not only that their currency be processed more quickly but, also, processed with more options in a less expensive manner. At the upper end of sophistication in this area of technology are machines that are capable of rapidly identifying, discriminating, and counting multiple currency denominations and then sorting the currency bills into a multitude of output compartments. Further, some of these high-end machines can segregate the processed bills into smaller batches for subsequent strapping with a paper strap. However, many of these high-end machines are extremely large and expensive such that they are commonly found only in large institutions. These machines are not readily available to businesses which have monetary and space budgets, but still have the need to process large volumes of currency. Other high-end currency handling machines require their own climate controlled environment which may place even greater strains on businesses having monetary and space budgets. For example, one of these machines can cost over $500,000, it can weigh over 1,400 pounds, measuring over 5 feet in length, over 2 feet in depth, and over 5 feet in height. Additionally, the stringent environment specifications may require a narrow humidity range, such as between 50–55%, and a narrow temperature range, such as between 70–74° F.

Some currency evaluating devices receive a stack of currency bills in an input receptacle and transport the bills through the evaluation device to a plurality of output receptacles. For example, a device adapted to process U.S. currency may contain six output receptacles with each output receptacle being designated to receive a particular denomination of U.S. currency, e.g., $1 bills are transported to the first output receptacle, $5 bills are transported to the second output receptacle, and so for $10, $20, $50, and $100 with $100 bills being transported to the sixth output receptacle. Such devices process bills placed into the input receptacle and sort the bills by denomination into the corresponding output receptacles. When a particular output receptacle becomes full, the operation of the device is suspended until an operator removes the bills from the full output receptacle. Take, for example, a situation where a stack of 500 bills is placed into an input receptacle. The stack contains 50 $1 bills followed by 300 $10, followed by 50 more $1 bills, and then 100 $20 bills. Assume that each output receptacle can hold a maximum of 200 bills. In operation, the device sends the first 50 $1 to the first pocket, the next 200 $10 bills to the third pocket and then suspends operation until the operator removes the 200 $10 bills from the third pocket. Once this is done, the operator may re-start the device. Once re-started, the next 100 $10 bills are delivered to the third pocket, the next 50 $10 bills are transported to the first pocket, and the last 100 $20 bills are delivered to the fourth pocket. In this example, the device suspended its operation when the $10 pocket became full.

There exist a need for a currency evaluation device which reduces the number of times the operation of the currency evaluation device is suspended.

SUMMARY OF THE INVENTION

Generally the present invention relates to methods and apparatuses for processing documents or currency bills using dynamic pocket assignment embodiments and software for use in the same. According to one embodiment of the present invention, a computer readable medium is used in a currency evaluator that comprises an input receptacle, a plurality of output receptacles, and a transport mechanism positioned to individually transport bills from the input receptacles to the output receptacles. The computer readable medium comprises programming steps for determining a denomination associated with a bill, determining if an output receptacle is associated with the bill denomination, assigning an output receptacle to the bill denomination if an output receptacle is not associated with the bill denomination, and causing the bill to be transported to an output receptacle assigned to the bill denomination.

Some embodiments of the present invention relate to methods and devices for dynamically assigning document parameters to output receptacles of a multiple output receptacle document evaluating device. Documents are directed into individual output receptacles based upon their document parameter or parameters.

According to one embodiment a currency evaluating device comprises an input receptacle adapted to receive a stack of currency bills, each bill having a denomination associated therewith, a plurality of output receptacles, a transport mechanism adapted to individually transport bills from the input receptacle to the output receptacles; and a processor adapted to control the operation of the currency evaluating device. The processor is programmed to determine the denomination of a bill and determine if an output receptacle is associated with the denomination of the bill. If an output receptacle is not associated with the denomination of the bill, the processor is programmed to associate an output receptacle with the denomination of the bill and cause the bill to be transported to an output receptacle associated with the denomination of the bill.

According to another embodiment, a currency denominating device comprises a plurality of output receptacles and an operator interface adapted to permit the operator of the device to change the designation of each one of the output receptacles between being a fixed pocket and being a dynamic pocket.

Many additional embodiments are described below and in the accompanying figures. Accordingly, the above summary of the present invention is not intended to represent each embodiment, or every aspect, of the present invention. Additional features and benefits of the present invention will become apparent from the detail description, figures, and claims set forth below.

BRIEF DESCRIPTION OF THE DRAWINGS

Other objects and advantages of the invention will become apparent upon reading the following detailed description in conjunction with the drawings in which:

FIGS. 32–37 illustrate examples of operating parameters selection screens;

FIGS. 38 and 39 are tables summarizing various embodiments of several operating modes;

FIG. 43 illustrates an example of the stack limits stored in memory according to one embodiment of the present invention;

FIG. 44 illustrates the status of various assignments according to one embodiment of the present invention;

DETAILED DESCRIPTION OF THE ILLUSTRATED EMBODIMENTS

Figure 1A:
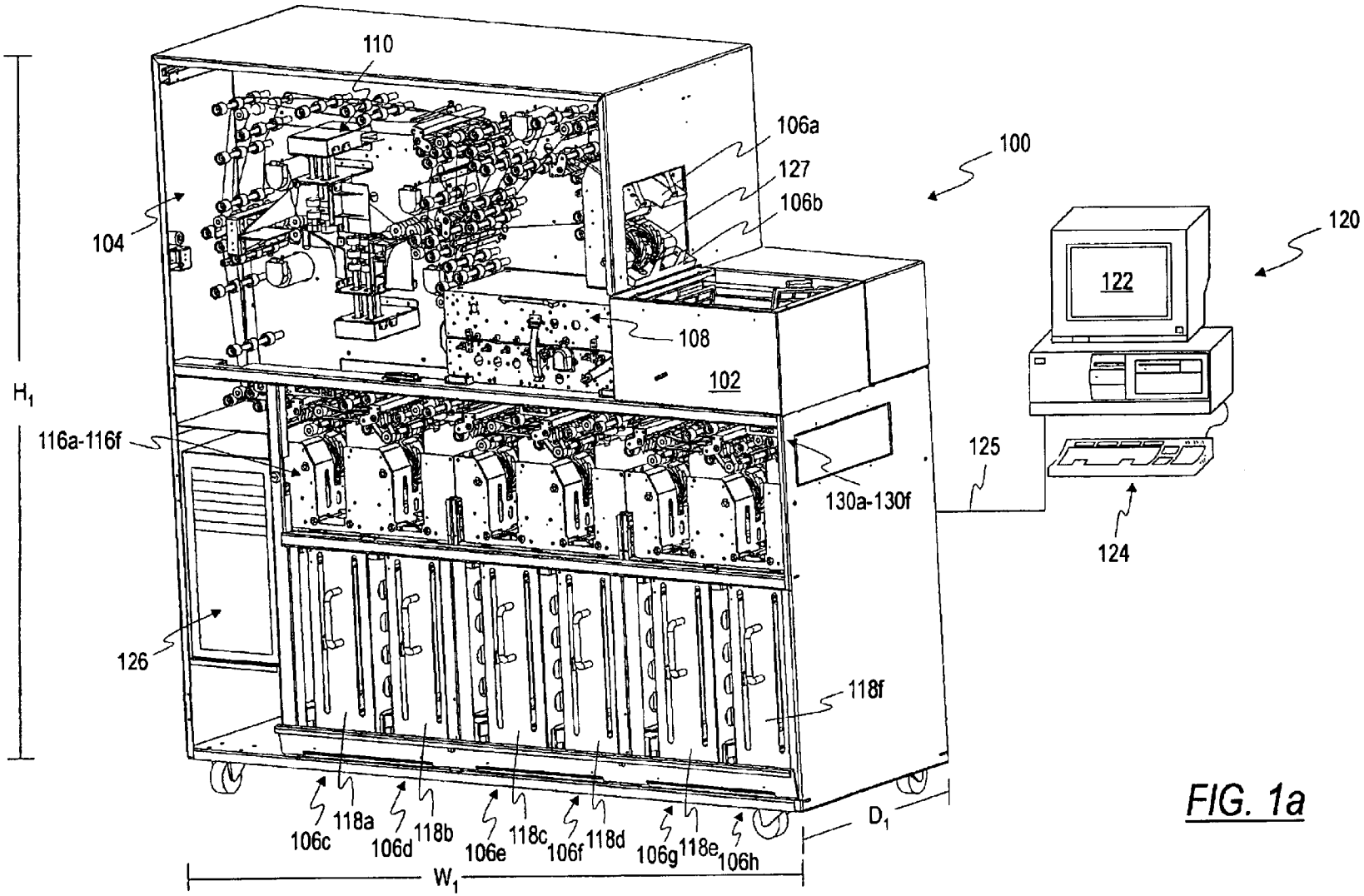
FIG. 1*a* is a perspective view of a document handling device according to one embodiment of the invention.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

When describing various embodiments of the present invention, the term "currency bills" refers to official currency bills including both U.S. currency bills, such as a $1, $2, $5, $10, $20, $50, or $100 note, and foreign currency bills. Foreign currency bills are bank notes issued by a non-U.S. governmental agency as legal tender, such as a Euro, Japanese Yen, or British Pound note.

The term "currency documents" includes both currency bills and "substitute currency media." Examples of substitute currency media include without limitation: casino cash-out tickets (also variously called cashout vouchers or coupons) such as "EZ Pay" tickets issued by International Gaming Technology or "Quicket" tickets issued by Casino Data Systems; casino script; promotional media such as Disney Dollars or Toys 'R Us "Geoffrey Dollars"; or retailer coupons, gift certificates, gift cards, or food stamps. Substitute currency media may include a barcode, and these types of substitute currency media are referred to herein as "barcoded tickets." Examples of barcoded tickets include casino cashout tickets such as "EZ Pay" tickets and "Quicket" cashout tickets, barcoded retailer coupons, barcoded gift certificates, or any other promotional media that includes a barcode. Although the invention embodiments refer to the "denomination" of currency bills as the criterion used in evaluating the currency bills, other predetermined criteria can be used to evaluate the currency bills, such as, for example, color, size, and orientation. The term "non-currency documents" includes any type of document, except currency documents, that can be evaluated according to a predetermined criterion, such as color, size, shape, orientation, and so on.

"Substitute currency notes" are sheet-like documents similar to currency bills but are issued by non-governmental agencies such as casinos and amusement parks and include, for example, casino script and Disney Dollars. Substitute currency notes each have a denomination and an issuing entity associated therewith such as a $5 Disney Dollar, a $10 Disney Dollar, a $20 ABC Casino note and a $100 ABC Casino note. "Currency notes" consist of currency bills and substitute currency notes.

First, a number of currency handling devices will be described together with descriptions of various features and operating modes that may be used in conjunction therewith. These descriptions are generally related to FIGS. 1–39.

Additional details of various embodiments of dynamic sorting methods are then described in conjunction with FIGS. 40–48. The dynamic sorting methods may be used in conjunction with the various devices described in connection with FIGS. 1–29.

Figure 1B:
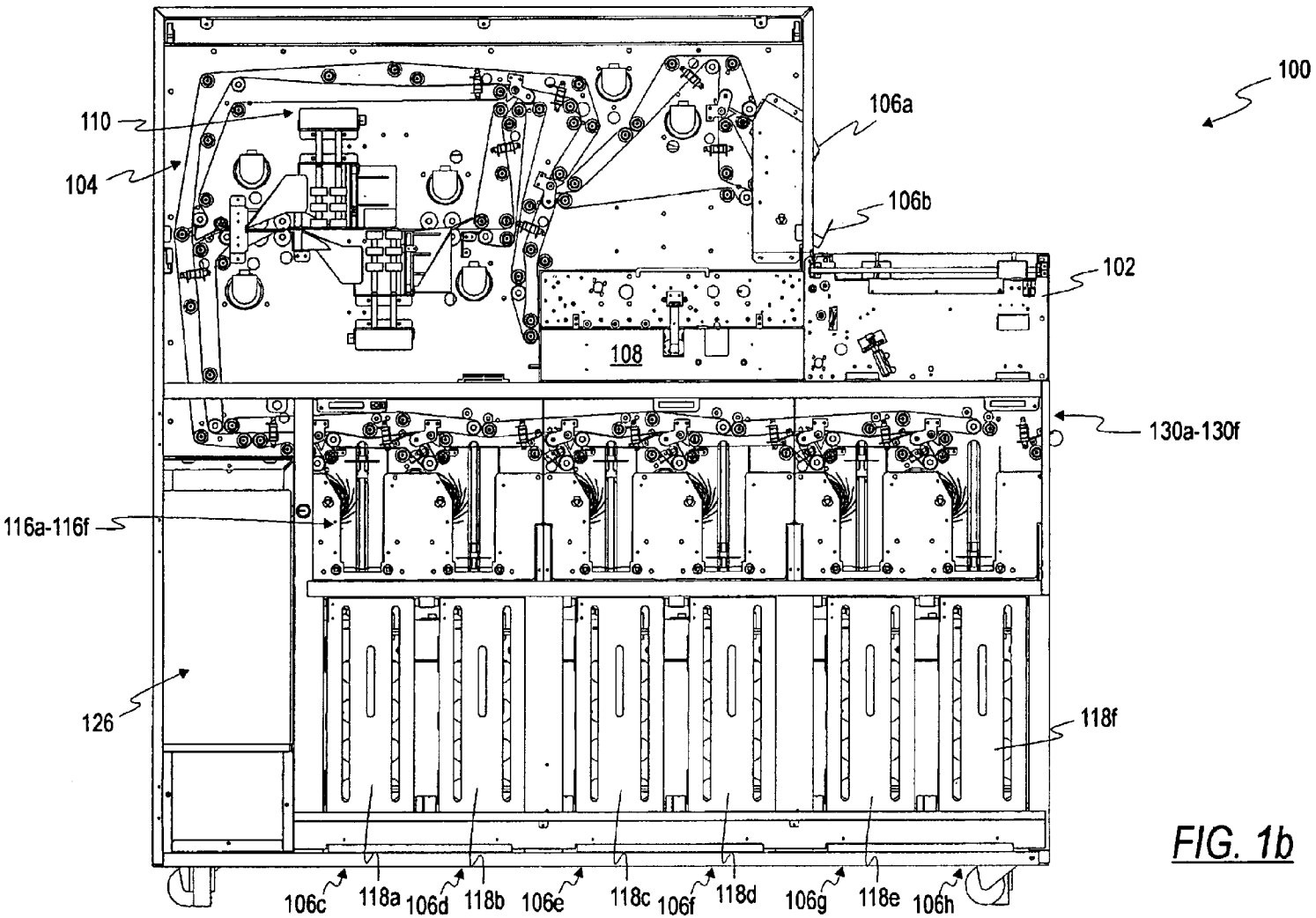
FIG. 1*b* is a front view of a document handling device according to one embodiment of the invention.

Referring to FIGS. 1*a* and 1*b*, a multi-pocket document processing device 100 such as a currency handling device according to one embodiment of the present invention is illustrated. Currency bills are fed, one by one, from a stack of currency bills placed in an input receptacle 102 into a transport mechanism 104. The transport mechanism 104 guides currency bills to one of a plurality of output receptacles 106*a*–106*h*, which may include upper output receptacles 106*a*, 106*b*, as well as lower output receptacles 106*c*–106*h*. Before reaching an output receptacle 106 the transport mechanism 104 guides the bill through an evaluation region 108 where a bill can be, for example, analyzed, authenticated, denominated, counted, and/or otherwise processed. In alternative embodiments of the currency handling device 100 of the present invention, the evaluation region 108 can determine bill orientation, bill size, or whether bills are stacked upon one another. The results of the above process or processes may be used to determine to which output receptacle 106 a bill is directed. The illustrated embodiment of the currency handling device has an overall width, $W_1$, of approximately 4.52 feet (1.38 meters), a height, $H_1$, of approximately 4.75 feet (1.45 meters), and a depth, $D_1$, of approximately 1.67 feet (0.50 meters).

In one embodiment, documents such as currency bills are transported, scanned, denominated, authenticated and/or otherwise processed at a rate equal to or greater than 600 bills per minute. In another embodiment, documents such as currency bills are transported, scanned, denominated, authenticated, and/or otherwise processed at a rate equal to or greater than 800 bills per minute. In another embodiment, documents such as currency bills are transported, scanned, denominated, authenticated and/or otherwise processed at a rate equal to or greater than 1000 bills per minute. In still another embodiment, documents such as currency bills are transported, scanned, denominated, authenticated, and/or otherwise processed at a rate equal to or greater than 1200 bills per minute.

In the illustrated embodiment, interposed in the bill transport mechanism 104, intermediate the bill evaluation region 108 and the lower output receptacles 106*c*–106*h* is a bill facing mechanism designated generally by reference numeral 110. The bill facing mechanism is capable of rotating a bill 180° so that the face orientation of the bill is reversed. The leading edge of the bill (the wide dimension of the bill according to one embodiment) remains constant while the bill is rotated 180° about an axis parallel to the smaller dimension of the bill) so that the face orientation of the bill is reversed. That is, if a U.S. bill, for example, is initially presented with the surface bearing a portrait of a president facing down, it may be directed to the facing mechanism 110, whereupon it will be rotated 180° so that the surface with the portrait faces up. The decision may be taken to send a bill to the facing mechanism 110 when the selected mode of operation or other operator instructions call for maintaining a given face orientation of bills as they are processed by the currency handling device 100. Using U.S. currency as an example, it may be desirable in certain circumstances for all of the bills ultimately delivered to the lower output receptacles 106*c*–106*h* to have the bill surface bearing the portrait of the president facing up. In such embodiments of the currency handling device 100, the bill evaluation region 108 is capable of determining the face orientation of a bill, such that a bill not having the desired face orientation can first be directed to the facing mechanism 110 before being delivered to the appropriate output receptacle 106. Further details of a facing mechanism which may be utilized for this purpose are disclosed in commonly-owned, co-pending U.S. application Ser. No. 09/181,254, entitled "Document Facing Method and Apparatus" which was filed on Oct. 28, 1998, incorporated herein by reference in its entirety, which may be employed in conjunction with the present invention such as the device illustrated in FIGS. 1*a* and 1*b*. Other alternative embodiments of the currency handling device 100 do not include the facing mechanism 110.

The currency handling device 100 in FIG. 1*a* may be controlled from a separate controller or control unit 120 which has a display/user-interface 122, which may incorporate a touch panel display in one embodiment of the present invention, which displays information, including "functional" keys when appropriate. The display/user-interface 122 may be a full graphics display. Alternatively, additional physical keys or buttons, such as a keyboard 124, may be employed. The control unit 120 may be a self-contained desktop or laptop computer which communicates with the currency handling device 100 via a cable 125. The currency handling device 100 may have a suitable communications port (not shown) for this purpose. In embodiments in which the control unit 120 is a desktop computer wherein the display/user-interface 122 and the desktop computer are physically separable, the desktop computer may be stored within a compartment 126 of the currency handling device 100. In other alternative embodiments, the control unit 120 is integrated into the currency handling device 100 so the control unit 120 is contained within the device 100.

The operator can control the operation of the currency handling device 100 through the control unit 120. Through the control unit 120 the operator can direct the bills into specific output receptacles 106*a*–106*h* by selecting various user defined modes. In alternative embodiments, the user can select pre-programmed user defined modes or create new user defined modes based on the particular requirements of the application. For example, the operator may select a user defined mode which instructs the currency handling device 100 to sort bills by denomination; accordingly, the evaluation region 108 would denominate the bills and direct one dollar bills into the first lower output receptacle 106*c*, five dollar bills into the second lower output receptacle 106*d*, ten dollar bills into the third lower output receptacle 106*e*, twenty dollar bills into the forth lower output receptacle 106*f*, fifty dollar bills into the fifth lower output receptacle 106*g*, and one-hundred dollar bills into the sixth lower output receptacle 106*h*. The operator may also instruct the currency handling device 100 to deliver those bills whose denomination was not determined, no call bills, to the first upper output receptacle 106*a*. In such an embodiment, upper output receptacle 106*a* would function as a reject pocket. In an alternative embodiment, the operator may instruct the currency handling device 100 to also evaluate the authenticity of each bill. In such an embodiment, authentic bills would be directed to the appropriate lower output receptacle 106*c*–106*h*. Those bills that were determined not to be authentic, suspect bills, would be delivered to the second upper output receptacle 106*b*. A multitude of user defined modes are disclosed by co-pending U.S. patent application Ser. No. 08/916,100 entitled "Multi-Pocket Currency Discriminator" which was filed on Aug. 21, 1997, incorporated herein by reference in its entirety, which may be employed in conjunction with the present invention such as the device illustrated in FIGS. 1*a* and 1*b*.

According to one embodiment, the currency handling device 100 is designed so that when the evaluation region 108 is unable to identify certain criteria regarding a bill, the unidentified bill is flagged and "presented" in one of the output receptacles 106*a*–106*h*, that is, the transport mechanism 104 is stopped so that the unidentified bill is located at a predetermined position within one of the output receptacles 106*a*–106*h*, such as being the last bill transported to one of the output receptacles. Such criteria can include denominating information, authenticating information, information indicative of the bill's series, or other information the evaluation region 108 is attempting to obtain pursuant to a mode of operation.

Which output receptacles 106*a*–106*h* the flagged bill is presented in may be determined by the user according to a selected mode of operation. For example, where the unidentified bill is the last bill transported to an output receptacle 106*a*–106*h*, it may be positioned within a stacker wheel or positioned at the top of the bills already within the output receptacle 106*a*–106*h*. While unidentified bills may be transported to any output receptacles 106*a*–106*h*, it may be more convenient for the operator to have unidentified bills transported to one of the upper output receptacles 106*a*, 106*b* where the operator is able to easily see and/or inspect the bill which has not been identified by the evaluation region 108. The operator may then either visually inspect the flagged bill while it is resting on the top of the stack, or alternatively, the operator may decide to remove the bill from the output receptacle 106 in order to examine the flagged bill more closely. In an alternative embodiment of the currency handling device 100, the device 100 may communicate to the user via the display/user-interface 122 in which one of the output receptacles 106*a*–106*h* a flagged bill is presented.

The currency handling device 100 may be designed to continue operation automatically when a flagged bill is removed from the upper output receptacle 106*a*, 106*b* or, according to one embodiment of the present invention, the device 100 may be designed to suspend operation and require input from the user via the control unit 120. Upon examination of a flagged bill by the operator, it may be found that the flagged bill is genuine even though it was not identified as so by the evaluation region 108 or the evaluation region 108 may have been unable to denominate the flagged bill. However, because the bill was not identified, the total value and/or denomination counters will not reflect its value. According to one embodiment, such an unidentified bill is removed from the output receptacles 106 and reprocessed or set aside. According to another embodiment, the flagged bills may accumulate in the upper output receptacles 106*a*, 106*b* until the batch of currency bills currently being processed is completed or the output receptacle 106*a*, 106*b* is full and then reprocessed or set aside.

According to another embodiment, when a bill is flagged, the transport mechanism may be stopped before the flagged bill is transported to one of the output receptacles. Such an embodiment is particularly suited for situations in which the operator need not examine the bill being flagged; for example, the currency handling device 100 is instructed to first process United States currency and then British currency pursuant to a selected mode of operation where the currency handling device 100 processes United States $1, $5, $10, $20, $50, and $100 currency bills into the lower output receptacles 106*c*–106*h*, respectively. Upon detection of the first British pound note, the currency handling device 100 may halt operation allowing the operator to empty the lower output receptacles 106*c*–106*h* and to make any spatial adjustments necessary to accommodate the British currency. A multitude of modes of operation are described in conjunction with bill flagging, presenting, and/or transport halting in commonly owned, co-pending U.S. patent application Ser. No. 08/916,100 entitled "Method and Apparatus for Document Processing" which was filed on May 28, 1997, incorporated herein by reference in its entirety above, which may be employed in conjunction with the present invention such as the device illustrated in FIGS. 1*a* and 1*b*.

In the illustrated embodiment, with regard to the upper output receptacles 106*a*, 106*b*, the second upper output receptacle 106*b* is provided with a stacker wheel 127 for accumulating a number of bills, while the first upper output receptacle 106*a* is not provided with such a stacker wheel. Thus, when pursuant to a preprogrammed mode of operation or an operator selected mode or other operator instructions, a bill is to be fed to the first upper output receptacle 106*a*, there may be a further instruction to momentarily suspend operation of the currency handling device 100 for the operator to inspect and remove the bill. On the other hand, it may be possible to allow a small number of bills to accumulate in the first upper output receptacle 106*a* prior to suspending operation. Similarly, the second upper output receptacle 106*b* may be utilized initially as an additional one of the lower output receptacles 106*c*–106*h*. However, there is no storage cassette associated with the second upper output receptacle 106*b*. Therefore, when the second upper output receptacle 106*b* is full, operation may be suspended to remove the bills at such time as yet further bills are directed to the second upper output receptacle 106*b* in accordance with the selected mode of operation or other operator instructions. In an alternative embodiment of the currency handling device 100 both the first and the second upper output receptacles 106*a*, 106*b* are equipped with a stacker wheel. In such an embodiment both the upper output receptacles 106*a*, 106*b* may also function as the lower output receptacle 106*c*–106*h* allowing a number of bills to be stacked therein.

Figure 1C:
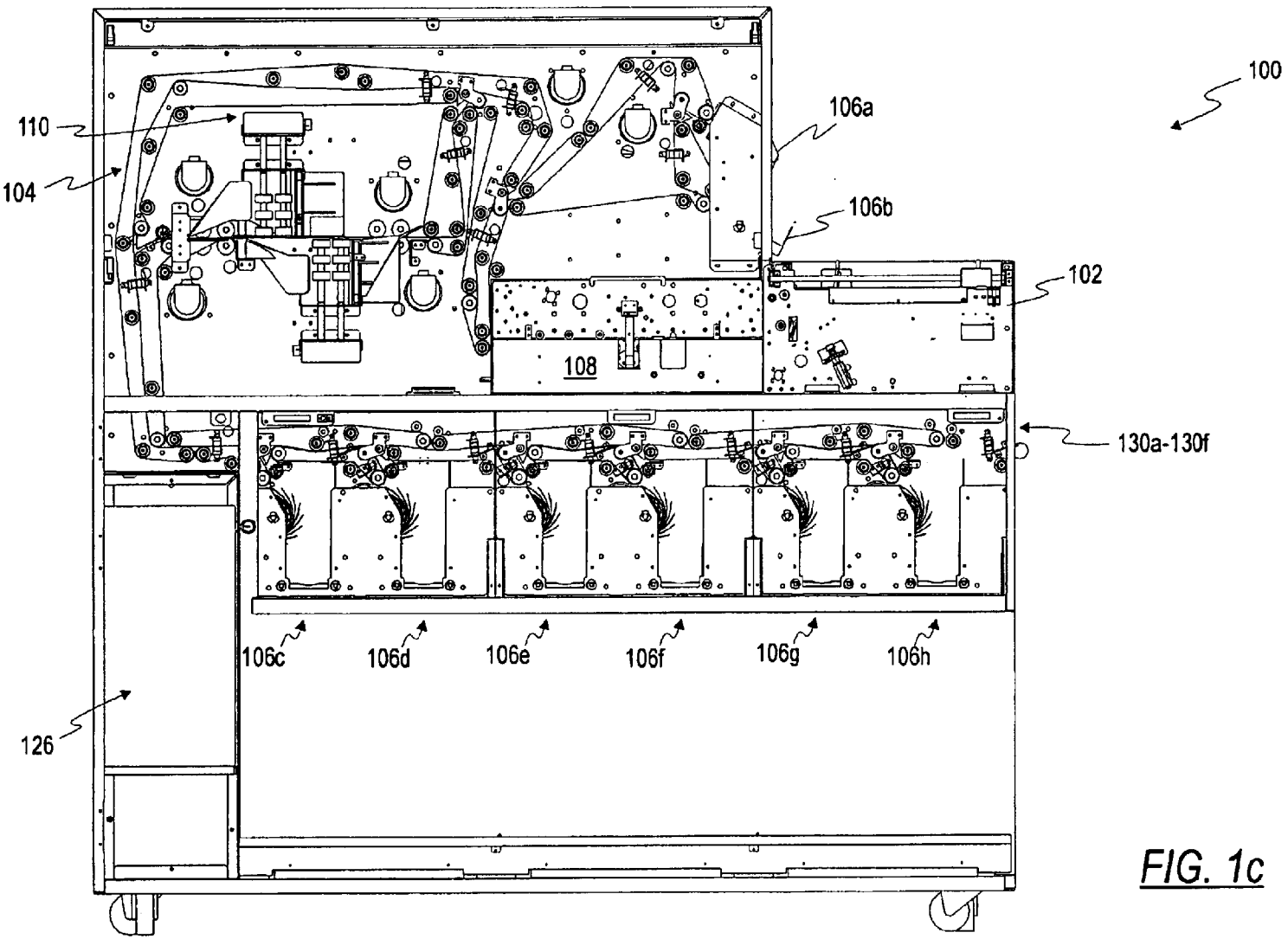
FIG. 1*c* is a front view of a document handling device according to one embodiment of the invention.

In FIGS. 1*a* and 1*b* each of the lower output receptacles 106*c*–106*h* includes a first portion designated as an escrow compartment 116*a*–116*f* and a second portion designated as a storage cassette 118*a*–118*f* (described in more detail below). In FIG. 1*c* a multi-pocket document processing device 100 such as a currency handling device according to one embodiment of the present invention is illustrated. The device of FIG. 1*c* is similar to that shown in FIG. 1*b* except that the lower output receptacles 106*c*–106*h* are not divided into two portions. That is, there are no storage cassettes in the embodiment shown in FIG. 1*c*.

Figure 2A:
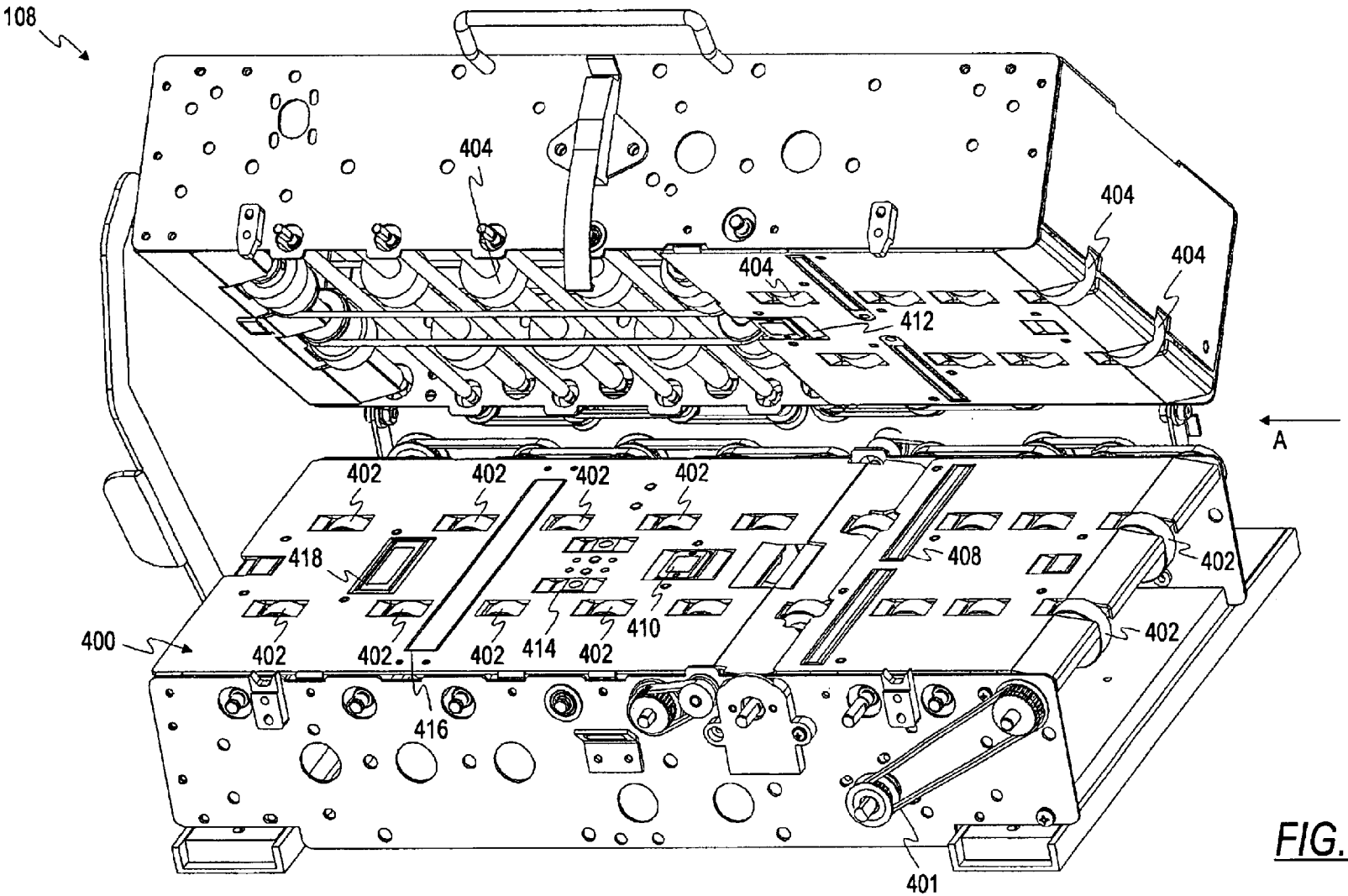
FIG. 2*a* is a perspective view of an evaluation region according to one embodiment of the document handling device of the present invention.
Figure 2B:
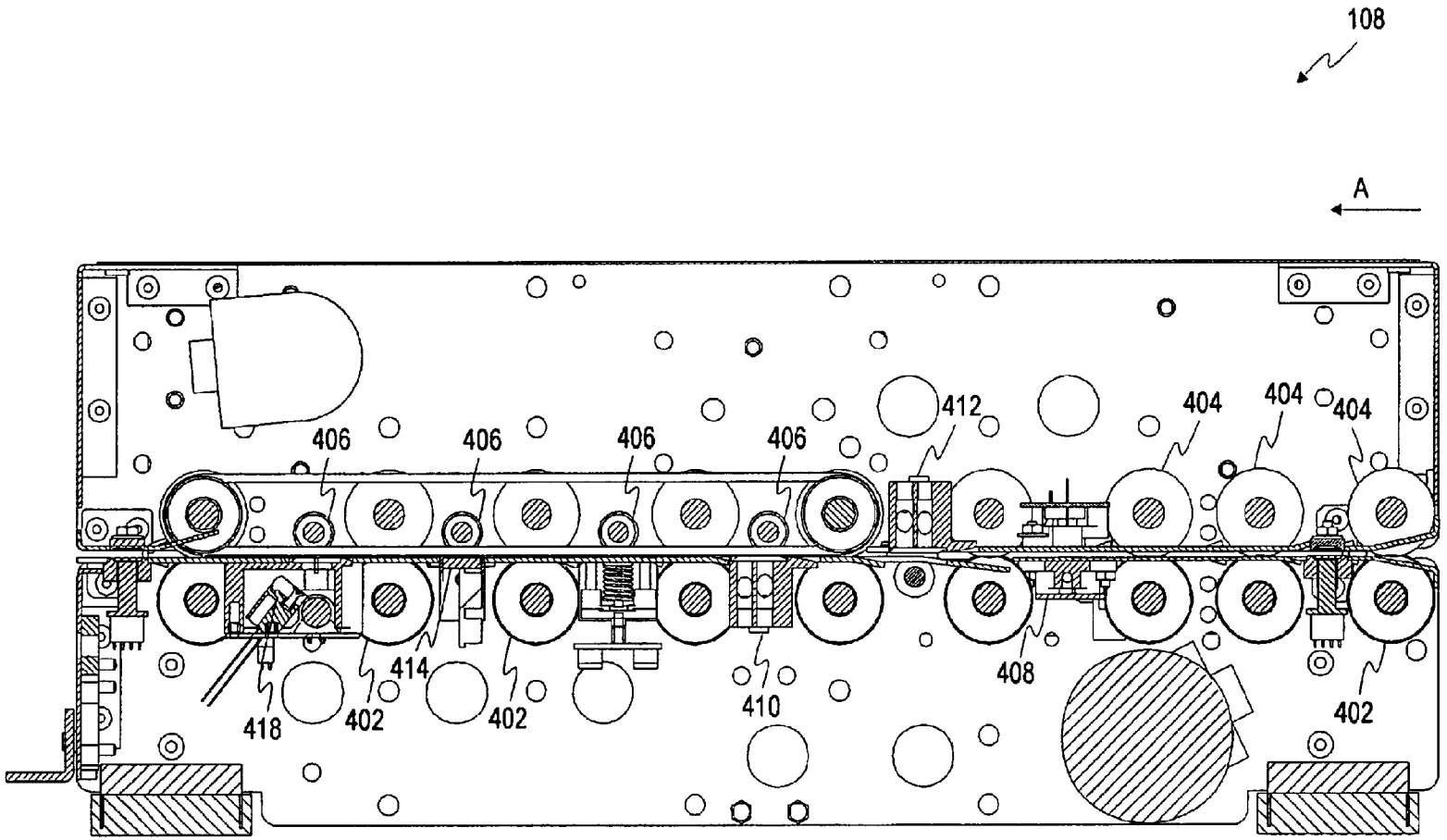
FIG. 2*b* is a side view of an evaluation region according to one embodiment of the document handling device of the present invention.
Figure 3A:
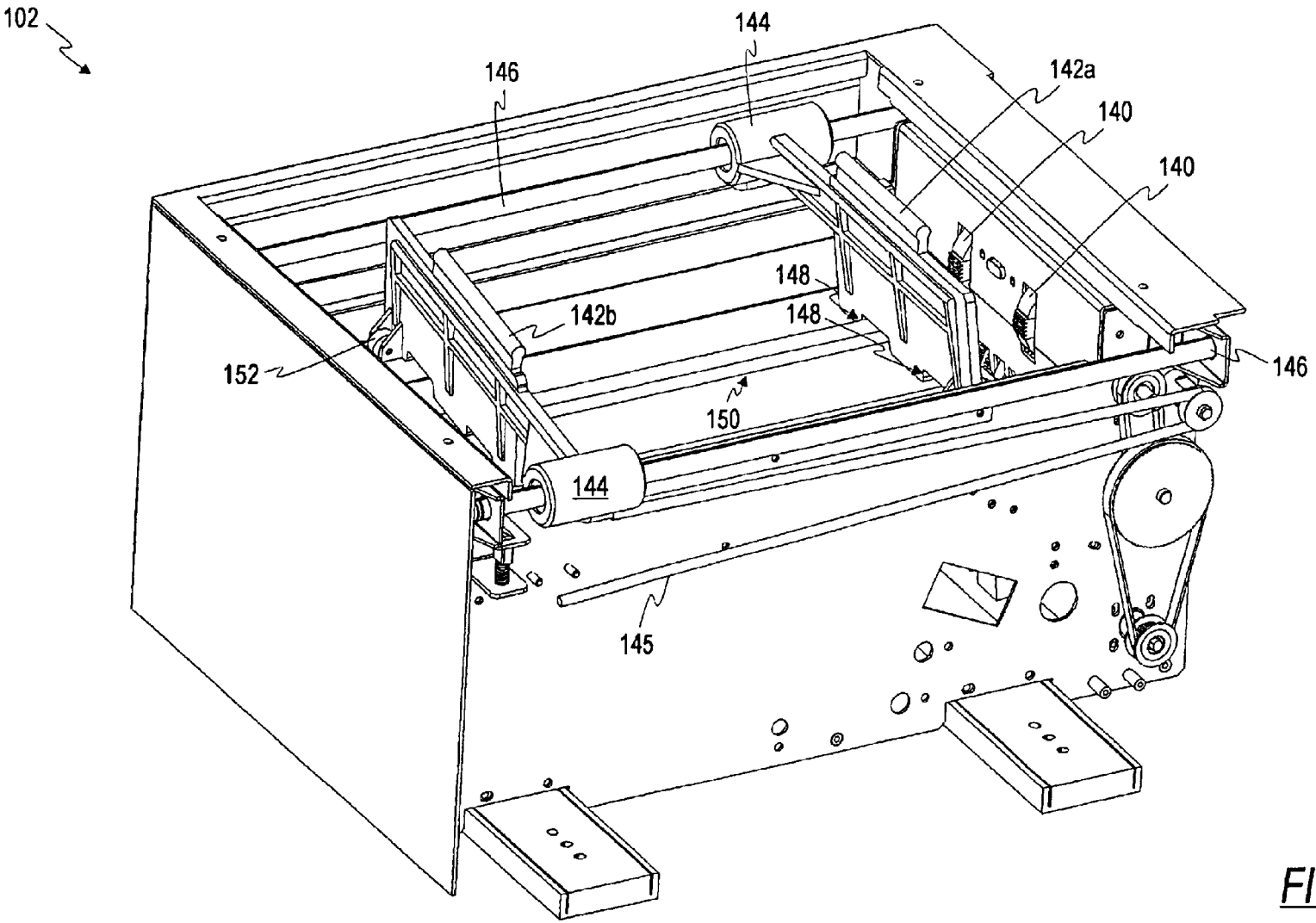
FIG. 3*a* is a perspective view of an input receptacle according to one embodiment of the document handling device of the present invention.
Figure 3B:
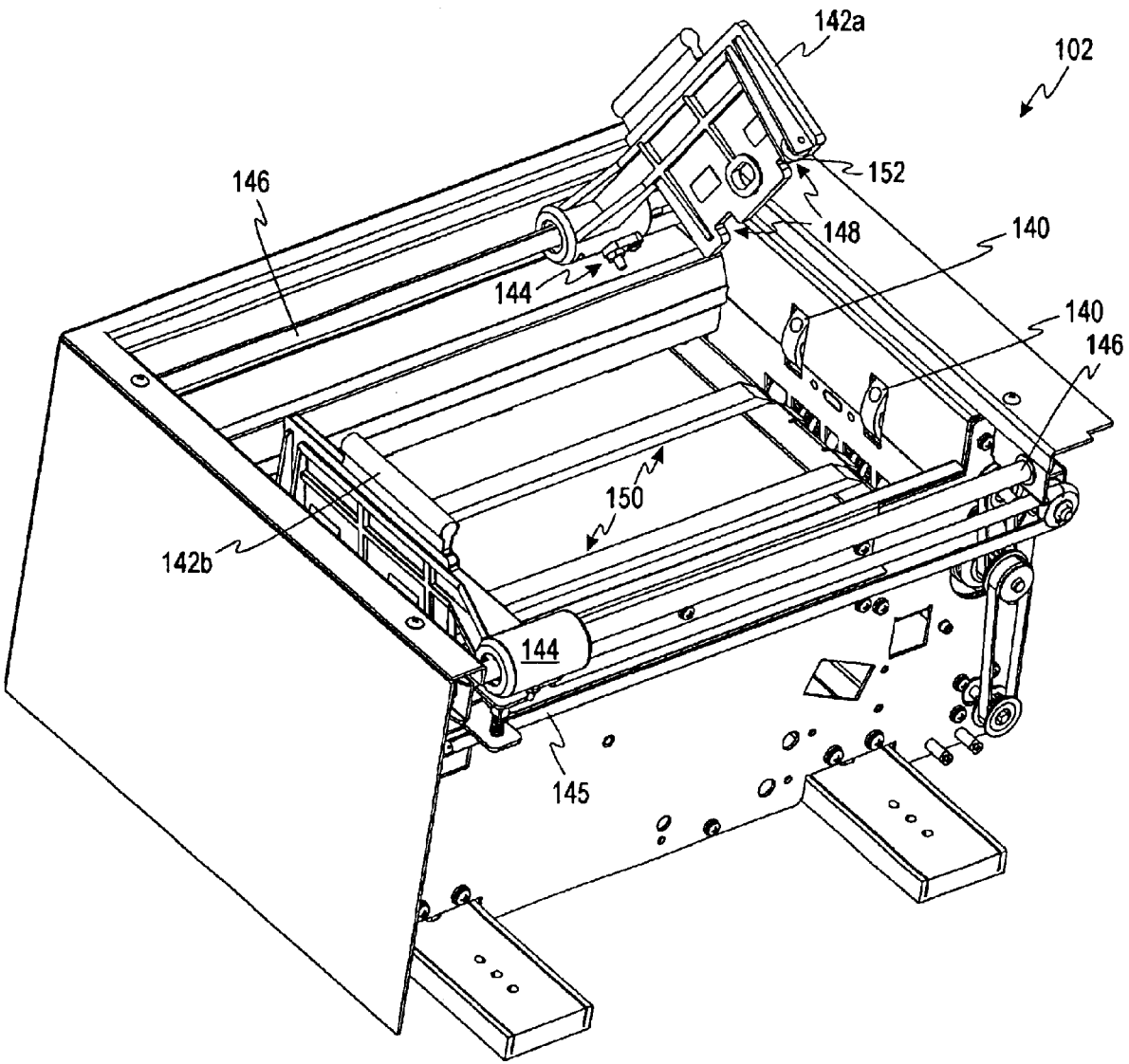
FIG. 3*b* is another perspective view of an input receptacle according to one embodiment of the document handling device of the present invention.
Figure 3C:
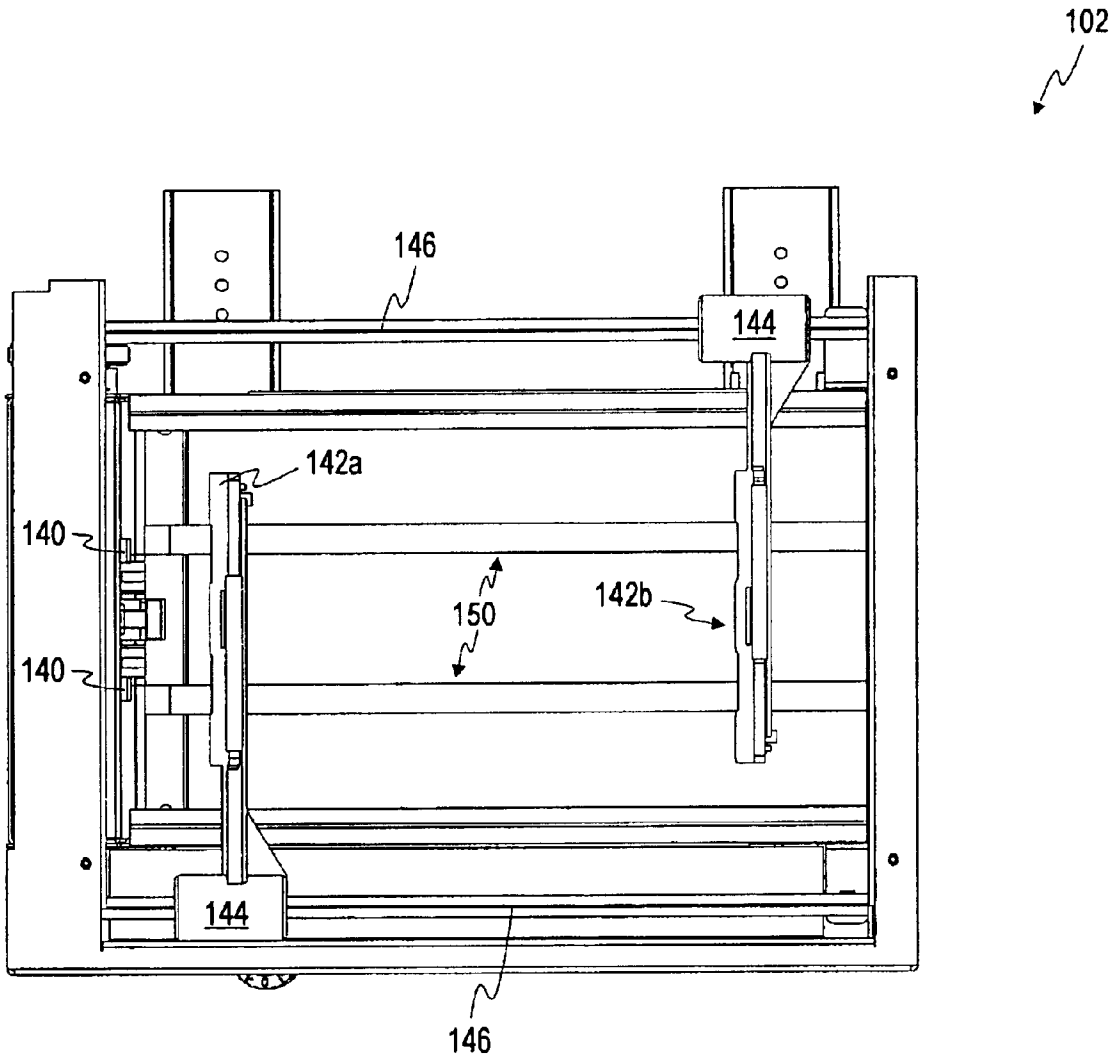
FIG. 3*c* is a top view of an input receptacle according to one embodiment of the document handling device of the present invention.
Figure 3D:
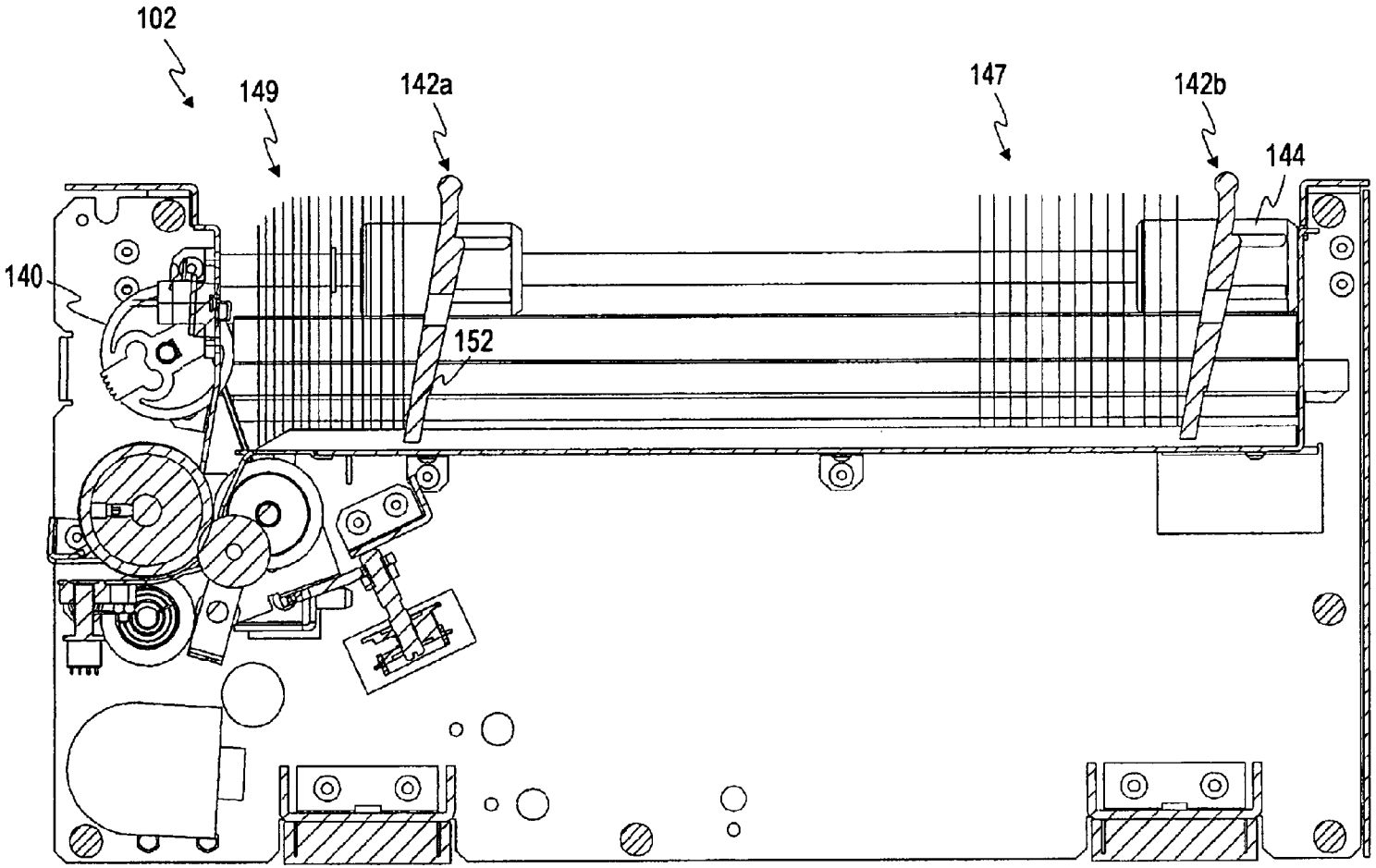
FIG. 3*d* is a side view of an input receptacle according to one embodiment of the document handling device of the present invention.

FIGS. 2*a* and 2*b* illustrate the evaluation region 108 according to one embodiment of the currency handling system 100. The evaluation region can be opened for service, access to sensors, clear bill jams, etc. as shown in FIG. 2*a*. The characteristics of the evaluation region 108 may vary according to the particular application and needs of the user. The evaluation region 108 can accommodate a number and variety of different types of sensors depending on a number of variables. These variables are related to whether the machine is authenticating, counting, or discriminating denominations and what distinguishing characteristics are being examined, e.g. size, thickness, color, magnetism, reflectivity, absorbability, transmissivity, electrical conductivity, etc. The evaluation region 108 may employ a variety of detection means including, but not limited to, a size detection and density sensor 408, a lower 410 and an upper 412 optical scan head, a single or multitude of magnetic sensors 414, a thread sensor 416, and an ultraviolet/fluorescent light scan head 418. These detection means and a host of others are disclosed in commonly owned, co-pending U.S. patent application Ser. No. 08/916,100 entitled "Multi-Pocket Currency Discriminator," incorporated by reference above.

The direction of bill travel through the evaluation region 108 is indicated by arrow A. The bills are positively driven along a transport plate 400 through the evaluation region 108 by means of a transport roll arrangement comprising both driven rollers 402 and passive rollers 404. The rollers 402 are driven by a motor (not shown) via a belt 401. Passive rollers 404 are mounted in such a manner as to be free-wheeling about their respective axis and biased into counter-rotating contact with the corresponding driven rollers 402. The driven and passive rollers 402, 404 are mounted so that they are substantially coplanar with the transport plate 400. The transport roll arrangement also includes compressible rollers 406 to aid in maintaining the bills flat against the transport plate 400. Maintaining the bill flat against the transport plate 400 so that the bill lies flat when transported past the sensors enhances the overall reliability of the evaluation processes. A similar transport arrangement is disclosed in commonly-owned U.S. Pat. No. 5,687,963 entitled "Method and Apparatus for Discriminating and Counting Documents," which is incorporated herein by reference in its entirety.

Referring now to FIGS. 3*a*–3*d*, the input receptacle 102 of the currency handling device 100 is illustrated. A feeder mechanism such as a pair of stripping wheels 140 aid in feeding the bills in seriatim to the transport mechanism 104 which first carries the bills through the evaluation region 108. According to one embodiment, the input receptacle 102 includes at least one spring-loaded feeder paddle 142*a* which is pivotally mounted, permitting it to be pivoted upward and drawn back to the rear of a stack of bills placed in the input receptacle 102 so as to bias the bills towards the evaluation region 108 via the pair of stripping wheels 140. The paddle 142*a* is coupled to an advance mechanism 144 to urge the paddle 142*a* towards the stripping wheels 140. In the illustrated embodiment, motion is imparted to the advance mechanism via a spring 145. In other alternative embodiments, the advance mechanism 144 is motor driven. The advance mechanism 144 is slidably mounted to a shaft 146. The advance mechanism 144 also constrains the paddle 142*a* to a linear path. The advance mechanism 144 may contain a liner bearing (not shown) allowing the paddle 142*a* to easily slide along the shaft 146. In the embodiment illustrated, the paddle 142*a* may also contain channels 148 to aid in constraining the paddle 142*a* to a linear path along a pair of tracks 150. The paddle 142*a* may additionally include a roller 152 to facilitate the movement of the paddle 142*a*.

In the embodiment illustrated in FIGS. 3*a*–3*d*, a second paddle 142*b* is provided such that a second stack of bills 147 may be placed in the input receptacle 102 behind a first group of bills 149, while the first group of bills 149 is being fed into the currency handling device 100. Thus, the two feeder paddles 142*a* and 142*b* may be alternated during processing in order to permit multiple stacks of currency bills to be loaded into the input receptacle 102. In such an embodiment, the operator would retract paddle 142*a* and place a stack of bills into the input receptacle. Once inside the input receptacle, the operator would place the paddle 142*a* against the stack of bills so that the paddle 142*a* biases the stack of bills towards the pair of stripper wheels 140. The operator could then load a second stack of bills into the input receptacle 102 by retracting the second paddle 142*b* and placing a stack of bills in the input receptacle between the paddles 142*a* and 142*b*. The second paddle 142*b* urges the second stack of bills up against the backside of the first paddle 142*a*. The operator can then upwardly rotate the first paddle 142*a* thus combining the two stacks. The first paddle 142*a* is then retracted to the rear of the input receptacle and the process can be repeated. The two paddle input receptacle allows the operator to more easily continuously feed stacks of bills to the currency handling device 100. In devices not having two feeder paddles, the operator is forced to awkwardly manipulate the two stacks of bills and the advance mechanism. Alternatively, the operator may wait for the stack of bills to be processed out of the input receptacle to add another stack; however, waiting to reload until each stack is processed adds to the total time to process a given amount of currency.

Figure 4:
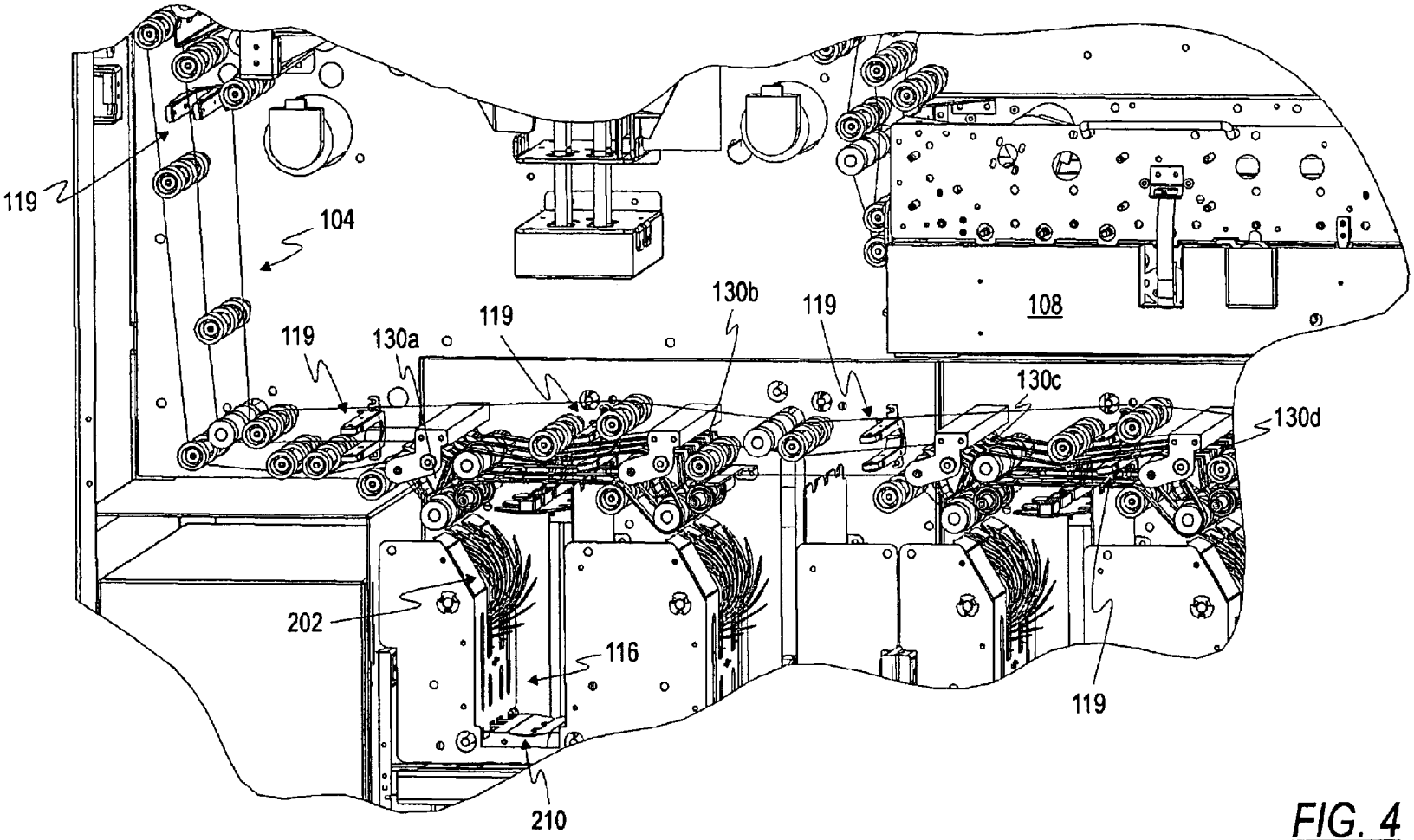
FIG. 4 is a perspective view of a portion of a transportation mechanism according to one embodiment of the present invention.

Referring to FIG. 4, a portion of the transport mechanism 104 and diverters 130*a*–130*d* are illustrated. A substantial portion of the transport path of the currency handling device 100 positively grips the bills during transport from the pair of stripping wheels 140 through the point where bills are delivered to upper output receptacle 106*a* or are delivered to the stacker wheels 202 of output receptacles 106*b*–106*h*. The positive grip transport path of the currency handling device 100 is less costly and weighs less than the vacuum transport arrangements of other currency processing devices.

The transport mechanism 104 is electronically geared causing all sections to move synchronously from the evaluation region 108 through the point where the bills are delivered to the output receptacles 106. Multiple small motors are used to drive the transport mechanism 104. Using multiple small, less costly motors is more efficient and less costly than a single large motor. Further, less space is consumed enabling the currency handling device 100 to be more compact. Electronically gearing the transport mechanism 104 enables a single encoder to monitor bill transportation within the currency handling system 100. The encoder is linked to the bill transport mechanism 104 and provides input to a processor to determine the timing of the operations of the currency handling device 100. In this manner, the processor is able to monitor the precise location of the bills as they are transported through the currency handling device 100. This process is termed "flow control." Input from additional sensors 119 located along the transport mechanism 104 of the currency handling device 100 enables the processor to continually update the position of a bill within the device 100 to accommodate for bill slippage. When a bill leaves the evaluation region 108 the processor expects the bill to arrive at the diverter 130*a* corresponding to the first lower output receptacle 106*c* after a precise number of encoder counts. Specifically, the processor expects the bill to flow past each sensor 119 positioned along the transport mechanism 104 at a precise number of encoder counts. If the bill slips during transport but passes a sensor 119 later within an acceptable number of encoder counts the processor updates or "re-queues" the new bill position. The processor calculates a new figure for the time the bill is expected to pass the next sensor 119 and arrive at the first diverter 130*a*. The processor activates a the one of the deviators 130*a*–130*f* to direct the bill into the appropriate corresponding lower output receptacle 106*c*–106*h* when the sensor 119 immediately preceding the diverted 130 detects the passage of the bill to be directed into the appropriate lower output receptacle 106*c*–106*h*.

The currency handling device 100 also uses flow control to detect jams within the transport mechanism 104 of the device 100. When a bill does not reach a sensor 119 within in the calculated number of encoder counts plus the maximum number of counts allowable for slippage, the processor suspends operation of the device 100 and informs the operator via the display/user-interface 122 that a jam has occurred. The processor also notifies the operator via the display/user-interface 122 of the location of the jam by indicating the last sensor 19 that the bill passed and generally the approximate location of the jam in the system. If the operator cannot easily remove the bill without damage, the operator can then electronically jog the transport path in the forward or reverse direction via the control unit 120 so that the jammed bill is dislodged and the operator can easily remove the bill from the transport path. The operator can then flush the system causing the transport mechanism 104 to deliver all of the bills currently within the transport path of the currency handling device 100 to one of the output receptacles 106. In an alternative embodiment, the user of the currency handling device 100 would have the option when flushing the system to first have the bills already within the escrow regions 116*a*–116*f* to be delivered to the respective lower storage cassettes 106*c*–106*h* so that those bills may be included in the aggregate value data for the bills being processed. The bills remaining in the transport path 104 would then be delivered to a predetermined escrow region 116 where those bills could be removed and reprocessed by placing those bills in the input receptacle 102.

Utilizing flow control to detect jams is more desirable than prior art currency evaluation machines which do not detect a jam until a sensor is actually physically blocked. The latter method of jam detection permits bills to pile up while waiting for a sensor to become blocked. Bill pile-up is problematic because it may physically halt the machine before the jam is detected and may cause physical damage to the bills and the machine. In order to remedy a jam in a prior art machine, the operator must first manually physically dislodge the jammed bills. The operator must then manually turn a hand crank which advances the transport path until all bills within the transport path are removed. Moreover, because the prior art devices permit multiple bills to pile up before a jam is detected, the integrity of the process is often ruined. In such a case, the entire stack of bills must be reprocessed.

Referring back to FIG. 1*a*, the illustrated embodiment of the currency handling device 100 includes a total of six lower output receptacles 106*c*–106*h*. More specifically, each of the lower output receptacles 106*c*–106*h* includes a first portion designated as an escrow compartment 116*a*–116*f* and a second portion designated as a storage cassette 118*a*–118*f* Typically, bills are initially directed to the escrow compartments 116, and thereafter at specified times or upon the occurrence of specified events, which may be selected or programmed by an operator, bills are then fed to the storage cassettes 118. The storage cassettes are removable and replaceable, such that stacks of bills totaling a predetermined number of bills or a predetermined monetary value may be accumulated in a given storage cassette 118, whereupon the cassette may be removed and replaced with an empty storage cassette. In the illustrated embodiment, the number of lower output receptacles 106*c*–106*h* including escrow compartments 116 and storage cassettes 118 are six in number. In alternative embodiments, the currency handling device 100 may contain more or less than six lower output receptacles including escrow compartments and storage cassettes 118. In other alternative embodiments, modular lower output receptacles 106 can be implemented to add many more lower output receptacles to the currency handling system 100. Each modular unit may comprise two lower output receptacles. In other alternative embodiments, several modular units may be added at one time to the currency handling device 100.

A series of diverters 130*a*–130*f*, which are a part of the transportation mechanism 104, direct the bills to one of the lower output receptacles 106*c*–106*h*. When the diverters 130 are in an upper position, the bills are directed to the adjacent lower output receptacle 106. When the diverters 130 are in a lower position, the bills proceed in the direction of the next diverter 130.

Figure 5:
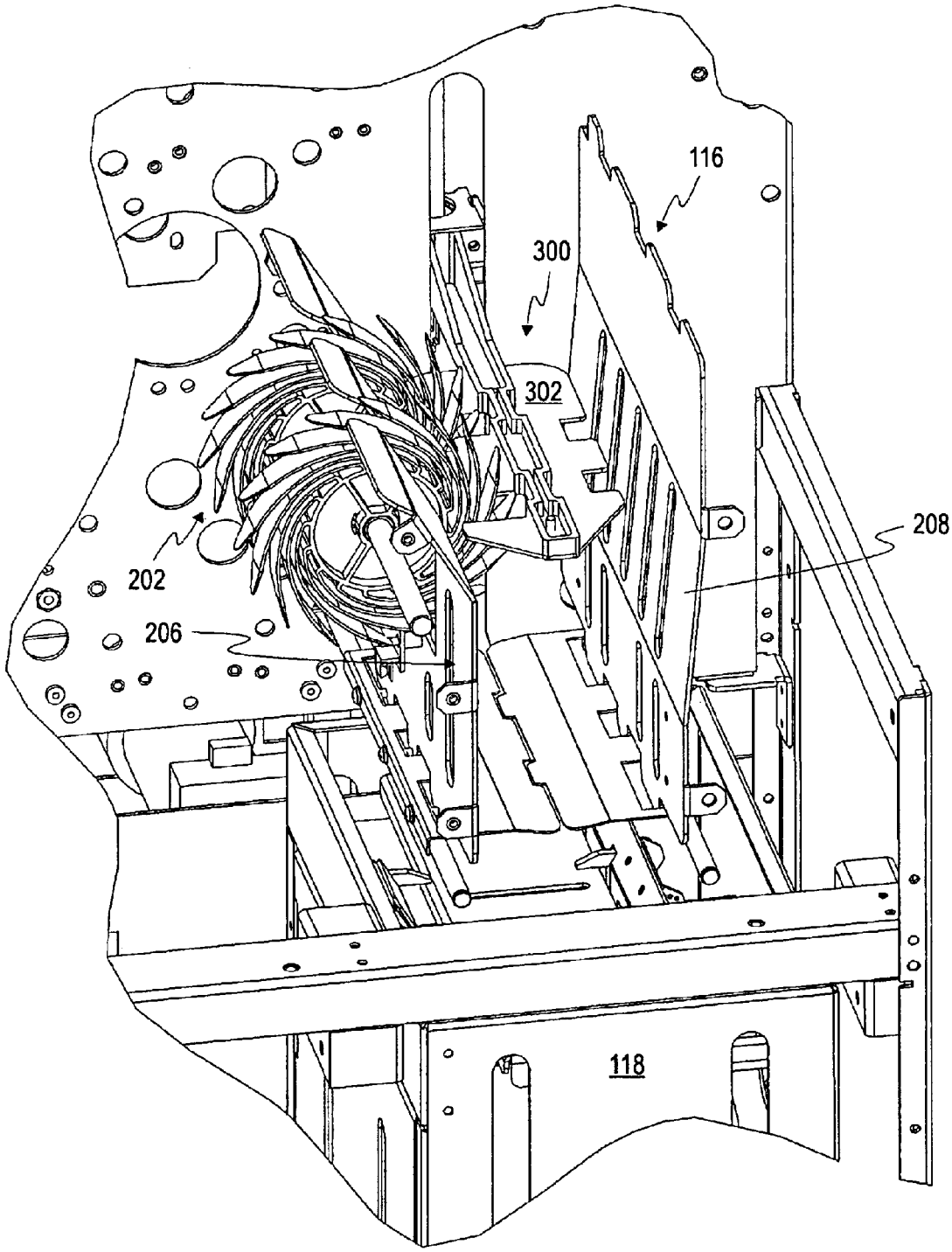
FIG. 5 is a front perspective view of an escrow compartment, a plunger assembly, and a storage cassette according to one embodiment of the document handling device of the present invention.

The vertical arrangement of the lower output receptacles 106*c*–106*h* is illustrated in FIG. 5. The escrow compartment 116 is positioned above the storage cassette 118. In addition to the escrow compartment 116 and the storage cassette 118, each of the lower output receptacles 106*c*–106*h* contains a plunger assembly 300. The plunger assembly 300 is shown during its decent towards the storage cassette 118.

Figure 6:
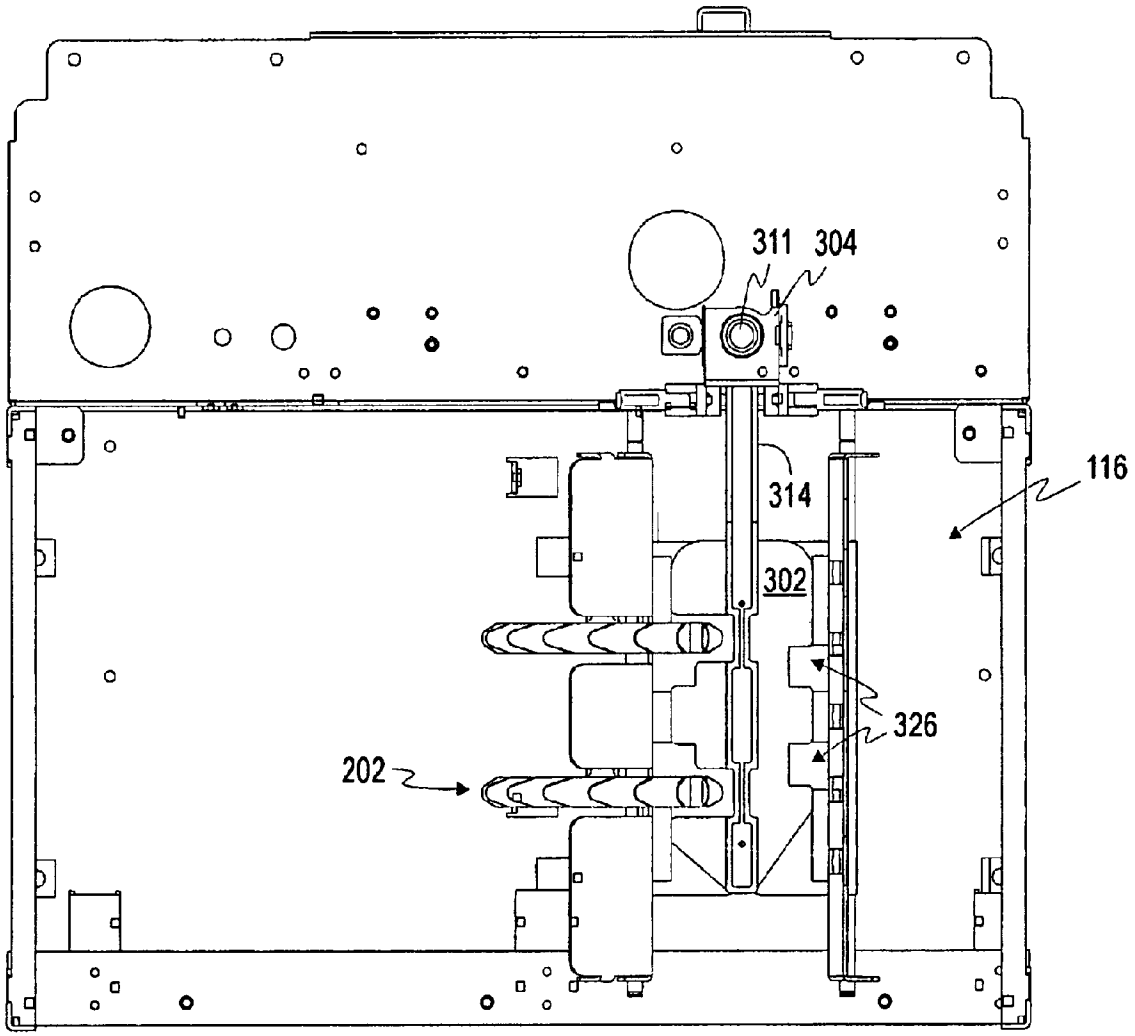
FIG. 6 is a top view of an escrow compartment and plunger assembly according to one embodiment of the document handling device of the present invention.
Figure 7:
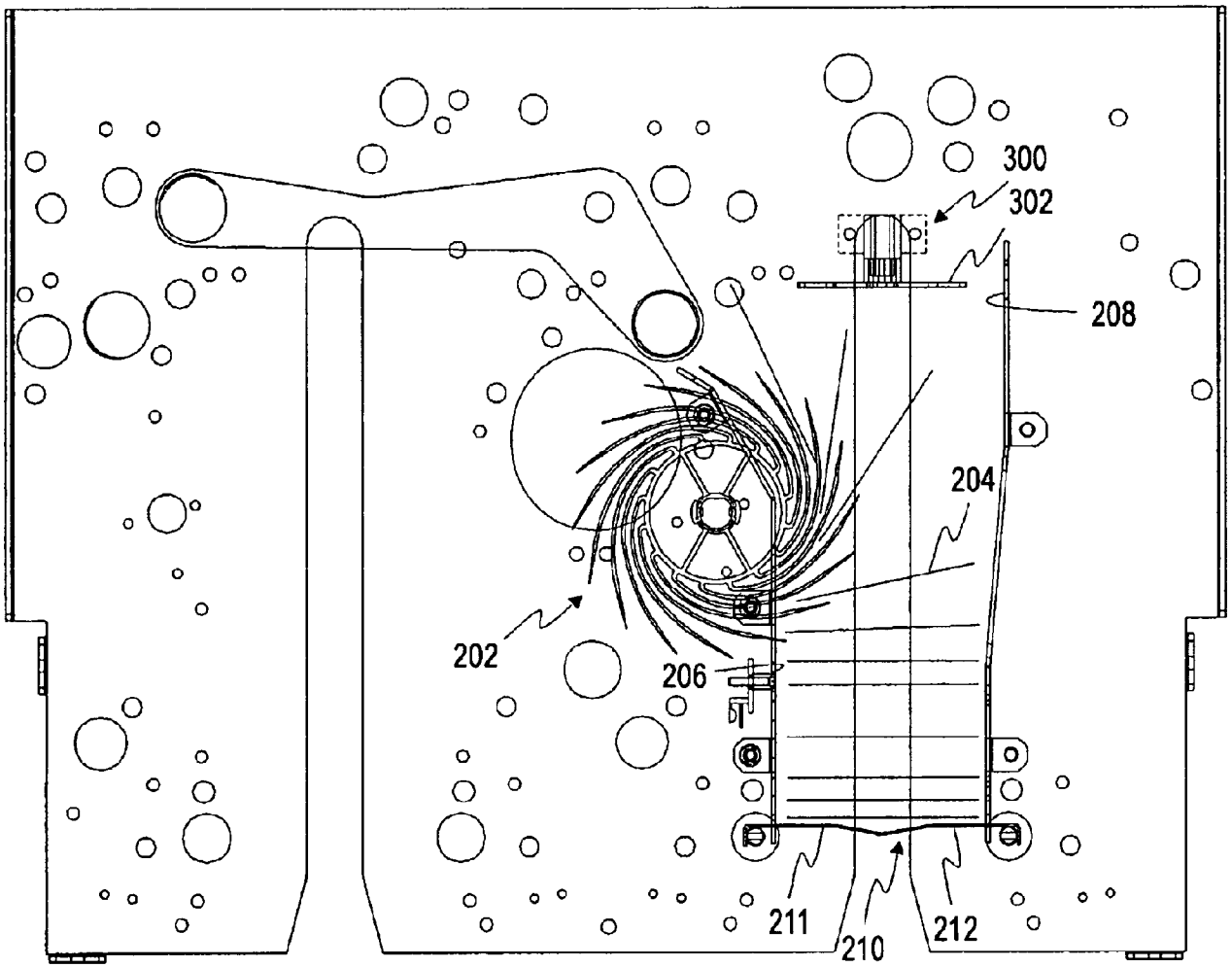
FIG. 7 is a front view of an escrow compartment and plunger assembly according to one embodiment of the document handling device of the present invention.

Referring now to FIGS. 6 and 7, one of the escrow compartments 116 of the lower output receptacles 106*c*–106*h* is shown. The escrow compartment 116 contains a stacker wheel 202 to receive the bills 204 from the diverter 130. The stacker wheel 202 stacks the bills 204 within the escrow compartment walls 206, 208 on top of a gate 210 disposed between the escrow compartment 116 and the storage cassette 118. In an alternative embodiment, the escrow compartment 116 contains a pair of guides to aid in aligning the bills substantially directly on top of one another. The gate 210 is made up of two shutters: a first shutter 211 and a second shutter 212. The shutters 211, 212 are hingedly connected enabling the shutters 211, 212 to rotate downward approximately ninety degrees to move the gate from a first position (closed position) wherein the shutters 211, 212 are substantially co-planer to a second position (open position) wherein the shutters 211, 212 are substantially parallel. Below the gate 210 is the storage cassette 118 (not shown in FIGS. 6 and 7).

Figure 8:
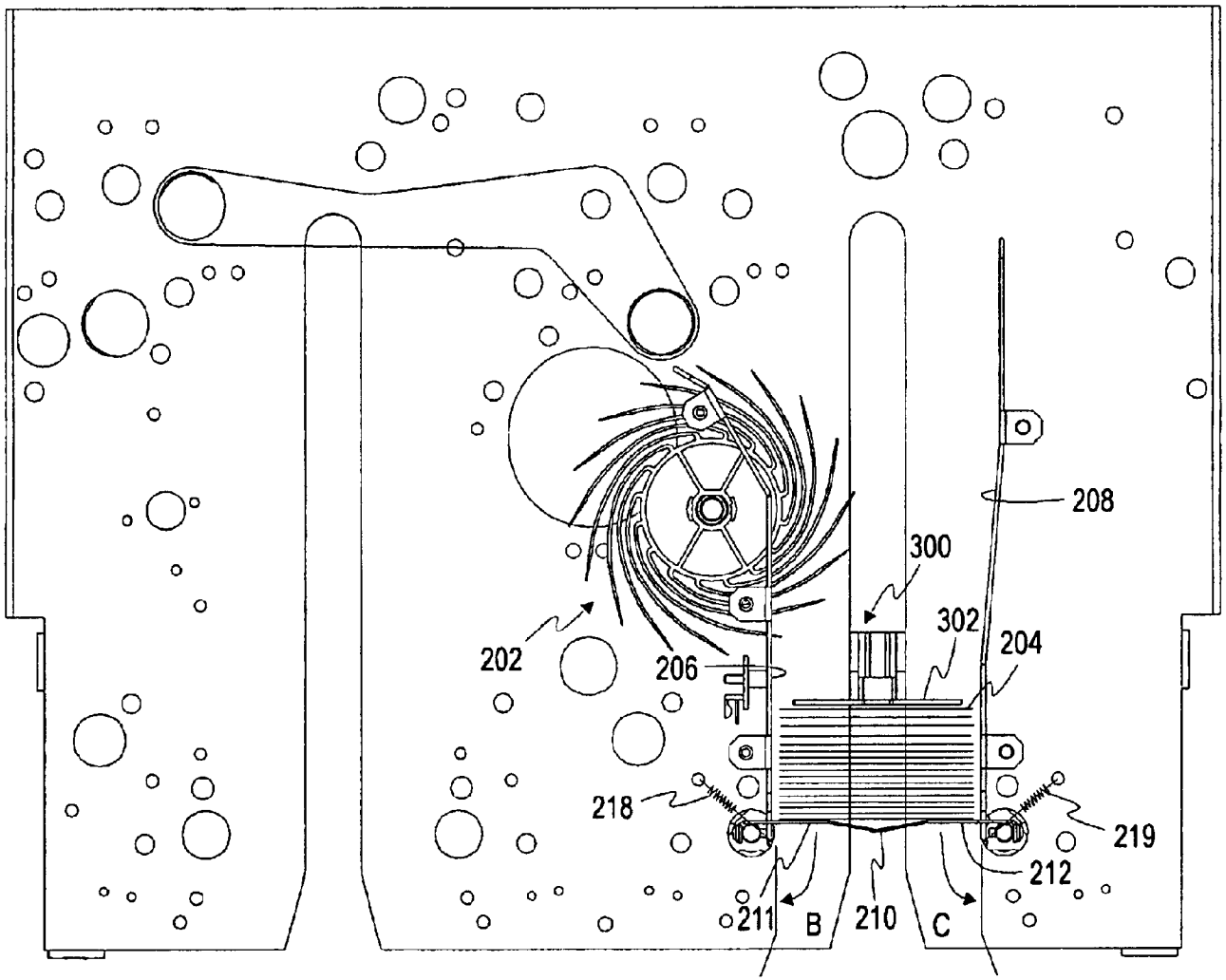
FIG. 8 is another front view of an escrow compartment and plunger assembly according to one embodiment of the document handling device of the present invention.

FIG. 8 illustrates the positioning of the paddle 302 when transferring a stack of bills from the escrow compartment 116 to the storage cassette 118. When the paddle descends upon the stack of bills 204 it causes shutters 211, 212 to quickly rotate in the directions referred to by arrows B and C, respectively; thus, "snapping" open the gate 210. The quick rotation of the shutters 211, 212 insures that the bills fall into the storage cassette 118 in a substantially stacked position. According to one embodiment, the paddle is programmed to descend after a predetermined number of bills 204 are stacked upon the gate 210. According to other embodiments, the operator can instruct the paddle 302 via the control unit 120 to descend upon the bills 204 stacked upon the gate 210.

Figure 9:
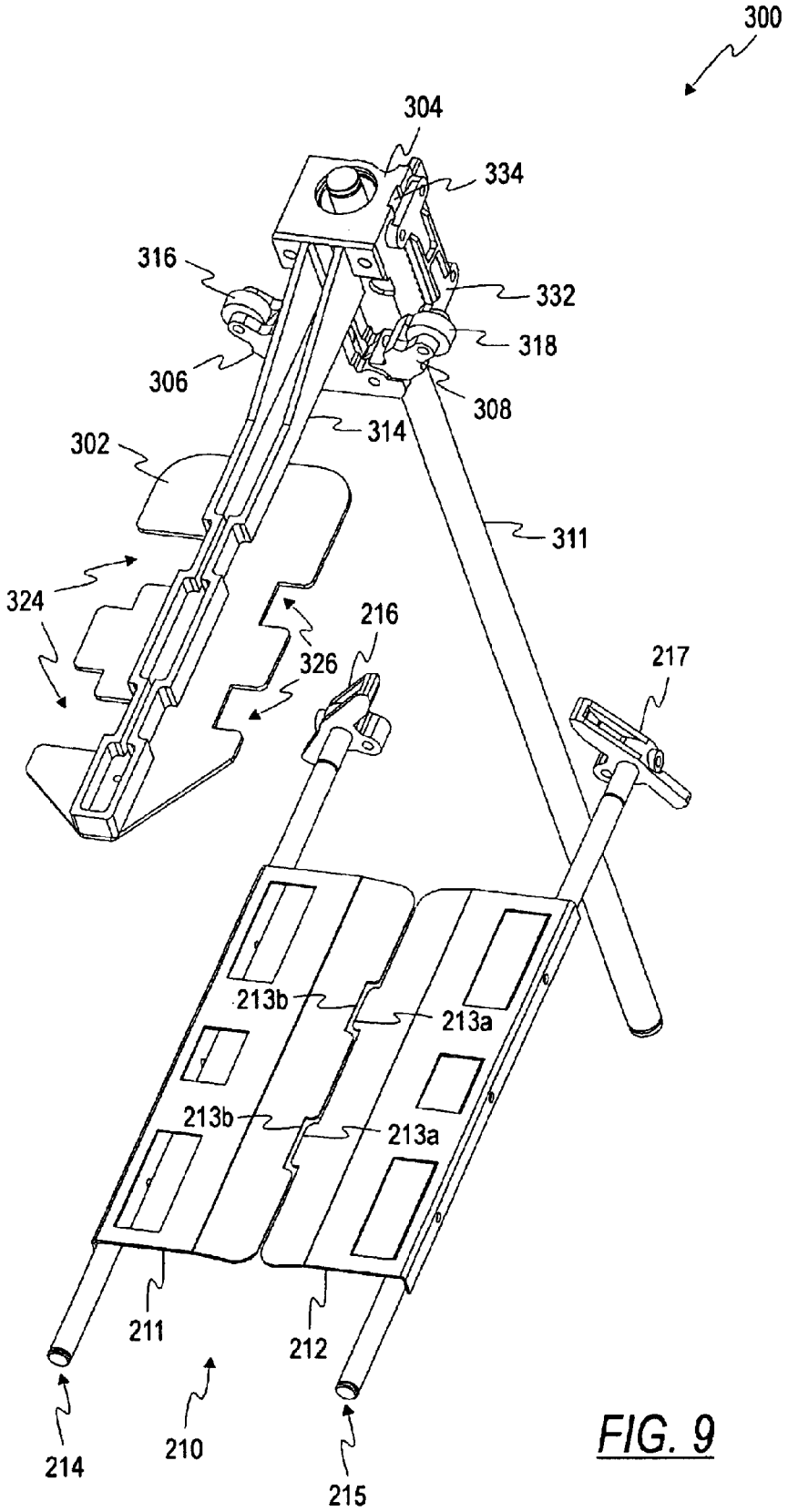
FIG. 9 is a perspective view of an apparatus for transferring currency from an escrow compartment to a storage cassette according to one embodiment of the document handling device of the present invention.

Referring now to FIG. 9, the plunger assembly 300 for selectively transferring the bills 204 from an escrow compartment 116 to a corresponding storage cassette 118 and the gate 210 are illustrated in more detail. One such plunger assembly 300 is provided for each of the six lower output receptacles 106*c*–106*h* of the currency handling device 100. The plunger assembly 300 comprises a paddle 302, a base 304, and two side arms 306, 308. Each of the shutters 211, 212 comprising the gate 210 extends inwardly from corresponding parallel bars 214, 215. The bars 214, 215 are mounted for pivoting the shutters between the closed position and the open position. Levers 216, 217 are coupled to the parallel bars 214, 215 respectively, to control the rotation of the bars 214, 215 and hence of the shutters 211, 212. Extension springs 218, 219 (shown in FIG. 8) tend to maintain the position of the levers 216, 217 both in the closed and open positions. The shutters 211, 212 have an integral tongue 213*a* and groove 213*b* arrangement which prevents any bills which are stacked upon the gate 210 from slipping between the shutters 211, 212.

The base 304 travels along a vertical shaft 311 with which it is slidably engaged. The base 304 may include linear bearings (not shown) to facilitate its movement along the vertical shaft 311. The plunger assembly 300 may also include a vertical guiding member 312 (see FIG. 11) with which the base 304 is also slidably engaged. The vertical guiding member 312 maintains the alignment of the plunger assembly 300 by preventing the plunger assembly 300 from twisting laterally about the vertical shaft 311 when the paddle 302 forces the bills 204 stacked in the escrow area 116 down into a storage cassette 118.

Figure 10:
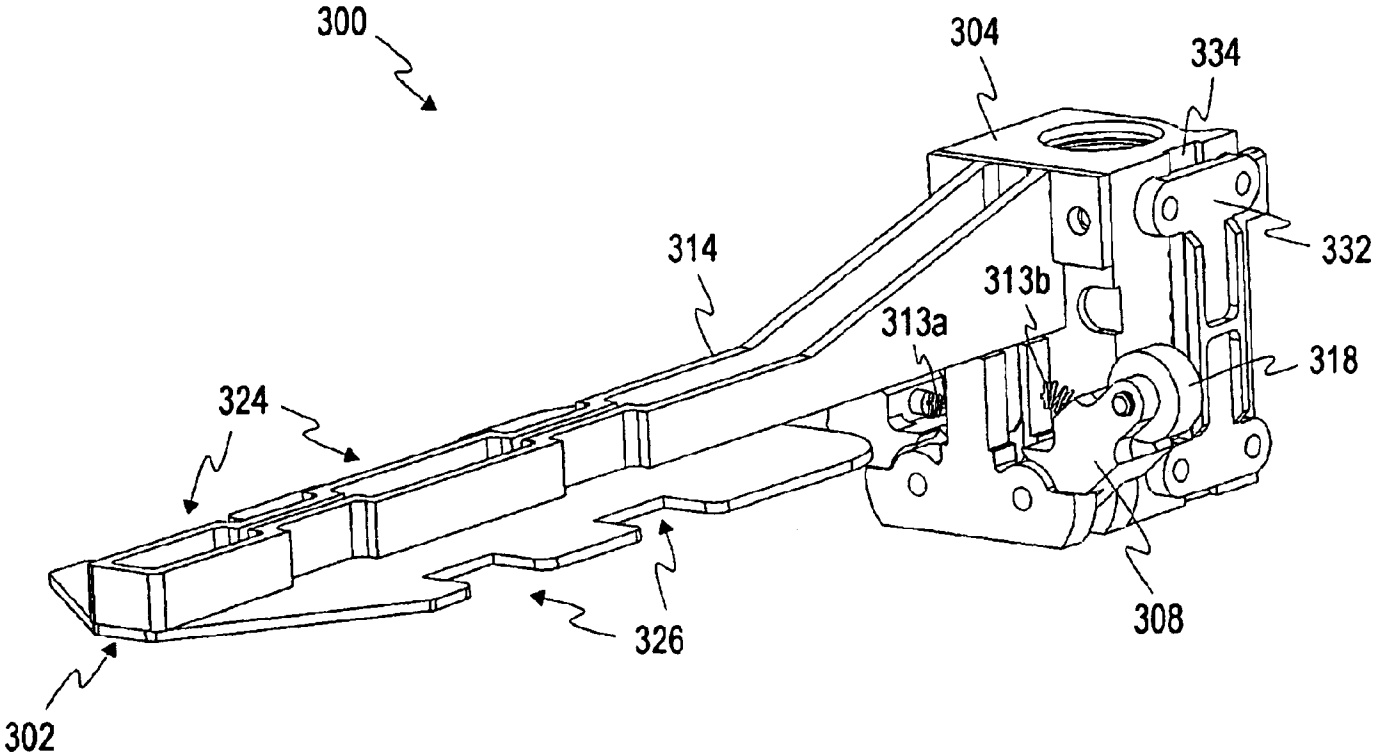
FIG. 10 is a perspective view of a paddle according to one embodiment of the document handling device of the present invention.

Referring also to FIG. 10, the paddle 302 extends laterally from the base 304. The paddle 302 is secured to a support 314 extending from the base 304. A pair of side arms 306, 308 are hingedly connected to the base. Each of the side arms 306, 308 protrude from the sides of the base 304. Rollers 316, 318 are attached to the side arms 306, 308, respectively, and are free rolling. Springs 313*a*, 313*b* are attached to the side arms 306, 308, respectively, to bias the side arms 306, 308 outward from the base 304. In the illustrated embodiment, the spring 313*a*, 313*b* are compression springs.

The paddle 302 contains a first pair of slots 324 to allow the paddle to clear the stacker wheel 202 when descending into and ascending out of the cassette 118. The first pair of slots 324 also enables the paddle 302 to clear the first pair of retaining tabs 350 within the storage cassette (see FIG. 14). Similarly, paddle 302 contains a second pair of slots 326 to enable the paddle 302 to clear the second pair of retaining tabs 350 within the storage cassette 118 (see FIG. 14).

Figure 11:
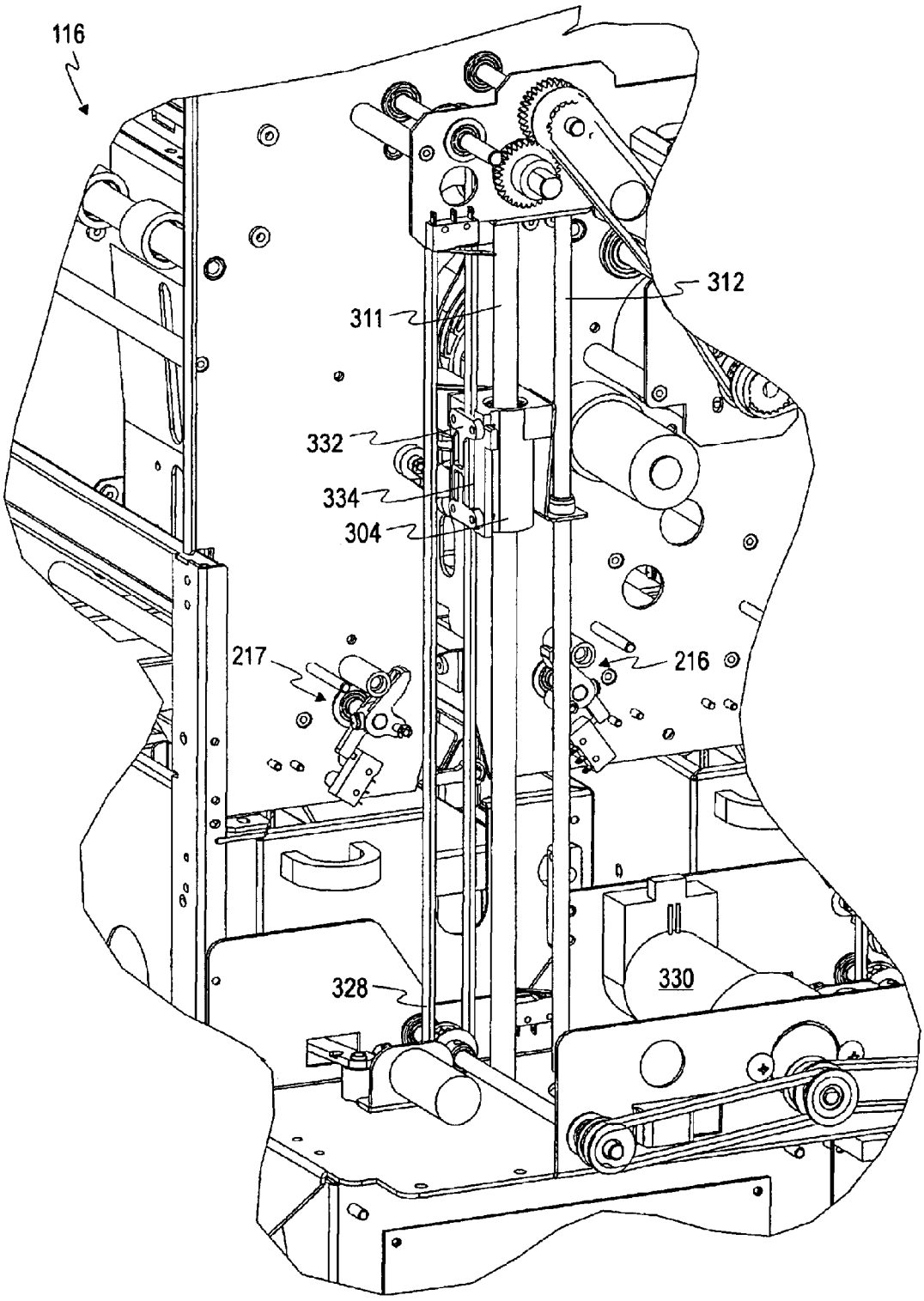
FIG. 11 is a rear perspective view of the escrow compartment, plunger assembly, and storage cassette according to one embodiment of the document handling device of the present invention.

Referring now to FIG. 11, which illustrates a rear view of one of the lower output receptacles 106*c*–106*h*, the plunger 300 is bidirectionally driven by way of a belt 328 coupled to an electric motor 330. A clamp 332 engages the belt 328 into a channel 334 in the base 304 of the plunger assembly 300. In the embodiment illustrated in FIG. 11, two plunger assemblies 300 are driven by a single electric motor 330. In one embodiment of the currency handling device, the belt 328 is a timing belt. In other alternative embodiments, each plunger assembly 300 can be driven by a single electric motor 330. In still other alternative embodiments, there can be any combination of motors 330 to plunger assemblies 300.

Figure 12:
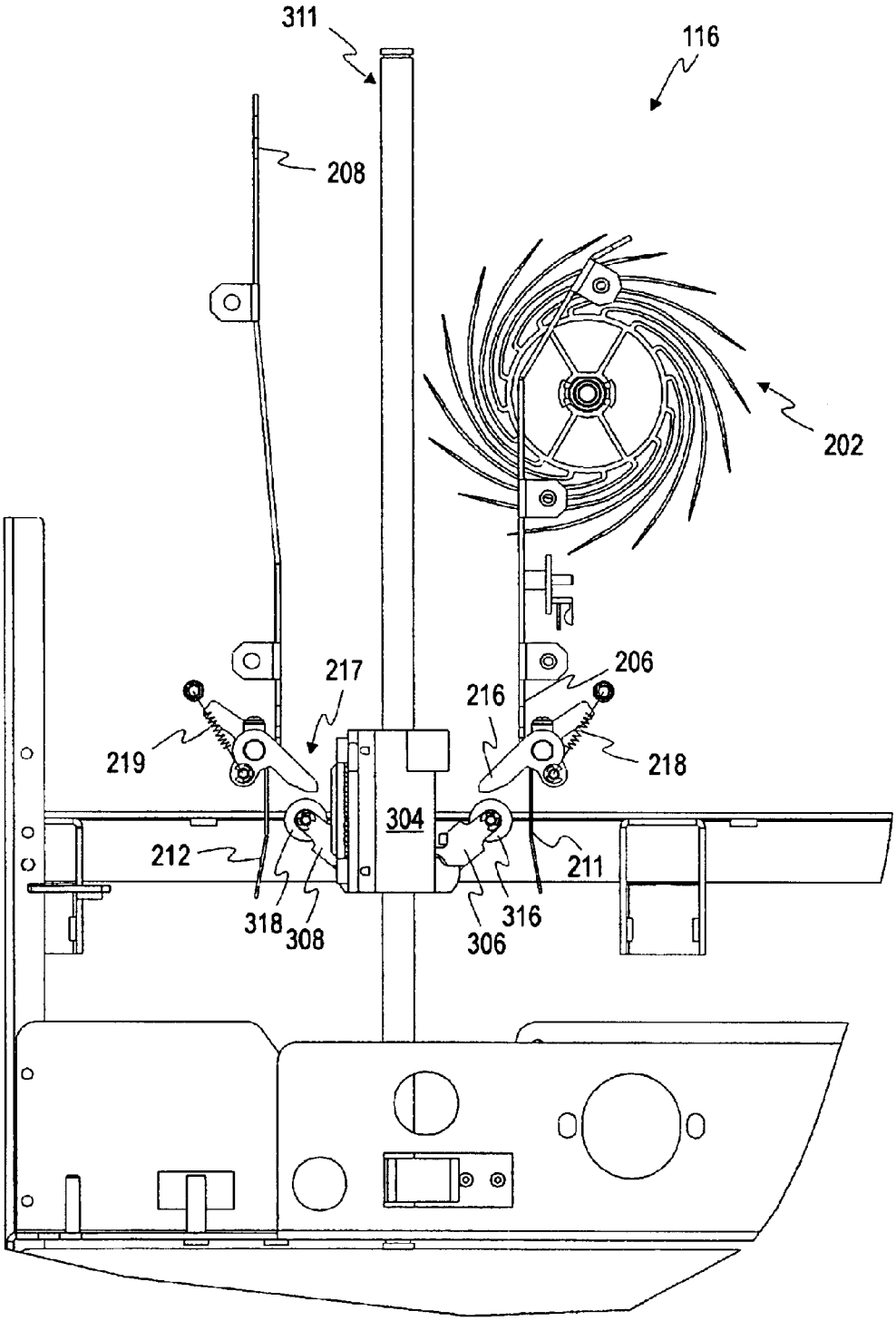
FIG. 12 is a rear view of a plunger assembly wherein the gate is in the open position according to one embodiment of the document handling device of the present invention.
Figure 13:
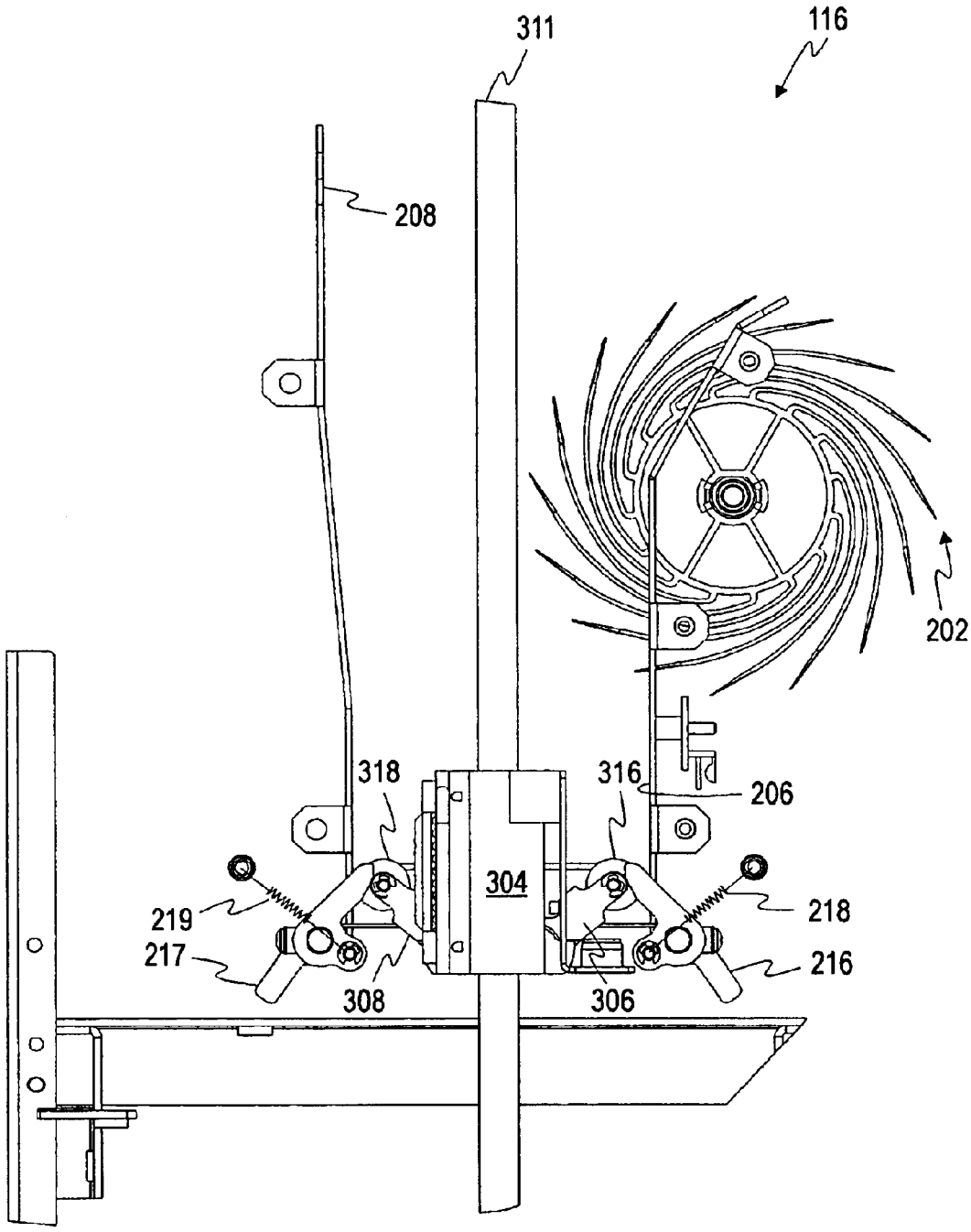
FIG. 13 is a rear view of a plunger assembly wherein the gate is in the closed position according to one embodiment of the document handling device of the present invention.

FIGS. 12 and 13 illustrate the interaction between the side arms 306, 308 and the levers 216, 217 when the paddle assembly 300 is descending towards and ascending away from the storage cassette 118, respectively. Initially, before descending towards the cassette, the shutters are in a first (closed) position. In the illustrated embodiment, it is the force imparted by the paddle 302 which opens the gate 210 when the paddle descends towards the storage cassette 118. When the paddle is ascending away from the storage cassette 119, it is the rollers 316, 318 coupled to the side arms 306, 308 which engage the levers 216, 217 that close the gate 210. The levers 216, 217 shown in FIG. 12 are positioned in the open position. When descending towards the storage cassette 118, the rollers 316, 318 contact the levers 216, 217 and roll around the levers 216, 217 leaving the shutters in the open position. The side arms 306, 308 are hinged in a manner which allows the side arms 306, 308 to rotate inward towards the base 304 as the rollers 316, 318 engage the levers 216, 217. FIG. 13 illustrates the levers in the second position wherein the gate 210 is closed. When the paddle ascends out of the storage cassette, the side arms 306, 308 are biased away from the base 304. The rollers 316, 318 engage the levers 216, 217 causing the levers to rotate upward to the first position thus closing the gate.

Figure 14:
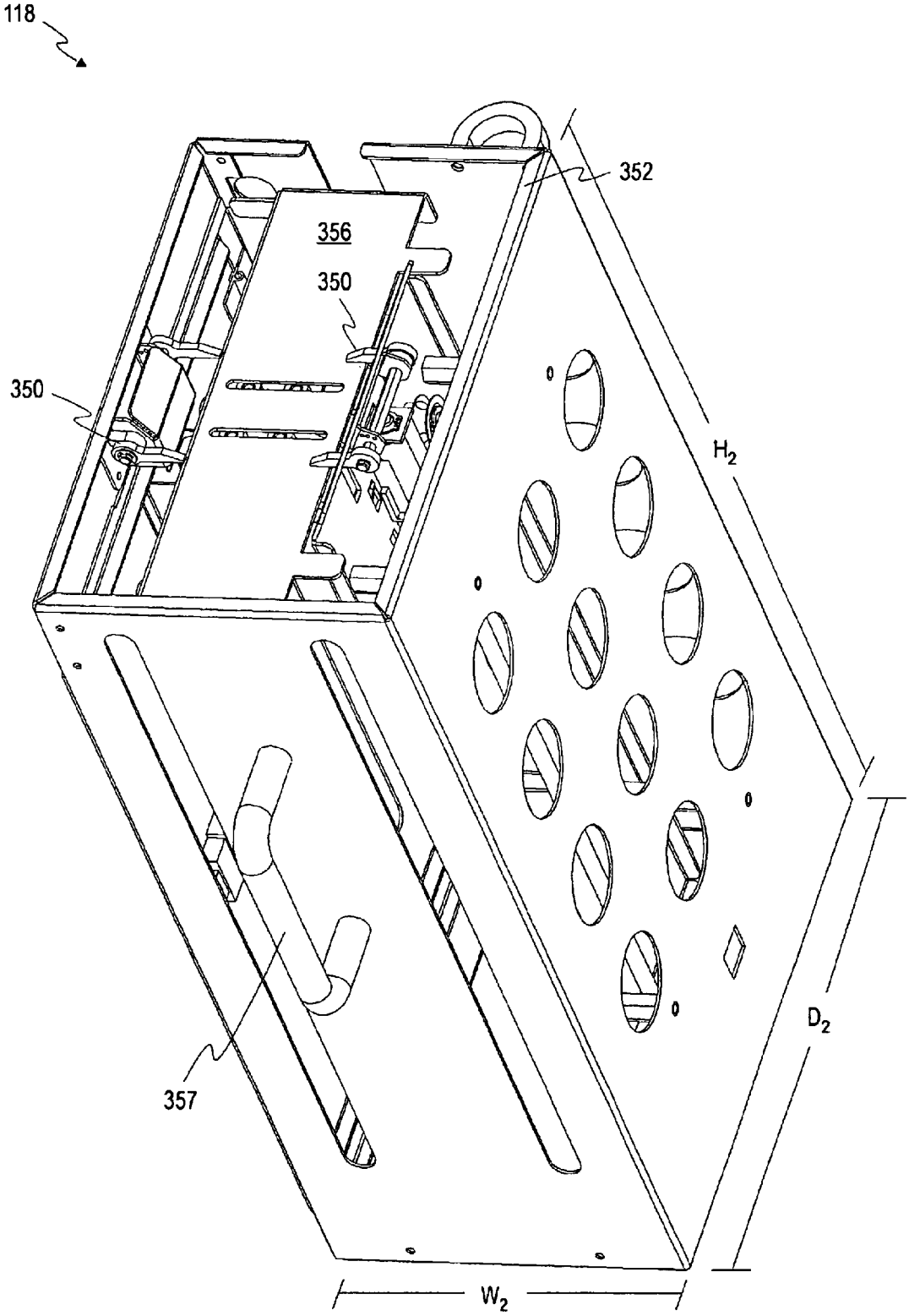
FIG. 14 is a perspective view of a storage cassette according to one embodiment of the document handling device of the present invention.
Figure 15:
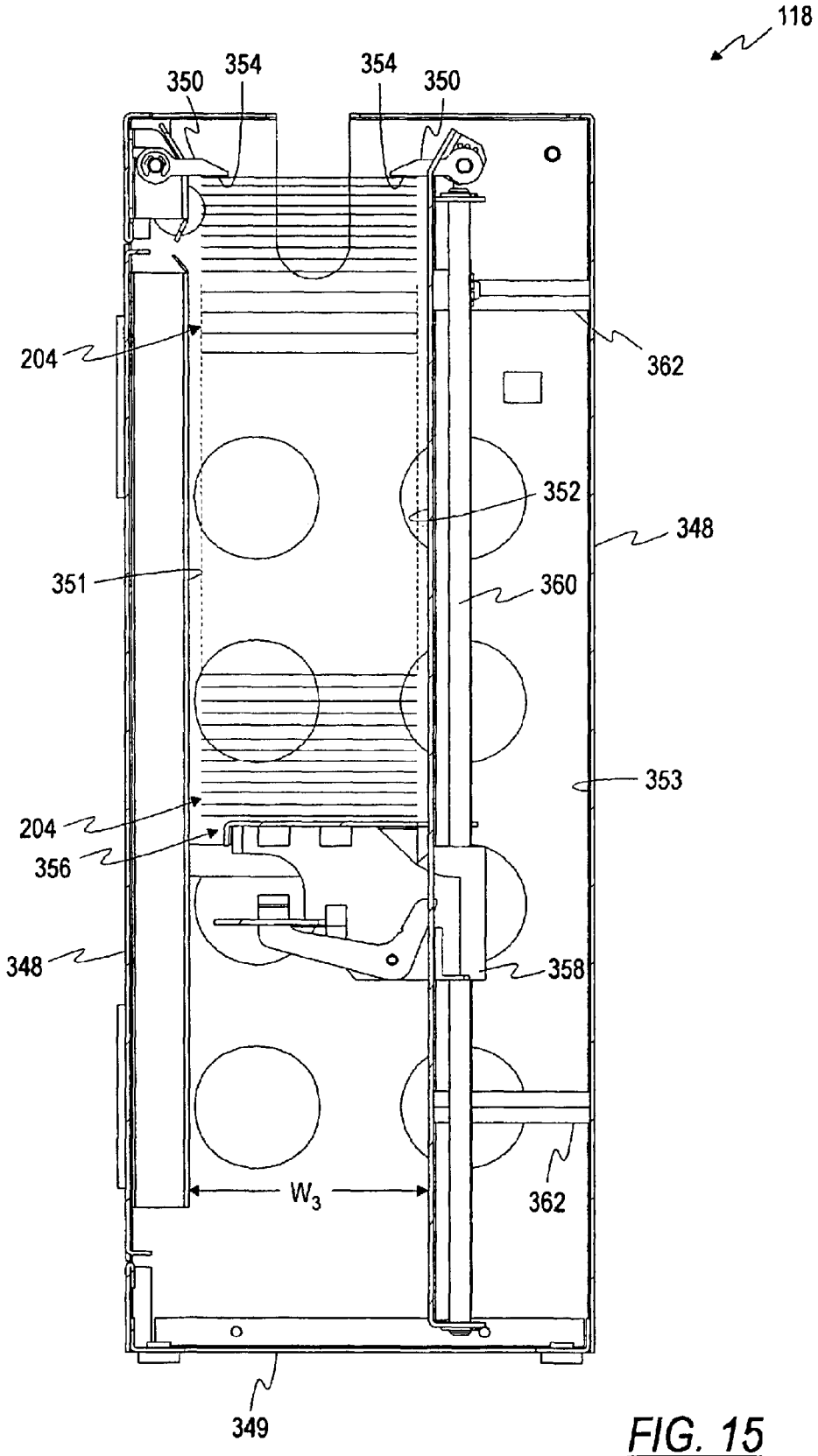
FIG. 15 is a rear view of a storage cassette according to one embodiment of the document handling device of the present invention.
Figure 16:
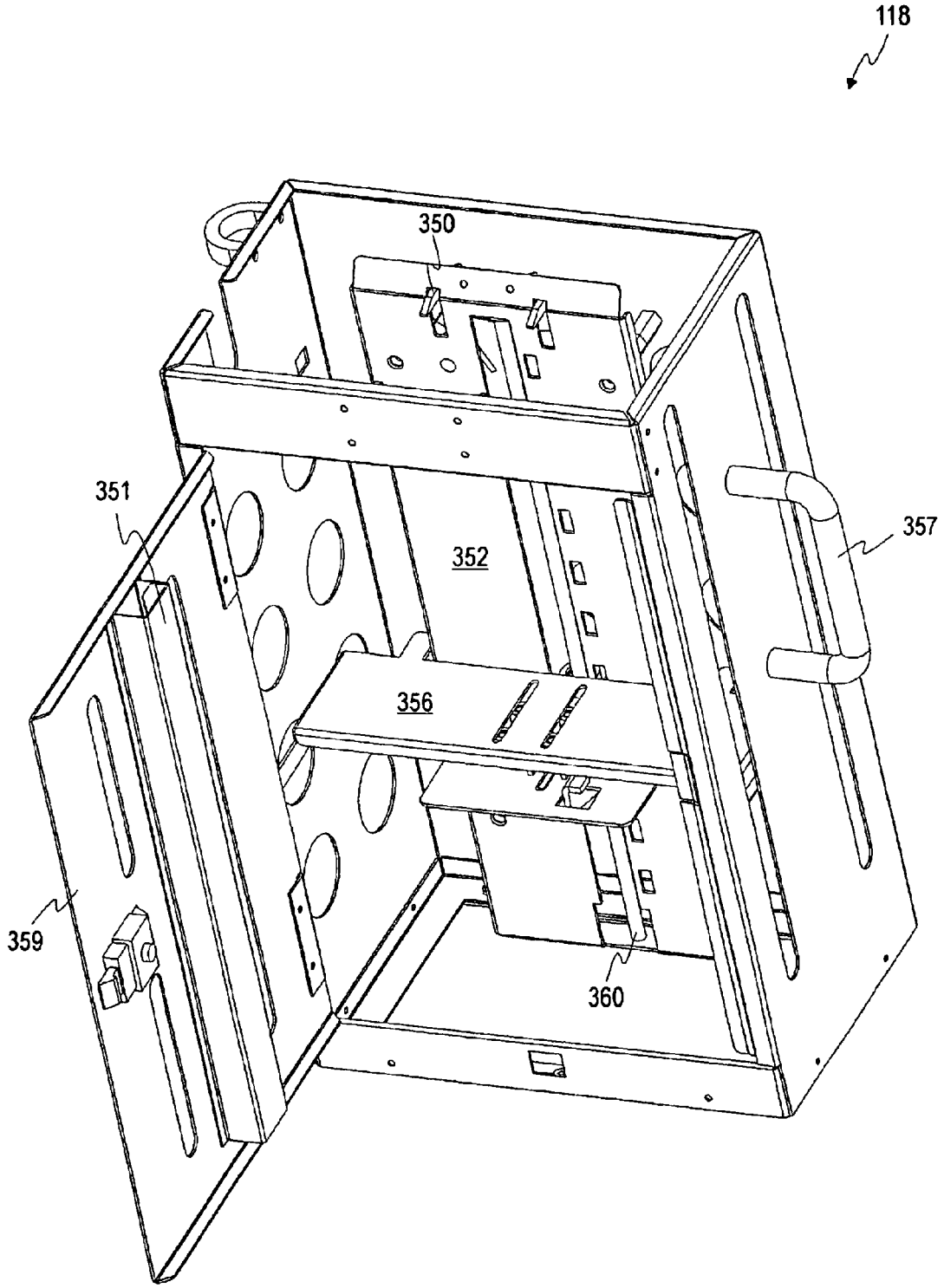
FIG. 16 is a perspective view of a storage cassette showing a door in the open position according to one embodiment of the document handling device of the present invention.

FIGS. 14, 15, and 16 illustrate the components of the storage cassettes 118. The bills 204 are stored within the cassette housing 348 which has a base 349. Each storage cassette 118 contains two pairs of retaining tabs 350 positioned adjacent to the interior walls 351, 352 of the storage cassette. The lower surface 354 of each tab 350 is substantially planar. The tabs 350 are hingedly connected to the storage cassette 118 enabling the tabs 350 to downwardly rotate from a horizontal position, substantially perpendicular with the side interior walls 351, 352 of the cassette 118, to a vertical position, substantially parallel to the interior walls 351, 352 of the cassette 118. The tabs 350 are coupled to springs (not shown) to maintain the tabs in the horizontal position.

The storage cassette 118 contains a slidable platform 356 which is biased upward. During operation of the currency handling system 100, the platform 356 receives stacks of bills from the escrow compartment 116. The floor 356 is attached to a base 358 which is slidably mounted to a vertical support member 360. The base 358 is spring-loaded so that it is biased upward and in turn biases the platform 356 upward. The storage cassettes 118 are designed to be interchangeable so that once full, a storage cassette can be easily removed from the currency handling device 100 and replaced with an empty storage cassette 118. In the illustrated embodiment, the storage cassette 118 is equipped with a handle 357 in order to expedite removal and/or replacement of the storage cassettes 118. Also in the illustrated embodiment, the storage cassette 118 has a door 359 which enables an operator to remove bills from the storage cassette 118

Figure 17A:
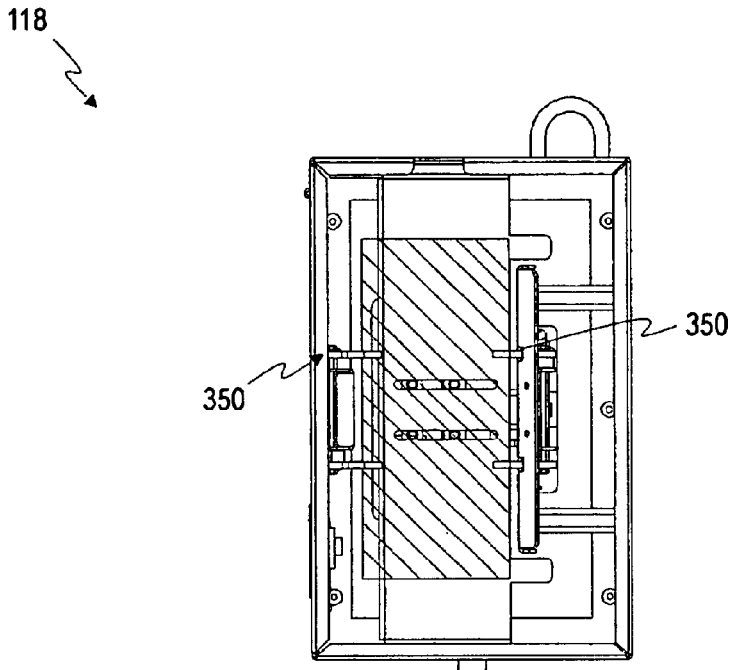
FIG. 17*a* is a top view of a storage cassette sized to accommodate United States currency documents according to one embodiment of the document handling device of the present invention.
Figure 17B:
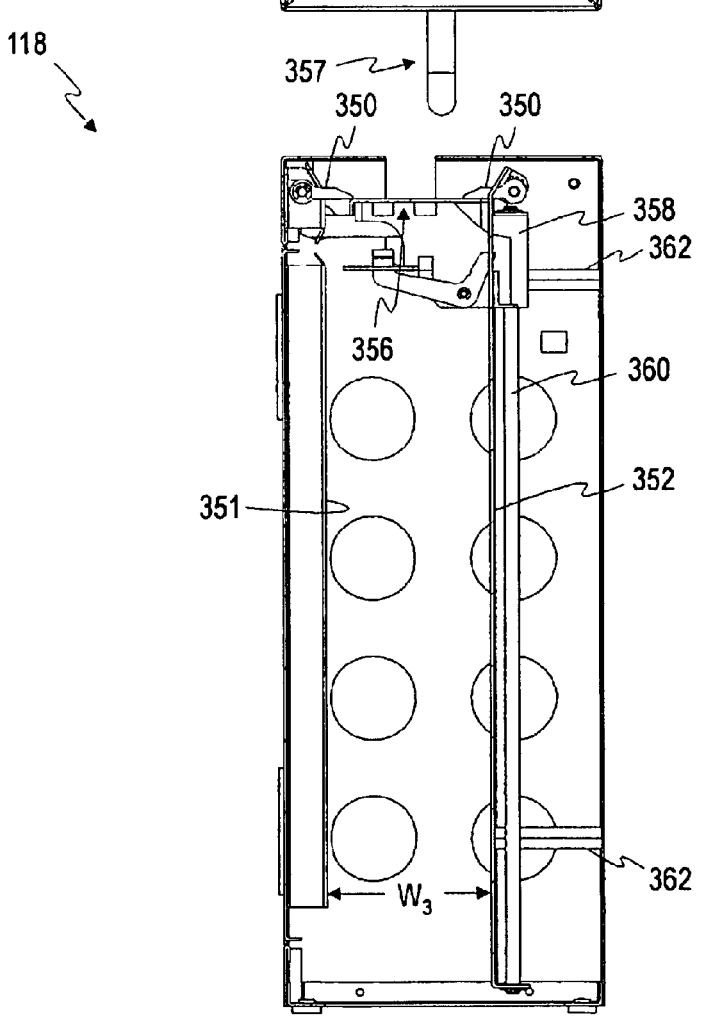
FIG. 17*b* is a rear view of a storage cassette sized to accommodate United States currency documents according to one embodiment of the document handling device of the present invention.
Figure 18A:
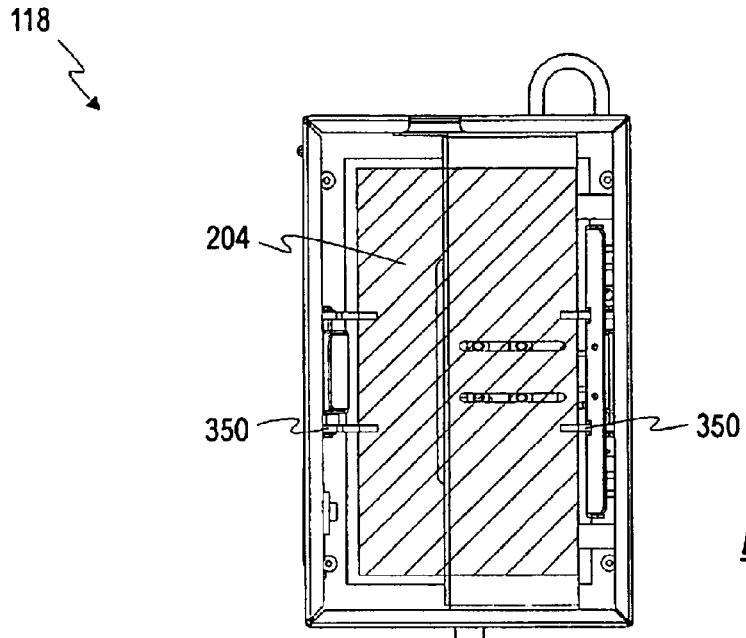
FIG. 18*a* is a top view of a storage cassette sized to accommodate large documents according to one embodiment of the document handling device of the present invention.
Figure 18B:
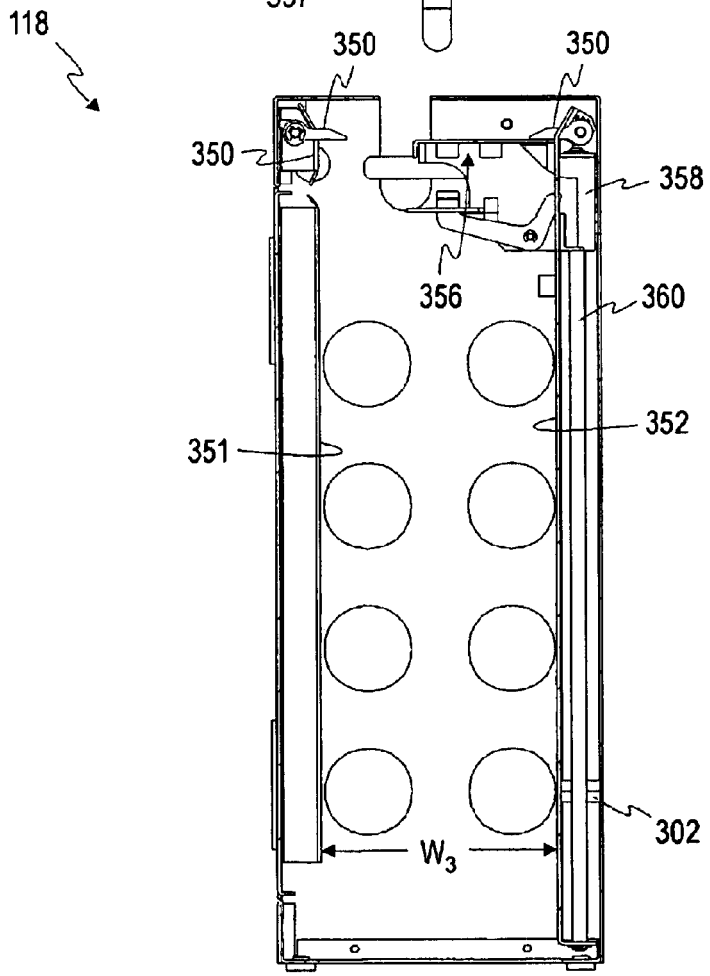
FIG. 18*b* is a rear view of a storage cassette sized to accommodate large documents according to one embodiment of the document handling device of the present invention.

The storage cassettes 118 are dimensioned to accommodate documents of varying sizes. In the illustrated embodiment, the storage cassette 118 has a height, $H_2$, of approximately 15.38 inches (39 cm), a depth, $D_2$, of approximately 9 inches (22.9 cm), and a width, $W_2$, of approximately 5.66 inches (14.4 cm). The storage cassette 118 illustrated in FIG. 15 has stand-offs 362 to set interior wall 352 off a fixed distance from in the interior wall 353 of the cassette housing 348. The interior walls 351, 352 aid in aligning the bills in a stack within the storage cassettes. The embodiment of the storage cassette 118 illustrate in FIG. 15 is sized to accommodate United States currency documents. To properly accommodate United States currency documents, the interior width of the storage cassette, $W_3$, is approximately 2.88 inches. FIGS. 17*a* and 17*b* also illustrate an embodiment of the storage cassette 118 sized to accommodate U.S. currency documents which have a width of approximately 2.5 inches (approximately 6.5 cm) and a length of approximately 6 inches (approximately 15.5 cm). In alternative embodiments, the length of the stand-offs 362 can be varied to accommodate documents of varying sizes. For example, the embodiment disclosed in FIGS. 118*a* and 18*b* has an interior width, $W_3$ of approximately 4.12 inches (104.6 cm) and is sized to accommodate the largest international currency, the French 500 Franc note, which has width of approximately 3.82 inches (9.7 cm) and a length of approximately 7.17 inches (18.2 cm). In order to accommodate large documents and increase the interior width, $W_3$, of the storage cassette 118, the lengths of stand-offs 362, illustrated in FIG. 16*b*, are shortened.

Beginning with FIG. 7, the operation of one of the lower output receptacles 106*c*–106*h* will be described. Pursuant to a mode of operation, the bills 204 are directed by one of the diverters 130 into the escrow compartment 116 of the lower output receptacle. The stacker wheel 202 within escrow compartment 116 receives the bills 204 from the diverter 130. The stacker wheel 202 stacks the bills 204 on top of the gate 210. Pursuant to a preprogrammed mode of operation, once a predetermined number of bills 204 are stacked in the escrow compartment 116, the control unit 120 instructs the currency handling device 100 to suspend processing currency bills and the paddle 302 then descends from its home position above the escrow compartment 116 to transfer the bills 204 into the storage cassette 118. Once the bills 204 have been deposited in the storage cassette 118 the currency handling device resumes operation until an escrow compartment is full or all the bills within the input receptacle 102 have been processed.

Referring now to FIGS. 8 and 9 the plunger assembly 300 downwardly travels placing the paddle 302 onto of the stack of bills 204. Upon making contact with the bills 204 the paddle 302 continues to travel downward. As the paddle 302 continues its descent, the paddle 302 forces the gate 210 to snap open. The paddle 302 imparts a force to the bills 204 that is transferred to the to the shutters 211, 212 causing the shutters 211, 212 to rotate from the closed position to the open position. The rotation of the shutters 211, 212 is indicated by the arrows B and C, respectively. Once the paddle 302 imparts the amount of force necessary to rotate levers 216, 217, the extension springs 218, 219 quickly rotate the shutters 211, 212 downward, thus "snapping" the gate 210 open. The downward rotation of the shutters 211, 212 causes each of the corresponding parallel bars 214, 215 to pivot which in turn rotates the levers 216, 217. The extension springs 218, 219 maintain the shutters 211, 212 in the open position allowing the paddle 302 to descend into the storage cassette 118. The hingedly connected side arms 306, 308 retract as the rollers 316, 318 to roll around the levers 216, 217 while the plunger assembly 300 is traveling downward into the cassette 118.

Referring now to FIG. 15, once the gate 210 is opened, the bills 204 fall a short distance onto the platform 356 of the storage cassette 118 or onto a stack of bills 204 already deposited on the platform 356. The paddle 302 continues its downward motion towards the storage cassette 118 to ensure that the bills 204 are transferred to the cassette 118. Initially, some bills 204 may be spaced apart from the platform 356 or the other bills 204 within the storage cassette by retaining tabs 350. As the plunger assembly 300 continues to descend downward into the cassette, the paddle 302 continues to urge the stack of bills 204 downward causing the retaining tabs 350 to rotate downward. The bills 204 are pushed past retaining tabs 350 and onto the platform 356.

Once the plunger assembly 300 has descended into the cassette 118 a distance sufficient for the paddle 302 to clear the retaining tabs 350 allowing the retaining tabs 350 to rotate upward, the plunger assembly initiates its ascent out of the storage cassette 118. The platform 356 urges the bills 204 upward against the underside of the paddle 302. The paddle 302 is equipped with two pairs of slots 324, 326 (FIG. 9) to enable the paddle to clear the pairs of retaining tabs 350. When the paddle 302 ascends past the pairs of retaining tabs 350 the bills 204 are pressed against the lower surfaces 354 of the pairs of retaining tabs 350 by the platform 356.

Referring now to FIG. 13, when the plunger assembly 300 is traveling upward out of the cassette 118, the rollers 316, 318 on the side arms 306, 308 engage the respective levers 216, 217 and move the respective levers 216, 217 from the second (open) position to the first (closed) position to move the gate 210 from the open position to the closed position as the paddle 302 ascends into the escrow compartment 116 after depositing the bills 204 in the storage cassette 118. The paddle 302 is mounted on the base 304 above the rollers 316, 318 on the side arms 306, 308 so that the paddle 302 clears the gate 210 before the gate 210 is moved to the closed position.

In alternative embodiments of the currency handling device 100, the output receptacles 106 can be sized to accommodate documents of varying sizes such as various international currencies, stock certificates, postage stamps, store coupons, etc. Specifically, to accommodate documents of different widths, the width of the escrow compartment 116, the gate 210, and the storage cassette 118 would need to be increased or decreased as appropriate. The document evaluation device 100 is sized to accommodate storage cassettes 118 and gates 210 of different widths. The entire transport mechanism 104 of the currency handling device 100 is dimensioned to accommodate the largest currency bills internationally. Accordingly, the document handling device 100 can be used to process the currency or documents of varying sizes.

In various alternative embodiments, the currency handling device 100 is dimensioned to process a stack of different sized currencies at the same time. For example, one application may require the processing of United States dollars (2.5 inches×6 inches, 6.5 cm×15.5 cm) and French currency (as large as 7.17 inches×3.82 inches, 18.2 cm×9.7 cm). The application may simply require the segregation of the United States currency from the French currency wherein the currency handling device 100 delivers United States currency to the first lower output receptacle 106*c* and the French currency to the second output receptacle 106*d*. In another alternative embodiment, the currency handling device 100 processes a mixed stack of U.S. ten and twenty dollar bills and French one hundred and two hundred Franc notes wherein the currency documents are denominated, counted, and authenticated. In that alternative embodiment, the U.S. ten and twenty dollar bills are delivered to the first 106*c* and second 106*d* lower output receptacles, respectively, and the French one hundred and two hundred Franc notes are delivered to the third 106*e* and fourth 106*f* lower output receptacle, respectively. In other alternative embodiments, the currency handling device 100 denominates, counts, and authenticates six different types of currency wherein, for example, Canadian currency is delivered to the first lower output receptacle 106*c*, United States currency is delivered to the second output receptacle 106*d*, Japanese currency is delivered to the third lower output receptacle 106*e*, British currency is delivered to the fourth lower output receptacle 106*f*, French currency is delivered to the fifth lower output receptacle 106*g*, and German currency is delivered to the sixth lower output receptacle 106*h*. In another embodiment, no call bills or other denominations of currency, such as Mexican currency for example, may be directed to the second upper output receptacle 106*b*. In another embodiment, suspect bills are delivered to the first upper output receptacle 106*a*.

In other alternative embodiments of the currency handling device 100, the user can vary the type of documents delivered to the output receptacles 106. For example, in one alternative embodiment an operator can direct, via the control unit 120, that a stack of one, five, ten, twenty, fifty, and one-hundred United States dollar bills be denominated, counted, authenticated, and directed into lower output receptacles 106*c*–106*h*, respectively. In still another alternative embodiment, the currency handling device 100 is also instructed to deliver other bills, such as a United States two dollar bill or currency documents from other countries that have been mixed into the stack of bills, to the second upper output receptacle 106*b*. In still another alternative embodiment, the currency handling device 100 is also instructed to count the number and aggregate value of all the currency bills processed and the number and aggregate value of each individual denomination of currency bills processed. These values can be communicated to the user via the display/user-interface 122 of the currency handling device 100. In still another alternative embodiment, no call bills and bills that are stacked upon one another are directed to the second upper output receptacle 106*b*. In still another alternative embodiment, the operator can direct that all documents failing an authentication test be delivered to the first upper output receptacle 106*a*. In another alternative embodiment, the operator instructs the currency handling device 100 to deliver no call bills, suspect bills, stacked bills, etc. to one of the lower output receptacles 106*c*–106*h*. The currency handling device 100 which has eight output receptacles 106*a*–106*h* provides a great deal of flexibility to the user. And in other alternative embodiments of the currency handling device 100, numerous different combinations for processing documents are available.

According to one embodiment, the various operations of the currency handling device 100 are controlled by processors disposed on a number of printed circuit boards ("PCBs") such as ten PCBs located throughout the device 100. In one embodiment of the present invention, the processors are Motorola processors, model number 86HC16, manufactured by Motorola, Inc. of Schaumburg, Ill. Each of the processors are linked to a central controller via a general purpose communications controller disposed on each PCB. In one embodiment of the present invention the communications controller is an ARCNET communications controller, model COM20020, manufactured by Standard Microsystems Corporation of Hauppauge, N.Y. The communications controller enables the central controller to quickly and efficiently communicate with the various components linked to the PCBs.

According to one embodiment, two PCBs, a "motor board" and a "sensor board," are associated with each pair of lower output receptacles 106*c*–106*h*. The first two lower output receptacles 106*c*, 106*d*, the second two lower output receptacles 106*e*, 106*f*, and the last two lower output receptacles 106*g*, 106*h* are paired together. Each of the lower output receptacles 106 contain sensors which track the movement of the bills into the lower output receptacles 106*c*–106*h*, detect whether each storage cassette 118*a*–118*e* is positioned within the currency handling device 100, detect whether the doors 359 of the storage cassettes 118 are opened or closed, and whether the cassettes 118 are full. These aforementioned sensors associated with each pair of the lower output receptacles are tied into a sensor board which is linked to the central controller. The operation of the plunger assembly 300, the stacker wheels 202, the portion of transportation mechanism 104 disposed above the lower output receptacles 116*c*–116*h*, and the diverters 130 are controlled by processors disposed on the motor board associated with each pair of lower output receptacles 106*c*–106*h*. Those sensors 130 which track the movement of bills along the transportation mechanism 104 that are disposed directly above the lower output receptacles 106*c*–106*h* are also tied into the respective motor boards.

One of the four remaining PCBs is associated with the operation of the one or two stacker wheels 127 associated with the upper output receptacles 106*a*, 106*b*, the stripping wheels 140, the primary drive motor of the evaluation region 108, a diverter which direct bills to the two upper output receptacles 106*a*, 106*b*, and the diverter which then directs bills between the two upper output receptacles 106*a*, 106*b*. The remaining three PCBs are associated with the operation of the transport mechanism 104 and a diverter which directs bills from the transport path to the bill facing mechanism 110. The plurality of sensors 130 disposed along the transport mechanism 104, used to track the movement of bills along the transport mechanism 104, also tied into these three remaining PCBs.

Referring now to FIGS. 19–22, a two belt bill facing mechanism 400 is illustrated. The two belt bill facing mechanism 400 is an alternative embodiment of the bill facing mechanism 110 referred to in FIGS. 1*a* and 1*b* and in the above related discussion. The two belt bill facing mechanism 400 can be used in conjunction with the currency handling device 100 shown in FIGS. 1*a* and 1*b* to rotate the face orientation of a bill 401 approximately 180°. For example, if a U.S. bill, for example, is initially presented with the surface bearing a portrait of a president facing down, it may be directed to the two belt bill facing mechanism 400, whereupon it will be rotated 180° so that the bill surface with the portrait faces up. The decision may be taken to send a bill 401 to the facing mechanism 400 when the selected mode of operation or other operator instructions call for maintaining a given face orientation of bills as they are processed by the currency handling device 100. For example, it may be desirable in certain circumstances for all of the bills ultimately delivered to the lower output receptacles 106*c*–106*h* to have the same face orientation. In such embodiments of the currency handling device 100, the bill evaluation region 108 is capable of determining the face orientation of a bill, such that a bill not having the desired face orientation can first be directed to the two belt bill facing mechanism 400 before being delivered to the appropriate lower output receptacle 106*c*–106*h*.

The two belt bill facing mechanism 400 ("facing mechanism") includes a first belt 402 and a second belt 404. Each of the first and the second belts 402, 404 forms a continuous loop. The belts 402, 404 are disposed adjacent to each other such that the opposing surfaces of each belt 402, 404 forms a bill facing transport path 406. The belts 402, 404 are twisted together so that an inlet 408 of the transport path 406 is rotated approximately 180° with respect to an outlet 410 of the transport path 406.

Figure 19:
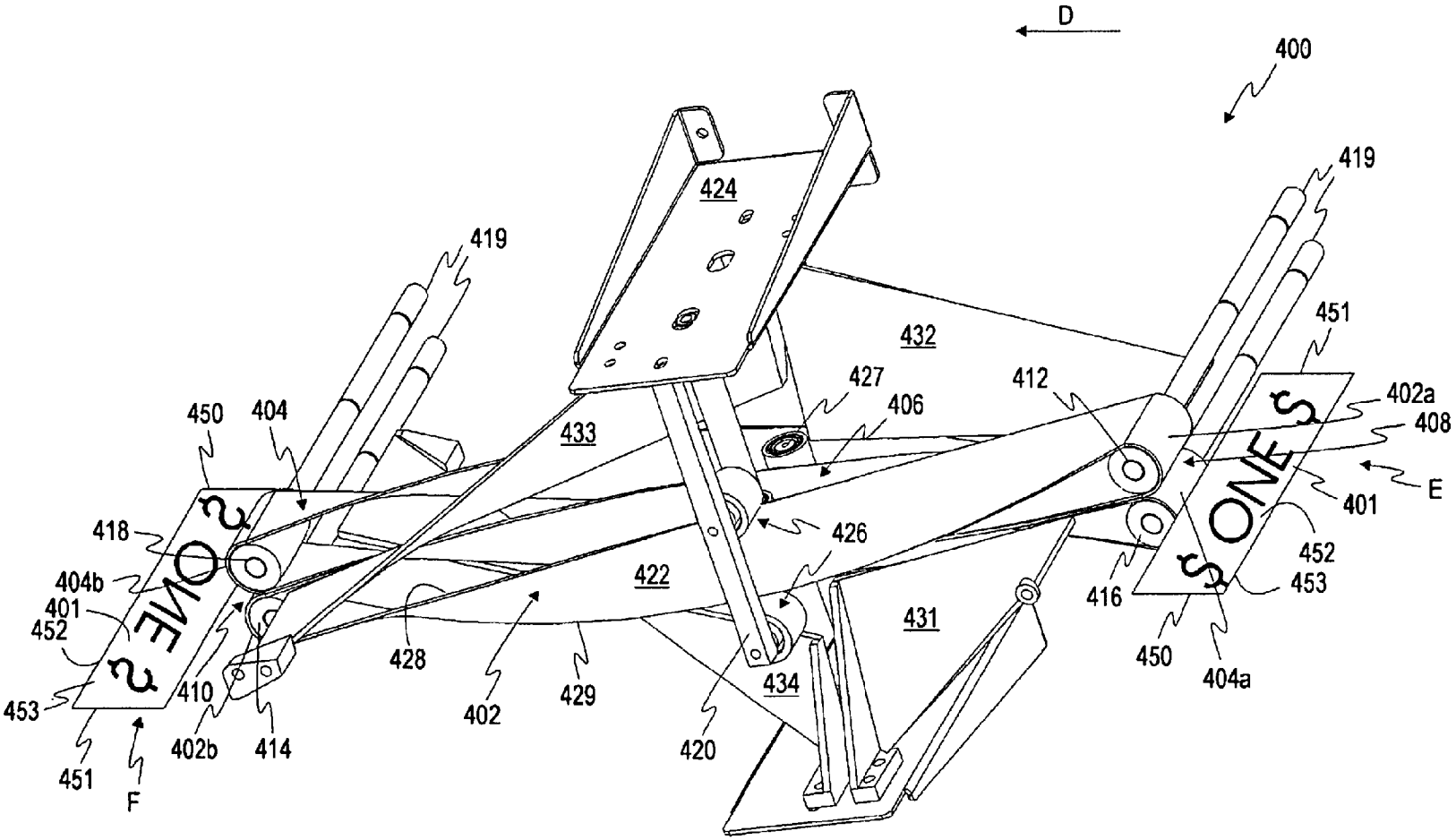
FIG. 19 is a perspective view of a two belt bill facing mechanism according to one embodiment of the present invention.

The first and second belts 402, 404 are each wrapped around two rollers. The first belt 402 is positioned around a first roller 412 disposed adjacent the inlet 408 and a second roller 414 disposed adjacent the outlet 410. The second belt 404 is positioned around a third roller 416 disposed adjacent the inlet 408 and a fourth roller 418 disposed adjacent the outlet 410. As illustrated in FIG. 19, the first and second rollers 412,414, associated with the first belt, are positioned such that the first roller 412 is the "top" roller at the inlet 408 and the second roller 414 is the "bottom" roller at the outlet 410. The third and forth rollers 416,418, associated with the second belt, are positioned such that the third roller 416 is the "bottom" roller at the inlet 408 and the forth roller 418 is the "top" roller at the outlet 410. This arrangement allows the for the "twisted" bill facing mechanism transport path 406. Starting from the inlet 408, a first end 402*a* of the first belt 402 is placed around the first roller 412 which is disposed above the third roller 416 around which a first end

404*a* of the second belt 404 is placed. Viewing FIG. 19 from right to left, the first and the second belts 402, 404 are together twisted 180° out of the page. The second end 404*b* of the second belt 404 is now disposed above the second end 402*b* of the first belt 402. The second end 404*b* of the second belt 404 is positioned around the forth roller 418 and the second end 402*b* of the first belt 402 is positioned around the third roller 414. Between the inlet 408 and the outlet 410, that is between the rollers, there is no structure supporting the portions of the first or the second belts 402, 404 which define the bill transport path 406. The rollers are connected to shafts 419 about which the rollers rotates. In one embodiment of the two belt bill facing mechanism, the rollers 414, 418 are driven rollers and the rollers 412, 416 are passive rollers. In such an embodiment, a motor (not shown) is coupled to the shafts 419 associated with driven rollers 414, 418.

Figure 20:
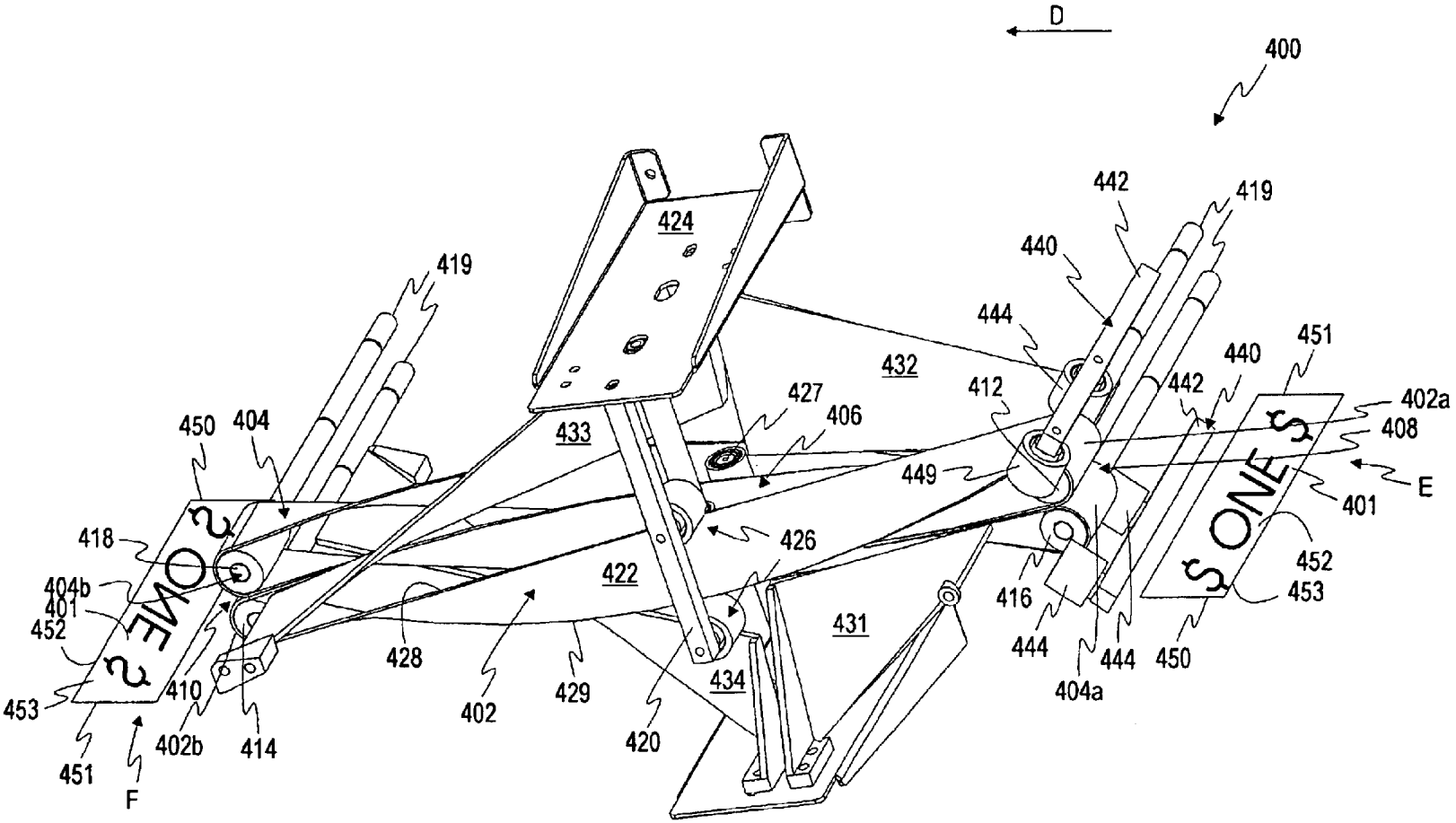
FIG. 20 is another perspective view of a two belt bill facing mechanism according to one embodiment of the document handling device of the present invention.
Figure 21:
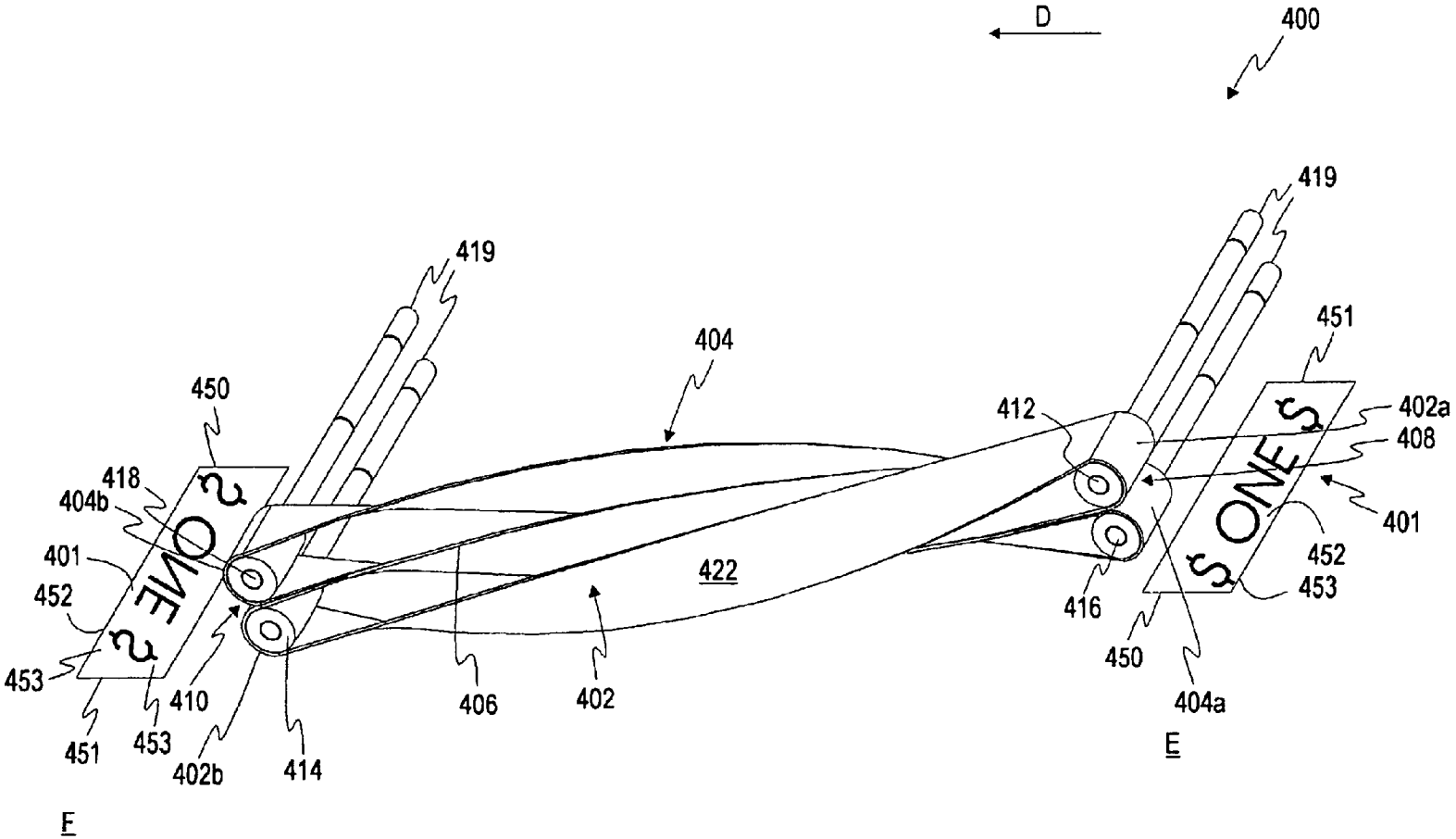
FIG. 21 is a perspective view of a two belt bill facing mechanism without belt guides or bill guides according to one embodiment of the document handling device of the present invention.
Figure 22:
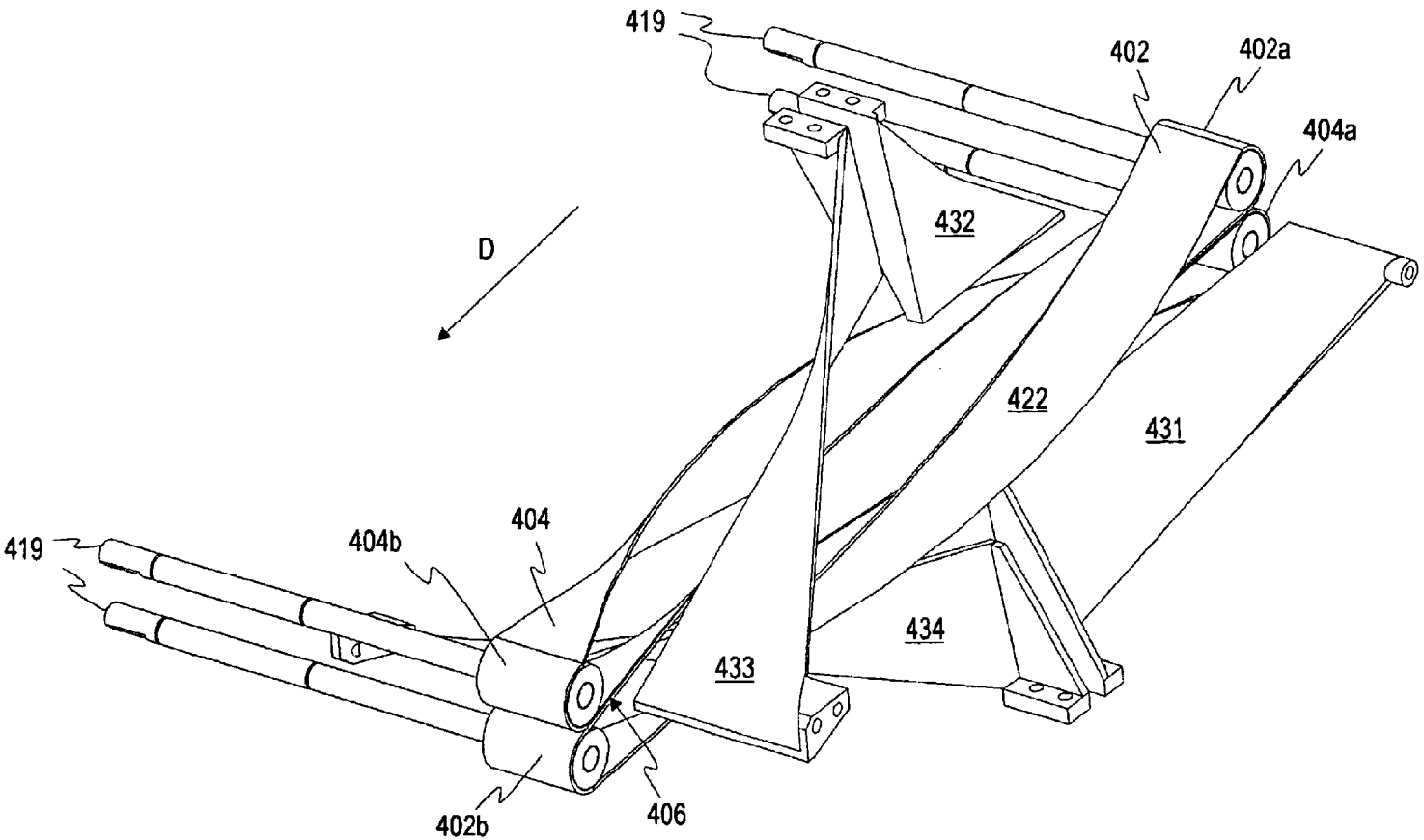
FIG. 22 is a perspective view of a two belt bill facing mechanism without belt guides according to one embodiment of the document handling device of the present invention.

Two belt guides 420 (FIGS. 19 and 20) are used to guide the portion of the belts not defining the transport path 406 or the return portion 422 of the belts away from the transport path. The return portion 422 of the belts 402, 404 is drawn away from the transport path 406 to insure that the return portion 422 does not contact a bill 401 traveling along the transport path 406 causing the bill 401 to become skewed relative to the transport path 406. Each belt guide 420 is attached to a structure 424 which is fixed to the currency handling device 100. In FIGS. 19 and 20, only the first belt guide 420 is clearly illustrated. In the illustrated embodiment, each belt guide 420 includes one vertical roller and two horizontal rollers 426. The vertical roller associated with the second belt guide 420 is labeled with reference number 427. The interior of each belt 402, 404 travels against the vertical roller. Any vertical movement of the return portion 422 of the belt is constrained by the two horizontal rollers 426 along which the edges 428, 429 of the belts 402, 404 travel. In an alternative embodiment, the belt guide 420 only contains one horizontal roller 426 to limit the vertical movement of the return portions of the belts.

In the embodiment illustrated in FIG. 20, the two belt bill facing mechanism contains belt end guides 440. The belt end guides 440 are used to maintain the position of belts 402, 404 on rollers 412, 416. The belt guides limit any horizontal movement of the belts 402, 404 at their first ends 402*a*, 404*b*. In another embodiment of the two, belt bill facing mechanism two more belt end guides are used to limit any horizontal of the belts 402, 404 at the second ends 402*b*, 404*b*. The belt end guides 440 consists of a structure 442 and two rollers 444. Because the belt guides 420 pull the return portion 422 away from the transport path 406, the belt guide rollers 444 maintain the belt ends on the rollers 412, 414, 416, 418 and prohibit any movement of the belts 402, 404 off of the rollers 412, 414, 416, 418.

The bill facing mechanism 400 also contains four guides 431, 432,433, 434 disposed along the bill transport path 406. Each of these guides are also fixed to the structures 424. The guides 431–434 are made out of a rigid material. A bill is transported through the bill facing mechanism (as well as the through the transport mechanism 104 of currency handling device 100) with the leading edge of the bill being the long or wide edge of the bill 401. The width of the bill 401 is greater than the width of the first and the second belts 402, 404 causing a significant portion of the bill 401 to overhang each edge of the belts 402, 404. The function of the guides is to provide support to those portions of the bill 401 which overhang the belts 402, 404. Because of the high processing rate at which the currency handling device 100 operates, a significant angular velocity is imparted to a bill directed through the facing mechanism. In alternative embodiments of the currency handling device 100, bills are processed at speeds in excess of 1200 bills per minute. The differences in air pressures acting on the front and the back surfaces areas of the bill 401 can cause the bill 401 to fold or be forced such that the bill is no longer being transported in a substantially flat manner. This situation can occur more readily when the bill stiffness is degraded due to bill wear resulting from heavy usage. Additionally, bills are often folded in a variety of manners which may cause a bill to be biased in a certain direction such that the bill will not lie flat under its own weight. It is preferable for the bill 401 to be transported through the bill facing mechanism 400 (and the currency handling device 100) in a substantially flat manner. If the bill 401 is not substantially flat when traveling from the outlet 410 of the bill facing mechanism 400 back into the bill transport mechanism 104 there is a possibility that the bill may become skewed at the interface between the outlet 410 and the transport mechanism 104 because the transport mechanism 104 may not "catch" the entire leading edge of the bill.

In operation, a bill 401, shown in position E, enters the inlet 408 of the bill facing mechanism 400 and is transported along the bill facing transport path 406 in a direction from right to left indicated by arrow D. The bill 401 adjacent to the outlet 410 is shown in position F which is a 180° rotation from position E. Referring to the bill 401 in position E, the bill 401 has narrow edges 450, 451 and surfaces 452, 453. The first and second belts 402, 404, a portion of which define the transport path 406, are twisted causing the bill 401 to rotate in manner such that the (near) edge 450 of the bill 401 drops into the page and the (far) edge 451 of the bill 401 rotates up and out of the page. As the bill 401 travels through the bill transport path 406, the surface 452 towards the (near) edge 450 of the bill 401 is guided by the first guide 431. The surface 453 towards the (far) edge 451 of the bill 401 is supported by the second guide 432. The guides 431, 432 support their respective surfaces of the bill 401 until the bill 401 is substantially in a vertical position. As the bill continues to travel towards the outlet 410 the edge 451 (now at the top of the page) continues to rotate out of the page while the edge 450 (now at the bottom of the page) rotates into the page. Continuing, the surface 453 towards the edge 451 is being guided by the guide 433. The surface 452 towards edge 450 is being guided by the guide 434. When the bill arrives at the outlet 410, the orientation of the bill has been rotated 180°. The bill then merges into the transport mechanism 104 of the currency handling device 104.

In another alternative embodiment, the currency handling device 100 operates in a stacking-for-strapping mode wherein pursuant to a user's input or selection of a preprogrammed mode of operation, currency bills are stacked in a manner so that smaller stacks of bills within a larger stack of bills are readily identifiable. Typically, in the handling of bulk currency, after the currency bills have been analyzed, denominated, authenticated, counted, and/or otherwise processed, the currency bills are strapped. Bill strapping is a process whereby a stack of a specific number of bills of a single denomination are secured together such as with a paper strap. For example, one dollar bills are segregated into stacks of one-hundred one dollar bills and then bound with a paper strap. Strapping facilitates the handling of bulk currency allowing the strapped stacks of bills to be counted rather than the individual currency bills.

Figure 23:
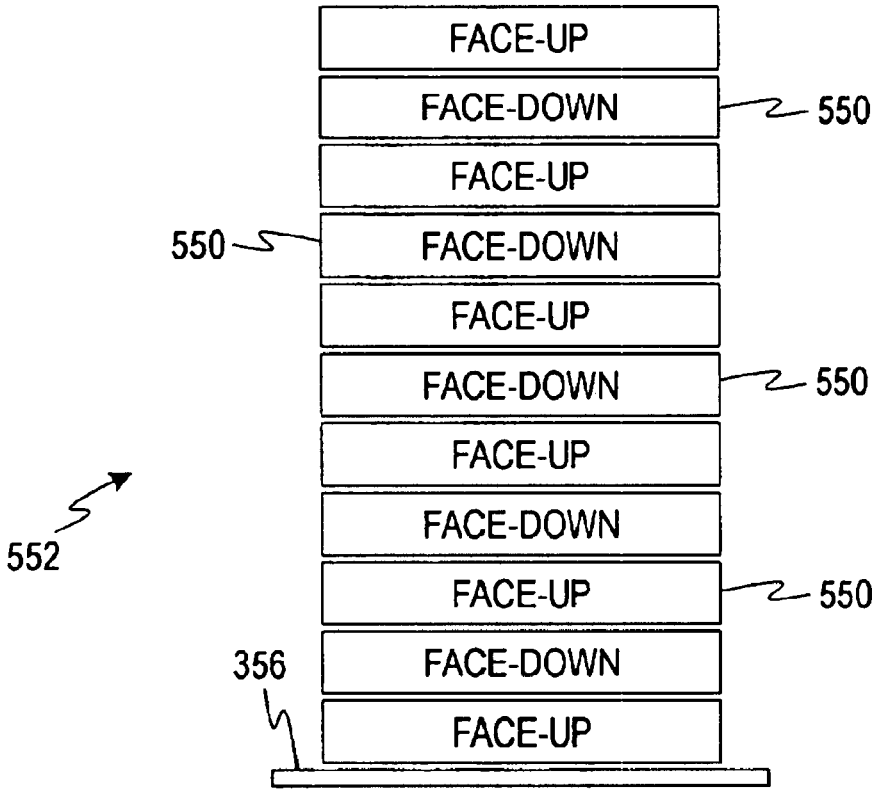
FIG. 23 is a front view of a stack of currency bills stacked pursuant to a stacking-for-strapping mode of operation according to one embodiment of the present invention.

When operating pursuant to a stacking-for-strapping mode, the currency handling device 100 stacks currency bills in the lower output receptacles 106*c*–106*h* in a manner so that smaller batches of currency bills are readily identifiable such as by alternating the face orientation of the smaller batches of bills within the stack. Put another way, as illustrated in FIG. 23, every other smaller stack 550 of bills comprising the larger stack 552 of bills is either orientated with the surface of the bill bearing the portrait of the president face-up or face-down. This arrangement allows a user of the currency handling device 100 to quickly segregate the smaller stacks 550 from the larger stack 552 of bills for strapping purposes after the user removes the larger stack 552 of bills from the storage cassette 118*a–f* associated with a corresponding lower output receptacle 106*c–h*. For example, a user desiring to "strap" U.S. $20 bills would instruct the currency handling device accordingly, so that the face-orientation of every batch of one-hundred $20 bills would alternate.

A bill turnover mechanism, such as for example, either the two belt bill facing mechanism 400, illustrated in FIGS. 19–22, or the bill facing mechanism 110, referred to in FIGS. 1*a* and 1*b*, can be incorporated into the currency handing device 100 to vary the face orientation of the bills pursuant to a stacking-for-strapping mode so that the individual currency bills within each smaller stack 550 of currency bills has a common face orientation. Alternatively, in other embodiments of the present invention, other turnover mechanisms can be used.

The total number of bills per smaller stack 550 of currency bills is referred to as a "limit." The "limit" is a predetermined number which is either defined by the user of the currency handling system 100 or is defined by a mode of operation. In one embodiment, the user defines via the user interface 122 that the limit is, for example, fifty currency bills. Accordingly, the face orientation of every fifty currency bills is alternated. In another alternative embodiment, a user selects via the user interface 122 a "$20 stacking-for-strapping mode" wherein, for example, the limit is predefined at one hundred $20 bills. While any number of bills can be included in a strap of currency bills, U.S. currency bills are traditionally strapped in one-hundred bill stacks.

Figure 24:
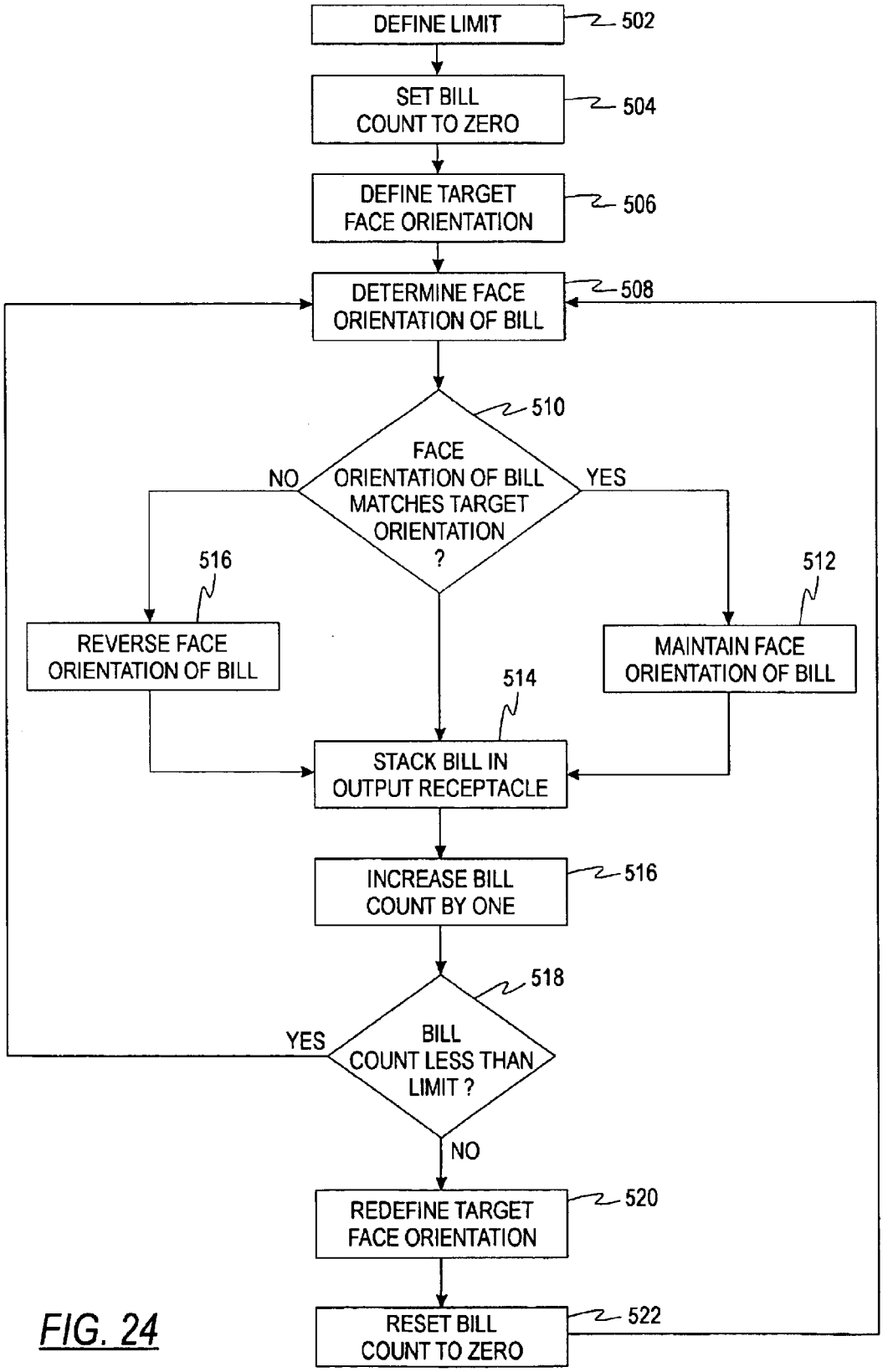
FIG. 24 is a flowchart illustrating the steps performed when operating pursuant to a stacking-for-strapping mode of operation according to one embodiment of the present invention.

Referring also to FIG. 24, the steps performed in a stacking-for-strapping mode of operation will be described in detail. For purposes of this example, the stack of bills consists of U.S. $20 bills arranged in both face orientations. Initially at steps 502, 504, and 506, the limit is defined, the bill count is set to zero, and the target orientation is defined, respectively. The target face orientation is the face orientation which the first smaller stack of bills are to have when stacked in a particular output receptacle 106*c–*106*h* such as output receptacle 106*f* The target orientation, either face-up or face-down, can be predetermined pursuant to a mode of operation or be input by a user at step 506. In an alternative embodiment of the currency handling device 100, the target orientation can be defined as the orientation of the first currency bill transported through the evaluation region 108 or the first currency bill of a given denomination transported through the evaluation region 108. The initial target orientation dictates the orientation of the first smaller currency bill stack 550 stacked on the platform 356 of a particular storage cassette 118*a–f* Accordingly, the initial target orientation of the stacking-for-strapping mode which resulted in the stack of currency bills illustrated in FIG. 23 was face-up.

Upon the commencement of the operation of the currency handling device 100, the bills are transported one at a time through the evaluation region 108 to one of the output receptacles 106*c–h*. At step 508, while being transported through the evaluation region 108, the face orientation of each of the bills is determined. The face orientation of the bill currently being evaluated is compared to the target orientation at 510. If the orientation of the currency bill currently being evaluated matches the target orientation, the face orientation of the bill is maintained at step 512 and the bill is transported to a particular one of the output receptacles 106*c–h* at step 514. If the orientation of the currency bill currently being evaluated fails to match the target orientation, the bill is first transported to the bill facing mechanism 400 at step 516, where the face orientation of the bill is reversed as the bill is rotated 180°. The properly faced bill is then transported to and stacked in a particular one of the output receptacles 106*c–h* at step 514. As each bill is transported to the output receptacle 106*c*–106*h*, at step 516, a bill counter increases by one until the number of bills transported to the particular output receptacle 106*c–h* having a common face orientation is equivalent to the strap limit. The strap limit is compared to the bill count at step 518. When the bill count is equivalent to the strap limit, the target face orientation is redefined to be the other of the two face orientations—face-up or face-down—at step 520. The bill count is then reset to zero at step 522. The currency evaluation device continues to operate in this manner until the entire batch of currency bills is processed.

The foregoing is one example of the steps performed in processing currency bills with the currency handling device 100 pursuant to a stacking mode of operation. In alternative embodiments, the sequence in which the steps are performed can be rearranged in a variety of other orders or combined. For example, in an alternative embodiment, the steps Define The Limit 502, Set Bill Count To Zero 504, and Define The Target Orientation 506 can be combined in a preprogrammed stacking-for-strapping mode of operation which the user simply selects from the user interface 122. For example, a "$50 stacking-for-strapping" mode of operation may be selected by the user, via the user interface 122, wherein the limit is predefined at one-hundred bills, the bill count is set to zero, and the initial target orientation is defined as face-down.

In alternative embodiments of the present invention, the currency bills can be processed into the lower output receptacles 106*c–h* in a variety of manners. For example, in one embodiment, bills are processed into the escrow region 116 until the escrow region 116 is full. At that time, the plunger assembly 300 transfers the bills from the escrow region 116 to the corresponding storage cassette 118. The currency handling device 100 operates in this manner until all of the bills have been processed into the storage cassette(s) 118. If, after all of the bills have been processed, a smaller stack of bills has been delivered to a storage cassette 118 containing a number of bills which is less than the strap limit, the currency handling device 100 can notify the user via the user interface 122. In still another alternative embodiment, after a number of bills equivalent to the strap limit are processed into the escrow region 116, the plunger assembly 300 transfers the bills to the storage cassette 300. In this embodiment of a stacking-for-strapping mode of operation, all of the smaller stacks of bills in the storage cassette comprise a number of bills equivalent to the strap limit. A stack of bill comprising a number of currency bill less then the limit remains in the escrow region until either the stack is removed by the operator of the currency handling device 100 or until the stack is supplemented with bills from an additional batch of currency processed by the currency handling device.

After the entire batch of currency bills is processed into the lower output receptacles 106*c–h* pursuant to a stacking-for-strapping mode of operation, a user of the currency handing device 100 removes the stacks of bills from each storage cassette 118*a–f* associated with corresponding lower output receptacles 106*c–h*. Because the smaller stacks of bills within each of the larger stacks of bills removed from the storage cassettes 118*a–f* are arranged with alternating face orientations, the user can quickly segregate the smaller stacks from the larger stacks and bind each of the smaller stacks with a strap.

In an alternative embodiment of the present invention, larger stacks of bills comprising smaller stacks of bills having alternative face orientations, such as illustrated in FIG. 23, can be formed in the lower output receptacles 106*c–h* without using the bill facing mechanism. In such an embodiment, face-up bills are transported to a "target" lower output receptacle and face-down bills are transported to another target lower output receptacle until the limit is reached in both lower output receptacles. The target receptacles 106 are then switched and the process is repeated. For example, bills of a given denomination having a face-up orientation are routed to the first lower output receptacle 106*c* and bills of the same denomination having a face-down orientation are routed to the second lower output receptacle 106*d*. Face-up and face-down bills continue to be processed into the first and second lower output receptacles 106*c*, 106*d*, respectively, until a number of bills equivalent to the limit have been processed into the first and second lower output receptacles 106*c*, 106*d*. At that time, the face-up bills are then routed to the second lower output receptacle 106*d* and the face-down bills are routed to the first lower output receptacle 106*c*. Bills continue to be processed in this manner until the limit is again reached in both the first and second lower output receptacles 106*c*, 106*d* at which time the target lower output receptacles 106 of the face-up and face-down bills are again switched. The process continues as described until the entire batch of currency is processed and each of the lower output receptacles 106*c*, 106*d* contain larger stacks of bills comprising smaller stacks having alternating face orientations. Obviously, the limit will be reached in one of the two lower output receptacles 106*c*, 106*d* before the other of the two lower output receptacles 106*c*, 106*d*. Accordingly, the excess bills are off-sorted or, alternatively, a similar method is performed in the adjacent lower output receptacles 106*e*, 106*f*. For example, when the limit is first reached with respect to face-up bills directed to the first lower output receptacle 106*c*, those face-up bills are then routed to the third lower output receptacle 106*e* while face-down bills continue to be directed to the second lower output receptacles 106*d*. Should the limit be reached in the third lower output receptacle 106*e* before the second lower output receptacle 106*d*, the face-up bills can then be directed to the next lower output receptacle 106*f* When the limit in the second output receptacle 106*d* is eventually reached, the target lower output receptacles 106*c*, 106*d* of the face-up and face-down bills can be switched as described. While the above example was discussed in conjunction with the processing of only one denomination of currency bills, in other alternative embodiments more than one denomination of currency bills can be processed in a similar manner.

In still other alternative embodiments of the present invention, smaller stacks of bills can be distinguished, for strapping purposes, from larger stacks of bills processed into lower output receptacles in a variety of other manners without alternating the face orientation of consecutive smaller stacks of bills. In one alternative embodiment, dividers such as sheets of paper are injected into the flow of currency bills so that the sheets of paper are disposed between each of the smaller stacks of currency bills. These "separation sheets" may be any one of a variety of colors that are readily distinguishable from the currency bills being processed such as, for example, fluorescent orange, pink, yellow, red, etc. Sheets which are readily distinguishable from the currency bills being processed will facilitate the user's identification and segregation of the smaller stacks of currency bills within the larger stack. In other embodiments, a marking on the "separation sheets" denoting the quantity of bills, the denomination of the bills, and/or the value of each smaller stack of bills may provide information to the user of the currency handling device 100.

Figure 25A:
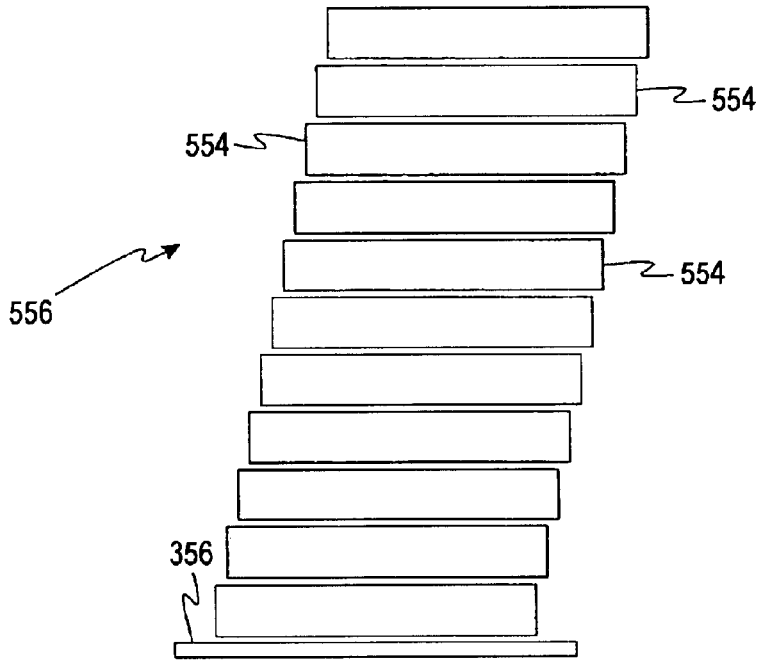
FIG. 25*a* is a front view of a stack of currency bills stacked pursuant to a stacking-for-strapping mode of operation according to one embodiment of the present invention.
Figure 25B:
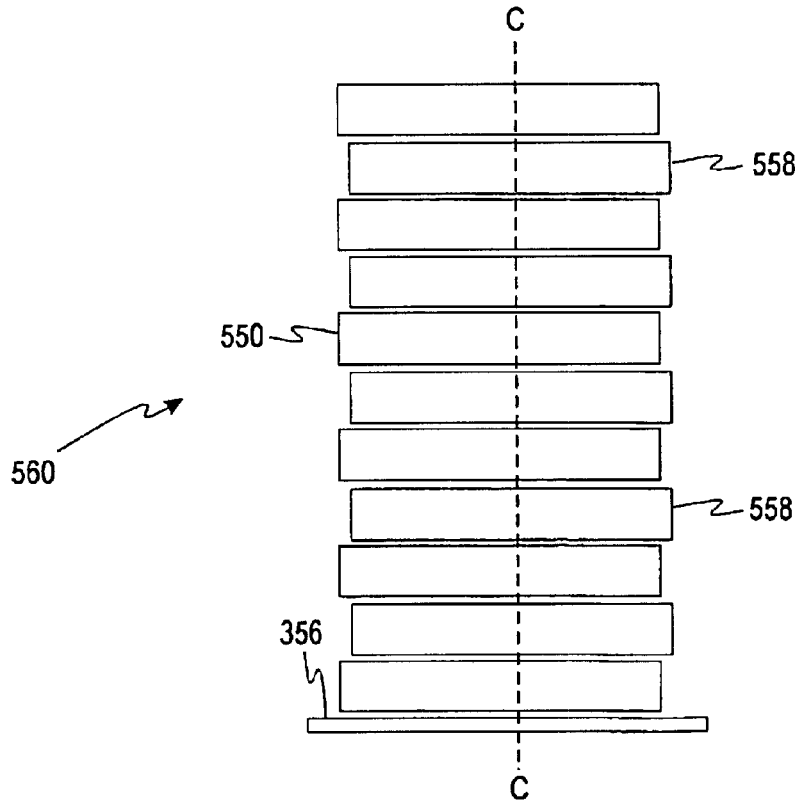
FIG. 25*b* is a front view of a stack of currency bills stacked pursuant to a stacking-for-strapping mode of operation according to one embodiment of the present invention.

In still another alternative embodiment, rather than reversing the face orientation of the bills to distinguish the smaller stacks of currency bills, each of the smaller stacks 554 are slightly offset from the previous smaller stack as illustrated in FIG. 25*a*. In such an embodiment, each consecutive smaller stack 554 of bills comprising the larger 556 stack may be offset so that the larger stack 556 of bills appear "stepped" in shape. Alternatively, as illustrated in FIG. 25*b*, each smaller stack of bills 558 are off-set to the left and to the right of a center C of the platform 356 of the storage cassette 118 in which the bills are stacked so that the side of the larger stack of bills 560 appear corrugated in shape.

Many of the aforementioned modes of operation can be combined with a stacking-for-strapping mode in a multitude of alternative embodiments of the present invention. For example, in an alternative embodiment of the present invention, several denominations of U.S. currency bills may be processed pursuant to a stacking-for-strapping mode of operation. In such an embodiment U.S. $1, $5, $10, $20, $50, and $100 bills are processed pursuant to a stacking-for-strapping mode of operation into the lower output receptacles 106*c*–106*h*, respectively—while alternating the face orientation of every set of one-hundred bills within each of the output receptacles. Accordingly, in such an embodiment, the currency handling device must denominate each of the currency bills being processed. Continuing with the current example, when a non-U.S. $1, $5, $10, $20, $50, or $100 bill is detected, such as a Canadian $1 bill or a U.S. $2 bill, that bill is off sorted to one of the upper output receptacles 106*a*, 106*b*. Further, according to some embodiments, the currency handling device 100 can also authenticate each of the currency bills being processed pursuant to a stacking-for-strapping mode of operation. Non-authentic bills can be routed to upper output receptacles 106*a*, 106*b* as well. Alternatively, non-authentic bills can be routed to upper output receptacle 106*a* and non-U.S. $1, $5, $10, $20, $50, or $100 bills or no call bills are routed to upper output receptacles 106*b*.

In other alternative embodiments, the currency handling device 100 is capable of denominating, authenticating, stacking, and facing for strapping purposes batches of bills containing several different international currencies. For example, in one embodiment of the present invention, a user may desire to segregate, denominate, authenticate, and stack for strapping purposes U.S. $20, $50, $100 bills and Canadian $20, $50, $100 bills. The U.S. $20, $50, $100 dollar bills may be directed to the first three lower output receptacles 106*c–e* and the Canadian $20, $50, $100 bills may be directed to the second three lower output receptacles 106*f–h*. Accordingly, the currency handling device must denominate each of the currency bills before directing the bills to a lower output receptacle 106*c–h*. Non-U.S. $20, $50, $100 bills and non-Canadian $20, $50, $100 are directed to one of the upper output receptacles 106*a*, 106*b* such as the second upper output receptacle 106*b*. The bills may also be authenticated. Authentic U.S. $20, $50, $100 bills and Canadian $20, $50, $100 are directed to the appropriate lower output receptacles 106*c–h*. Those bills which are not authenticated, suspect bills, can be routed to the first upper output receptacle 106*a*. Further, non-U.S. $20, $50, $100 suspect bills and non-Canadian $20, $50, $100 suspect bills can also be directed to the first upper output receptacle 106*a*. Additionally, in other alternative embodiments of the present invention, modular output receptacles can be added so that, for example, U.S. $5 and $10 bills are processed in the same manner along side the U.S. $20, $50, $100 bills and Canadian $20, $50, $100 bills.

As is apparent from the foregoing discussion, a stacking-for-strapping mode of operation can be combined with other modes of operation to instruct the currency handling device to operate in a multitude of different variations.

In addition to the various multi-pocket document evaluation devices described above in connection with FIGS. 1–25, additional multi-pocket document evaluation devices and method of operating the same will now be described in connection with FIGS. 26*a*–39. The operating modes to be described in connection with FIGS. 26*a*–39 may also be applied to the embodiments described in connection with FIGS. 1–25.

Figure 26A:
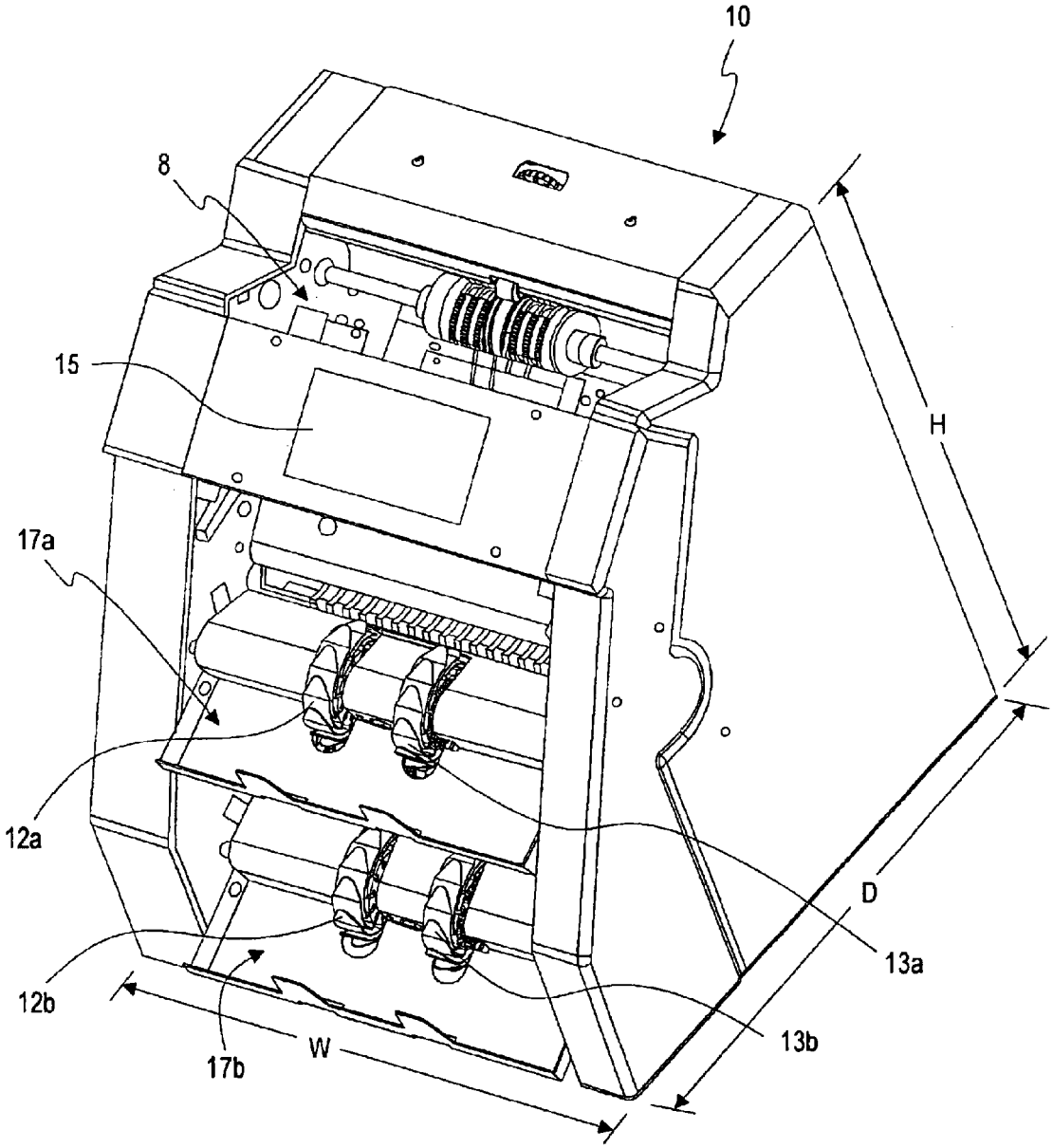
FIG. 26*a* is a perspective view of a multi-pocket document evaluation device according to one embodiment of the present invention.
Figure 26B:
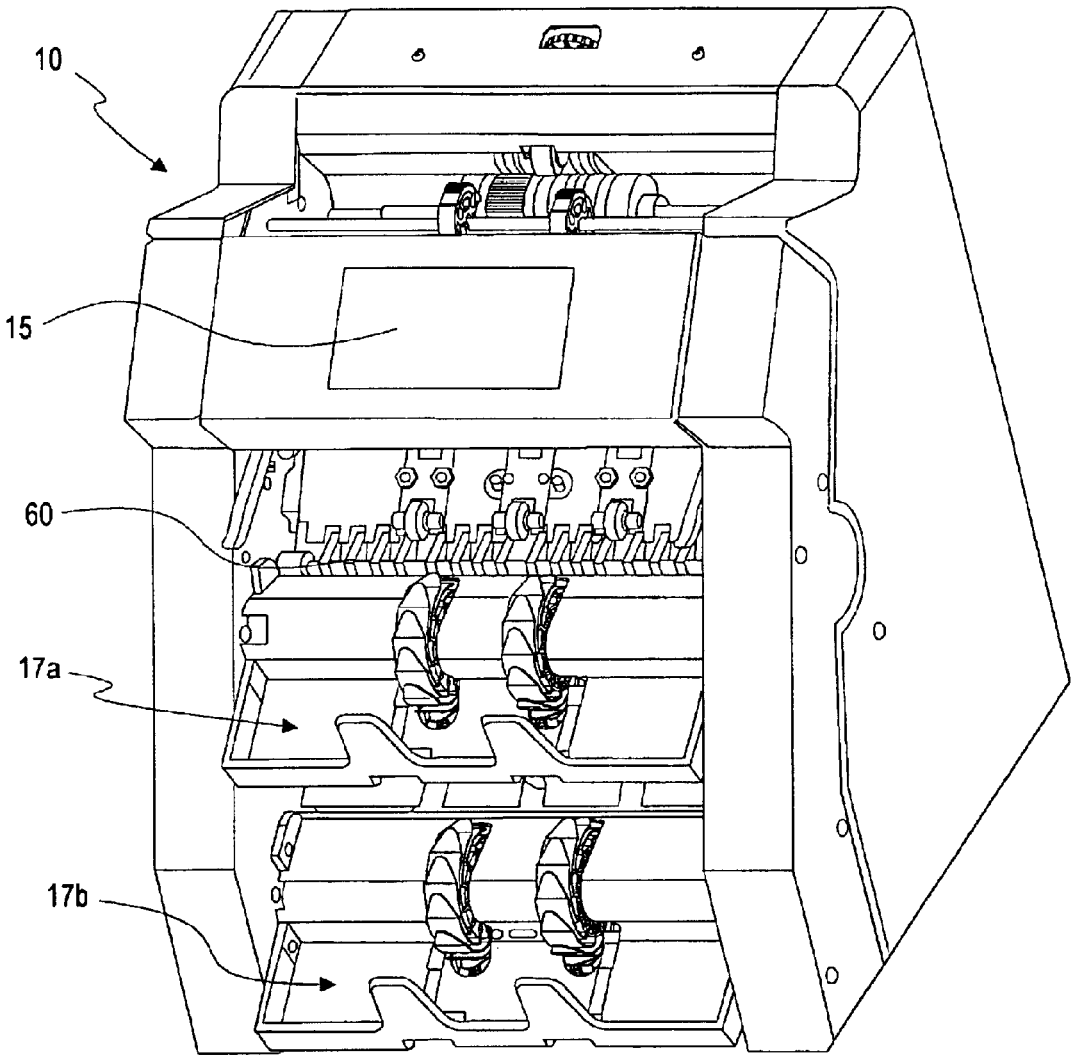
FIG. 26*b* is another perspective view of a multi-pocket document evaluation device according to one embodiment of the present invention.
Figure 26C:
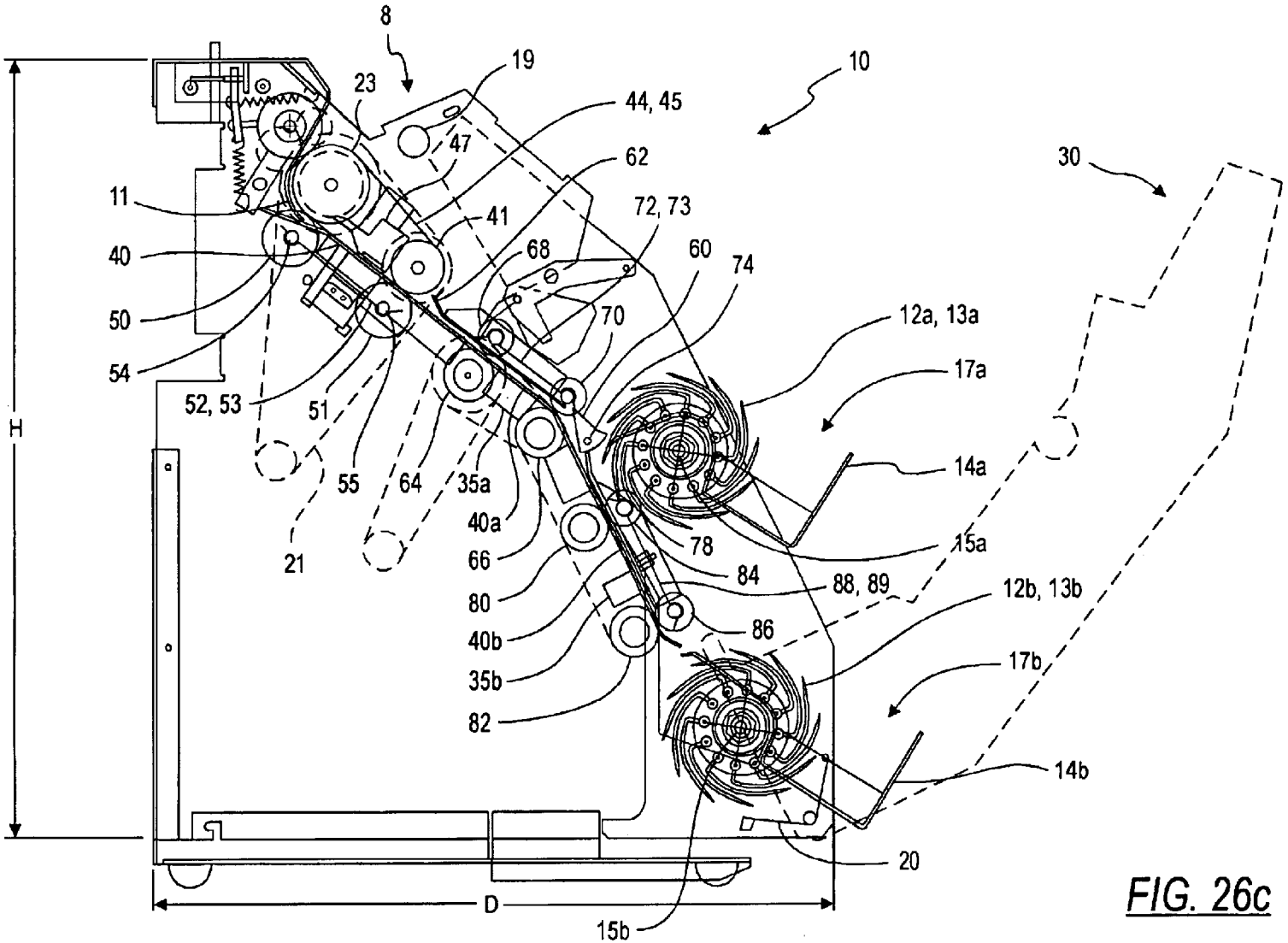
FIG. 26*c* is a side view of an evaluation device depicting various transport rolls in side elevation according to one embodiment of the present invention.

FIGS. 26*a* and 26*b* depict an exterior perspective view and FIG. 26*c* is a side view of a multi-pocket document evaluation device 10 such as a currency discriminator according to one embodiment of the present invention. According to one embodiment the currency discriminator 10 is compact having a height (H) of about 17½ inches (44.5 cm), width (W) of about 13½ inches (34.3 cm), and a depth (D) of about 15 inches (38.1 cm) and weighs approximately 35 lbs. (16 kg). The evaluation device 10 may be rested upon a tabletop.

In FIGS. 26*a*, 26*b*, and 26*c*, currency bills are fed, one by one, from a stack of currency bills placed in an input receptacle 8 into a transport mechanism. The transport mechanism includes a transport plate or guide plate 40 for guiding currency bills to one of a plurality of output receptacles 17*a* and 17*b*. Before reaching the output receptacles 17*a*, 17*b* a bill can be, for example, evaluated, analyzed, authenticated, discriminated, counted and/or otherwise processed. The results of the above process or processes may be used to determine to which output receptacle 17*a*, 17*b* a bill is directed. In one embodiment, documents such as currency bills are transported, scanned, and identified at a rate equal to or greater than 600 bills per minute. In another embodiment, documents such as currency bills are transported, scanned, and identified at a rate equal to or greater than 800 bills per minute. In another embodiment, documents such as currency bills are transported, scanned, and identified at a rate equal to or greater than 1000 bills per minute. For currency bills, the identification may include the determination of the denomination of each bill.

FIGS. 26*a*–26*c* are described in more detail in U.S. Pat. No. 6,311,819 B1 incorporated herein by reference in its entirety. The currency discriminator 10 in FIGS. 26*a* and 26*b* has a touch panel display 15 in one embodiment of the present invention which displays appropriate "functional" keys when appropriate. The touch panel display 15 simplifies the operation of the multi-pocket currency discriminator 10. The touch panel display 15 may be a full graphics display. Alternatively or additionally physical keys or buttons may be employed.

From the input receptacle 8, the currency bills are moved in seriatim from the bottom of a stack of bills along a curved guideway 11 (shown in FIG. 26*c*) which receives bills moving downwardly and rearwardly and changes the direction of travel to a forward direction. The curvature of the guideway 11 corresponds substantially to the curved periphery of a drive roll 23 so as to form a narrow passageway for the bills along the rear side of the drive roll 23. An exit end of the curved guideway 11 directs the bills onto the transport plate 40 which carries the bills through an evaluation section and to one of the output receptacles 17*a*, 17*b*.

Stacking of the bills in one embodiment is accomplished by a pair of driven stacking wheels 12*a* and 13*a* for the first or upper output receptacle 17*a* and by a pair of stacking wheels 12*b* and 13*b* for the second or bottom output receptacle 17*b*. The stacker wheels 12*a,b* and 13*a,b* are supported for rotational movement about respective shafts 15*a,b* journalled on a rigid frame and driven by a motor (not shown). Flexible blades of the stacker wheels 12*a* and 13*a* deliver the bills onto a forward end of a stacker plate 14*a*. Similarly, the flexible blades of the stacker wheels 12*b* and 13*b* deliver the bills onto a forward end of a stacker plate 14*b*.

A diverter 60 directs the bills to either the first or second output receptacle 17*a*, 17*b*. When the diverter is in a lower position, bills are directed to the first output receptacle 17*a*. When the diverter 60 is in an upper position, bills proceed in the direction of the second output receptacle 17*b*.

Figure 27A:
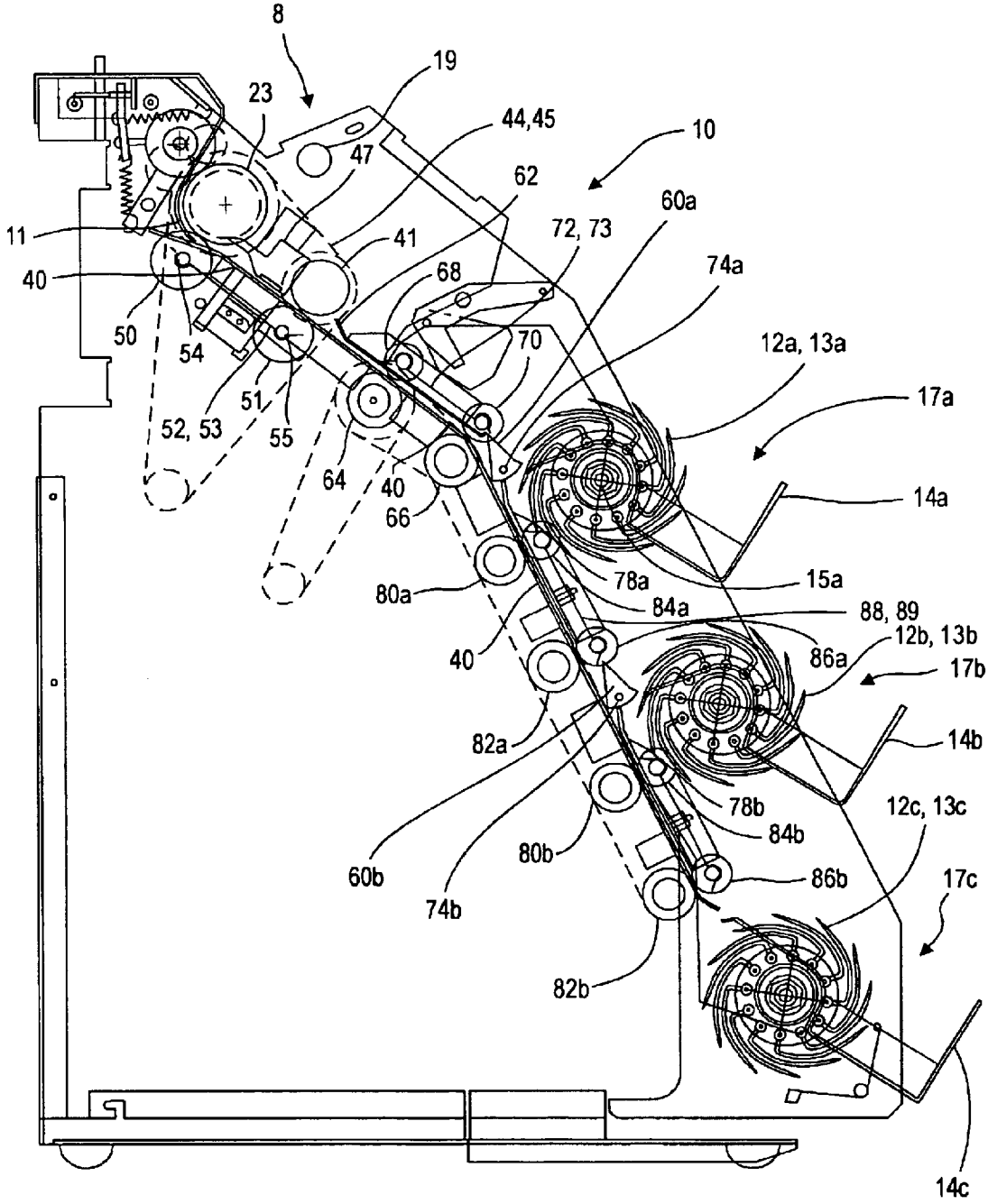
FIG. 27*a* is a side view of an evaluation device having three output receptacles depicting various transport rolls in side elevation according to one embodiment of the present invention.
Figure 27B:
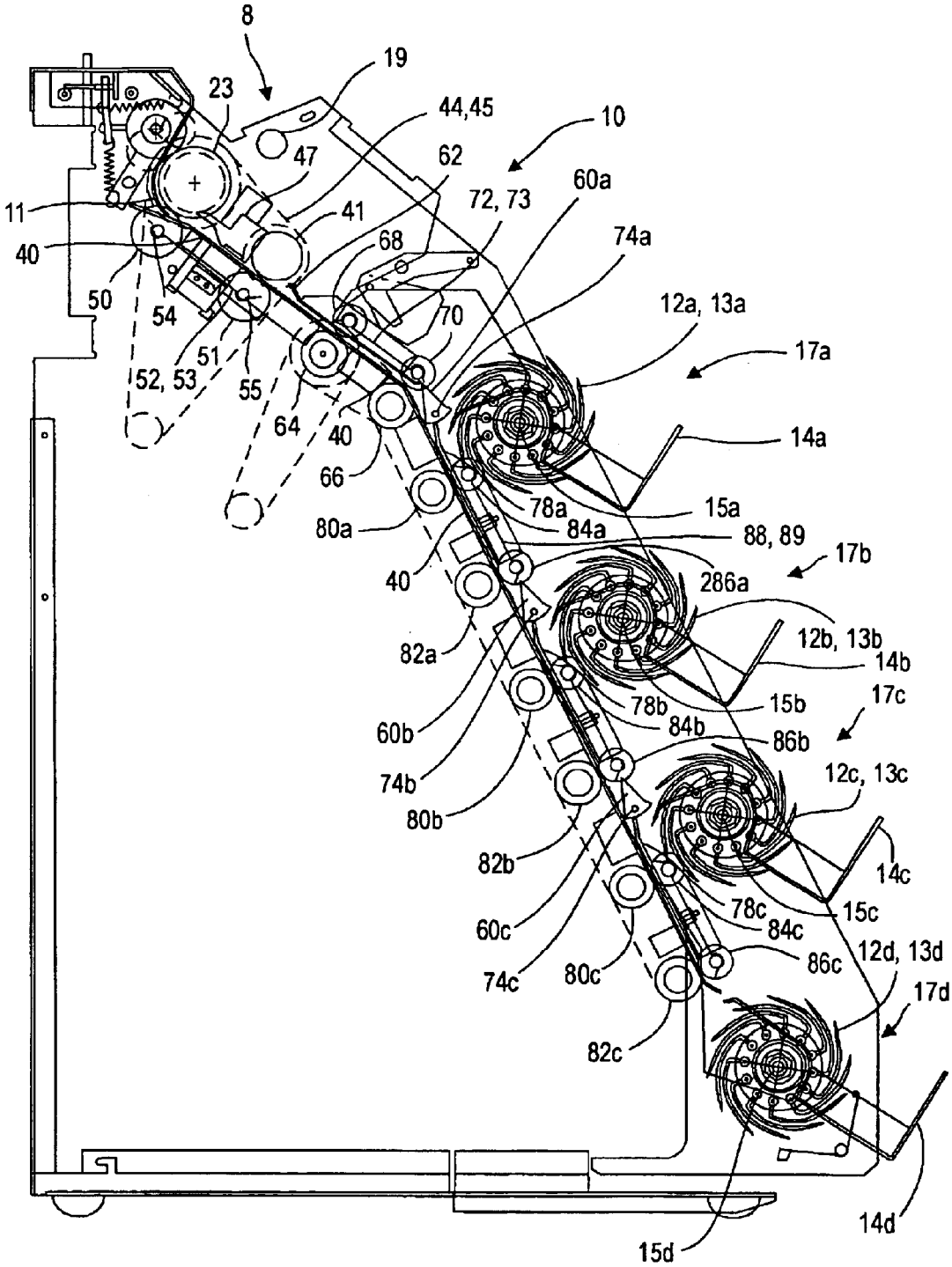
FIG. 27*b* is a side view of an evaluation device having four output receptacles depicting various transport rolls in side elevation according to one embodiment of the present invention.
Figure 27C:
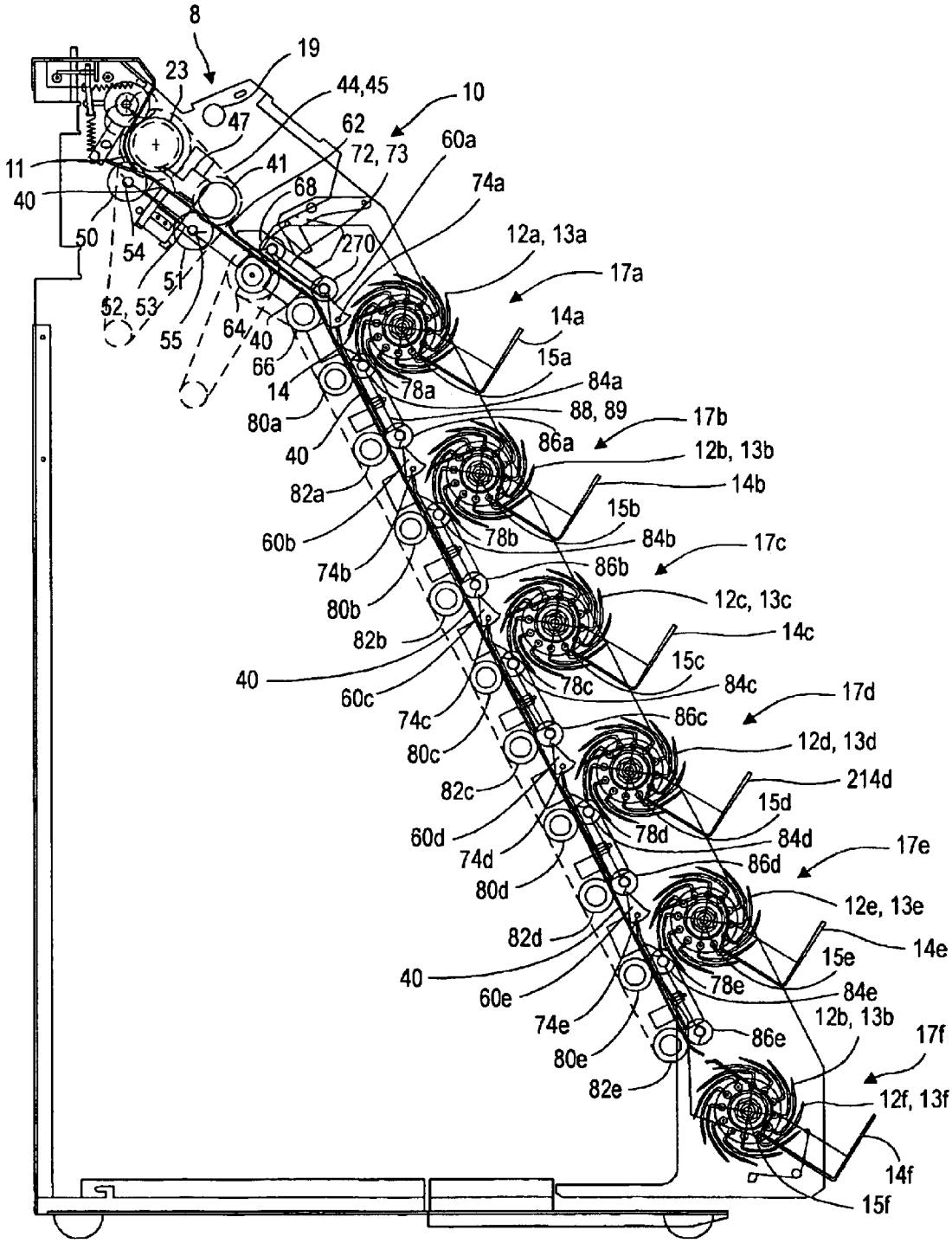
FIG. 27*c* is a side view of an evaluation device having six output receptacles depicting various transport rolls in side elevation according to one embodiment of the present invention.

FIGS. 27*a–c* depict multi-pocket document evaluation devices 10, such as a currency discriminators, according to other embodiments of the present invention. FIG. 27*a* depicts a three-pocket document evaluation device 10, such as a currency discriminator. FIG. 27*b* depicts a four-pocket document evaluation device 10, such as a currency discriminator. FIG. 27*c* depicts a six-pocket document evaluation device 10, such as a currency discriminator.

The multi-pocket document evaluation devices 10 in FIGS. 27*a–c* have a transport mechanism which includes a transport plate or guide plate 40 for guiding currency bills to one of a plurality of output receptacles 17. The transport plate 40 according to one embodiment is substantially flat and linear without any protruding features. Before reaching the output receptacles 17, a bill can be, for example, evaluated, analyzed, authenticated, discriminated, counted and/or otherwise processed.

The multi-pocket document evaluation devices 10 move the currency bills in seriatim from the bottom of a stack of bills along the curved guideway 11 which receives bills moving downwardly and rearwardly and changes the direction of travel to a forward direction. An exit end of the curved guideway 11 directs the bills onto the transport plate 40 which carries the bills through an evaluation section and to one of the output receptacles 17. A plurality of diverters 60 direct the bills to the output receptacles 17. When a diverter 60 is in its lower position, bills are directed to the corresponding output receptacle 17. When a diverter 60 is in its upper position, bills proceed in the direction of the remaining output receptacles.

Evaluation Region

The characteristics of the evaluation region 47 may vary according to the particular application and needs of the user. The evaluation region can accommodate a number and variety of different types of sensors depending on a number of variables. These variables are related to whether the machine is authenticating, counting or discriminating and what distinguishing characteristics are being examined, e.g., size, color, magnetism, reflectivity, absorbability, transmissivity, electrical conductivity, etc. The evaluation region 47 may be incorporated in any of the above described devices including the devices illustrated in FIGS. 1*a*–1*c*, 26*a*–26*c*, and 27*a*–27*c*.

The evaluation region 47 may employ a variety of detection means such as magnetic or optical sensors. For example, as described above in connection with the evalaution region 108 (FIGS. 2*a* and 2*b*) and in U.S. Pat. No. 6,311,819 B1 (incorporated herein by reference in its entirety) a variety of currency characteristics can be measured using magnetic, optical, electrical conductivity, capacitive, and mechanical sensing. Exemplary scanheads are illustrated in FIGS. 13–16 of U.S. Pat. No. 6,311,819 B1.

Figure 28:
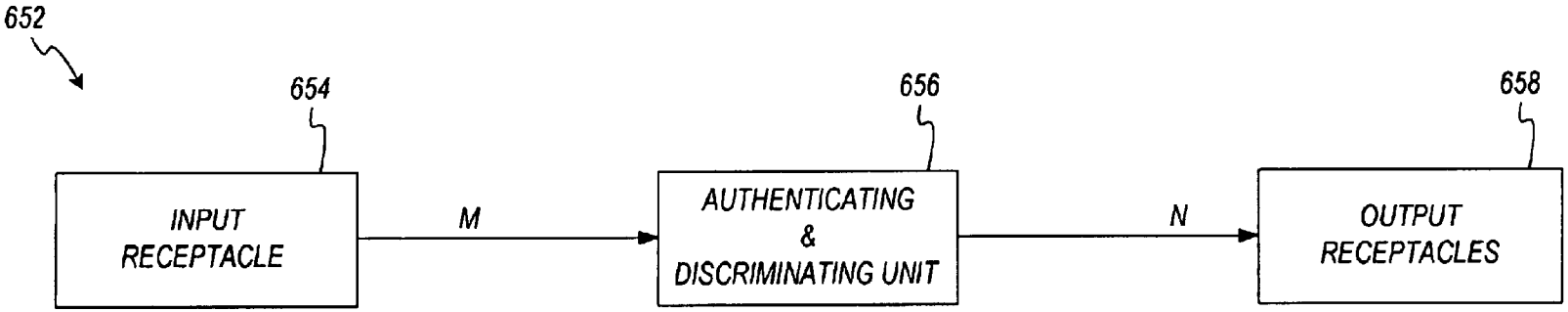
FIG. 28 is a functional block diagram illustrating a document authenticator and discriminator according to one embodiment of the present invention.

Turning now to FIG. 28, there is shown a functional block diagram illustrating an embodiment of a document authenticator and discriminator according to the present invention. The discriminator system 652 comprises an input receptacle 654 for receiving a stack of currency bills. A transport mechanism defining a transport path (as represented by arrow M) transports the bills in the input receptacle, one at a time, past one or more sensors of an authenticating and discriminating unit 656. Bills are then transported to one of a plurality of output receptacles 658 (arrow N). The system 652 may correspond, for example, to the discriminators described above having multiple output pockets such as those shown in FIGS. 1*a*–1*c*, 26*a*–26*c*, and 27*a*–27*c*. The authenticating and discriminating unit scans and determines the denomination of each passing bill. Any variety of discriminating techniques may be used. For example, the discriminating method disclosed in U.S. Pat. No. 5,295,196 (incorporated by reference herein in its entirety) may be employed to optically scan each bill. In addition to determining the denomination of each scanned bill, the authenticating and discriminating unit 656 may additionally include various authenticating tests. Additional details of FIG. 28 are described in U.S. Pat. No. 6,311,819 B1 (incorporated by reference above).

Signals from the authenticating and discriminating unit 656 are sent to a signal processor such as a central processor unit ("CPU"). The CPU records the results of the authenticating and discriminating tests in a memory. When the authenticating and discriminating unit 656 is able to confirm the genuineness and denomination of a bill, the value of the bill is added to a total value counter in memory that keeps track of the total value of the stack of bills that were inserted in the input receptacle 654 and scanned by the authenticating and discriminating unit 656. Additionally, depending on the mode of operation of the discriminator system 652, counters associated with one or more denominations may be maintained in the memory. For example, a $1 counter may be maintained to record how many $1 bills were scanned by the authenticating and discriminating unit 656. Likewise, a $5 counter may be maintained to record how many $5 bills were scanned, and so on. In an operating mode where individual denomination counters are maintained, the total value of the scanned bills may be determined without maintaining a separate total value counter. The total value of the scanned bills and/or the number of each individual denomination may be displayed on a display such as a monitor or LCD display.

According to one embodiment, the discriminator system 652 is designed so that when the authenticating and discriminating unit is unable to identify a bill, the unidentified note is "presented" in one of the output receptacles, that is, the transport mechanism is stopped so that the unidentified bill is located at a predetermined position within one of the output receptacles, such as being the last bill transported to one of the output receptacles. For example, where the unidentified bill is the last bill transported to an output receptacle, it may be positioned within the stacker wheels or positioned at the top of or at the rear of the stack of bills resting on a stacker plate in the output receptacle 658. The output receptacles 658 are preferably positioned within the discriminator system 652 so that the operator may conveniently see the flagged bill and/or remove it for closer inspection. Accordingly, the operator is able to easily see the bill which has not been identified by the authenticating and discriminating unit 656. The operator may then either visually inspect the flagged bill while it is resting on the top of or at the rear of the stack, or alternatively, the operator may chose to remove the bill from the output receptacle in order to examine the flagged bill more closely.

According to another embodiment, when a bill is flagged, the transport mechanism may be stopped before the flagged bill is transported to one of the output receptacles. Such an embodiment is particularly suited for situations in which the operator need not examine the bill being flagged, such as upon the occurrence of a denomination change or separate series error described below. For example, upon the occurrence of a denomination change where all available output receptacles already have one or more bills in them, the machine may stop with the denomination change bill residing within the transport mechanism. The machine may then prompt the operator to remove all the bills from a given output receptacle. When the operator does so, the machine automatically resumes operation (or alternatively, the machine may resume operation after the selection of a continue key) and delivers the denomination change bill into the cleared output receptacles.

With respect to FIG. 28, in one embodiment, where the authenticating and discriminating unit determines that a bill is a fake, the flagged bill is routed to a separate one of said output receptacles. The operation of the discriminator may or may not then be suspended. When a bill is not determined to be fake but for some reason the authenticating and discriminating unit 656 is not able to identify the denomination of the bill, the no call bill may be transported one of the output receptacles. In one embodiment, no call bills are transported to a separate one of the output receptacles. In another embodiment, no calls are not delivered to a special separate output receptacle. The operation of the discriminator may or may not then be suspended.

In another embodiment according to FIG. 28, no call bills are delivered to an output receptacle separate from the one or more output receptacles receiving identified bills. The operation of the discriminator need not be suspended until all the bills placed in the input receptacle have been processed. The value of any no call bills may then be added to the appropriate counters after the stack of bills has been processed through a reconciliation process. Additional details concerning reconciling or inputting the value of flagged bills which have not been incorporated into running totals or counters are described in U.S. Pat. No. 6,311,819 B1 (incorporated by reference above).

One embodiment that may be used for stopping the transport mechanism in response to the detection of an unidentified bill or a bill meeting some other criteria such as being a suspect bill, denomination change, etc., is described in more detail in U.S. Pat. No. 5,295,196 incorporated herein by reference in its entirety. Basically, one or more sensors retrieve information from passing bills. This information is processed by a signal processor such as a CPU. The position of bills in the transport mechanism is monitored. This monitoring of bill positioned is accomplished via the use of an optical encoder as described in U.S. Pat. No. 5,295,196. If the denomination of the bill is identified, the signal processor generates a signal indicative of the determined denomination. If the denomination of the bill is not determined, the signal processor generates a no call signal. If the signal processor determines the bill to be suspect, a suspect signal is generated or a particular type of suspect signal is generated indicative of the reason why the bill is believed to be suspect, e.g., failure of a magnetic test, failure of a UV test, etc. Additionally, error signals may be generated for other reasons including the detection of various minor errors such as a denomination change or stranger condition or the detection a major error such as doubles or chains. As a result of the generation of one or more of these error signals, the signal processor can be programmed to generate one or more signals that cause the transport mechanism to halt in a particular manner such as by sending appropriate signals to the motor driving the transport mechanism and/or to cause one or more diverters to direct bills toward an appropriate output receptacle such as by sending appropriate signals to the diverter driving mechanisms such as the solenoids described above. Positional information obtained from the encoder may be employed to stop a bill in a controlled manner and so that the bill is stopped in a predetermined position or identifiable location.

Figure 29:
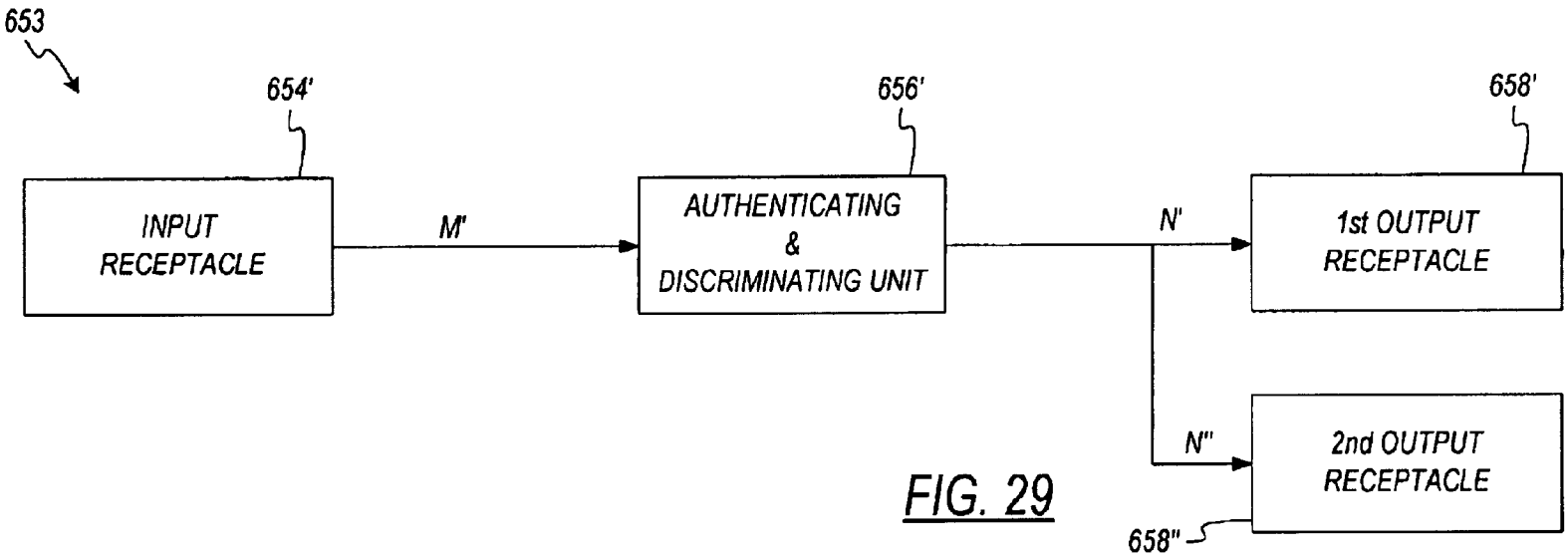
FIG. 29 is a functional block diagram illustrating a two-pocket document authenticator and discriminator according to one embodiment of the present invention.

Turning now to FIG. 29, there is shown a functional block diagram illustrating a two-pocket document authenticator and discriminator according to one embodiment of the present invention. The discriminator system 653 comprises an input receptacle 654' for receiving a stack of currency bills. A transport mechanism defining a transport path (as represented by arrow M') transports the bills in the input receptacle, one at a time, past one or more sensors of an authenticating and discriminating unit 656'. Bills are then transported to one of two output receptacles 658', 658" (as represented by arrows N', N").

In one embodiment, where the authenticating and discriminating unit 656 determines that a bill is a fake, the flagged bill is routed to a specific one of the output receptacles. The operation of the discriminator may or may not then be suspended. When a bill is not determined to be fake but for some reason the authenticating and discriminating unit 656 is not able to identify the denomination of the bill, the no call bill may be transported to one of the output receptacles 658', 658".

In one embodiment, no call bills are transported to a specific one of the output receptacles 658', 658". In another embodiment, no call bills are not delivered to a special separate output receptacle. The operation of the discriminator may or may not then be suspended. For example, in a two output pocket discriminator, all bills may be transported to the same output receptacle regardless of whether they are determined to be suspect, no call, or properly identified. In this example, the operation of the discriminator may be suspended and an appropriate message displayed when a suspect or no call bill is encountered. Alternatively, suspect bills may be delivered to a specific one of the two output receptacles (i.e., a reject receptacle) and no calls and identified bills may be sent to the other output receptacle. In this example, the operation of the discriminator need not be suspended when a suspect bill is encountered but may be suspended when a no call bill is encountered. If the operation is suspended at the time the no call bill is detected and the operator determines that the no call bill is acceptable, the operator returns the bill to the output receptacle from which it was removed (if it was removed) and selects a selection element (not shown) corresponding to the denomination of the flagged bill. Appropriate counters (not shown) are incremented, the discriminator system 653 resumes operation. On the other hand, if the operator determines that the flagged bill is unacceptable, the operator removes the bill without replacement from the output receptacle and selects a continuation element (not shown). The discriminator system 653 resumes operation without incrementing the counters associated with the various denomination and/or the total value counters.

In another embodiment, no call bills are delivered to a specific output receptacle separate from the output receptacle receiving identified bills. The operation of the discriminator need not be suspended until all the bills placed in the input receptacle 654 have been processed. Alternatively, the operation of the discriminator need not be suspended when a no call is encountered but may be suspended when a suspect bill is detected so that the operator may remove any suspect bills from the discriminator. The value of any no call bills may then be added to the appropriate counters after the stack of bills has been processed through a reconciliation process. In an alternate embodiment, suspect and no call bills may be delivered to a specific one of the two output receptacles (i.e., a reject receptacle) and identified bills may be sent to the other output receptacle. Additionally, according to this embodiment, the operation of the discriminator may be suspended and an appropriate message displayed when a suspect or no call bill is encountered.

As described above in connection with FIG. 28, when the transport mechanism is to be stopped in response to a bill being flagged, the flagged bill may be located at a predetermined position within an output receptacle, e.g., last bill, in stacker wheel, or alternatively, the transport mechanism may be stopped before the flagged bill is transported to one of the output receptacles.

The system 653 may correspond, for example, to the discriminators described above having two output pockets such as those shown in FIGS. 26*a*–26*c*. In one embodiment, the discrimination system is selectively programmable among several operating modes so that an operator may select, for example, which bills to flag, in which pocket to direct the flagged or unflagged bills, and/or which stopping conditions to activate or de-activate. The several operating modes will be discussed in detail below. In any of the selected operating modes, the system may be programmed to deliver a flagged bill into a selected pocket and suspend operation of the machine to allow for inspection of the bill, as described in relation to FIG. 28, or the machine may be programmed to "off-sort" flagged or unflagged bills into a different pocket and either stop to allow for inspection of the "off-sorted" bill or continue processing the stack of bills without stopping.

According to some embodiments, a bill may be flagged and the discriminator systems described above such as those in conjunction with FIGS. 1*a*–1*c*, 26*a*–26*c*, 27*a*–27*c*, and 28–12 may be stopped upon encountering an unidentified or "no call" bill, as discussed above, or for any number of other stopping conditions. In general, according to some embodiments, these discriminator systems may stop upon the occurrence of minor errors or major errors, both of which will be discussed in detail below. These discriminator systems may include an audio alarm to provide an audible signal upon the occurrence of one or more of the minor or major error conditions. Preferably, the audio alarm is programmable to permit the operator to selectively activate or de-activate the audio alarm for any or all of the minor or major error conditions. The following description including the description relating to error conditions, operating modes, and touch panel screens are applicable to these discriminator systems and particularly to the above described discriminator systems having two output pockets such as shown in FIGS. 26*a*–26*c* and 29. Furthermore, such systems transport and divert bills to one of the output pockets at speeds equal to or greater than 600 documents per minute. According to another embodiment, such systems transport and divert bills to one of the output pockets at speeds equal to or greater than 800 documents per minute. According to another embodiment, such systems transport and divert bills to one of the output pockets at speeds equal to or greater than 1000 documents per minute.

Minor Error Conditions

Minor errors are conditions which may or may not cause the machine to stop depending on the set-up, mode of operation, and error involved. Minors errors do not involve the review of more than one, if any, note. Minor errors do not disrupt running totals such as batch or sub-totals. According to one embodiment, the minor error conditions may be selectively activated or de-activated as desired by the user. For example, the machine may be programmed stop upon the occurrence of a "no call" document but not upon the occurrence of a "suspect document". The minor error conditions are listed as follows:

1) No Call (NC)
2) Suspect Document (SD)
3) Denomination Change (DC)
4) Stranger (S)
5) Separate Series (SS)
6) Improper Size (SZ)
7) Unfit Document (UD)
8) Reverse-Faced (RF)
9) Reverse-Oriented (RO)
10) Strap Limit (SL)
11) Stacker Full (SF)

No Call

A "no call" condition occurs when the discriminating device is unable to identify or determine the denomination of a note, the unidentified note being termed a no call.

Suspect Document

A "Suspect Document" is a note that fails one or more authentication tests based on a variety of monitored parameters. A discriminating device may permit the operator to enable or disable the detection of Suspect Documents, by for example, enabling or disabling one or more the authentication tests.

Denomination Change

A "Denomination Change" condition occurs when a note is identified having a denomination other than prior bills or a target denomination while the machine is operating in one of the sort modes described below. For example, when a $100 bill is scanned in a stack of previously scanned $50 bills, the condition "Denomination Change" may occur under certain circumstances while the machine is operating in a sort mode.

Stranger

The "Stranger" condition occurs when a note is identified having a denomination other than prior bills or a target denomination while the machine is operating in one of the stranger modes described below. The stranger mode is generally used when it is expected that most bills in a stack are of the same denomination. The stranger condition will be discussed in greater detail hereinafter in connection with several stranger modes of operation.

Separate Series (SS)

A "Separate Series" condition occurs when a note is identified as having a different series than prior bills or a target series. For example, when a new-series $100 bill (i.e., a 1996-series $100 bill) is scanned in a stack of previously scanned old-series $100 bills, the condition "Separate Series" may occur. This function may be employed in conjunction with the modes described below where it is desired to discriminate of notes based on their series, e.g., to discriminate between a 1993-series $50 bills and 1950-series $50 bills or to discriminate between all pre-1996 series U.S. notes from all 1996 and later series U.S. notes.

Improper Size

An "Improper Size" condition occurs when a document has a size that does not correspond to the size of one of the genuine documents that the system is programmed to recognize. For example, if the machine is set to process U.S. bills, then all documents should have the same size and any document that is not the same size as genuine U.S. currency will cause an "improper size" condition to occur. Likewise, for foreign bills, any document having a size other than one of the sizes of genuine foreign currency will cause an "improper size" condition to occur.

Unfit Document

An "Unfit Document" condition occurs when a document fails one or more fitness tests. Such fitness tests may detect, for example, the degree to which a bill is soiled, torn, or otherwise damaged. Likewise, the limpness of a document may also be employed as a fitness test.

Reverse-Faced

An "Reverse-Faced" condition occurs when a machine is operating in a facing mode and a document having a face orientation other than a target face orientation is detected.

Reverse-Oriented

An "Reverse-Oriented" condition occurs when a machine is operating in a Forward/Reverse Orientation mode and a document having a forward/reverse orientation other than a target forward/reverse orientation is detected.

Strap Limit

The discrimination device may permit the setting of limits on the number of bills based on various conditions. For example, it may be desirable to gather $20 bills into stacks of fifty bills. Accordingly, if for example bills are being processed such that $20 bills and only $20 are being directed into the first output receptacle, the device may halt after fifty $20 bills have been delivered into the first pocket. The display may then indicate that a strap limit has been reached for the first output pocket. Various strap limits may be factory-preset or user-set. Alternatively, "Strap Limits" may be determined by combining the number of notes delivered to two or more of the output pockets.

Stacker Full

The "Stacker Full" condition occurs when either or both of the pockets are at or near capacity and are not to receive additional notes. For example, in an embodiment in which the pockets are designed to receive a maximum of 300 currency notes, the discriminating device may be programmed to halt after 300 notes have been delivered to either of the pockets. The "stacker full" condition thereby will occur upon delivery of the 300th note. Similarly, in an embodiment in which the pockets are designed to receive 600 currency notes, the "stacker full" condition will occur upon delivery of the 600th note.

Major Error Conditions

Major errors are conditions which typically will stop the machine and may require the operator to remove and re-process more than one note. According to one embodiment, major error conditions include Jam (J), Double (D) and Chain (C). The condition "Jam" occurs when one or more sensors detect that a jam is occurring when notes are being transported between the input receptacle and the output receptacles. The condition "Double" occurs when two or more notes are fed by the transport mechanism in a stacked manner. The condition "Chain" occurs when two or more notes are fed by the transport mechanism in an overlapping manner.

Operating Modes

The discrimination system may be selectively programmed to operate in any of several operating modes. In general, these operating modes may be categorized as "stranger modes", "sort modes", "mixed modes" and "count modes". As will be described in greater detail hereinafter, the operating mode categories generally include two or three specific operating modes. An operator may select an individual operating mode or combination of operating modes as desired.

A. Stranger Modes

In general, stranger modes are used to process a stack of notes expected to be of the same denomination, in which the operator desires to remove "stranger" notes, or notes not having the same denomination. For example, a stranger mode may be selected to process a stack of notes substantially comprised of $10 bills so that all non-$10 bills may be removed from the stack. In a stranger mode, the machine will process the stack and place the "target" $10 notes into a selected pocket (e.g., pocket 1). Upon encountering a stranger note (or upon encountering another selected error condition), the machine may "present" the flagged note into the same pocket as the target note (i.e., stop the machine after the flagged bill is delivered into an output pocket, e.g., pocket 1) to allow the operator to inspect the note, or the machine may be programmed to off-sort the flagged note into the other pocket (e.g., pocket 2). Upon off-sorting the stranger note into pocket 2, the machine may be designed to either stop (present the note into pocket 2) and allow the operator to inspect the note, or continue processing the remaining notes in the stack.

A display, such as a touch panel display (e.g. FIG. 26), may indicate the number or aggregate value of notes having the target denomination, e.g., $10 bills. In one embodiment, the display is also capable of including totals associated with stranger notes via operator selection choices. For example, if a $5 stranger bill is detected in a stack of $10 bills, the operator may be prompted via the display as to whether the $5 bill should be incorporated into the running totals. If the operator responds positively, the $5 bill is incorporated into appropriate running totals, otherwise it is not. Alternatively, a set-up selection may be chosen whereby all stranger notes are automatically incorporated into appropriate running totals. The machine may include the following stranger modes as described below: stranger 1, stranger 2, stranger facing and stranger orientation.

1. Stranger 1 (STR 1)

In "Stranger 1" mode, the discriminator will process a stack of notes and place notes having a target denomination into pocket 1. The target denomination may be selected automatically by the discriminator to be that of the first note in the stack, or the target denomination may be explicitly selected by the operator. Upon the occurrence of a "stranger" condition (i.e., upon encountering a note not having the target denomination), the system may either present the flagged note into pocket 1 or off-sort the flagged note into pocket 2. Depending upon the set-up selected, the machine may either present the off-sorted flagged bill or continue processing bills. Optionally, the system may be similarly programmed to either present or off-sort flagged notes upon the occurrence of the "no call", "separate series", or "suspect document" conditions (minor errors). Upon encountering either the "strap limit", "stacker full", "chain", "double" or "jam" condition, the machine will stop, requiring the operator to undertake the appropriate corrective action before continuing such as removing bills from a full pocket or clearing a jam.

2. Stranger 2 (STR 2)

In "Stranger 2" mode, as in "Stranger 1" mode, the discriminator will process the stack and place notes having a target denomination into pocket 1. Upon encountering either the "strap limit" or "stacker full" condition, however, the machine will automatically begin delivering the target notes to pocket 2 provided that pocket is empty. Thereafter, upon encountering the "strap limit" or "stacker full" conditions again, the machine will automatically switch pockets and begin delivering bills into the other pocket if the other pocket has been cleared by the operator. If the other pocket has not been cleared, the machine will stop, requiring the operator remove the bills from either pocket 1 or pocket 2 before continuing. The display may indicate the aggregate value of the notes in the stack and/or the value or number of notes of each denomination in either pocket 1 or pocket 2.

Upon the occurrence of a minor error condition such as "stranger" (when the other pocket has not been cleared), no call, suspect document or separate series, the system may either present the flagged note into the current pocket or off-sort the flagged note into the other pocket and stop (i.e., present the flagged note in the other pocket). Alternatively, the system may be set to always present flagged notes into a given pocket (e.g., pocket 2) regardless of which pocket is the current pocket. Major errors will cause the machine to stop and the operator to take appropriate corrective action such as clearing a jam and/or re-processing a stack of notes.

3. Stranger Facing (STR F)

In "Stranger Facing" mode, the machine is designed to process a stack of notes faced in substantially the same direction, e.g., placed in the input hopper face up, and to detect any notes facing the opposite direction. The ability to detect and correct for reverse-faced notes is important as the Federal Reserve requires currency it receives to be faced in the same direction. Thus, in "Stranger Facing" mode, the discriminator will process a stack of notes and place notes faced in a target direction and having a target denomination into pocket 1. The target direction and denomination may be selected automatically by the discriminator to be that of the first note in the stack, or the target direction and/or denomination may be explicitly selected by the operator. Upon the occurrence of a "stranger" condition (i.e., upon encountering a note having a denomination other than the target denomination) or upon the occurrence of a "reverse-faced" condition (i.e., upon encountering an opposite-faced note of the target denomination), the machine will either present the flagged note into pocket 1 or pocket 2 or off-sort the flagged note into pocket 2 and continue processing notes. Minor errors such as "suspect document", "no call", or "separate series" may be handled as discussed above, such as by presenting a flagged bill into either pocket 1 or pocket 2 or off-sorting into pocket 2 and continuing to process bills. For example, target notes may be delivered to pocket 1 and all other notes (strangers, no calls, suspect, separate series, reverse-faced) may be delivered to pocket 2. These bills may be simply off-sorted to pocket 2 and the machine may continue to process successive notes. Alternatively, one or more of the above conditions may be presented into pocket 2 (e.g., no calls and suspects may cause the machine to halt and appropriate messages to be displayed while strangers and reverse-faced notes are simply off-sorted but not presented).

According to another embodiment, notes having the target denomination and face orientation are delivered to one pocket (e.g., pocket 1) and notes having the target denomination but not the target face orientation are delivered to the other pocket (e.g., pocket 2). Only notes not having the target denomination are treated as stranger notes and may be handled by being presented into one of the pockets. Likewise, minor errors such as "suspect document", "no call", or "separate series" may be handled by presenting a flagged bill into either pocket 1 or pocket 2.

"Stacker full" or "strap limit" conditions may be handled by stopping and waiting for the operator to clear one or both pockets. The "strap limit" may be set up on a pocket by pocket basis or based on the combined contents of pockets 1 and 2. Major errors are handled as discussed above (see e.g., discussion of the stranger 2 mode).

4. Stranger Orientation (STR O)

In "Stranger Orientation" mode, the machine is designed to process a stack of notes faced in substantially the same forward/reverse orientation, e.g., in a predetermined forward or reverse orientation direction. The forward direction may be defined as the feed direction whereby the top edge of a note is fed first and conversely for the reverse direction. The ability to detect and correct for reverse-oriented notes is important as the United States Federal Reserve may soon require currency it receives to be oriented in the same forward/reverse direction. Thus, in "Stranger Orientation" mode, the discriminator will process a stack of notes and place notes having a target forward/reverse orientation and having a target denomination into pocket 1. The target orientation and denomination may be selected automatically by the discriminator to be that of the first note in the stack, or the target direction and/or denomination may be explicitly selected by the operator. Upon the occurrence of a "stranger" condition (i.e., upon encountering a note having a denomination other than the target denomination) or a "reverse-oriented" condition (i.e., upon encountering an opposite-oriented note of the target denomination), the machine will either present the flagged note into pocket 1 or pocket 2 or off-sort the flagged note into pocket 2 and continue processing notes. Minor errors such as "suspect document", "no call", or "separate series" may be handled as discussed above, such as by presenting a flagged bill into either pocket 1 or pocket 2 or off-sorting into pocket 2 and continuing to process bills. For example, target notes may be delivered to pocket 1 and all other notes (strangers, no calls, suspect, separate series, reverse-oriented) may be delivered to pocket 2. These bills may be simply off-sorted to pocket 2 and the machine may continue to process successive notes. Alternatively, one or more of the above conditions may be presented into pocket 2 (e.g., no calls and suspects may cause the machine to halt and appropriate messages to be displayed while strangers and reverse-oriented notes are simply off-sorted but not presented).

According to another embodiment, notes having the target denomination and orientation are delivered to one pocket (e.g., pocket 1) and notes having the target denomination but not the target orientation are delivered to the other pocket (e.g., pocket 2). Only notes not having the target denomination are treated as stranger notes and may be handled by being presented into one of the pockets. Likewise, minor errors such as "suspect document", "no call", or "separate series" may be handled by presenting a flagged bill into either pocket 1 or pocket 2.

"Stacker full" or "strap limit" conditions may be handled by stopping and waiting for the operator to clear one or both pockets. The "strap limit" may be set up on a pocket by pocket basis or based on the combined contents of pockets 1 and 2. Major errors are handled as discussed above (see e.g., discussion of the stranger 2 mode).

B. Sort Modes

Generally speaking, sort modes are designed to accommodate a pre-sorted stack of notes having a "rainbow" configuration, e.g., wherein the stack of notes includes two or more groups of notes, each group having a different denomination but each note within a given group having the same denomination. For example, the stack of notes may be pre-sorted to include a group of $1 bills at the beginning of the stack, followed by a group of $5 bills, followed by a group of $10 bills, etc. Sort modes permit a user to separate such a "rainbow" stack of notes into separate stacks according to denomination. Alternatively, sort modes may be used to sort a mixed stack of notes, e.g., not pre-sorted, into separate stacks according to denomination.

For example, in a sort mode, the machine may process a stack of notes and deposit a first group of "target" notes (e.g., $1 bills) into a selected pocket. Upon encountering a "denomination change" condition (or upon encountering another selected flagging condition), the machine may "present" the flagged note into the same pocket as the target note and stop to allow the operator to inspect the note, or the machine may be programmed to off-sort the flagged note into the other pocket. Upon off-sorting the denomination change note or other flagged note into pocket 2, the machine may be designed to either stop and allow the operator to inspect the note or to continue processing the remaining notes in the stack.

As described in relation to stranger modes above, the discrimination system may include a display to indicate the number or aggregate value of notes of each respective denomination and/or the number or aggregate value of notes in the stack. The machine may include the following sort modes as described below: sort 1, sort 2, sort 3, sort facing and sort orientation.

1. Sort 1 (SRT 1)

In "Sort 1" mode, the discriminator is designed to process a stack of notes and place notes having a first target denomination (e.g., target denomination 1) into pocket 1 and a second target denomination (e.g., target denomination 2) into pocket 2. The target denominations may be selected by the operator prior to sorting through a stack, or may be selected automatically by the discriminator, e.g., the first encountered denomination being designated target denomination 1 and the second encountered denomination being designated target denomination 2.

Where target denominations are set by the operator, bills of target denomination 1 are delivered into pocket 1 and bills of target denomination 2 are delivered to pocket 2. Bills having a denomination other than target denomination 1 or 2 are flagged. The flagged bills are presented into either pocket 1 or pocket 2.

For example, in one embodiment, the discriminator automatically designates the first target denomination (target note 1) to be that of the first note in the stack, then proceeds to deliver target note 1 to pocket 1. Upon encountering a "denomination change" condition, the discriminator flags the note, designates the flagged note as the second target denomination (target note 2) and delivers target notes 2 to pocket 2. Thereafter, upon encountering another "denomination change" condition, if the appropriate pocket has been cleared by the operator, the machine will proceed to deliver the third denomination of bills into pocket 1, the fourth denomination of bills into pocket 2, and so on. If the appropriate pocket has not been cleared, the machine will stop upon a "denomination change" condition, requiring the operator remove the bills from the appropriate pocket before continuing.

Upon encountering other minor errors such as "no call", "suspect document", and "separate series", the machine will stop, presenting the flagged bills into one of the pockets.

"Stacker full" or "strap limit" conditions may be handled by stopping and waiting for the operator to clear one or both pockets. Major errors are handled as discussed above (see e.g., discussion of the stranger 2 mode).

For example, in an embodiment in which the discriminator automatically selects the target denominations, if the first note in the stack is a $1 bill, the machine will designate target note 1 as a $1 bill and deliver $1 bills into pocket 1 until encountering the first non-$1 bill. The first non-$1 bill, which for example may be a $5 bill, is then designated as target note 2 and is delivered to pocket 2. Then, if and when the discriminator encounters a bill having a third denomination, which for example may be a $10 bill, the machine will either direct any subsequent $10 bills into pocket 1, or will stop if necessary to allow the operator to clear pocket 1. The machine may be designed to automatically resume operation delivering subsequent $10 bills into pocket 1 when the operator removes all the bills present in pocket 1. Assuming that pocket 1 is clear, the machine will then deliver $10 bills into pocket 1 until encountering the next series of bills, and so on until the entire stack has been processed.

2. Sort 2 (SRT 2)

In "Sort 2" mode, the discriminator will process a stack of notes and place notes having a target denomination into pocket 1. The target denomination may be selected automatically by the discriminator to be that of the first note in the stack, or the target denomination may be selected by the operator. Upon the occurrence of the "denomination change" condition (e.g., upon encountering a note not having the target denomination), the system will "present" the flagged note into pocket 1 and stop to allow the operator to inspect the note. Alternatively, the system may be programmed to present "denomination change" notes in pocket 2.

Upon encountering other minor errors such as "no call", "suspect document", and "separate series", the machine will stop, presenting the flagged bills into one of the pockets. Alternatively, one or more of these conditions may cause flagged bills to be off-sorted into pocket 2 without causing the system to stop. The system may permit the operator to select how these bills are to be handled via a set-up option.

"Stacker full" or "strap limit" conditions may be handled by stopping and waiting for the operator to clear one or both pockets. Major errors are handled as discussed above (see e.g., discussion of the stranger 2 mode).

For example, in an embodiment in which the discriminator automatically selects the target denominations, if the first note in the stack is a $1 bill, the machine will designate $1 as the target note and will deliver $1 bills into pocket 1 until encountering the first non-$1 bill. The first non-$1 bill, which may for example be a $5 bill, will then be "presented" into pocket 1. The operator may then remove all $1 bills from pocket 1 and then select an appropriate continuation key. If the first note in the remainder of the stack is also a $5 bill, the machine will designate $5 as the new target note and will proceed to deliver $5 bills into pocket 1 until encountering the first non-$5 bill, and so on until the entire stack has been processed. If the first note in the remainder of the stack is not a $5 bill, then a denomination change error will occur and the machine will present the non-$5 bill into pocket 1, and so on. According to another embodiment, after a denomination change note is presented into pocket 1, the machine restarts automatically when the operator removes all the bills in pocket 1. The operator may then separate the bills by denomination (e.g., place all $1 bills into one stack and the last $5 bill into its own stack).

3. Sort 3 (SRT 3)

In "Sort 3" mode, the discriminator will process a stack of notes and place notes having a target denomination into pocket 1, as in the Sort 2 mode. However, upon the occurrence of the "denomination change" condition, the system will off-sort the flagged note into pocket 2 rather than present the flagged note into pocket 1. The system may or may not be designed to stop after encountering non-target notes, i.e., "denomination change" notes.

According to one embodiment notes having a target denomination (target 1) are delivered to pocket 1. Upon encountering a first denomination change, the denomination of the first non-target 1 note is designated as a target 2 denomination (target 2). Target 2 notes and then off-sorted into pocket 2 without causing the machine to stop. The machine continues to process notes, delivering target 1 notes to pocket 1 and target 2 notes to pocket 2, until the first note having a denomination other than target 1 denomination or target 2 denomination is encountered. At this point this third denomination note is designated as the "new" target 2 denomination and is directed toward pocket 2. According to one embodiment this third denomination note is delivered to pocket 2 and the machine is stopped with the display indicating a denomination change in pocket 2. The operator can then take the appropriate action such as removing all notes in pocket 2 (e.g. in an automatic restart configured set up) or remove all bills other than the third denomination bill and press a continuation key. The machine will then continue processing notes, continuing to deliver original target 1 notes to pocket 1 and delivering "new" target 2 notes to pocket 2, until encountering a bill having a denomination other than target 1 or the present target 2. At this point, a denomination change occurs as described above and a new target 2 denomination is designated.

According to another embodiment, when a new target 2 note is encountered, the transport mechanism stops before the new target 2 note is delivered into the second output receptacle and a denomination change in pocket 2 message is displayed. In this manner, when the machine stops, all the bills in pocket 2 have the same denomination. The operator may then remove all the bills in pocket 2 and set them aside. Depending on the set up, the machine may either resume operation automatically or resume upon the selection of a continuation key. When the machine resumes, the new target note 2 is delivered into the now empty pocket 2 and the machine continues processing bills until encountering a "new" target note 2 denomination.

Upon encountering other minor errors such as "no call", "suspect document", and "separate series", the machine will stop, presenting the flagged bills into one of the pockets. "Stacker full" or "strap limit" conditions may be handled by stopping and waiting for the operator to clear one or both pockets. Major errors are handled as discussed above (see e.g., discussion of the stranger 2 mode).

For example, in an embodiment in which the discriminator automatically selects the target denominations, if the first note in the stack is a $1 bill, the machine will designate $1 as the target note and will deliver $1 bills into pocket 1 until encountering the first non-$1 bill. The first non-$1 bill, which may for example be a $5 bill, will then be off-sorted into pocket 2. According to one embodiment, the machine then continues to process notes, delivering $1 bills into pocket 1 and $5 bills into pocket 2, until encountering the next denomination change (i.e., a bill other than a $1 or a $5). Thereafter, upon encountering the next denomination change, such as a $10 bill, the $10 bills are designated as the new target 2 denomination and the system halts so that pocket 2 may be cleared. When the system resumes operation, the machine continues to process notes, delivering $1 bills into pocket 1 and $10 bills into pocket 2, until encountering the next denomination change (i.e., a bill other than a $1 or a $10), and so on.

4. Sort 4 (SRT 4)

In "Sort 4" mode, the discriminator will process a stack of notes and place notes having a target denomination into pocket 1. All other notes are delivered to pocket 2. Thus, upon the occurrence of the "denomination change" condition, the system will off-sort the flagged note into pocket 2. The system then continues processing any remaining bills without stopping. According to one embodiment, only notes having the target denomination (pocket 1) are counted while all non-target notes are simply delivered to pocket 2 without being counted.

Upon encountering other minor errors such as "no call", "suspect document", and "separate series", the machine may be programmed to stop, presenting the flagged bills into one of the pockets such as pocket 2. Alternatively, the machine may be programmed to effectively ignore one or more of the minor errors such as "no call", "suspect document", and "separate series" and to simply off-sort such bills to pocket 2 and continue processing any remaining bills. For example, the system may be set-up to simply off-sort into pocket 2 and continue processing bills upon encountering a "no call" or "separate series" note while stopping and presenting any "suspect documents" into pocket 2. Thus in this example, the machine will quickly process an entire stack of bills, separating bills of a target denomination from all other notes in the stack. Apart from major errors and "stacker full" or "strap limit" conditions, the machine would only stop if a suspect document is encountered.

"Stacker full" or "strap limit" conditions may be handled by stopping and waiting for the operator to clear one or both pockets. Major errors are handled as discussed above (see e.g., discussion of the stranger 2 mode).

5. Sort Facing (SRT F)

"Sort Facing" mode is substantially similar to "Stranger Facing" mode, the primary difference being the configuration of the stack of notes prior to processing. In "Sort Facing" mode, the stack of notes is generally pre-sorted into one or more groups of notes, each group being faced in a different direction, but each note within a given group facing the same direction and having the same denomination as other notes in that group, whereas in "Stranger Facing" mode, each note in the stack is expected to be faced in the same direction and have the same denomination. Thus, in "Sort Facing" mode, the discriminator will process the stack and place notes of a target denomination faced in a target direction into pocket 1. Upon encountering a target denomination but reverse-faced note (i.e., a reverse-faced condition), the machine will either present the flagged note into pocket 1 or off-sort the flagged note into pocket 2. When the reverse-faced target note is off-sorted to pocket 2, the machine may either present this note into pocket 2 or continue processing notes. The system may permit the operator to select how these bills are to be handled via a set-up option (e.g., present into pocket 1, present into pocket 2, or off-sort into pocket 2 and continue).

Upon encountering other minor errors such as "no call", "suspect document", and "separate series", the machine will stop, presenting the flagged bills into one of the pockets. "Stacker fill" or "strap limit" conditions may be handled by stopping and waiting for the operator to clear one or both pockets. The "strap limit" may be set up on a pocket by pocket basis or based on the combined contents of pockets 1 and 2. Major errors are handled as discussed above (see e.g., discussion of the stranger 2 mode).

6. Sort Orientation (SRT O)

"Sort Orientation" mode is substantially similar to "Stranger Orientation" mode, the primary difference being the configuration of the stack of notes prior to processing. In "Sort Orientation" mode, the stack of notes is pre-sorted into one or more groups of notes, each group being oriented in a different direction, but each note within a given group having the same denomination and being oriented the same as other notes in that group. The discriminator will process the stack and place notes having the target denomination and being oriented in a target direction into pocket 1. Upon encountering a target denomination but reverse-oriented note (i.e., a reverse-oriented condition), the machine will either present the flagged note into pocket 1 or off-sort the flagged note into pocket 2. When the reverse-oriented target note is off-sorted to pocket 2, the machine may either present this note into pocket 2 or continue processing notes. The system may permit the operator to select how these bills are to be handled via a set-up option (e.g., present into pocket 1, present into pocket 2, or off-sort into pocket 2 and continue).

Upon encountering other minor errors such as "no call", "suspect document", and "separate series", the machine will stop, presenting the flagged bills into one of the pockets. "Stacker full" or "strap limit" conditions may be handled by stopping and waiting for the operator to clear one or both pockets. The "strap limit" may be set up on a pocket by pocket basis or based on the combined contents of pockets 1 and 2. Major errors are handled as discussed above (see e.g., discussion of the stranger 2 mode).

7. Sort Series (SRT S)

In "Sort Series" mode, the discriminator will process a stack of notes and place notes of a target series or group of series into pocket 1. Upon the occurrence of the "separate series" condition (e.g., upon encountering a note not having the target series), the system will off-sort the flagged note into pocket 2. The system may be programmed to stop or not to stop after encountering non-target notes, i.e., "separate series" notes. Alternatively, upon the occurrence of the "separate series" condition, the system may "present" the flagged note into pocket 1 and stop to allow the operator to inspect the note.

a. Update Pocket 2 Target—Denomination and Series

For example, in an embodiment in which the discriminator automatically selects the target series and denomination, if the first note in the stack is a 1996-series $100 bill, the machine will designate 1996-series $100 bills as the target note and will deliver 1996-series $100 bills into pocket 1 until encountering the first non-1996-series $100 bill. The first non-1996-series $100 bill, which may, for example, be a 1995-series $5 bill, will then be off-sorted into pocket 2. According to one embodiment, the machine then continues to process notes, delivering 1996-series $100 bills into pocket 1 and 1995-series $5 bills into pocket 2, until encountering the next separate series condition (i.e., a bill other than a 1996-series $100 or a 1995-series $5). Thereafter, upon encountering the next separate series condition, such as a 1995-series $10 bill, the 1995-series $10 bills are designated as the new target 2 series and the system halts so that pocket 2 may be cleared. When the system resumes operation, the machine continues to process notes, delivering 1996-series $100 bills into pocket 1 and 1995-series $10 bills into pocket 2, until encountering the next separate series condition (i.e., a bill other than a 1996-series $100 or a 1995-series $10), and soon.

b. Update Target 1—Denomination and Series

According to another embodiment in which target notes are defined in terms of series and denomination and in which the discriminator automatically selects the target series and denomination, if the first note in the stack is a 1996-series $100 bill, the machine will designate 1996-series $100 as the target series and denomination and will deliver 1996-series $100 bills into pocket 1 until encountering the first non-1996-series $100 bill. The first non-1996-series $100 bill, which may for example be a 1995-series $5 bill, will then be "presented" into pocket 1. The operator may then remove all 1996-series $100 bills from pocket 1 and then select an appropriate continuation key. The machine will then designate 1995-series $5 as the new target note and will proceed to deliver 1995-series $5 bills into pocket 1 until encountering the first non-1995-series $5 bill, and so on until the entire stack has been processed. If a note in the remainder of the stack is not a 1995-series $5 bill, then a separate series error will occur and the machine will present the non-1995-series $5 bill into pocket 1, and so on. According to another embodiment, after a separate series note is presented into pocket 1, the machine restarts automatically when the operator removes all the bills from pocket 1. The operator may then separate the bills by denomination and series (e.g., place all 1996-series $100 bills into one stack and the last 1995-series $5 bill into its own stack). Minor errors such as "no calls" and "suspect documents" may be presented in pocket 2 or off-sorted into pocket 2 with the machine continuing to process bills.

c. Update Pocket 2 Target—Series

According to another embodiment, target notes are defined only by series or group of series regardless of denomination. According to one embodiment, notes having a target series (target 1) are delivered to pocket 1. Upon encountering a first separate series condition, the series of the first non-target 1 note is designated as a target 2 series (target 2). Target 2 notes are then off-sorted into pocket 2 without causing the machine to stop. The machine continues to process notes, delivering target 1 notes to pocket 1 and target 2 notes to pocket 2, until the first note having a series other than target 1 series or target 2 series is encountered. At this point this third series note is designated as the "new" target 2 series and is directed toward pocket 2. According to one embodiment this third series note is delivered to pocket 2 and the machine is stopped with the display indicating a series change in pocket 2. The operator can then take the appropriate action such as removing all notes in pocket 2 (e.g., in an automatic restart configured set up) or remove all bills other than the third series bill and press a continuation key. The machine will then continue processing notes, continuing to deliver original target 1 notes to pocket 1 and delivering "new" target 2 notes to pocket 2, until encountering a bill having a series other than target 1 or the current target 2. At this point, a separate series condition occurs as described above and a new target 2 series is designated.

According to another embodiment, when a new target 2 note is encountered, the transport mechanism stops before the new target 2 note is delivered into the second output receptacle and a series change in pocket 2 message is displayed. In this manner, when the machine stops, all the bills in pocket 2 have the same series. The operator may then remove all the bills in pocket 2 and set them aside. Depending on the set up, the machine may either resume operation automatically or resume upon the selection of a continuation key. When the machine resumes, the new target note 2 is delivered into the now empty pocket 2 and the machine continues processing bills until encountering a "new" target note 2 series.

Upon encountering other minor errors such as "no call" and "suspect document", the machine will stop, presenting the flagged bills into one of the pockets. "Stacker full" or "strap limit" conditions may be handled by stopping and waiting for the operator to clear one or both pockets. Major errors are handled as discussed above (see e.g., discussion of the stranger 2 mode).

For example, in an embodiment in which the discriminator automatically selects the target series, if the first note in the stack is a 1996-series $100 bill, the machine will designate 1996-series bills as the target series and will deliver all 1996-series bills into pocket 1 until encountering the first non-1996-series bill. The first non-1996-series bill, which may for example be a 1995-series $5 bill, will then be off-sorted into pocket 2. According to one embodiment, the machine then continues to process notes, delivering 1996-series bills into pocket 1 and 1995-series bills into pocket 2, until encountering the next separate series condition (i.e., a bill other than a 1996-series or a 1995-series note). Thereafter, upon encountering the next separate series condition, such as a 1993-series $20 bill, 1993-series bills are designated as the new target 2 series and the system halts so that pocket 2 may be cleared. The machine then continues to operate in a similar manner as described in the paragraph entitled "Update Pocket 2 Target—Denomination and Series."

d. Update Target 1—Series

According to another embodiment in which target notes are defined only by series or group of series regardless of denomination and in which the discriminator automatically selects the target series and denomination, if the first note in the stack is a 1996-series $100 bill, the machine will designate 1996-series as the target series and will deliver all 1996-series bills into pocket 1 until encountering the first non-1996-series bill. The first non-1996-series bill, which may for example be a 1995-series $5 bill, will then be "presented" into pocket 1. The machine then continues to operate in a similar manner as described in the above paragraph entitled "Update Target 1—Denomination and Series" designating 1995-series notes as the new target series. Minor errors such as "no calls" and "suspect documents" may be presented in pocket 2 or off-sorted into pocket 2 with the machine continuing to process bills.

According to another embodiment, target series are defined by series or group of series without regard to denomination. Moreover, factory default or user defined series categories may be defined. For example, a "new series" group may be defined to include all bills having a series of 1996 or later. This group may include for example, 1996-series $100s and 1997-series $50s and $20s). An "old-series" group may be defined as all other bills. Alternatively, a "series 1" group may be defined to include, for example, all 1996-series and later $100s, all 1997-series and later $50s and $20s, and all $1s, $2, $5, and $10 regardless of series). Likewise, an accompanying "series 2" group may be defined to include all pre-1996-series $100s and all pre-1997-series $50s and $20s. Using series 1 or series 2 in one of the above described series mode embodiments will permit the separation of all "old" series $100s, $50s, and $20s from all other bills. Such an embodiment facilitates in the culling of all bills that are to be removed from circulation. As additional "new" series bill enter circulation (e.g., a 1999-series $10 bill), the definitions of series 1 and series 2 may then be modified so that all bills that are to be removed from circulation may be easily culled from all other bills.

For example, a series group (Series A) may be defined as all bills having a series of 1995 or later. According to one embodiment, Series A is designated as the target series and all Series A notes are delivered to pocket 1 and all non-Series A bills are off-sorted to pocket 2. The machine may or may not be programmed to halt when a non-Series A note is encountered. Where the machine is not programmed to halt, a stack of bills may be quickly processed and separated into a group consisting of all 1995 and later series notes (pocket 1) and all pre-1995 series notes (pocket 2).

C. Mixed Modes

Generally speaking, mixed modes are designed to accommodate a stack of notes having a "mixed" configuration, e.g., including two or more denominations of notes in no particular order, where the operator desires to determine the number or aggregate value of notes of each respective denomination and/or the number or aggregate value of notes in the stack. Mixed modes "Mix 1", "Mix 2", "Mixed Facing" and "Mixed Orientation", each of which will be described below. As with stranger and sort modes, the discrimination system may include a display to indicate the number or aggregate value of notes of each respective denomination and/or the number or aggregate value of notes in the stack.

1. Mixed 1 (Mix 1)

In "Mix 1" mode, the discriminator will process the stack of mixed notes and will generally place the notes into pocket 1. However, upon the occurrence of the "no call" or "suspect document" condition, the discriminator will flag the note and either present the flagged note into pocket 1 or off-sort the flagged note into pocket 2. The system may permit the operator to select how these bills are to be handled via a set-up option (e.g., present into pocket 1, present into pocket 2, or off-sort into pocket 2 and continue).

A "Stacker full" condition may be handled by stopping and waiting for the operator to clear the full pocket. Major errors are handled as discussed above (see e.g., discussion of the stranger 2 mode).

2. Mixed 2 (Mix 2)

In "Mix 2" mode, as in "Mix 1" mode, the discriminator will process the stack and begin placing notes into pocket 1 until encountering a "no call" or "suspect document" condition, in which case the discriminator will flag the note and present the flagged note into either pocket 1 or pocket 2. The system may permit the operator to select how these bills are to be handled via a set-up option (e.g., present into pocket 1 or present into pocket 2).

Upon encountering the "stacker fill" condition, however, the machine will not stop, as in "Mix 1" mode, but instead will automatically begin delivering the notes to pocket 2. Thereafter, upon encountering the "stacker full" condition in pocket 2, the machine will again switch pockets and begin delivering bills into pocket 1 if pocket 1 has been cleared by the operator. If pocket 1 has not been cleared and the "stacker full" condition thereby exists in both pockets 1 and 2, the machine will stop, requiring the operator to remove the bills from either pocket 1 or pocket 2 before continuing.

Major errors are handled as discussed above (see e.g., discussion of the stranger 2 mode).

3. Mixed Facing (Mix F)

In "Mixed Facing" mode, the discriminator will process a stack of mixed notes and place notes faced in a target direction into pocket 1. Upon encountering a reverse-faced note, the machine will either present the reversed-faced note into pocket 1 or off-sort the reverse-faced note into pocket 2. The system may permit the operator to select how these bills are to be handled via a set-up option (e.g., present into pocket 1, present into pocket 2, off-sort into pocket 2 and continue).

Upon encountering a "no call" or "suspect document" condition, the discriminator will flag the note and either present the flagged note into pocket 1 or off-sort the flagged note into pocket 2. The system may permit the operator to select how these bills are to be handled via a set-up option (e.g., present into pocket 1, present into pocket 2, off-sort into pocket 2 and continue). Where reverse-faced notes are being off-sorted into pocket 2 without causing the machine to halt, no calls and suspect documents should be presented into either pocket 1 or pocket 2.

The machine will stop, requiring the operator to remove the bills from the appropriate pocket before continuing, upon encountering a "stacker full" condition. Major errors are handled as discussed above (see, e.g., discussion of the stranger 2 mode).

4. Mixed Orientation (Mix O)

In "Mixed Orientation" mode, the discriminator will process a stack of mixed notes and place notes oriented in a target direction into pocket 1. Upon encountering a reverse-oriented note, the machine will either present the flagged note into pocket 1 or off-sort the flagged note into pocket 2. The system may permit the operator to select how these bills are to be handled via a set-up option (e.g., present into pocket 1, present into pocket 2, off-sort into pocket 2 and continue).

Upon encountering a "no call" or "suspect document" condition, the discriminator will flag the note and either present the flagged note into pocket 1 or off-sort the flagged note into pocket 2. The system may permit the operator to select how these bills are to be handled via a set-up option (e.g., present into pocket 1, present into pocket 2, off-sort into pocket 2 and continue). Where reverse-oriented notes are being off-sorted into pocket 2 without causing the machine to halt, no calls and suspect documents should be presented into either pocket 1 or pocket 2.

The machine will stop, requiring the operator to remove the bills from the appropriate pocket before continuing, upon encountering the "stacker full" condition. Major errors are handled as discussed above (see e.g., discussion of the stranger 2 mode).

D. Count Mode (CNT)

"Count Mode" is designed to accommodate a stack of notes in any configuration, where the operator desires to determine the number or total value of notes in a stack. The discriminator will process the stack, placing notes into pocket 1 until encountering a "stacker full" or "strap limit" condition, in which case the discriminator will automatically begin to place the notes into pocket 2. Thereafter, upon encountering the "stacker full" or "strap limit" condition in pocket 2, the machine will again switch pockets and begin delivering bills into pocket 1 if pocket 1 has been cleared by the operator. If pocket 1 has not been cleared and the "stacker full" or "strap limit" condition thereby exists in both pockets 1 and 2, the machine will stop, requiring the operator to remove the bills from either pocket 1 or pocket 2 before continuing. Count mode may operate in either a unit mode or a value mode. In the unit mode, notes are simply counted and the total number of notes is communicated. In the value mode, the values of notes are totaled and the total value is communicated. Likewise, strap limits may be defined in terms of a unit or piece count (e.g., 100 notes) or in terms of a total value (e.g., $200 notes in notes).

The machine will also stop, requiring the operator to remove the bills from the appropriate pocket, upon encountering a "suspect document" condition. Major errors are handled as discussed above (see, e.g., discussion of the stranger 2 mode).

FIGS. 38 and 39 summarize some embodiments of the above described modes. For example, in Stranger 1 mode (STR 1), bills having a target denomination are delivered into pocket 1. Chains (C), Jams (J), and Doubles (D) cause the machine to halt with chain, jammed, and doubled bills being directed to pocket 1. Also, strap limits (SL) and stacker full (SF) errors in pocket 1 cause the machine to halt. Strangers (S), No Calls (NC), Separate Series (SS), and Suspect (SD) bills may be optionally directed to either pocket 1 or pocket 2 depending on user selections.

Figure 30:
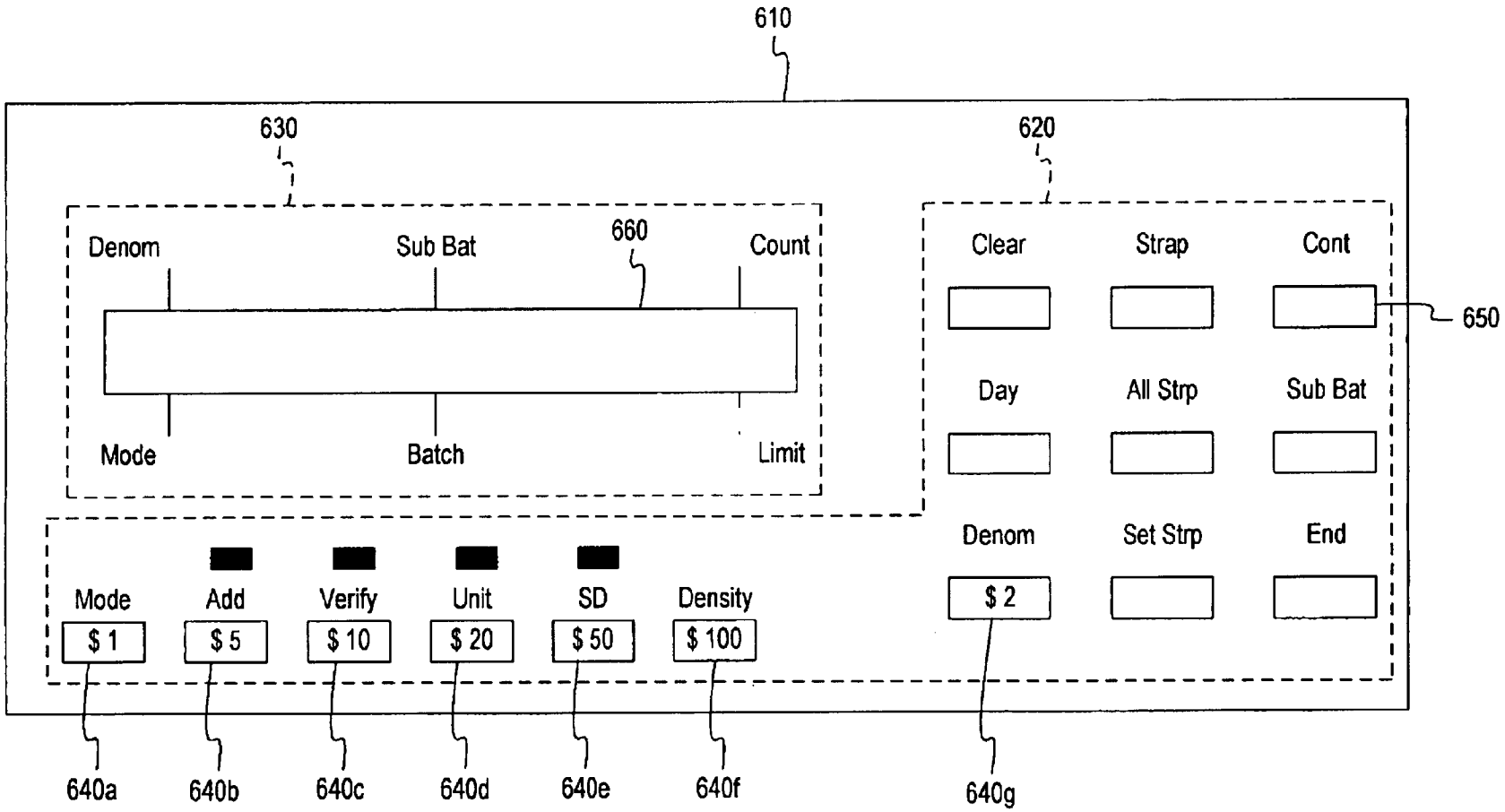
FIG. 30 is a front view of a control panel according to one embodiment of the present invention.

Each of the above operating modes is designed to be selectively activated, either individually or in combination, by an operator. In one embodiment of the present invention, the operating modes may be activated through a control panel. FIG. 30 is a front view of a control panel 610 according to one embodiment of the present invention. The control panel 610 comprises a keypad 620 and a display section 630. The keypad 620 comprises a plurality of keys including seven denomination selection elements 640*a*–640*g*, each associated with one of seven U.S. currency denominations, i.e., $1, $2, $5, $10, $20, $50, and $100. For foreign bill discriminators, the denomination selection elements may be labeled according to the currency system which a discriminator is designed to handle, and accordingly, there may be more or less than seven denomination selection elements. The $1 denomination selection key 640*a* also serves as a mode selection key. The keypad 620 also comprises a "Continuation" selection element 650. Various information such as instructions, mode selection information, authentication and discrimination information, individual denomination counter values, and total batch counter value are communicated to the operator via an LCD 660 in the display section 630.

According to another embodiment, a touch screen is employed to display selection elements for selection by the operator as well as to display various messages to the operator including status and error conditions. Additionally, the touch screen input/output device may be employed to provide on-line help information to the operator, for example, to explain an operation feature or how to handle a given error condition. An example of a touch screen is described in more detail in U.S. Pat. No. 6,311,819 B1 (incorporated by reference above).

As described briefly above, one of the functions of the touch screen display is to display selection elements which may be selected by touching the portion of the screen associated with the selection element. The touch screen thereby serves in one respect as a "keyboard", wherein the selection elements displayed on the screen represent "keys" that are activated by touching the associated area of the screen. Alternatively, it will be appreciated that a conventional keyboard may be used instead of or in addition to the touch screen keyboard to facilitate selection of various selection elements. At any rate, in embodiments using a touch screen, the touch screen display may display not only selection elements or "keys", but also may display messages to the operator including status and error conditions of the discrimination system. Preferably, the configuration of the touch screen display is programmably changeable between several configurations, so that at any given time the touch screen will display only those "keys" or status and error conditions that are appropriate with respect to the present status of the discrimination system. For example, the touch screen may display a series of "menus" or "sub-menus", each menu being associated with a particular mode of operation or status of the discrimination system and thereby including only those keys or display conditions appropriate to the particular mode or status of the discrimination system. The menu-driven approach is designed to simplify the "keyboard" for operators and reduce training times accordingly. The touch screen display may be programmed via computer software including set-up software, operation software and diagnostic software.

Set-Up Information

The set-up software is designed to enable the operator to customize various operating parameters and engage or disengage various features of the discrimination system. The operating parameters may include, for example, default settings, stopping conditions, off-sort modes, pocket settings, denomination keys, stranger records or communications port settings. For example, a set-up mode may permit the user to identify which pocket is to receive no calls, suspect documents, mis-faced and mis-oriented documents, strangers, denomination changes, doubles, and chains or other bills or documents causing other types of minor or major errors. This information may be retrieved from the user via a routing interface having a data retrieval device such as a touch-screen. Alternatively, the data retrieval device may be some other kind of input or input/output device such as a keypad, buttons, or switches. Likewise, the set-up mode may permit the user to define which pockets are to receive which kinds of documents and whether the system should stop upon the occurrence of various events, e.g., various minor errors. Information concerning whether the system should stop upon the occurrence of one or more of the above conditions may be retrieved from the user via a flagging control interface having a flagging data retrieval device such as a touch-screen. Alternatively, the flagging data retrieval device may be some other kind of input or input/output device such as a keypad, buttons, or switches. The flagging control interface may be combined with the routing interface. Likewise the same touch-screen or input device may be used both to retrieve data concerning to which pockets various bills are to be directed as well as whether the system should stop upon the occurrence of one or more events such as the occurrence of one or more types of minor errors. The features of the discrimination system which may be engaged or disengaged in the set-up mode include operating modes, operating keys, sub-batching, suspect document authentication tests, stranger records, separate series discrimination, and/or audio alarms.

As described generally above, in a touch screen embodiment, the above-described operating features may be activated by touching selection elements or "keys" in respective "menus" associated with the operating features. Thus, in the set-up mode, the discrimination system may include the following:

(1) a key or keys which allows the customization of user-default settings or the selection of a factory default setting;

(2) a key which engages or disengages sub-batching;

(3) a key or keys which engage or disengage the operating modes, e.g., STR 1, STR 2, STR F, STR O, SRT 1, SRT 2, SRT 3, SRT F, SRT O, Mix 1, Mix 2, MIX F, MIX O and Count;

(4) a key or key which engages or disengages the operating keys "Verify" (permits the machine to process bills without affecting existing totals), "Unit" (toggles between unit and value modes), "SD", "Density", "Add" (toggles between maintaining running totals and clearing running totals when the input hopper and both output pockets are cleared) or "Mode";

(5) a key or keys which engages or disengages the audio alarms for the various error conditions, e.g., Jam (J), Doubles (D), Chain (C), Stranger (S), Denomination Change (DC), No Call (NC), Suspect Document (SD), Separate Series (SS), Strap Limit (SL), or Stacker Full (SF);

(6) a key or keys which sets the use of denomination keys for the minor errors of no call (NC) and suspect document (SD);

(7) a key or keys which sets a stranger record (i.e., sets whether the system should "record" or reflect in the appropriate counters the denomination/value of stranger notes);

(8) a key for enabling or disabling the SD minor error condition;

(9) a key for enabling or disabling the SS minor error condition;

(10) a key or keys for setting the configuration of communication ports;

(11) a key or keys for setting pockets for target notes, either manually or automatically;

(12) a key or keys for enabling or disabling the "off-sort" function or customizing stopping conditions related to the off-sort function (e.g., present into pocket 1, present into pocket 2, off-sort and continue); and

(13) a key or keys for engaging or disengaging the "Face" and "Right" keys (the "Right" key is a forward/reverse orientation key).

When engaged in the set-up mode, pressing the "Face" key gives the user the ability to quick-face a stack of bills. The machine will deliver face-up bills to pocket 1 and face-down bills to pocket 2. Similarly, pressing the "Right" key gives the user the ability to quick-right a stack of bills. The machine will deliver "readable" bills, e.g., wherein the words of the bill are right-side-up, to pocket 1 and non-readable bills, e.g., wherein the words of the bill are upside-down, to pocket 2. Accordingly, the "Right" key causes bills having a forward orientation to be delivered to one pocket while causing bills having a reverse orientation to be delivered to the other pocket.

Operation Screens

Figure 31:
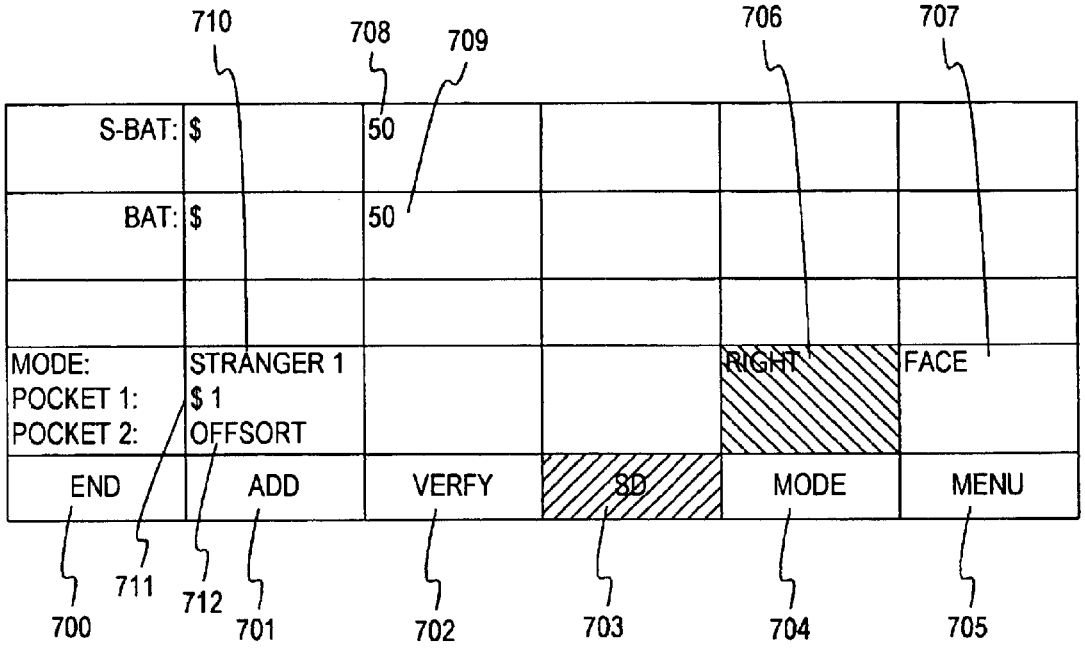
FIG. 31 illustrate an example of a touch screen display according to various embodiments of the present invention.

The operating software is designed to provide the operator with a series of menus or screens, each screen generally being associated with one or more modes of operation, e.g., STR 1, STR 2, etc. As described above, in a touch screen embodiment, each of the screens include selection elements or "keys" which the operator may touch to activate appropriate functions related to the operating mode or status of the discriminator. The screens are further designed to display messages to the operator related to the operating modes such as, for example, batch or sub-batch totals and status or error conditions. Preferably, the touch screen at any given time will display only those "keys" or status and error conditions that are associated with the present status of the discrimination machine. FIG. 31 represents a "crossroad" or "main" touch screen associated with the a machine operating in "Stranger 1" (STR 1) mode. The hatched keys represent functions that are engaged. The touch screen contains the following keys and displays:

| | |
|---|---|
| END (700) | This key ends either a sub-batch (by pressing once) or a batch (by pressing twice). |
| ADD (701) | This key engages or disengages the Add function. |
| VERFY (702) | This key allows for Verify mode operation. |
| SD (703) | This key engages or disengages the Suspect Document (SD) minor error condition. |
| MODE (704) | This key engages the operating modes. |
| MENU (705) | This key enables the operator to view totals, set strap limits, and SD and Density thresholds. |
| RIGHT (706) | This key enables the operator to quick-right a stack of bills when this function is enabled in the set-up mode. |
| FACE (707) | This key enables the operator to quick-face a stack of bills when in this function is enabled in the set-up mode. |
| S-BAT display (708) | This displays aggregate totals associated with a sub-batch of currency bills. |
| BAT display (709) | This displays aggregate totals associated with a batch of currency bills. |
| MODE display (710) | This displays the selected mode of operation of the machine. |
| POCKET 1 display (711) | This displays the target note associated with pocket 1. |
| POCKET 2 display (712) | This displays the notes associated with pocket 2. |

Additional discussion of examples of operating screens and their use is described in more detail in U.S. Pat. No. 6,311,819 B1 (incorporated by reference above).

While many of the above embodiments have been described in conjunction with U.S. currency, systems according to the present invention may alternatively or additionally process currency of other countries such as the United Kingdom, France, Germany, Japan, Spain, Canada, Italy, Brazil, Mexico, Taiwan, and Saudi Arabia. Likewise, the above systems may support the processing of multiple types of documents including, for example, checks, deposit slips, header documents, etc.

Additionally, the systems described above may contain fitness sensors such as density sensors, reflectance sensors, magnetic sensors, correlation, UV and soil sensors, tear detectors, etc. Also the systems may utilize flash memory as mentioned above and $E^2$ proms for reliable storage of data and set ups.

Additionally, the systems described above may contain unique customization features such as user-defined keys, user-defined print outs, user-defined modes of operation, user-defined document distribution parameters, user-defined set-ups. The customization features may be controlled or changed through simple input though an interface device such as a keyboard or touch screen.

User Customization

As described above and as to be further described below, according to embodiments of the present invention, the system permits the user or operator to customize the operation of the machine in a number of ways. For example, in the above described modes of operation, the user may be permitted to designate into which pocket certain bills are delivered and whether the machine should stop, e.g., deliver any no calls into pocket 2 and stop the machine after each no call is delivered to pocket 2. Additional examples of how the user may customize a system according to the present invention are described in connection with FIGS. 32–37. FIGS. 32–37 illustrate examples of displays designed to aid the operator in tailoring the operation of the machine according to the operator's preferences. These figures illustrate displays that may be used to aid in retrieval of routing and flagging information from a user such as via a routing interface having a data retrieval device such as a touch-screen. Alternatively, the data retrieval device may be some other kind of input or input/output device such as a keypad. Additionally or alternatively, information concerning whether the system should stop upon the occurrence of one or more conditions may be retrieved from the user via a flagging control interface having a flagging data retrieval device such as a touch-screen. Alternatively, the flagging data retrieval device may be some other kind of input or input/output device such as a keypad. The flagging control interface may be combined with the routing interface into a single interface system.

FIG. 32 illustrates an example of an operating parameters selection screen in which no selections have been made. The left-hand column (C1) lists various features and conditions for which the operator may make selections. The right-hand column (C3) lists the available selection choices or options associated with each feature or condition and the middle column (C2) displays the selected option for each feature or condition (in FIG. 32 no selections have been made).

Turning to FIG. 33, an example of the operating parameters selection screen for a Stranger Facing mode is illustrated. In general, options which are not available are displayed in a non-highlighted or dim manner, illustrated in FIG. 33 via striking through unavailable options, e.g., the "OFF" and "ALL" selection choices for the Target 1denomination. Based on the selections displayed in FIG. 33, the system will deliver to pocket 1 bills having the same denomination and face orientation as the first bill in a stack. This is evident with reference to box C2,R1 which designates the target denomination as that of the "1st BILL". Additionally, box C2,R2 designates a target face orientation as the face orientation of the "1st BILL". Neither forward/reverse orientation ("orientation") nor "series" has been activated so bills are not distinguished on those bases. With respect to the designation of the Target 1 denomination, the operator may change the selection from "1st BILL" to a specific denomination, $1–$100 or to User Select (US). If User Select is chosen, at the time the mode is invoked, the operator will be prompted as to the desired selection. In the case of selecting a denomination, any available option may be chosen such as "1st BILL" or a specific denomination. This may be accomplished, for example, by pressing the screen in box C2,R1 in a touch screen environment which will cause the displayed selection to scroll through the available options. Likewise, with respect to the designation of the target face orientation, the operator may scroll through the options of "1st BILL", "FACE UP", "FACE DOWN", and "US". In boxes C3, R1 and C3,R2 the option "OFF" is not available in a Stranger Facing mode.

With respect to forward/reverse orientation, the operator may choose either "OFF", "1st BILL", FORWARD", "REVERSE", or "US". With respect to series selection, the operator may choose either "OFF", "1st BILL", "US", or scroll through any defined series groups such as those described above, e.g., in connection with the Sort Series modes. These series groups may include factory-defined series groups and user-defined groups. Additionally, the operator may be given the option to simply designate a given series or range of series, e.g., "1996+" for all bills of a 1996 or later series or "1990–1996" for all bills having a series from 1990 to 1996.

In box C2,R5, the operator may designate whether the parameters defining Target 1 should be updated upon the occurrence of a relevant condition such as a denomination change, stranger, or separate series condition. The updating may be permitted, for example, for all activated parameters defining a target denomination (e.g., denomination and face orientation in the example of FIG. 33) or alternatively, the user may elect to update only certain ones of the activated parameters (e.g., update upon a stranger condition (new denomination) but not on a reverse face condition). As displayed in FIG. 33, the Target 1 parameters are not updated during the processing of a stack of bills.

In the Stranger Facing modes, the operator is not permitted to designate a second set of target parameters and accordingly this section (C2,R6–C3,R10) of the display is dimmed.

Boxes C2,R11–C2,R19 permit the operator to designate how certain minor error conditions are to be handled, i.e., by presenting the flagged bill in pocket 1 (P1), presenting the flagged bill in pocket 2 (P2), or delivering the flagged bill to pocket 2 and continuing to process any remaining bills (CONT-2).

Additionally, for strangers, denomination changes, and separate series, the operator is also given the option of having the transport mechanism stopped with the flagged bill being maintained within the transport mechanism (ST), i.e., before the flagged bill is delivered into a pocket. Positional information obtained from an encoder may be employed to stop a bill in a controlled manner and so that the bill is stopped in a predetermined position or identifiable location. For example, the transport mechanism may be stopped such that a flagged minor error bill is located after a diverter and before a next diverter or output receptacle such as between diverter 60 and output receptacle 17*b* such as being adjacent to plate 78 of FIG. 26*c*. Alternatively, using the embodiment of FIG. 26*c* as an example, a flagged minor error bill may be stopped before reaching diverter 60 such as being adjacent to plate 62 One embodiment of a stopping mechanism employing an interconnected CPU, optical encoder, transport mechanism, and drive motor is described in U.S. Pat. No. 5,295,196 incorporated herein in its entirety. Likewise on a currency evaluation device having only a single output receptacle such as that describe in U.S. Pat. No. 5,295,196, a flagged minor error bill such as a stranger, denomination change, or separate series bill may be stopped so that it is located at a predetermined or identifiable position within the transport mechanism (i.e., before being transport to the output receptacle).

As illustrated in FIG. 33, stranger bills, no calls, suspect documents, documents having an improper size, and unfit documents are all presented into pocket 2. Additionally, reverse faced notes are delivered to pocket 2 but do not cause the machine to halt operation. Accordingly, bills having the target denomination and target face orientation are delivered into pocket 1 while bills having the target denomination but not the target face orientation are delivered to pocket 2. The error conditions of denomination change, reverse forward-reverse orientation, and separate series have been disabled by the choices selected above, i.e., a denomination change error can not occur in a stranger mode, and by turning off orientation and series selections in boxes C2,R3–C2,R4 orientation and series error conditions will not occur.

Boxes C2,R20–C2,R23 permit the operator to set how stacker full, strap limit, chain, and double error conditions are handled. As illustrated in FIG. 33, the machine will stop upon the occurrence of a stacker full condition. Another option includes switching delivery of target notes to the non-current pocket when the current pocket becomes full provided there are no bills in the non-current pocket. Otherwise the machine will halt until one of the pockets is cleared. Box C2,R21 indicates that strap limits will be counted using the contents of both output pockets, i.e., a strap limit will occur when the combined number of target denomination bills delivered to pocket 1 (having the target face orientation) and target denomination bills delivered to pocket 2 (having a reverse face orientation) reaches the limit associated with the target denomination. When either a chain or a double error condition occurs, the machine stops with any chain or double bills being delivered into pocket 2.

Turning to FIG. 34, an example of the operating parameters selection screen for a Sort 3 mode is illustrated. Here $5 bills (having any face orientation, any forward/reverse orientation, or any series) are delivered to pocket 1 while the first non-$5 bill becomes the second target denomination and is off-sorted into pocket 2. Thereafter $5 bills are delivered to pocket 1 and target 2 denominated bills are delivered to pocket 2. Upon the occurrence of a denomination change, the denomination change bill will be presented into pocket 2 (C2,R12) and the denomination of the flagged bill will become the new target 2 denomination (C2,R10). The target 1 denomination will remain $5 as box C2,R5 indicates that this denomination should not be updated.

Turning to FIG. 35, an example of the operating parameters selection screen for a first user defined mode is illustrated. The system may permit the operator to set a number of personalized operating modes (e.g., user-defined 1, user-defined 2, etc.) Likewise the system may permit user to define the name of the modes, e.g., "Acme Bank Closing Mode", "Acme Bank Commercial Mode"). According to the selections made in FIG. 35, all face up $100 bills having a series of 1996 or later are delivered into pocket 1 while all face down $100 bills having a series of 1995 or earlier are delivered to pocket 2. When any possible minor error listed in rows R11–R19 occurs, the flagged bill is presented in pocket 2.

Information concerning user-defined modes is stored in a memory such as an $E^2$ PROM so that it can be recalled in the future such as on days subsequent to the day that it is original defined. This information is stored in such a manner that it is not lost after the power switch of the currency discriminator is turned off as in a nonvolatile memory. The definition of particular user-defined mode will remain unchanged until it is re-defined by a user of the currency discriminator. In this manner a user may define a mode of operation that is particularly adapted to the needs of the user and repeatedly recall that mode of operation whenever the user desires to operate the machine in that mode. For example, the operate could desire to process a stack of currency bills using one of the factory default modes such as the Mixed 1 mode of operation and then process of second stack of bills using an user-defined mode. In such a case, the operator would first select the factory mode desired such as Mixed 1, process the first stack of bills, then select the desired user-defined mode, and process the second stack of bills. The definitions of the factory-defined or default modes may also be stored in an $E^2$PROM.

Turning to FIG. 36, an example of the operating parameters selection screen for a second user defined mode is illustrated. According to the selections made in FIG. 36, bills of all denominations (as in a mixed mode), are delivered into pocket 1. This is indicated by the selection of "ALL" in box C2,R1. No calls are presented in pocket 1 while suspects, improperly size bills and unfit document are presented in pocket 2. Chains and doubles are directed to pocket 1 and the machine stops.

Turning to FIG. 37, an example of the operating parameters selection screen for a third user defined mode is illustrated. According to the selections made in FIG. 37, bills of all denominations (as in a mixed mode) are delivered into pocket 2. No calls are presented in pocket 2 while suspects, improperly size bills and unfit document are presented in pocket 1. Chains and doubles are directed to pocket 1 and the machine stops.

Now various embodiments of dynamic sorting or assignment methods are described in more detail in conjunction with FIGS. 40–48. The dynamic sorting methods may be used in conjunction with the various devices described above such as those illustrated in and described in conjunction with FIGS. 1*a*–1*c*, 26*a*–26*c*, 27*a*–27*c*, 28, and 29.

Generally a Dynamic Assignment is a quick evaluating method that allows a multi-pocket currency evaluating device, such as the Cummins Multi-Pocket Sorter or variations of the Cummins Multi-Pocket Sorter, to automatically assign a denomination to an "open pocket," which is a pocket that has not had a denomination assigned thereto and which has no currency in it. Exemplary evaluating devices compatible with the invention are described in commonly-owned, co-pending U.S. application Ser. No. 09/635,181, entitled "Method of Creating Identifiable Smaller Stacks of Currency Bills Within a Larger Stack of Currency Bills" which was filed on Aug. 9, 2000, incorporated herein by reference in its entirety, which may be employed in conjunction with the present invention. Likewise, examples of multi-pocket sorters ("MPS") are illustrated in FIGS. 1*a*–1*c*, 26*a*–26*c*, 27*a*–27*c*, 28, and 29.

Embodiments of the Dynamic Assignment method provide fast and efficient results when processing mixed denomination currency. Some embodiments of Dynamic Assignment methods allow the highest volume denominations to be dynamically assigned to the open pockets, and therefore the evaluating device can keep evaluating currency as long as open pockets are available even though one or more pockets has reached its currency bill limit. After all the pockets have been taken (i.e., no open pockets are available) the evaluating device can operate as long as the currency bills being evaluated have the same denominations as the currency bills that have already been evaluated and that are residing in output pockets in which the stack limit has not been reached. Also, after a dynamic pocket is emptied and is open again, a new denomination can be assigned to that pocket. In general, without a dynamic assignment the evaluating device would stop when a pocket or pockets with a fixed assigned denomination reaches a limit.

According to some embodiments a multi-pocket currency discriminator may be provided in which all pockets are fixed pockets but which permit an operator the option to assign more than one pocket for a particular denomination. Such embodiments present at least two problems. One problem is that the assignment of other pockets to one denomination is done at the expense of pockets for other denominations. Another problem is that the operator must anticipate approximately how many currency bills of a particular denomination exist in the batch of currency bills requiring evaluating. Dynamic Assignment operation greatly reduces these and other problems. Furthermore, dynamic parameters, those parameters on which dynamic assignment is made, are not limited to denomination. Other predetermined parameters may be used as dynamic parameters to determine to which pockets currency bills will be delivered, e.g., country, orientation, size, authenticity characteristic, and others, and any combination of parameters may be applied to the currency bills.

Figure 40:
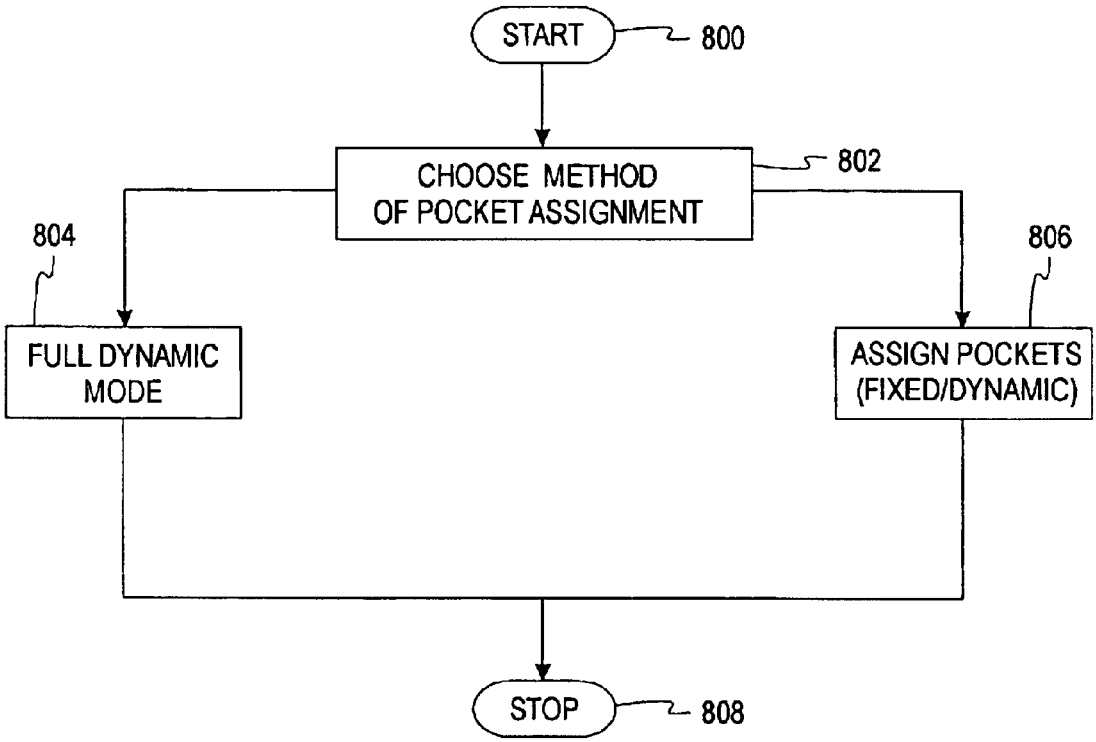
FIG. 40 illustrates a flowchart for making parameter assignments to pockets such as denomination parameter assignments according to one embodiment of the present invention.

Referring to FIG. 40, FIG. 40 illustrates a flowchart for making parameter assignments to pockets such as denomination parameter assignments. Such parameters assignments may be made in setup mode. The process begins at step 800 and the currency evaluation device prompts the operator to choose a method of assignment (802). The currency evaluation device may contain a user interface to provide information to and receive information from an operator of the device. The operator can choose full dynamic assignment (804) or make individual assignment decisions (806) about individual pockets or output receptacles. Once the pocket assignment procedure has been completed, the process ends (808).

By selecting fill dynamic assignment (804) all pockets (or all available pockets) are designated to be dynamic pockets. Embodiments of dynamic pockets will be described in more detail below but generally a dynamic pocket is a pocket which can be assigned to a particular denomination or sorting parameter during normal operation of a currency evaluation device, that is, a denomination or other parameter assignment can be made on-the-fly. For example, a dynamic pocket may be a pocket that does not have a specific denomination pre-assigned to it in which case the evaluating device automatically assigns a denomination to a particular dynamic pocket on-the-fly. After a dynamic pocket has been assigned a denomination the dynamic pocket becomes "temporarily" a fixed pocket, accepting only currency bills of the same denomination as the automatically assigned denomination until the pocket has been cleared so that it becomes once again an open pocket. When the dynamic pocket becomes an open pocket the evaluating device will automatically assign another denomination to the dynamic pocket, as needed, which could be the same or different than the previous denomination that was assigned to the dynamic pocket.

Figure 41:
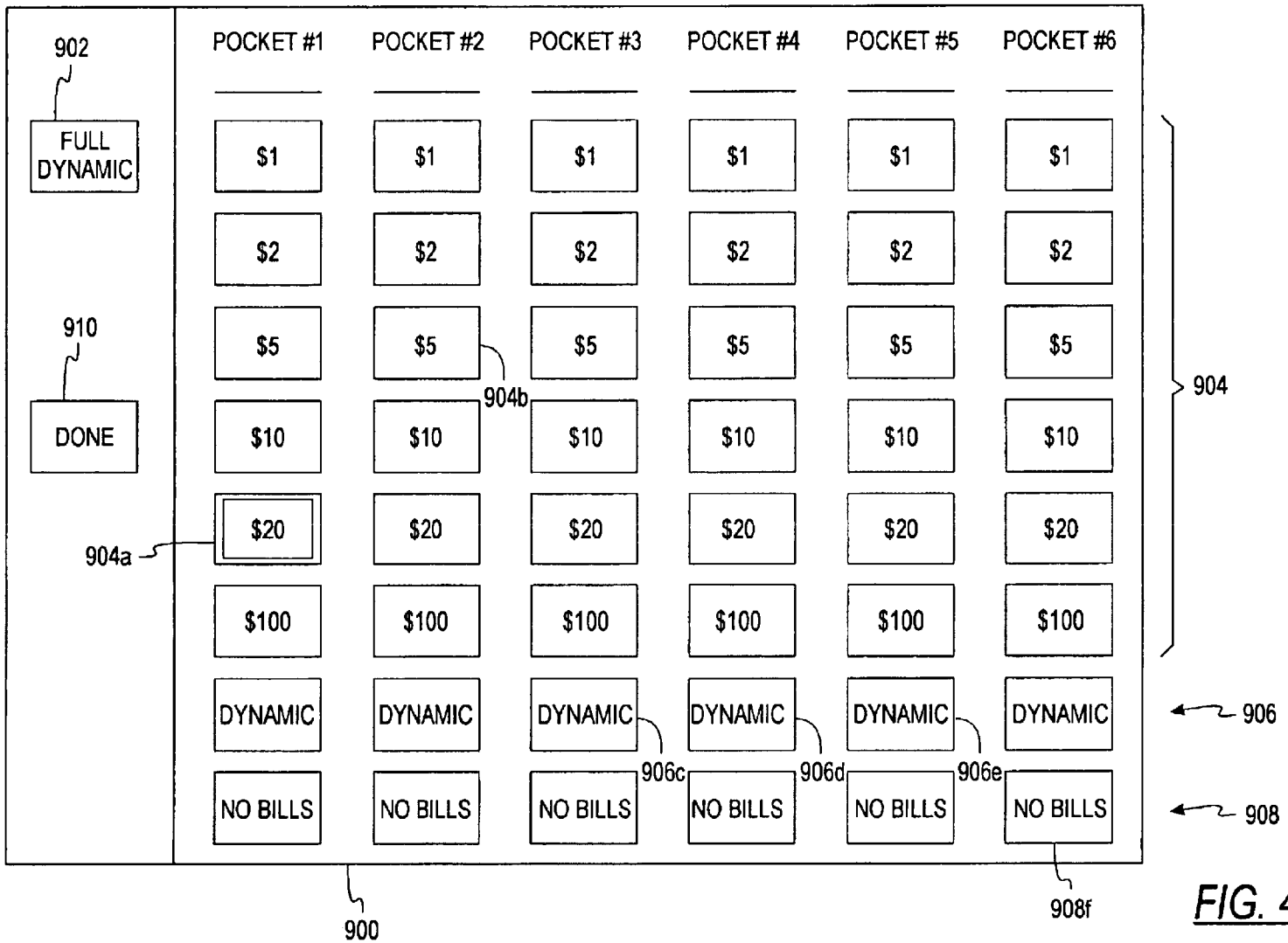
FIG. 41 illustrates one embodiment of a user interface.

The process of making pocket assignment is discussed in more detail in conjunction with FIG. 41 which illustrates one embodiment of a user interface 900. Any of a variety of user interfaces may be utilized. For example, the user interface 900 may be a touch screen, a combination of a display and physical selection elements such as physical keys, buttons, or switches, or may comprise a touch screen and a non-touch display and/or physical keys, buttons or switches. In some embodiments, a touch screen, a non-touch screen display, and/or physical selection elements are mounted directly on the currency evaluation device. In other embodiments, a touch screen, a non-touch screen display, and/or physical selection elements may be physically separate from the currency evaluation device. For example, the display (touch screen or non-touch screen) may be mounted directly on the currency evaluation device and a separate keyboard may be electrically coupled to the currency evaluation device. Likewise the interface may comprise lights and/or buzzers to communicate information to an operator.

The user interface 900 illustrated in FIG. 41 comprises a number of selection elements such as a full dynamic selection element 902, a plurality of denomination assignment selection elements 904, a plurality of dynamic assignment selection elements 906, a plurality of "no bills" assignment selection elements 908 and a "done" selection elements (710). As discussed above, the selection elements may be either physical selection elements or displayed selection elements on a touch screen. For example, user interface 900 may be a touch screen and the selection elements may be displayed keys which can be touched to make various selections.

The user interface 900 is provided with means for an operator to make different parameter assignments for a plurality of output receptacles. In the example shown in FIG. 41, the operator is permitted to designate assignments for six output receptacles, which may correspond, for example, to pockets 116*a*–116*f* of the currency evaluation device 100 illustrated in FIG. 1*a* or the output pockets illustrated in FIG. 1*c*.

A method of indicating pockets assignments will now be discussed in conjunction with FIG. 41. If the operator wishes to make all pockets dynamic pockets, the operator may simply select the full dynamic selection element 902. Alternatively, the operator may achieve the same result by selecting all the dynamic selection elements 906. Of course, full dynamic selection element 902 may be omitted in some embodiments in which case a full dynamic assignment may be made by selection all the dynamic selection elements 906.

The operator may make a pocket to a fixed pocket by selecting an appropriate one of the denomination selection elements 904. For example, the interface permits the operator to make Pocket #1 a $20 bill fixed pocket by selecting selection element 904*a*. When selection element 904*a* has been selected, the operation of the currency evaluation device is controlled, for example, by a processor so that only $20 bills may be transported into Pocket #1. If the operator wishes to assign the $5 denomination to Pocket #2, selection element 904*b* may be selected. Likewise, if the operator desires to designate Pockets #3–#5 dynamic pockets, then selection elements 906*c*–906*e* may be selected. Finally, if the operator desires to turn off Pocket #6 so that no bills are transported into Pocket #6 during normal operation, the operator may select selection element 908*f*. Of course, the option to turn off a pocket may be omitted in some embodiments in which case selection elements 908 may be omitted. In some embodiments, the currency evaluation device may be adapted to automatically turn off one or more of its pockets. This may be done, for example, by disabling the selection elements associated with a particular pocket such as the column of selection elements associated with a non-functional pocket. For example, if a stacking unit in one of the pockets breaks, the device, e.g., via the control of a processor, may turn off that pocket. Such embodiments have the advantage of permitting the currency evaluation device to continue operating using the other, functional output receptacles even when one or more of the pockets become non-functional. This has the advantage of minimizing any interruption of the normal work of a business using the currency evaluation device during the time it tales to get a non-functional pocket repaired.

It is apparent that the user interface 900 of FIG. 41 permits the operator of a currency evaluation device complete flexibility in making pocket assignments. For example, the operator may choose to make all pockets (or all functional pockets) dynamic pockets (e.g., via selection element 902 or selection elements 906)—such an assignment choice is called as a full dynamic assignment. Alternatively, the operator may choose to assigned fixed denomination to all pockets (or all available pockets) (e.g., via choosing from selection elements 904 and not any of the individual dynamic selection elements 906) such an assignment is called a full fixed assignment. Alternatively, the operator may make some pockets fixed while making others dynamic (e.g., via choosing some denomination selection elements 904 and some individual dynamic selection elements 906)—such an assignment is called a dynamic-fixed combination assignment or dynamic-fixed assignment. An example of a fixed-dynamic combination assignment is illustrated in FIG. 44, described in more detail below.

In a "Fixed Assignment" each output pocket, such as output receptacles 106*c*–106*h* shown in FIGS. 1*a*–1*b*, is designated as a fixed pocket which means that the pocket is "fixed" to accept only an operator assigned denomination. Of course, the operator may choose at a later time to change the denomination that is assigned to that particular pocket. The operator may also choose at a later time to change a fixed pocket to a dynamic pocket. However, if the operator chooses to change the denomination that is assigned to a particular pocket without changing any of the fixed pockets to dynamic pockets, the pocket will still be a "fixed" pocket, the only difference being that the denomination that the pocket is "fixed" to accept has changed. For example, each pocket can be assigned one bill denomination: pocket 1 is assigned a $1 denomination, pocket 2 is assigned a $5 denomination, pocket 3 is assigned a $10 denomination, pocket 4 is assigned a $20 denomination, pocket 3 is assigned a $10 denomination, pocket 4 is assigned a $20 denomination, pocket 5 is assigned a $50 denomination, and pocket 6 is assigned a $100 denomination. Accordingly each respective pocket will only accept the particular denomination that it has been assigned. Therefore, if any one pocket becomes full then the evaluating device will stop when another bill having the denomination assigned to the full pocket is encountered, even if there is one or more empty pockets.

Alternatively, the operator may fix the pockets according to any combination that the operator desires. For example, assuming that the operator may know that $1 currency bills comprise 50 percent or more of the currency stack requiring evaluation, then the operator may fix half of the evaluating device's pockets, which would be three pockets according to the previous example, to receive $1 bills. The three pockets assigned to receive $1 bills can be any of the pockets of the evaluating device.

A "Dynamic-Fixed Assignment." is a hybrid assignment that combines the "Full Dynamic Assignment" and the "Fixed Assignment" into one. Some of the evaluating device's pockets will be selected to be dynamic pockets while the others will be fixed pockets. The dynamic pockets will operate according to the "Dynamic Assignment" described above and the fixed pockets will operate according to the "Fixed Assignment" described above. In the "Dynamic-Fixed Assignment" the operator can be given a choice to select preprogrammed alternatives as far as which pockets will be fixed pockets, which will be dynamic pockets, which denomination or denominations will be dynamically assigned, which denomination or denominations will be fixed, and which denomination or denominations will be fixed to which pocket. Alternatively, the operator may be able to fully customize the pocket assignment.

Additionally, in some embodiments of a Dynamic-Fixed Assignment open dynamic pockets may not be accessible to bills having denominations fixed to one or more pockets. For example, if Pocket #1 is fixed to $1 bills and Pockets 2–6 are dynamic pockets and the $1^{st}$ 101 bills are $1 bills, the device will stop operating upon the detection of the $101^{st}$ $1 bill (assuming a stack limit of 100). The device stops even though pockets 2–6 are open dynamic pockets. Likewise, if Pockets 1 and 2 are both fixed to $1 bills, in the above example, the device may continue operating until the denomination of the $201^{st}$ $1 (assuming Pocket 1 was not cleared after becoming full).

Alternatively, in some embodiments of a Dynamic-Fixed Assignment open dynamic pockets may be indicated (e.g., via a user interface) to be accessible to bills having denominations fixed to one or more pockets. According to such an embodiment and using the example for above, if Pocket #1 is fixed to $1 bills and Pockets 2–6 are dynamic pockets and the $1^{st}$ 101 bills are $1 bills, the device will not stop operating upon the detection of the $101^{st}$ $1 bill (assuming a stack limit of 100). Rather the $101^{st}$ $1 bill may be dynamically assigned to Pocket #2.

As discussed above, according to some embodiments, the currency evaluation device may be programmed to permit the operator to choose one of three different ways of assignment: a "Full Dynamic Assignment", a "Dynamic-Fixed Assignment", or a "Fixed Assignment". Means for selecting each way of assignment are provided in the evaluating device, such as a user interface such as a touch screen or other type of control panel. For example, a selection button may allow an operator to choose between "Full Dynamic," "Dynamic-Fixed," and "Fixed" Assignment. If the operator chooses either the "Dynamic-Fixed Assignment" or the "Fixed Assignment"), then the operator has to assign at least one denomination to at least one pocket. Means for assigning a denomination to a fixed pocket are provided in the evaluating device such as, for example, one or more assignment buttons which permit the assignment of a particular denomination to a particular pocket. Alternatively and/or additionally, other sorting criteria may be assigned to particular pockets, e.g., face orientation, country, etc.

Figure 42:
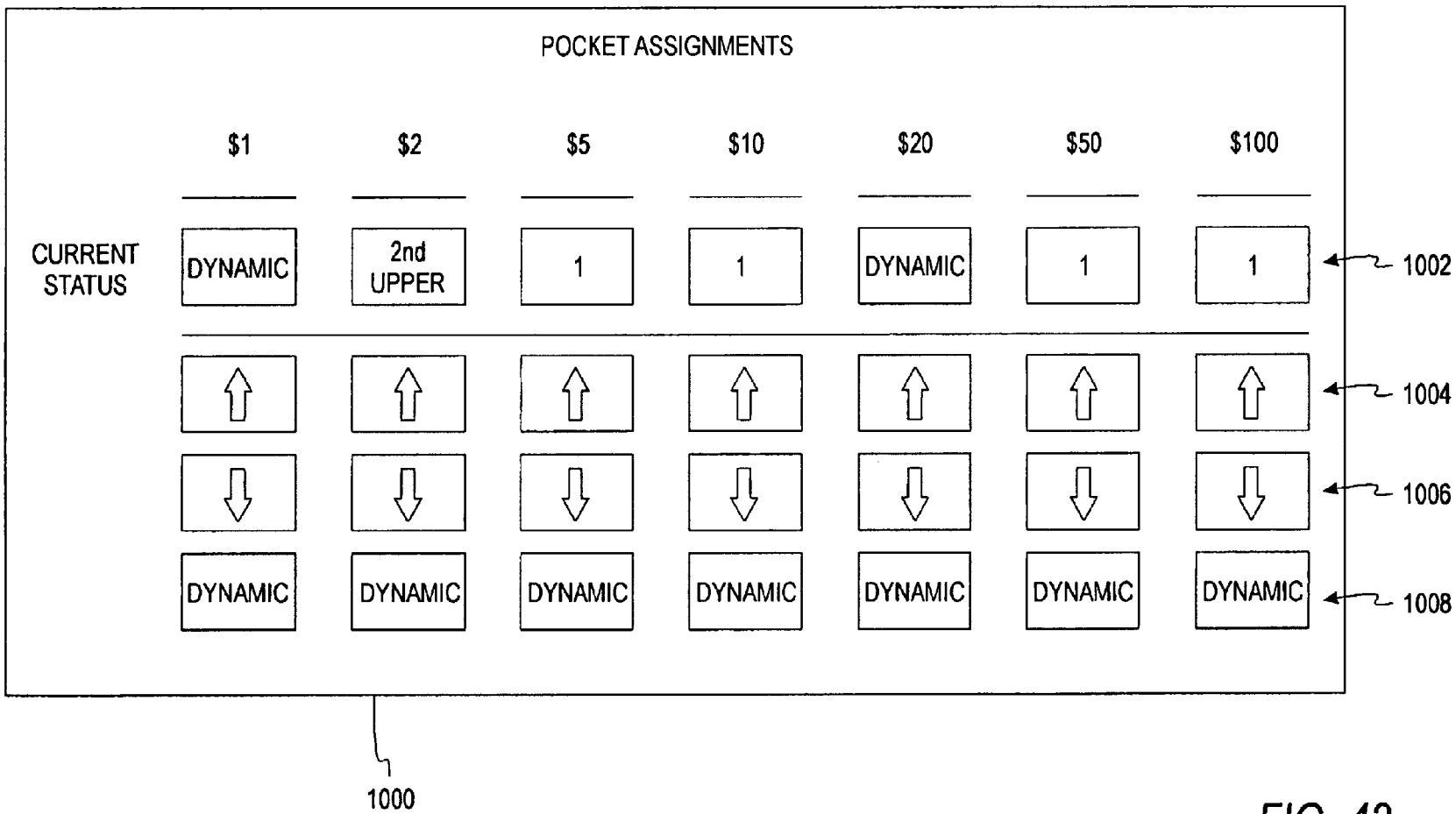
FIG. 42 illustrates an example of a user interface in which dynamic vs. fixed assignments are made on a per denomination basis according to one embodiment of the present invention.

Additionally, according to some embodiments, dynamic/fixed assignment can be made on a per denomination basis. FIG. 42 illustrates an example of a user interface 1000 in which dynamic vs. fixed assignments are made on a per denomination basis. The interface 1000 may be any type of interface as explained above, e.g., touch screen, non-touch screen display and physical selection elements, or a combination thereof. In the example illustrated in FIG. 42, a column is associated with each U.S. denomination. The current pocket assignment is displayed in row 1002. The current pocket assignment can be changed using scroll selection elements 1004 and 1006 or the dynamic selection elements 1008. Selection of a dynamic selection element 1008, designates a corresponding denomination as one that will be dynamically assigned to an available dynamic pocket. The scroll keys 1004 and 1006 may be used to scroll through pockets of the currency evaluation device. For example, in the case of the currency evaluation device shown in FIG. 1*a* or 1*c*, the scroll keys 1004 and 1006 may scroll through a list containing a "$1^{st}$ Upper Pocket" (e.g., 106*a*), a "$2^{nd}$ Upper Pocket" (e.g., 106*b*), a "$1^{st}$ Lower Pocket" or "1" (e.g., 106*c*), a "$2^{nd}$ Lower Pocket" or "2" (e.g., 106*d*), a "$3^{rd}$ Lower Pocket" or "3" (e.g., 106*e*), a "$4^{th}$ Lower Pocket" or "4" (e.g., 106*f*), a "$5^{th}$ Lower Pocket" or "5" (e.g., 106*g*), and a "$6^{th}$ Lower Pocket" or "6" (e.g., 106*h*). Of course, the exact appearance of the user interface 1000 may be modified in any number of ways. For example, "dynamic" could be added to the scroll list and the dynamic selection elements 1008 could then be omitted. Also, the scroll selection elements 1004 or 1006 could be replaced with a "Next" or "Change" selection element. Also, the interface may be adapted to permit a user to assign more than one fixed pocket to a denomination, e.g., the $5 denomination could be fixed to both lower Pockets #1 and #2.

In the example illustrated in FIG. 42, the $1 and $20 denominations are designated to be dynamic denominations, meaning that they can be dynamically assigned to any open dynamic pocket. The $2, $5, $10, $50, and $100 denominations are fixed denominations, meaning they are pre-assigned (via a setup mode) to one or more fixed pockets. In the illustrated case the $2 denomination is assigned to a $2^{nd}$ Upper pocket (e.g., 106*b* in FIG. 1*a* or 1*c*) and the $5, $10, $50, and $100 denominations are assigned to the first lower pocket (e.g., 106*c* in FIG. 1*a* or 1*c*).

According to some embodiments, more than one denomination can be assigned to a given pocket. For example, as shown in FIG. 42, the first lower pocket is assigned to be a fixed pocket to which \$5, \$10, \$50, and \$100 bills are directed. Such an assignment scheme may be advantageous when few \$5, \$10, \$50, and \$100 bills are expected in a stack of bills to be processed and when many \$1 and \$20 bills are expected. By assigning low expected volume bill denominations to the same pocket, more pockets become available for dynamic sorting of high volume notes. In the example illustrated in FIG. 42 five lower pockets would be available for dynamic sorting (assuming the currency evaluation devices shown in FIG. 1*a* or 1*c* are being utilized). Assuming a stack of bills to be processed does contain mostly \$1 and \$20 bills, the operator would then be given more time to clear pockets which have become full (e.g., reached a strap limit) as there are more dynamic pockets available to accept subsequent \$1 and \$20 notes. As a result, the time during which the device must halt operation due to the lack of available pockets to receive bills can be reduced. The currency evaluation device can be adapted to report a total for the value of bills contained in a pocket, the number of bills in a pocket, the number of bills per denomination in a pocket, and/or the value of bills per denomination in a pocket. Such reporting may be particularly useful when having a fixed pocket which is accepting more than one denomination.

According to some embodiments, some output receptacles may be excluded from the fixed, dynamic assignment scheme, for example, when a particular output pocket is designated to be an offsort pocket. For example, referring to FIGS. 1*a* and 1*b*, output receptacles 106*a* and 106*b* may be designated as offsort pockets, while output receptacles 106*c*–106*h* may be designated as dynamic pockets or fixed pockets. In another embodiment employing the currency evaluation device illustrated in FIG. 1*a* or 1*c*, one of the upper output receptacles 106*a* or 106*b*, is designated an offsort pocket (e.g., receives no calls, suspects), the other upper output receptacle 106*a* or 106*b* is a fixed pocket assigned to \$2 denomination (i.e., receives bills determined to be \$2 bills), while the lower output receptacles 106*c*–106*h* may be assigned to be fixed or dynamic pockets as described above in connection with FIG. 41.

In some embodiments, the operator is permitted to set stack limits for one or more of the output receptacles of a currency evaluation device. For example, the currency evaluation device according to some embodiments is provided with a user interface which permits the operator to assign stack limits to individual pockets, e.g., 100 bills for Pockets #1–#3 and 200 bills for Pockets #4–#6. Alternatively, the currency evaluation device according to some embodiments is provided with a user interface which permits the operator to assign stack limits to individual sorting parameters such as bill denomination. For example, a user interface may be provided which permits the operator to assign a stack limit of 100 bills to \$1 and \$5 denominations and a stack limit of 200 bills for \$20 bills. An example of the stack limits stored in memory according to such an embodiment is illustrated in FIG. 43. In this way, regardless to which pocket(s) an individual denomination is assigned, an appropriate stack limit can be assigned. According to such embodiments it does not matter if \$1 bills are initially set to Pocket #1 and then later assigned to Pocket #4. When the \$1 denomination is assigned to a pocket that pocket will have to \$1 stack limit associated therewith, e.g., 100 notes. Likewise, in the above example, if during operation Pocket #1 becomes reassigned from \$1 bills to \$20 bills, the stack limit for Pocket #1 will be changed for the \$1 stack limit (e.g., 100 notes) to the \$20 stack limit (e.g., 200 notes). A processor, for example, may keep track of individual denomination stack limits (e.g., by storing such limits in a memory) and pocket denomination assignments (e.g., that the \$1 denomination has been assigned to Pocket #4). Alternatively, in some embodiments, the stack limits may not be user-definable but rather are predetermined by the manufacturer.

When a stack limit has not be designated, a particular pocket's pocket limit will apply. A pocket limit is the maximum number of bills a given pocket is adapted to accept. For example, a pocket may have a capacity or pocket limit of 250 notes. If \$1 bills are assigned to that pocket and a strap limit of 100 notes has been assigned to \$1 bills, then the pocket will be designated as full when the pocket contains 100 notes. However, if no strap limit has been set for \$1 notes (and no strap limit has otherwise been set for the pocket), then the pocket will be designated as full when the pocket limit is reached, e.g., when pocket contains 250 notes.

FIG. 44 provides an example of the status of various assignments. Such information may be maintained in a memory under the control of a processor. Likewise such information may be communicated to the operator of the device such as via a display or printout. In the example illustrated in FIG. 44, Pocket #1 has been designated a fixed pocket which accepts \$20 bills. The current stack limit associated with Pocket #1 is 200 notes. Pocket #1 is not an open pocket because it has been assigned to the \$20 denomination. Pocket #1 is currently not full, meaning that fewer than 200 notes are contained in the pocket. It may or may not be empty.

Pockets #2–#5 have been designated to be dynamic pockets. Currently, no denomination has been assigned to Pocket #2 and thus its status is open (there are no bills in Pocket #2) and not full. There is currently no stack limit assigned to Pocket #2. Note that if a denomination later becomes to be assigned to Pocket #2 and the assigned denomination has an associated stack limit, that denomination stack limit would be assigned to Pocket #2. Pocket #3 has been dynamically assigned to \$1 bills. There are currently 100 \$1 bills in Pocket #3 as indicated by the full status and the stack limit of 100 notes. Because there are bills in dynamic Pocket #3, the pocket is not open. If Pocket #3 is cleared (that is the bills are removed), the pocket will again become open and non-full. Additionally, the stack limit may be cleared as would be the case if the stack limit currently assigned to Pocket #3 came to become assigned to Pocket #3 because \$1 bills were dynamically assigned to Pocket #3 and \$1 bills had a stack limit of 100 associated therewith.

Pocket #4 has been dynamically assigned to \$5 bills and the current stack limit is 100. The stack limit of 100 for Pocket #4 may be associated with the assigned denomination as described above (e.g., \$5 bills have been assigned a stack limit of 100 as shown in FIG. 43, and thus 100 note stack limit becomes associated with Pocket #4 when the \$5 denomination is assigned to Pocket #4). Alternatively, in some embodiments stack limits may be assigned directly to individual pockets and remain the same regardless of which denominations become assigned thereto. Currently there are some \$5 bills in Pocket #4 (open status=not open) but fewer than 100 notes (full status=non-full).

Pocket #5 has been dynamically assigned to the \$1 denomination. As will be explained below, this would have occurred upon the processing of the $101^{st}$ \$1 bill because after the $100^{th}$ \$1 bill, Pocket #3 became full and thus unable to accept additional $1 bills. Pocket #5 is not an open dynamic pocket (open status=no) and the pocket is not full (full status=no).

Pocket #6 has been disabled (assignment status=no bills). Because the pocket has been disabled it is not an open pocket. In some embodiments it may be treated as a full pocket. In other embodiments, the full status of a disabled pocket is disregarded as the pocket is simply treated as being disabled. As described above, in some embodiments, the operator (via, e.g., a user interface) may be provided the option of turning a pocket off (disabled). Likewise in some embodiments a currency evaluation device may be programmed to automatically disable a pocket, for example, when a problem with the pocket is detected (e.g., through a self-diagnosis the currency evaluation device determines that the stacking wheel in Pocket #6 is not working properly and thus automatically disables Pocket #6 and provides any indication to the operator of the nature of the problem and/or the need to call for service).

Figure 45A:
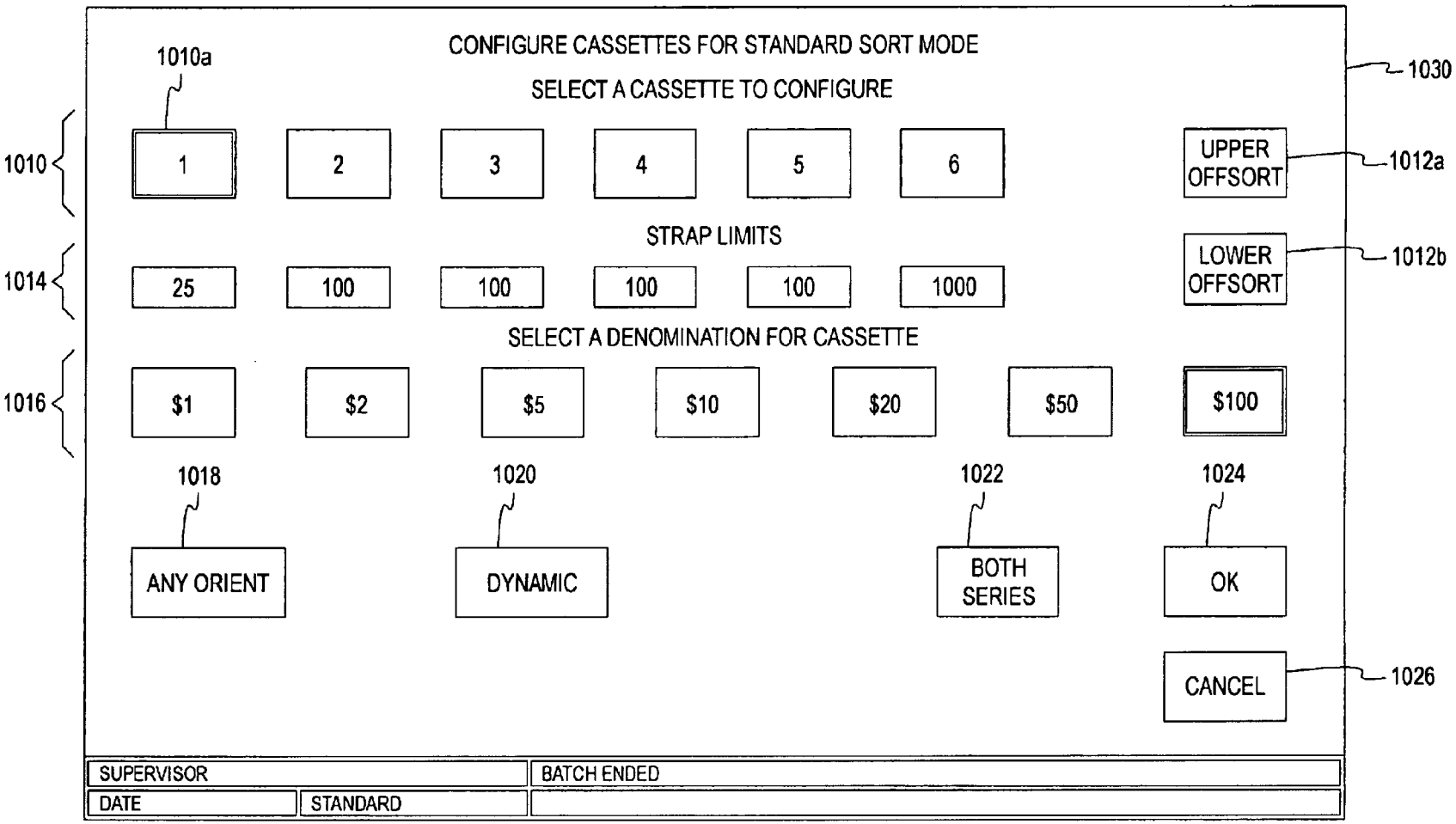
FIGS. 45*a* and 45*b* illustrate additional embodiments of user interfaces.
Figure 45B:
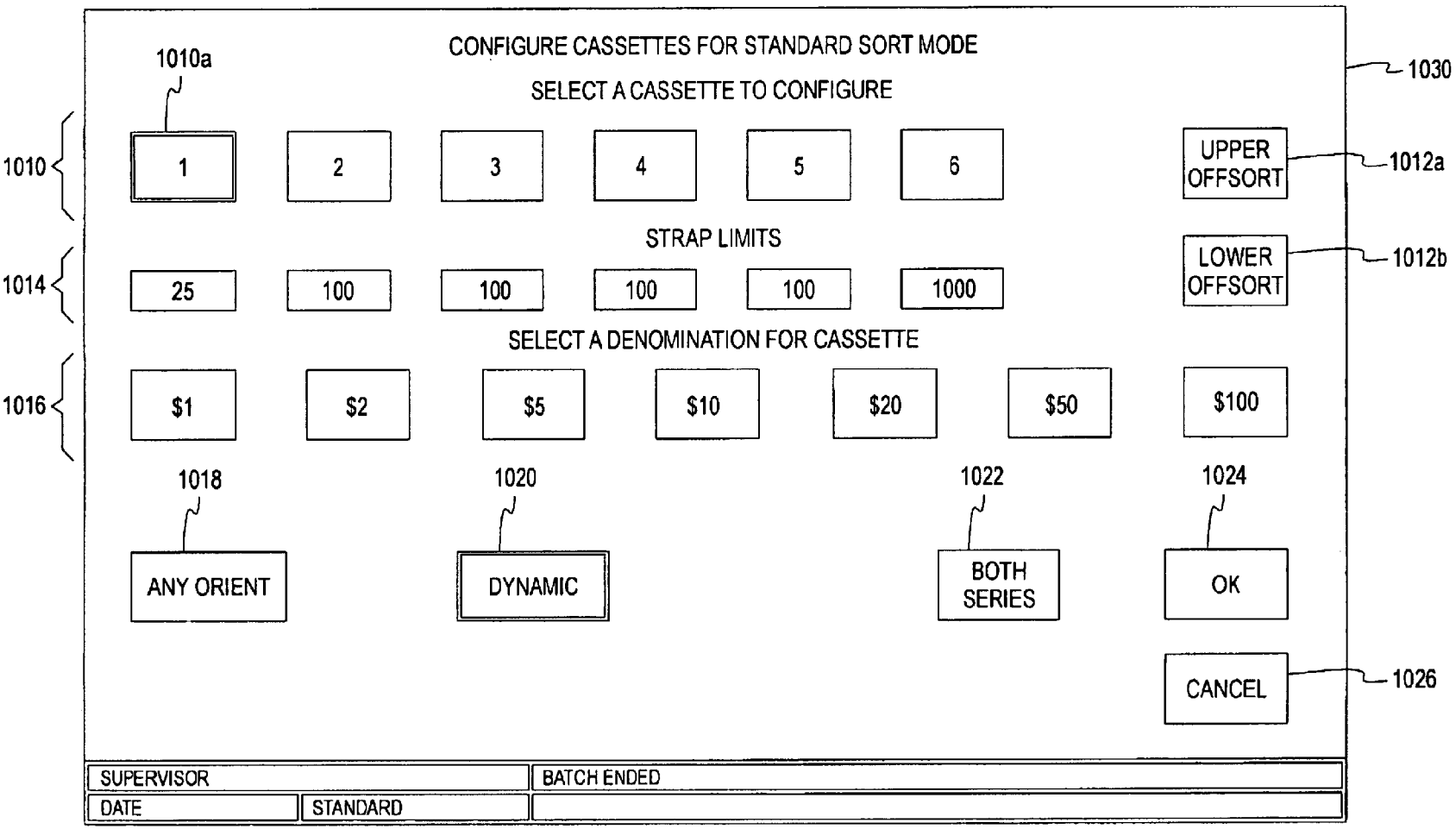

Referring to FIGS. 45*a* and 45*b*, these figures illustrate additional embodiments of user interfaces. In some embodiments the user interface 1030 comprises a touch screen. Of course, other variations could be utilized such as the physical keys or the combination of a display and physical keys. As illustrated in FIGS. 45*a* and 45*b*, the user interface 1030 comprises pocket selection elements 1010 and 1012*a* and 1012*b*, strap limit selection elements 1014, denomination selection elements 1016, an orientation selection element 1018, a dynamic selection element 1020, a series selection element 1022, an accept or OK selection element 1024 and a cancel selection element 1026. According to some embodiments, pocket selection elements 1010 labeled 1–6 may correspond to six main output receptacles such as pockets 106*c*–106*h* illustrated in FIGS. 1*a*–1*c*. According to some embodiments, pocket selection elements 1012*a* and 1012*b* labeled Upper Offsort and Lower Offsort may correspond with smaller output receptacles such as pockets 106*a*–106*b* illustrated in FIGS. 1*a*–1*c*.

To vary the characteristics or assignment criteria applicable to a particular output receptacle, an operator may select an appropriate pocket selection element 1010 or 1012. In FIGS. 45*a* and 45*b* Pocket #1 has been selected as indicated by the additional box surrounding pocket selection element 1010*a*. Of course, other methods may be used to indicate that a particular selection element has been selected such as the use of reverse-video or a change in color. In embodiments wherein user interface 1030 is a touch screen, selection of a particular selection element can be achieved by the operator touching the touch screen in the vicinity of the displayed selection element icon.

Once a particular pocket has been selected, characteristic of the selected pocket may be varied. For example, a particular denomination may be assigned to a particular pocket by selecting one of the denomination selection elements 1016. Such a procedure would make the selected pocket a fixed pocket. As illustrated by the additional box about the $100 denomination selection element 1016, Pocket #1 in FIG. 45*a* has been assigned to the $100 denomination, thus making Pocket #1 a fixed pocket. Additional denominations may be assigned to pockets by selecting additional denomination selection elements. For example, in FIG. 45*a*, if the operator were to next touch the $50 key 1016, then both the $100 and the $50 denomination selection keys 1016 would be selected and Pocket #1 would be assigned to receive both $50 and $100 bills. The user interface may be adapted such that repeated touches to a denomination selection element 1016 toggles the denomination selection element on and off.

In FIG. 45*b*, Pocket #1 has been designated to be a dynamic pocket as indicated by the additional boxes about selection elements 1010*a* and 1020. Similar to the denomination selection elements 1016, dynamic selection element 1020 may be designed to toggle on and off with repeated touches.

Orientation criteria may be assigned to particular pockets via orientation selection element 1018. According to some embodiments, repeated touches of orientation selection element 1018 may cause the orientation selection to scroll through a number of orientation options such as Face-Up, Face-Down, Forward Orientation, Reverse Orientation, Face-Up & Forward Orientation, Face-Up & Reverse Orientation, Face-Down & Forward Orientation, Face-Down & Reverse Orientation, and/or Any Orientation. In FIG. 45*a*, Pocket #1 has been designated to receive $100 bills of any orientation. In FIG. 45*b*, Pocket #1 has been designed to receive bills of whatever particular denomination becomes dynamically assigned to the pocket without regard to orientation.

Similar to orientation selection element 1018, series selection element 1022 permits a user to assign a series sorting criteria to a pocket. According to some embodiments such as those adapted to process US currency bills, the user interface 1030 can be adapted such that repeated touches of series selection element 1022 causes the selected series to scroll through the options of Old Series, New Series, and Both Series. As indicated in FIGS. 45*a* and 45*b*, Both Series has been designated for Pocket #1.

Once the pockets have been configured as desired, the OK selection element 1024 may be selected such as by being touched or depressed. If the operator wishes to revert to the pocket configuration existing before he or she began modifying the configuration (for example, the configuration which existed before the user accessed the pocket configuration set up screen illustrated in FIGS. 45*a* and 45*b*), the user may select the Cancel selection element 1026.

Strap limit selection elements 1014 indicate the current strap limits assigned to corresponding pockets 1–6. In some embodiments, a strap limit may be adjusted by selecting a desired strap limit selection element 1014. For example, repeated touches may result in the scrolling through of preset strap limits, e.g., 1, 10, 25, 50, 100, 300, none. Alternatively, in some embodiments touching a strap limit selection element will bring up a separate "strap limit" touch screen which permits the adjustment of strap limits (e.g., by providing pre-set strap limit selection elements and/or increase/decrease (e.g., "+1" and "−1") selection elements.) According to some embodiments, such a "strap limit" touch screen may permit the adjustment of the limits for all pockets 1–6 regardless of which strap limit selection element 1014 was touched to cause the screen to change to the "strap limit" screen.

Particular denominations can also be assigned to offsort pockets such as pockets 106*a*–106*b* of FIGS. 1*a*–1*c*. For example, touching pocket selection element 1012*a* and the $50 denomination selection element 1016 would assign the $50 denomination to the corresponding output receptacle such as pocket 106*a* of FIGS. 1*a*–1*c*. Assignment of particular denominations (or bills satisfying designated sorting criteria) to one or more of the offsort pockets may be particularly advantageous wherein few bills of that denomination (or satisfying the designated criteria) are expected in a batch of bills to be processed. For example, if it anticipated that a large batch of bills is likely to contain few $50 and $2 bills, then the $50 and $2 denominations can be assigned to one or more of the offsort pockets. Having done so, available dynamic pockets will not be taken up by the occurrence of such low volume bills. Take, for example, a large bundle of bills containing only one $50 bill. Assume the first sixty bills are $20 bills followed by the single $50 bill. Also assume that pockets 1–6 are all dynamic pockets. Without assigning the $50 denomination to an offsort pocket, then upon encountering the $50 bill, it would be dynamically assigned to Pocket #2 (Pocket #1 having been assigned to $20 bills). Pocket #2 would then become unavailable for dynamic assignment for more frequently occurring bills. Assigning such low volume denominations (or other sorting criteria) to an offsort pocket would result in the dynamic pockets being available for assignment to higher volume notes which in turn would decrease the likelihood that the machine would have to halt because no dynamic pockets remain available for assignment when needed.

In addition to a denomination criteria, orientation and series criteria, and combinations thereof may be assigned to offsort pockets via selection elements 1012*a* and 1012*b*. According to some embodiments, no calls, suspects, and other error criteria bills such as chains and doubles may be assigned to the offsort pockets as well. Likewise, in a fully fixed mode of operation (i.e., all six main pockets have been assigned to less than all possible denominations or sorting parameter criteria), bills of non-assigned denominations or sorting parameter criteria may be routed to offsort pockets. For example, if Pockets 1–3 were fixed to be $1 pockets and Pockets 3–6 were fixed to be $20 pockets, then bills of the remaining denominations (i.e., $2, $5, $50, and $100) would be routed to an offsort pocket.

As an example of the assignment of a combination of sorting parameters to offsort pockets, via the pocket selection elements 1012*a* and 1012*b*, the $50 denomination selection element 1016, and the orientation selection element 1018, the operator may designate that face-up $50 bills go into a first or upper offsort pocket while face-down $50 bills go into a second or lower offsort pocket.

As another example, via selection elements 1012*a* and 1018, the user may assign all face-down bills to be routed to a first offsort pocket. Such a configuration may be particularly useful in a document evaluation device which does not have a bill turn-over mechanism. Accordingly, when processing a batch of bills, during an initial run, all acceptable face-up bills may be sorted into the various pockets 1–6 according to any of a variety of sorting criteria (e.g., by denomination). During the initial run, the first offsort pocket may be assigned to receive all acceptable face-down bills. A second offsort pocket may be programmed to accept any unacceptable bills (e.g., suspects, unfit bills). Then after the initial run, the operator may remove the acceptable but face-down bills from the first offsort pocket, re-orient them, place them back into the input receptacle, and re-start the device. The acceptable bills will then be oriented face-up and can be routed into the appropriate ones of Pockets 1–6. Of course, any of the other sorting criteria described in this application or combinations thereof may be used in place of face orientation in the above example. Likewise, while this example was described in connection with offsort pockets, main pockets could be programmed in a similar way as desired to an operator.

Figure 46:
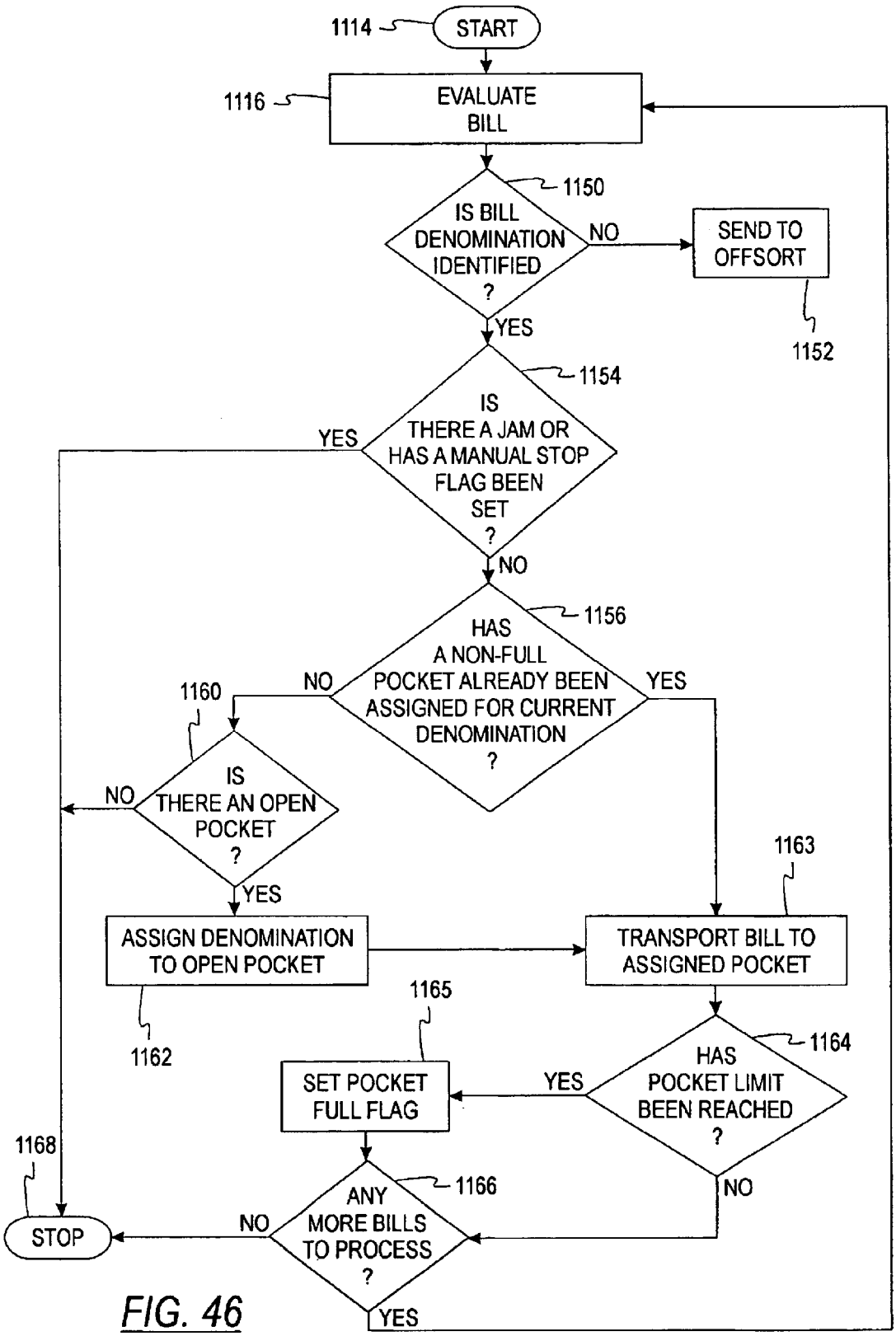
FIG. 46 is a flowchart illustrating steps performed when evaluating the denomination of currency bills pursuant to a Dynamic Sorting Assignment according to one embodiment of the present invention

Turning now to FIG. 46, a flowchart is provided illustrating steps performed when evaluating the denomination of currency bills pursuant to a Dynamic Sorting Assignment according to one embodiment of the present invention. This flowchart illustrates the steps performed during normal operation of a currency evaluation device wherein dynamic pockets have been assigned. The process starts at step 1114. Bills in an input receptacle of the currency evaluation device are fed one-by-one from the input receptacle and past a discrimination region containing one or more sensors.

At step 1116 the evaluating device evaluates a currency bill received from the input receptacle. At step 1116 a currency bill is evaluated according to at least one predetermined criterion, such as denomination, face orientation, forward/reverse orientation, and/or currency-type. An example of a predetermined criterion is the denomination of a U.S. currency bill.

A determination whether the denomination of a currency bill (or some other criterion, e.g., has the currency type/country, face orientation, and denomination) has been identified is made at step 1150. If the currency bill is not identified (e.g., in this present embodiment meaning denominated) then it is sent to an offsort pocket (step 1152), where the evaluating device has at least one offsort pocket, for example, output receptacle 106*a* which is shown in FIGS. 1*a* and 1*b*. If a bill has other problems, such as being a suspect bill, it may likewise be routed to an offsort pocket. However, if the currency bill is identified the process continues. In step 1154 an option is given to stop the process if a jam occurs or if an operator desires the process to stop. However, if a jam has not occurred and if the process is not manually stopped, then a determination is made at step 1156 whether the denomination of the current bill is the first of its kind, that is, whether a pocket has already been assigned to the denomination of the current bill. If a non-full pocket has already been assigned to the denomination of the current bill, the currency bill is transported to the assigned pocket (step 1163).

If at step 1156 a determination is made that the current denomination has not been assigned to a non-full pocket, then the next determination is whether an open pocket is available (step 1160). If an open pocket is not available, then the evaluation process ends (step 1168) and the evaluating device stops. However, if an open pocket is available, then the denomination of the currency bill is assigned to the open pocket (step 1162). If there is more than one open pocket then the evaluating device may choose arbitrarily or in a predetermined manner which open pocket to assign to the identified denomination. For example, if the evaluating device has six pockets numbered 1 through 6, then the evaluating device may be preprogrammed to select pocket 1 first, pocket 2 second, pocket 3 third, and so on. The priority of selecting open pockets may be preprogrammed, or be a customizable option that allows the operator to select the priority of pocket assignment.

Next, the currency bill is transported to the assigned pocket (step 1163) and a determination is made whether a stack limit (or in its absence a pocket limit) has now been reached (step 1164). If not, the process proceeds to step 1166 where the evaluating device checks to see if there are any more bills to process. If a limit has been reached at step 1164, then the evaluating device sets a flag that the pocket is full (step 1165) and proceeds to check to see if there are any more bills to process (step 1166). If the currency stack has been depleted the evaluation process ends (step 1168). However, if the currency stack has not been depleted, the evaluation process loops to step 1116 where it begins to evaluate the next currency bill from the input receptacle.

Although the evaluating procedure has been described in a particular order, it will be apparent to those of skill in the art that the order of the steps may be varied to suit different applications. Likewise not all steps are necessary in all embodiments. For example, the process of checking for jams or the presence of a manual stop flag may be carried out independently of the process detailed in FIG. 46. Likewise, in some embodiments the currency evaluation device may be programmed to stop upon the detection of a bill meeting a particular parameter such as a no call or suspect bill rather than off sorting the bill at step 652. Means for reconciling no call and suspects bills and/or restarting the currency evaluation device are discussed in more detail in U.S. Pat. No. 5,790,697 incorporated herein by reference in its entirety.

Figure 48A:
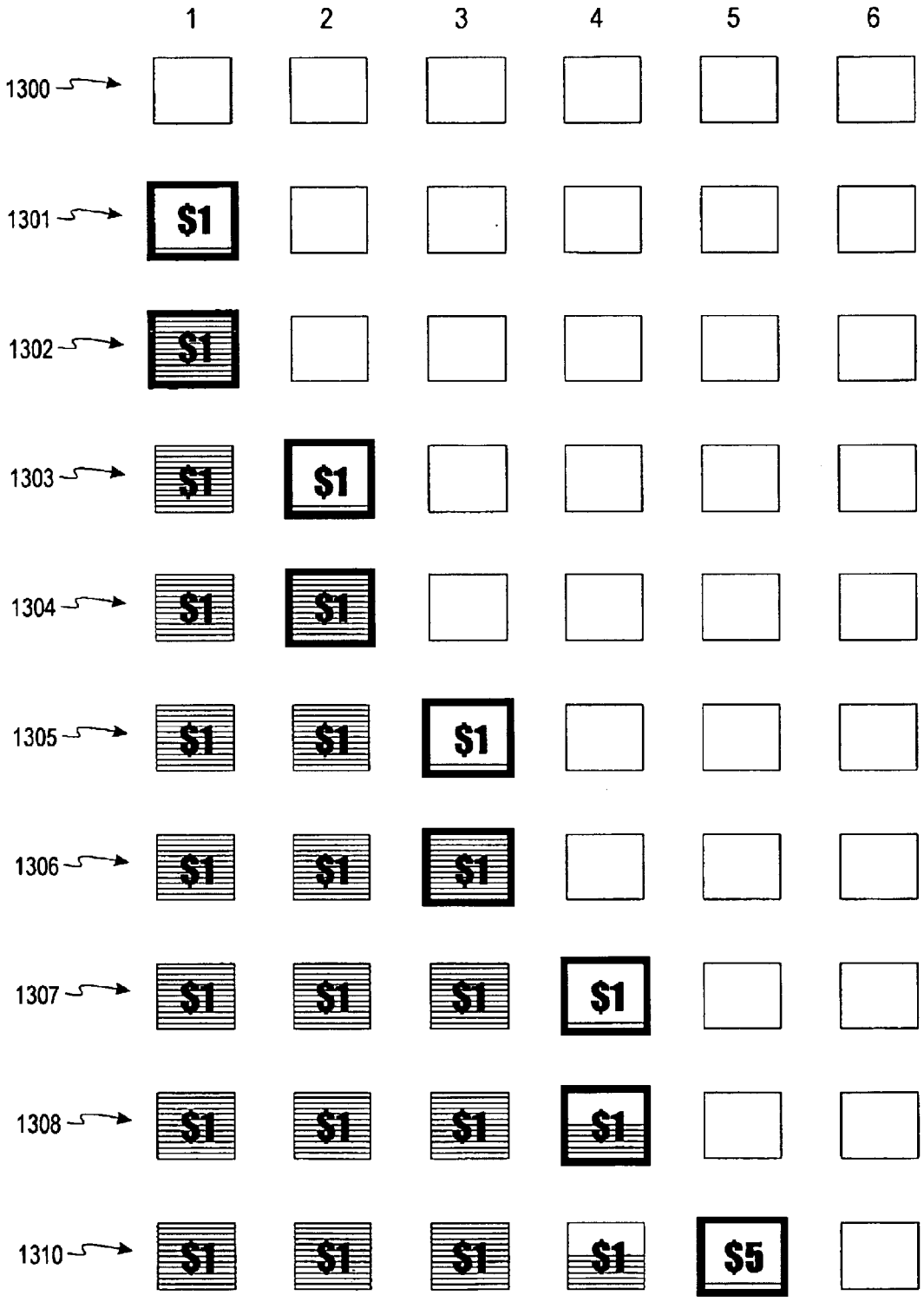
FIG. 48*a* is a functional diagram illustrating an example of evaluating currency bills pursuant to the Dynamic Sorting Assignment of FIG. 46.
Figure 48B:
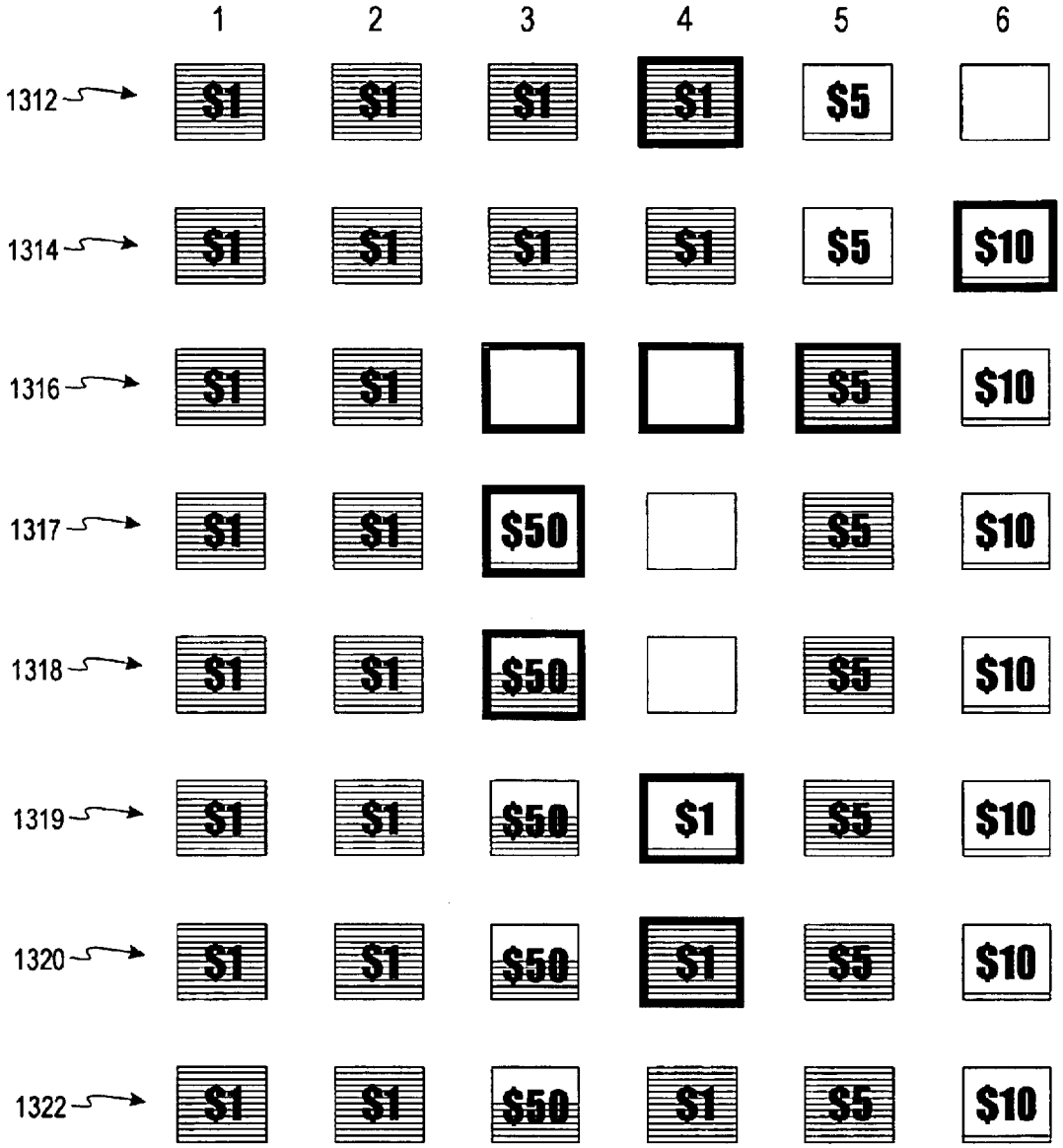
FIG. 48*b* is a continuation of FIG. 48*a*.

An example of a Dynamic Assignment method is illustrated in FIGS. 48*a*–48*b* for an evaluating device that has six output pockets, numbered 1 through 6. Each column represents a particular pocket, and each row represents a different stage in the evaluation process. A dark outline represents a change from the previous step, and the amount of shading inside a box represents the approximate number of currency bills in a particular pocket. Furthermore, the denomination assigned to a pocket is labeled on the particular pocket. Also, it is assumed that a strap limit of 100 has been assigned to each pocket and that the operator has selected the "Full Dynamic Assignment," meaning that each output pocket is designated as a dynamic pocket. After a stack of mixed denomination U.S. currency bills has been placed in the input receptacle, as described above, the evaluation process begins.

At step 1300 no currency bills have been evaluated yet. Therefore, all six pockets are represented as empty boxes. At step 1301, the evaluating device identifies the first bill as being a $1 bill. The evaluating device then assigns the $1 denomination to the first available pocket, which in this case is pocket 1, and transports the first bill to pocket 1. At step 1302, the evaluating device identifies the next 99 bills, bills 2–100, as also being $1 bills, and, therefore, the bills are transported to pocket 1. At this point pocket 1 is full because the limit of 100 has been reached, and it cannot accept any other bills until the pocket has been cleared by having an operator remove the currency bills from the pocket. Accordingly, the full status of pocket 1 is changed to yes. A processor may monitor the status of each output receptacle. When a non-empty pocket is emptied, the associated full flag is cleared as is any dynamic denomination assignment. Likewise, the processor may reset the open status flag to the "open" status.

At step 1303 the evaluating device identifies the next bill, bill 101, as being a $1 bill. Because pocket 1 has reached its limit and the currency stack has not been removed, the only available dynamic pockets for bill 101 are pockets 2–6. Assuming that pocket 2 has priority over pockets 3–6, the evaluating device then assigns the $1 denomination to pocket 2 and transports bill 101 to pocket 2. At step 1304 the evaluating device identifies the next 99 bills, bills 102–200, as also being $1 bills, and, therefore, the bills are transported to pocket 2. At this point pocket 2 is full because the limit of 100 has been reached, and it cannot accept any other bills until the pocket has been cleared by having an operator remove the currency bills from the pocket.

At step 1305 the evaluating device identifies the next bill, bill 201, as being a $1 bill. Because pockets 1 and 2 have reached their limit and because the currency stacks have not been removed from pockets 1 and 2, the only available dynamic pockets for bill 201 are pockets 3–6. Assuming that pocket 3 has priority over pockets 4–6, the evaluating device then assigns the $1 denomination to pocket 3 and transports bill 201 to pocket 3. At step 1306 the evaluating device identifies the next 99 bills, bills 202–300, as also being $1 bills, and, therefore, the bills are transported to pocket 3. At this point pocket 3 is full because the limit of 100 has been reached, and it cannot accept any other bills until the pocket has been cleared by having an operator remove the currency bills from the pocket.

At step 1307 the evaluating device identifies the next bill, bill 301, as being a $1 bill. Because pockets 1–3 have reached their limit and because the currency stacks have not been removed from pockets 1–3, the only available dynamic pockets for bill 201 are pockets 4–6. Assuming that pocket 4 has priority over pockets 5–6, the evaluating device then assigns the $1 denomination to pocket 4 and transports bill 301 to pocket 4. At step 1308 the evaluating device identifies the next 49 bills, bills 302–350, as also being $1 bills and transports bills 302–350 to pocket 4. However, unlike pockets 1–3, pocket 4 has not reached its strap limit of 100, and therefore it can still accept up to 50 more currency bills that have the $1 denomination. At this point, pockets 1–3 have not been cleared and therefore they cannot accept any more currency bills, pocket 4 has been "temporarily" fixed or assigned to accept only $1 currency bills and it can accept only 50 more bills, and pockets 5 and 6 are open pockets that are available to accept any denomination.

At step 1310 the evaluating device identifies the next currency bill, bill 351, as being a $5 bill. Assuming that pocket 5 has priority over pocket 6, bill 351 is placed in pocket 5. Thus, pocket 5 has been "temporarily" fixed or assigned to accept only $5 bills until the pocket has been cleared. Also, because the limit is 100 pocket 5 can accept 99 more $5 bills. At this point the only remaining open pocket is pocket 6.

At step 1312 the evaluating device identifies the next 50 bills, bills 352–401, as being $1 bills. Although pocket 6 is an open pocket and it can obviously accept these bills, pocket 4 can still accept 50 $1 bills before its limit is reached. Therefore, bills 352–401 are placed in pocket 4. Thus, pocket 4 has now reached its limit by having a total of 100 $1 bills: bills 301–350 and bills 352–401.

At step 1314 the evaluating device identifies the next currency bill, bill 402, as being a $10 bill. The only open pocket is pocket 6 and, because no non-full pockets have a $10 bill, bill 402 is placed in pocket 6. At this point all the pockets have been "temporarily" fixed or assigned to a denomination, with pockets 1–4 being full because they reached their limit.

At step 1316 the evaluating device identifies the next 99 currency bills, bills 403–502, as being $5 bills. Pocket 5, having only 1 $5 bill, accepts bills 403–502. At this point pocket 5 has reached its limit. However, the currency bills from pockets 3 and 4 have been removed, clearing these pockets to become once again open pockets, as they were in steps 1300–1304. Therefore, pockets 3 and 4 are available to accept any denomination that may be identified in the currency stack from the input receptacle. If pockets 1 and 2 would have been cleared, then they also would have been available to receive additional currency bills.

At step 1317 the evaluating device identifies the next currency bill, bill 503, as being a $50 bill. Pocket 1, 2 and 5 are full and therefore not available to accept currency bills. Pocket 6 has been "temporarily" fixed or assigned to accept $10 bills. Pockets 3 and 4 are the only pockets available to accept the $50 bill. Therefore, bill 503 is assigned to pocket 3, under the continuing assumption that pocket 3 has priority over pocket 4. At step 1318 the evaluating device identifies the next 49 currency bills, bills 504–552, as being $50 bills. They are transported to pocket 3 which after step 1317 can still accept an additional 99 $50 bills before it reaches its limit. At this point 50 additional $50 bills may be placed in pocket 3, 100 bills of any one denomination may be placed in pocket 4, and 99 additional $10 bills may be placed in pocket 6.

At step 1319 the evaluating device identifies the next currency bill, bill 553, as being a $1 bill. From the above discussion it is clear that the only available pocket is pocket 4. Therefore, bill 553 is assigned to pocket 4. At step 1320 the evaluating device identifies the next 99 currency bills, bills 554–652, as being $1 bills. Because pocket 4 can still accept up to 99 more $1 bills before it reaches its limit, bills 553–652 are placed in pocket 4. At this point pocket 4 has reached its strap limit and, therefore, cannot accept any additional currency bills until it is cleared.

At step 1322 the evaluating device identifies the next currency bill, bill 653, as being a $20 bill. At this point none of the pockets are available to accept bill 653: pockets 1,2, 4, and 5 are full, pocket 3 is "temporarily" assigned to accept bills of the $50 denomination, and pocket 6 is "temporarily" assigned to accept bills of the $10 denomination. The evaluating device would temporarily stop at this point until at least one pocket is cleared. The evaluating device can be designed to restart automatically or upon the selection of a manual start button after at least one pocket has been cleared. However, as long as the operator continues to clear full pockets the evaluating device can continue to evaluate currency bills until the currency is depleted, unless the operator manually stops the machine or unless a jam occurs.

Figure 47:
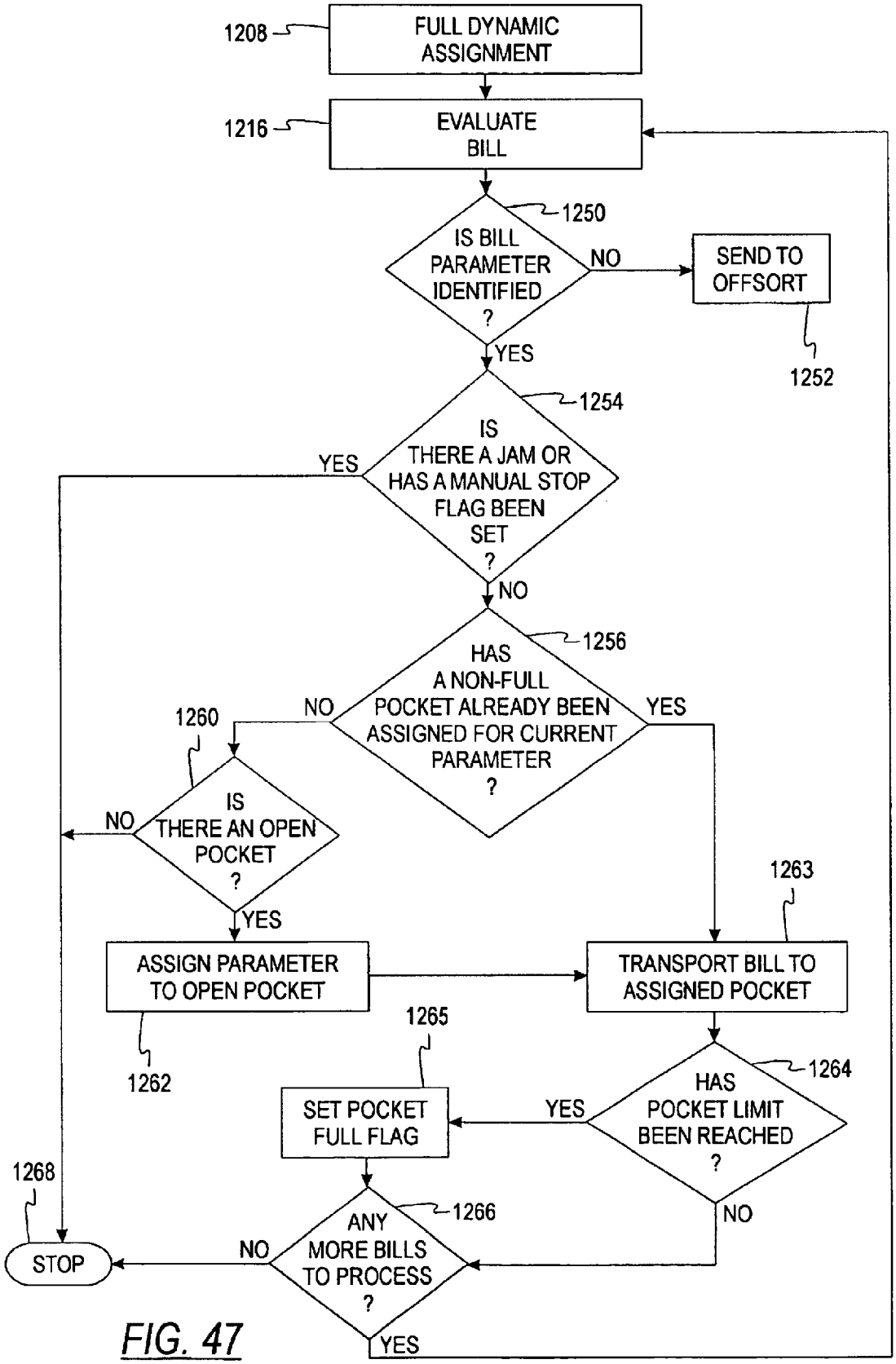
FIG. 47 is a flowchart illustrating steps performed when evaluating a parameter of currency bills pursuant to a Dynamic Sorting Assignment according to one embodiment of the present invention.

Referring to FIG. 47, a detailed description of a "Full Dynamic Assignment" according to other embodiments is shown using any parameter of a currency bill, such as, for example, country of origin, face orientation, forward/reverse orientation, fitness, size, color, or shape. Examples of discriminating by denomination, face orientation, and/or face orientation are described in more detail in U.S. Pat. No. 5,815,592 incorporated herein by reference in its entirety. The method of the present embodiment of the invention is similar to the method described above in reference to FIG. 46, except that any parameter of currency bills may be used as an evaluating criteria. Additionally, although the description refers to "a parameter," any combination of parameters can be used in the evaluating process, including a bill denomination.

For example, bills may be pre-assigned (fixed) or dynamically assigned to pockets based on the combination of currency type/country of origin (e.g., Japanese yens, European euros, British pounds) and denomination. For example, each pocket (fixed or dynamic) can be limited to accept only bills having the same denomination and country of origin (e.g., Pocket 1 receives U.S. $20 bills, Pocket 2 receives 1000 ¥ notes, etc.). As another example, assignments may be based on the combination of denomination and face orientation and country type. For example, in a Full Dynamic Mode, if the first bill is a face down US $1, it may be routed to Pocket 1 and the combination of US face-down $1 bills is assigned to Pocket 1. If the next non-face-down-US-$1 is a face-up US $1 bill, the combination of face-up, US, and $1 may be dynamically assigned to Pocket 2 and bills meeting this combination will be routed to Pocket 2. The next new country/face orientation/denomination parameter combination would be assigned to the next open dynamic pocket (e.g., face-up US $20 bills). Take the following example stack of bills, all US bills: Bill #1=face-down $1, Bill #2=face-up $1 bill, Bill #3=face-down $1 bill, Bill #4=face-up $20 bill, and Bill #5=face-down $20. If dynamic sorting parameters are selected to be the combination of US country, face orientation, and denomination (or if the device is capable of recognizing only US bills and the sorting parameters are selected to be the combination of face orientation and denomination), then Bill #1 and #3 would be transported to Pocket 1 and Pocket 1 would be assigned the combination of face-down US $1 bills. Similarly, Bill #2 would be transported to Pocket 2 and Pocket 2 would be dynamically assigned to the combination of face-up US $1 bills. Bill #4 would be transported to Pocket 3 and Pocket 3 would be dynamically assigned to the combination of face-up US $20 bills. And Bill #5 would be transported to Pocket 4 and Pocket 4 would be dynamically assigned to the combination of face-down US $20 bills.

Sorting criteria can be defined in a set-up mode. For example, an operator may employ a user interface to indicate which sorting parameters should be detected and employed to sort currency bills into different output receptacles. As described above in conjunction with providing an operator flexibility of designating into which pockets bills of different denominations should be transported, the user interface in some embodiments provides similar flexibility with respect to a variety of sorting parameters (e.g., denomination, country of origin/issuing entity, face orientation, forward/reverse orientation, fitness, size, color, and combinations thereof). For example, the user interface may permit an operator to designate country of origin/issuing entity (e.g., US dollars, Canadian dollars, Japanese Yens, Euros, Disney Dollars, ABC Casino) as a dynamic sorting parameters. In a full dynamic mode, currency bills (or other types of documents such as substitute currency notes or currency notes) are separated into different output pockets by country of origin/issuing entity. Take for example a stack of 100 documents comprising twenty $5 US bills, twenty $50 US bills, twenty $50 Canadian bills, twenty $100 Canadian bills, and twenty 5000¥ Japanese Yens In an example of a full dynamic mode embodiment in which sorting is based solely on country of origin, the forty US bills would be delivered to a first pocket, the forty Canadian bills would be delivered to a second pocket, and the twenty Japanese bills would be delivered to a third pocket.

As discussed above, multiple sorting parameters may be selected. Taking the example above of the 100 documents, in an embodiment wherein the operator designated sorting parameters to be country of origin and denomination, then the twenty $5 US bills would be delivered to one pocket, the twenty $50 US bills would be delivered to a second pocket, the twenty $50 Canadian bills would be delivered to a third pocket, the twenty $100 Canadian bills would be delivered to a fourth pocket, and the twenty 5000¥ Japanese Yens would be delivered to a fifth pocket. In a full dynamic mode, exactly to which pockets the individual combinations of country of origin and denomination would be assigned would depend on the order in which the bills were placed in the input receptacle and discriminated. For example, if the first 10 bills were 5000¥ Japanese Yens and the next two bills were $50 Canadian bills, and the next bill was a $50 US bill, then in one embodiment the 5000¥ Japanese Yen combination of parameters would be assigned to Pocket #1, the $50 Canadian bill combination of parameters would be assigned to Pocket #2, and the $50 US bill combination of parameters would be assigned to Pocket #3.

Likewise as described above in connection with the simple example of a sorting parameter of US denominations, the user interface in some embodiments is designed to permit the designation of one or more sorting parameters in a fixed assignment and a fixed-dynamic assignment. One example of such a fixed-dynamic assignment would be wherein the operator designates Pocket #1 as a fixed pocket to which the combination of US country and $20 is assigned, and Pockets #2–#6 are designated to be dynamic pockets wherein pocket assignments are dynamically made based on the discrimination of each bill's country of origin and denomination.

Returning to FIG. 47, the "Full Dynamic Assignment" begins by having an operator select the assignment at step 1208. The selection automatically selects all the output pockets to become dynamic pockets. In general, a pocket that is designated as an offsort pocket, which is used for collecting unidentified currency bills, may not be designated as a dynamic pocket. However, in some embodiments even a pocket normally designated as an offsort pocket may be re-designated as a dynamic pocket if the operator would so desire (in which case, the pocket would no longer be an offsort pocket). For example, referring to FIGS. 1*a* and 1*b*, output receptacles 106*a* and 106*b* may be designated as offsort pockets, while output receptacles 106*c*–106*h* may be designated as dynamic pockets. A dynamic pocket is a pocket that does not have a specific parameter or parameter combination pre-assigned to it. Rather, the evaluating device automatically assigns a parameter or parameter combination to a particular dynamic pocket on-the-fly, as will be described in more detail below. After a dynamic pocket has been assigned a parameter (parameter combination), the dynamic pocket becomes "temporarily" a fixed pocket, accepting only currency bills of the same parameter (parameter combination) as the automatically assigned parameter (parameter combination) until the pocket has been cleared so that it becomes once again an open pocket. When the dynamic pocket becomes an open pocket the evaluating device will automatically assign another parameter (parameter combination) to the dynamic pocket, as needed, which could be the same or different than the previous parameter (parameter combination) that was assigned to the dynamic pocket.

In step 1216 the evaluating device evaluates a currency bill. A determination whether the currency bill is identified is made at step 1250, that is, the whether the parameter(s) which serves as the basis of sorting can be determined. If the currency bill is not identified then it is sent to an offsort pocket (step 1252), where the evaluating device has at least one offsort pocket, for example, output receptacle 106*a* which is shown in FIGS. 1*a* and 1*b*. However, if the currency bill is identified, the process continues. According to some embodiments, in step 1254 the currency evaluation device determines whether the process should be stopped because a jam has occurred or an operator has selected a manual stop selection element. However, if a jam has not occurred and if the process is not manually stopped, then a determination is made at step 1256 whether the parameter of the current bill is the first of its kind, that is, whether a pocket has already been assigned to the parameter of the current bill.

If at step 1256 a determination is made that the current parameter has not been assigned to a non-full pocket, then the next determination is whether an open pocket is available (step 1260). If an open pocket is not available, then the evaluation process ends (step 1268) and the evaluating device stops. However, if an open pocket is available, then the parameter of the currency bill is assigned to the open pocket (step 1262). If there is more than one open pocket then the evaluating device may choose arbitrarily or in a predetermined manner which open pocket to assign to the identified parameter. For example, if the evaluating device has six pockets numbered 1 through 6, then the evaluating device may be preprogrammed to select pocket 1 first, pocket 2 second, pocket 3 third, and so on. The priority of selecting open pockets may be preprogrammed, or be a customizable option that allows the operator to select the priority of pocket assignment.

Next, the currency bill is transported to the assigned pocket (step 1263) and a determination is made whether the limit has now been reached (step 1264). If the limit has been reached then the evaluating device sets a flag that the pocket is full (step 1265) and then checks to see if there are any more bills to process (step 1266). If the limit has not been reached then the evaluating device checks to see if there are any more bills to process (step 1266). If the currency stack has been depleted the evaluation process ends (step 1268). However, if the currency stack has not been depleted, the evaluation process loops to step 1216 where it begins to evaluate the next currency bill from the input receptacle.

If at step 1256 a determination is made that the parameter of the current bill has been assigned to a non-full pocket, then the current bill is transported to the assigned pocket (step 1263). After transporting the current bill to the assigned pocket (step 1263), the procedure is the same as above starting with step 1264 and either stopping at step 1268 or looping back to step 1216.

Although the procedures above have been described in a particular order, it will be apparent to those of skill in the art that the order of the steps may be varied to suit different applications.

Although many of the above embodiments have been described in connection with a currency evaluation device having six or eight output receptacles, the number of output receptacles can be varied. For example, the above described dynamic assignment embodiments may be employed in conjunction with a currency evaluation device having fourteen output receptacles. Likewise the devices illustrated in FIGS. 1*a*–1*c* may be adapted to accommodate the modular addition of additional pockets such as a modular units having one or two output receptacles each. Such a modular scheme permits the addition of output receptacles in increments of one or two receptacles so that the currency evaluation device may be expanded to accommodate the needs of a particular business or operator.

While the above techniques including the dynamic assignment, fixed assignment, and dynamic-fixed assignment embodiments have been discussed in terms of processing currency bills, other embodiments employ documents, "currency documents", "substitute currency media" such as casino script or Disney Dollars, "substitute currency notes", "currency notes" and/or "non-currency documents". Likewise barcoded documents such as barcoded currency documents and barcoded substitute currency media are also contemplated.

In addition to embodiments described above or in the accompanying claims, several embodiments of the present inventions will now be described.

Alternative Embodiment A

A. One embodiment of the present invention is a method of sorting currency bills, each having an associated denomination, using a currency bill evaluating device adapted to dynamically assign denominations to output receptacles. The currency evaluating device comprises an input receptacle, a plurality of output receptacles, and a transport mechanism positioned to individually transport bills from the input receptacle to the output receptacles. The method comprises:

(A) transporting bills from the input receptacle past a bill denominating sensor;

(B) determining the denomination of the transported bills;

(C) for each bill, determining whether the denomination of the bill has been assigned to a non-full output receptacle and (i) if so, transporting the bill to the assigned non-full output receptacle;

(ii) if not, determining whether there is an open output receptacle and (a) if so, assigning the denomination of the bill to an open output receptacle and transporting the bill to the assigned output receptacle;

(b) if not, stopping the operation of the device.

Alternative Embodiment B

B. Another embodiment is a method of sorting currency bills, each having an associated denomination, using a currency bill evaluating device adapted to dynamically assign denominations to output receptacles. The currency evaluating device comprises an input receptacle, a plurality of output receptacles, and a transport mechanism positioned to individually transport bills from the input receptacle to the output receptacles. The method comprises:

(A) transporting a bill from the input receptacle past a bill denominating sensor;

(B) determining the denomination of the transported bill;

(C) determining whether the denomination of the bill has been assigned to a non-full output receptacle and (i) if so, transporting the bill to the assigned non-full output receptacle;

(ii) if not, determining whether there is an open output receptacle and (a) if so, assigning the denomination of the bill to an open output receptacle and transporting the bill to the assigned output receptacle;

(b) if not, stopping the operation of the device;

(D) repeating steps (A)–(C).

Alternative Embodiment C

C. Another embodiment is a method of sorting currency bills, each having an associated denomination, using a currency bill evaluating device adapted to dynamically assign denominations to output receptacles. The currency evaluating device comprises an input receptacle, a plurality of output receptacles, and a transport mechanism positioned to individually transport bills from the input receptacle to the output receptacles. The method comprises:

(A) transporting a bill from the input receptacle past a bill denominating sensor;

(B) determining the denomination of the transported bill;

(C) determining whether the denomination of the bill has been assigned to a non-full output receptacle and (i) if so, transporting the bill to the assigned non-full output receptacle;

(ii) if not, determining whether there is an open output receptacle and (a) if so, assigning the denomination of the bill to an open output receptacle and transporting the bill to the assigned output receptacle;

(b) if not, stopping the operation of the device;

(D) determining whether an output receptacle to which a bill has been transported has reached an output receptacle limit and, if so, designating the output receptacle as being full;

(E) determining whether there are any more bills to be processed and if so repeating steps (A)–(E).

Alternative Embodiment D

D. In another embodiment, the method of embodiment C further comprises:

providing an indication to an operator that an output receptacle is full when an output receptacle is designated as being full; and designating an output receptacle as being open after an operator has removed all bills from the output receptacle.

Alternative Embodiment E

E. In another embodiment, the method of embodiment C further comprises:

providing an indication to an operator that an output receptacle is full when an output receptacle is designated as being full.

Alternative Embodiment F

F. In another embodiment, the method of embodiment C further comprises:

designating an output receptacle as being open after all bills have been removed therefrom.

Alternative Embodiment G

G. In another embodiment, the method of embodiment C further comprises:

designating an output receptacle as being open when no bills are contained therein.

Alternative Embodiment H

H. Another embodiment is a method of sorting currency bills, each having an associated denomination, using a currency bill evaluating device adapted to dynamically assign denominations to output receptacles. The currency evaluating device comprises an input receptacle, a plurality of output receptacles, and a transport mechanism positioned to individually transport bills from the input receptacle to the output receptacles. The method comprises:

(A) determining the denomination of a bill;

(B) determining whether the denomination of the bill has been assigned to a non-full output receptacle and (i) if so, transporting the bill to the assigned non-full output receptacle;

(ii) if not, determining whether there is an open output receptacle and (a) if so, assigning the denomination of the bill to an open output receptacle and transporting the bill to the assigned output receptacle;

(b) if not, stopping the operation of the device;

(C) repeating steps (A)–(B).

Alternative Embodiment I

I. Another embodiment is a method of operating a multi-output receptacle currency evaluator comprising an input receptacle, a plurality of output receptacles, and a transport mechanism positioned to individually transport bills from the input receptacle to the output receptacles, each bill having a denomination associated therewith. The method comprises:

(a) determining the denomination of a bill;

(b) determining if an output receptacle is associated with the denomination of the bill;

(c) if an output receptacle is not associated with the denomination of the bill, associating an output receptacle with the denomination of the bill; and (d) causing the bill to be transported to an output receptacle associated with the denomination of the bill.

Alternative Embodiment J

J. The method of embodiment I wherein the currency evaluator comprises three or more output receptacles.

Alternative Embodiment K

K. A method of operating a multi-output receptacle currency evaluating device in a manner employing both one or more fixed output receptacles and one or more dynamic output receptacles wherein the currency evaluation device comprises an input receptacle adapted to receive currency bills, the currency bills each having an associated denomination, a plurality of output receptacles, each of the one or more fixed output receptacles having a denomination assigned thereto and each of the dynamic output receptacles being capable of being dynamically assigned to a denomination, the method comprises:

(a) determining the denomination of a bill;

(b) determining if the denomination of the bill has been assigned to one of the output receptacles and, if so, transporting the bill to the assigned output receptacle;

(c) if the denomination of the bill has not been assigned to an output receptacle, dynamically assigning the denomination to an output receptacle and transporting the bill to the assigned output receptacle.

Alternative Embodiment L

L. A method of operating a multi-output receptacle currency evaluating device in a manner employing both one or more fixed output receptacles and one or more dynamic output receptacles wherein the currency evaluation device comprises an input receptacle adapted to receive currency bills, the currency bills each having an associated denomination, a plurality of output receptacles, each of the one or more fixed output receptacles having one or more denominations assigned thereto and each of the dynamic output receptacles being capable of being dynamically assigned to a denomination, the method comprises:

(a) determining the denomination of a bill;

(b) determining if the denomination of the bill has been assigned to one of the output receptacles and, if so, transporting the bill to the assigned output receptacle;

(c) if the denomination of the bill has not been assigned to an output receptacle, dynamically assigning the denomination to an output receptacle and transporting the bill to the assigned output receptacle.

Alternative Embodiment M

M. The method according to any of embodiments K–L wherein the currency evaluating device is operated in a manner employing two or more dynamic output receptacles.

Alternative Embodiment N

N. The method according to any of embodiments K–L wherein the currency evaluating device is operated in a manner employing three or more dynamic output receptacles.

Alternative Embodiment O

O. A method of operating a multi-output receptacle currency evaluating device in a manner employing both one or more fixed output receptacles and one or more dynamic output receptacles wherein the currency evaluation device comprises an input receptacle adapted to receive currency bills, the currency bills each having an associated denomination, a plurality of output receptacles, each of the one or more fixed output receptacles having a denomination assigned thereto and each of the dynamic output receptacles being capable of being dynamically assigned to a denomination, the method comprises:

(A) determining the denomination of a bill;

(B) determining if the denomination of the bill has been assigned to one or more of the fixed output receptacles, and if so, determining whether one or more of the assigned fixed output receptacles is not full, and, if so, transporting the bill to one of the assigned non-full fixed output receptacles;

(C) determining if the denomination of the bill has been assigned to a non-full dynamic output receptacle, and (i) if so, transporting the bill to the assigned, non-full output receptacle, (ii) otherwise, dynamically assigning the denomination of the bill to an open dynamic output receptacle and transporting the bill to the assigned output receptacle.

Alternative Embodiment P

P. A method of operating a multi-output receptacle currency evaluating device in a manner employing both one or more fixed output receptacles and one or more dynamic output receptacles wherein the currency evaluation device comprises an input receptacle adapted to receive currency bills, the currency bills each having an associated denomination, a plurality of output receptacles, each of the one or more fixed output receptacles having one or more denominations assigned thereto and each of the dynamic output receptacles being capable of being dynamically assigned to a denomination, the method comprises:

(A) determining the denomination of a bill;

(B) determining if the denomination of the bill has been assigned to one or more of the fixed output receptacles, and if so, determining whether one or more of the assigned fixed output receptacles is not full, and, if so, transporting the bill to one of the assigned non-full fixed output receptacles;

(C) determining if the denomination of the bill has been assigned to a non-full dynamic output receptacle, and (i) if so, transporting the bill to the assigned, non-full output receptacle, (ii) otherwise, dynamically assigning the denomination of the bill to an open dynamic output receptacle and transporting the bill to the assigned output receptacle.

Alternative Embodiment Q

Q. The method according to any of embodiments O–P further comprises suspending the operation of the device if in step (C)(ii) an open dynamic output receptacle is not available.

Alternative Embodiment R

R. The method according to any of embodiments O–Q wherein the currency evaluating device is operated in a manner employing two or more dynamic output receptacles.

Alternative Embodiment S

S. The method according to any of embodiments O–Q wherein the currency evaluating device is operated in a manner employing three or more dynamic output receptacles Alternative Embodiment T T. The method according to any of embodiments O–S further comprises suspending the operation of the device when the denomination of the bill has been assigned to one or more of the fixed output receptacles but none of the one or more assigned fixed output receptacles are not full.

Alternative Embodiment U

U. The method according to any of embodiments O–T further comprises proceeding to step (C) when the denomination of the bill has been assigned to one or more of the fixed output receptacles but none of the one or more assigned fixed output receptacles are not full, thereby permitting the denomination of the bill to be assigned to one of the dynamic output receptacles when all associated fixed output receptacles are full.

Alternative Embodiment V

V. The method according to any of embodiments U further comprises suspending the operation of the device if in step (C)(ii) an open dynamic output receptacle is not available.

Alternative Embodiment W

W. The method according to any of embodiments O–V further comprises repeating steps (A)–(C) for subsequent bills in the input receptacle until there are no more bills to be processed.

Alternative Embodiment X

X. A method of assigning a denomination to an output receptacle of a multi-output receptacle currency denominating device, the method comprises an operator of the device setting an output receptacle to be either a dynamic pocket, subject to dynamic assignment of a bill denomination during normal operation of the device, or assigning a particular denomination to the output receptacle thereby making the output receptacle a fixed pocket such that during normal operation of the device only bills having the particular denomination may be transported into the output receptacle.

Alternative Embodiment Y

Y. A method of assigning a denomination to an output receptacle of a multi-output receptacle currency denominating device, the method comprises an operator of the device setting an output receptacle to be either a dynamic pocket, subject to dynamic assignment of a bill denomination during normal operation of the device, or assigning one or more particular denominations to the output receptacle thereby making the output receptacle a fixed pocket such that during normal operation of the device only bills having the one or more particular denominations may be transported into the output receptacle.

Alternative Embodiment Z

Z. A method of assigning denominations to output receptacles of a currency denominating device comprising a plurality of output receptacles, the method comprises setting each one of the output receptacles to be either a dynamic pocket, subject to dynamic assignment of a bill denomination during normal operation of the denominating device, or a fixed pocket, the setting of an output receptacle to be fixed pocket comprising assigning a particular denomination to the output receptacle such that during normal operation only bills of the particular denomination may be transported to the fixed output receptacle.

Alternative Embodiment AA

AA. A method of assigning denominations to output receptacles of a currency denominating device comprising a plurality of output receptacles, the method comprising setting each one of the output receptacles to be either a dynamic pocket, subject to dynamic assignment of a bill denomination during normal operation of the denominating device, or a fixed pocket, the setting of an output receptacle to be a fixed pocket comprising assigning one or more particular denominations to the output receptacle such that during normal operation only bills of the one or more particular denominations may be transported to the fixed output receptacle.

Alternative Embodiment AB

AB. The method according to any of embodiments A–AA further comprising disabling an output receptacle thereby making the output receptacle unavailable to receive bills during normal operation.

Alternative Embodiment AC

AC. The method of embodiment AB wherein the disabling comprises automatically disabling an output receptacle when a problem with the output receptacle is detected.

Alternative Embodiment AD

AD. The method of embodiment AB wherein the disabling comprises an operator to manually designating the output receptacle as unavailable via a user interface.

Alternative Embodiment AE

AE. A currency evaluating device comprising:

an input receptacle adapted to receive a stack of currency bills, each bill having a denomination associated therewith, a plurality of output receptacles, a transport mechanism adapted to individually transport bills from the input receptacle to the output receptacles; and a processor adapted to control the operation of the currency evaluating device, the processor being programmed to:

determine the denomination of a bill;

determine if an output receptacle is associated with the denomination of the bill;

if an output receptacle is not associated with the denomination of the bill, associate an output receptacle with the denomination of the bill; and cause the bill to be transported to an output receptacle associated with the denomination of the bill.

Alternative Embodiment AF

AF. A currency bill evaluating device adapted to dynamically assign denominations to output receptacles, the currency evaluating device comprising:

an input receptacle, a plurality of output receptacles, a transport mechanism adapted to individually transport bills from the input receptacle to the output receptacles and a processor adapted to control of the operation of the device, the processor being programmed to:

(A) cause a bill to be transported from the input receptacle past a bill denominating sensor;

(B) determine the denomination of the transported bill;

(C) determine whether the denomination of the bill has been assigned to a non-full output receptacle and (i) if so, transport the bill to the assigned non-full output receptacle;

(ii) if not, determine whether there is an open output receptacle and (a) if so, assign the denomination of the bill to an open output receptacle and cause the bill to be transported to the assigned output receptacle;

(b) if not, stop the operation of the device;

(D) determine whether an output receptacle to which a bill has been transported has reached an output receptacle limit and, if so, designate the output receptacle as being full;

(E) determine whether there are any more bills to be processed and if so repeating steps (A)–(E).

Alternative Embodiment AG

AG. The device of embodiment AF wherein the processor is further programmed to:

provide an indication to an operator that an output receptacle is full when an output receptacle is designated as being full;

designate an output receptacle as being open after an operator has removed all bills from the output receptacle.

Alternative Embodiment AH

AH. The device of embodiment AF wherein the processor is further programmed to provide an indication to an operator that an output receptacle is full when an output receptacle is designated as being full.

Alternative Embodiment AI

AI. The device of embodiment AF wherein the device is adapted to permit an operator to remove bills from the output receptacles and wherein the processor is further programmed to:

designate an output receptacle as being open after an operator has removed all bills from the output receptacle, thereby making the output receptacle available to have a denomination re-assigned thereto.

Alternative Embodiment AJ

AJ. The device of embodiment AF wherein the device is adapted to permit bills to be removed from the output receptacles and wherein the processor is further programmed to:

designate an output receptacle as being open when no bills are contained therein thereby making the output receptacle available to have a denomination dynamically assigned thereto.

Alternative Embodiment AK

AK. A currency denominating device comprising:

(a) a plurality of output receptacles; and (b) an operator interface adapted to permit the operator of the device to change the designation of each one of the output receptacles between being a fixed pocket and being a dynamic pocket.

Alternative Embodiment AL

AL. A currency denominating device comprising:

(a) a plurality of output receptacles; and (b) an operator interface adapted to permit the operator of the device to change the designation of at least one of the output receptacles between being a fixed pocket and being a dynamic pocket.

Alternative Embodiment AM

AM. A currency denominating device adapted to denominate currency bills of a plurality of denominations comprising:

(a) a plurality of output receptacles; and (b) an operator interface adapted to permit the operator of the device to change the designation of at least one of the output receptacles among a plurality of fixed denomination designations and a dynamic denomination designation.

Alternative Embodiment AN

AN. A currency denominating device comprising:

(a) a plurality of output receptacles; and (b) an operator interface adapted to permit the operator of the device to change the designation of at least one of the output receptacles between being a fixed pocket and being a dynamic pocket, wherein a fixed pocket is a pocket assigned to a particular denomination such that during normal operation only bills of the particular denomination may be transported to the fixed output receptacle and wherein a dynamic pocket is a subject to dynamic assignment of a bill denomination during normal operation of the denominating device.

Alternative Embodiment AO

AO. A currency denominating device comprising:

(a) a plurality of output receptacles; and (b) an operator interface adapted to permit the operator of the device to change the designation of at least one of the output receptacles between being a fixed pocket and being a dynamic pocket, wherein a fixed pocket is a pocket assigned to one or more particular denominations such that during normal operation only bills of the one or more particular denominations may be transported to the fixed output receptacle and wherein a dynamic pocket is a subject to dynamic assignment of a bill denomination during normal operation of the denominating device.

Alternative Embodiment AP

AP. The device according to any of embodiments AE–AO further comprising means for disabling an output receptacle thereby making the output receptacle unavailable to receive bills during normal operation.

Alternative Embodiment AQ

AQ. The device of embodiment AP wherein the means for disabling comprises a processor automatically disabling an output receptacle when a problem with the output receptacle is detected.

Alternative Embodiment AR

AR. The device of embodiment AP wherein the means for disabling comprises a user interface permitting an operator to manually designate the output receptacle as unavailable.

Alternative Embodiment AS

AS. A method of sorting documents using a document evaluating device adapted to dynamically assign sorting parameters to output receptacles, the document evaluating device comprising an input receptacle, a plurality of output receptacles, and a transport mechanism positioned to individually transport documents from the input receptacle to the output receptacles, the method comprising:

(A) transporting documents from the input receptacle past a document parameter sensor;

(B) determining one or more sorting parameters of the transported documents;

(C) for each document, determining whether the one or more sorting parameters of the document have been assigned to a non-full output receptacle and (i) if so, transporting the document to the assigned non-full output receptacle;

(ii) if not, determining whether there is an open output receptacle and (a) if so, assigning the one or more sorting parameters of the document to an open output receptacle and transporting the document to the assigned output receptacle;

(b) if not, stopping the operation of the device.

Alternative Embodiment AT

AT. A method of sorting documents, each having one or more associated parameters, using a document evaluating device adapted to dynamically assign sorting parameters to output receptacles, the document evaluating device comprising an input receptacle, a plurality of output receptacles, and a transport mechanism positioned to individually transport documents from the input receptacle to the output receptacles, the method comprising:

(A) transporting a document from the input receptacle past a document parameter sensor;

(B) determining one or more sorting parameters of the transported document;

(C) determining whether the one or more sorting parameters of the document have been assigned to a non-full output receptacle and (i) if so, transporting the document to the assigned non-full output receptacle;

(ii) if not, determining whether there is an open output receptacle and (a) if so, assigning the one or more sorting parameters of the document to an open output receptacle and transporting the document to the assigned output receptacle;

(b) if not, stopping the operation of the device;

(D) repeating steps (A)–(C).

Alternative Embodiment AU

AU. A method of sorting documents, each having one or more associated parameters, using a document evaluating device adapted to dynamically assign sorting parameters to output receptacles, the evaluating device comprising an input receptacle, a plurality of output receptacles, and a transport mechanism positioned to individually transport documents from the input receptacle to the output receptacles, the method comprising:

(A) transporting a document from the input receptacle past a document parameter sensor;

(B) determining one or more sorting parameters of the transported document;

(C) determining whether the one or more sorting parameters of the document have been assigned to a non-full output receptacle and (i) if so, transporting the document to the assigned non-full output receptacle;

(ii) if not, determining whether there is an open output receptacle and (a) if so, assigning the one or more sorting parameters of the document to an open output receptacle and transporting the document to the assigned output receptacle;

(b) if not, stopping the operation of the device;

(D) determining whether an output receptacle to which a document has been transported has reached an output receptacle limit and, if so, designating the output receptacle as being full, (E) determining whether there are any more documents to be processed and if so repeating steps (A)–(E).

Alternative Embodiment AV

AV. The method of embodiment AU further comprising:

providing an indication to an operator that an output receptacle is full when an output receptacle is designated as being full; and designating an output receptacle as being open after an operator has removed all documents from the output receptacle.

Alternative Embodiment AW

AW. The method of embodiment AU further comprising:

providing an indication to an operator that an output receptacle is full when an output receptacle is designated as being full.

Alternative Embodiment AX

AX. The method of embodiment AU further comprising:

designating an output receptacle as being open after all documents have been removed therefrom.

Alternative Embodiment AY

AY. The method of embodiment AU further comprising:

designating an output receptacle as being open when no documents are contained therein.

Alternative Embodiment AZ

AZ. A method of sorting documents, each having one or more associated parameters, using a document evaluating device adapted to dynamically assign sorting parameters to output receptacles, the evaluating device comprising an input receptacle, a plurality of output receptacles, and a transport mechanism positioned to individually transport documents from the input receptacle to the output receptacles, the method comprising:

(A) determining one or more sorting parameters of a document;

(B) determining whether the one or more sorting parameters of the document have been assigned to a non-full output receptacle and (i) if so, transporting the document to the assigned non-full output receptacle, (ii) if not, determining whether there is an open output receptacle and (a) if so, assigning the one or more sorting parameters of the document to an open output receptacle and transporting the document to the assigned output receptacle;

(b) if not, stopping the operation of the device;

(C) repeating steps (A)–(B)

Alternative Embodiment BA

BA. A method of operating a multi-output receptacle document evaluator comprising an input receptacle, a plurality of output receptacles, and a transport mechanism positioned to individually transport documents from the input receptacle to the output receptacles, each document having one or more parameters associated therewith, the method comprising:

(a) determining one or more sorting parameters of a document;

(b) determining if an output receptacle is associated with the one or more sorting parameters of the document;

(c) if an output receptacle is not associated with the one or more sorting parameters of the document, associating an output receptacle with the one or more sorting parameters of the document; and (d) causing the document to be transported to an output receptacle associated with the one or more sorting parameters of the document.

Alternative Embodiment BB

BB. The method of embodiment BA wherein the document evaluator comprises three or more output receptacles.

Alternative Embodiment BC

BC. A method of operating a multi-output receptacle document evaluating device in a manner employing both one or more fixed output receptacles and one or more dynamic output receptacles wherein the document evaluation device comprises an input receptacle adapted to receive documents, the documents each having one or more associated parameters, a plurality of output receptacles, each of the one or more fixed output receptacles having a parameter assigned thereto and each of the dynamic output receptacles being capable of being dynamically assigned to a parameter, the method comprising:

(a) determining a sorting parameter of a document;

(b) determining if the parameter of the document has been assigned to one of the output receptacles and, if so, transporting the document to the assigned output receptacle;

(c) if the parameter of the document has not been assigned to an output receptacle, dynamically assigning the parameter to an output receptacle and transporting the document to the assigned output receptacle.

Alternative Embodiment BD

BD. A method of operating a multi-output receptacle document evaluating device in a manner employing both one or more fixed output receptacles and one or more dynamic output receptacles wherein the document evaluation device comprises an input receptacle adapted to receive documents, the documents each having one or more associated parameters, a plurality of output receptacles, each of the one or more fixed output receptacles having one or more parameters assigned thereto and each of the dynamic output receptacles being capable of being dynamically assigned to one or more parameters, the method comprising:

(a) determining one or more sorting parameters of a document;

(b) determining if the one or more sorting parameters of the document have been assigned to one of the output receptacles and, if so, transporting the document to the assigned output receptacle;

(c) if the one or more sorting parameters of the document have not been assigned to an output receptacle, dynamically assigning the one or more sorting parameters to an output receptacle and transporting the document to the assigned output receptacle.

Alternative Embodiment BE

BE. The method according to any of embodiments BC-BD wherein the document evaluating device is operated in a manner employing two or more dynamic output receptacles.

Alternative Embodiment BF

BF. The method according to any of embodiments BC–BD wherein the document evaluating device is operated in a manner employing three or more dynamic output receptacles.

Alternative Embodiment BG

BG. A method of operating a multi-output receptacle document evaluating device in a manner employing both one or more fixed output receptacles and one or more dynamic output receptacles wherein the document evaluation device comprises an input receptacle adapted to receive documents, the documents each having one or more associated parameters, and a plurality of output receptacles, each of the one or more fixed output receptacles having one or more sorting parameters assigned thereto and each of the dynamic output receptacles being capable of being dynamically assigned to one or more sorting parameters, the method comprising:

(A) determining one or more sorting parameters of a document;

(B) determining if the one or more sorting parameters of the document have been assigned to one or more of the fixed output receptacles, and if so, determining whether one or more of the assigned fixed output receptacles is not full, and, if so, transporting the document to one of the assigned non-full fixed output receptacles;

(C) determining if the one or more sorting parameters of the document have been assigned to a non-full dynamic output receptacle, and (i) if so, transporting the document to the assigned, non-full output receptacle, (ii) otherwise, dynamically assigning the one or more sorting parameters of the document to an open dynamic output receptacle and transporting the document to the assigned output receptacle.

Alternative Embodiment BH

BH. A method of operating a multi-output receptacle document evaluating device in a manner employing both one or more fixed output receptacles and one or more dynamic output receptacles wherein the document evaluation device comprises an input receptacle adapted to receive documents, the documents each having one or more associated parameters, and a plurality of output receptacles, each of the one or more fixed output receptacles having one or more sorting parameters assigned thereto and each of the dynamic output receptacles being capable of being dynamically assigned to one or more sorting parameters, the method comprising:

(A) determining one or more sorting parameters of a document;

(B) determining if the one or more sorting parameters of the document have been assigned to one or more of the fixed output receptacles, and if so, determining whether one or more of the assigned fixed output receptacles is not full, and, if so, transporting the document to one of the assigned non-full fixed output receptacles;

(C) determining if the one or more sorting parameters of the document have been assigned to a non-full dynamic output receptacle, and (i) if so, transporting the document to the assigned, non-full output receptacle, (ii) otherwise, dynamically assigning the one or more sorting parameters of the document to an open dynamic output receptacle and transporting the document to the assigned output receptacle.

Alternative Embodiment BI

BI. The method according to any of embodiments BG–BH further comprising suspending the operation of the device if in step (C)(ii) an open dynamic output receptacle is not available.

Alternative Embodiment BJ

BJ. The method according to any of embodiments BG–BI wherein the document evaluating device is operated in a manner employing two or more dynamic output receptacles.

Alternative Embodiment BK

BK. The method according to any of embodiments BG–BI wherein the document evaluating device is operated in a manner employing three or more dynamic output receptacles.

Alternative Embodiment BL

BL. The method according to any of embodiments BG–BK further comprising suspending the operation of the device when the one or more sorting parameters of the document has been assigned to one or more of the fixed output receptacles but none of the one or more assigned fixed output receptacles are not full.

Alternative Embodiment BM

BM. The method according to any of embodiments BG–BL further comprising proceeding to step (C) when the one or more sorting parameters of the document has been assigned to one or more of the fixed output receptacles but none of the one or more assigned fixed output receptacles are not full, thereby permitting the one or more sorting parameters of the document to be assigned to one of the dynamic output receptacles when all associated fixed output receptacles are full.

Alternative Embodiment BN

BN. The method according to any of embodiments BM further comprising suspending the operation of the device if in step (C)(ii) an open dynamic output receptacle is not available.

Alternative Embodiment BO

BO. The method according to any of embodiments BG–BN further comprising repeating steps (A)–(C) for subsequent documents in the input receptacle until there are no more documents to be processed.

Alternative Embodiment BP

BP. A method of assigning a sorting parameter to an output receptacle of a multi-output receptacle document sorting device, the method comprising an operator of the device setting an output receptacle to be either a dynamic pocket, subject to dynamic assignment of a sorting parameter during normal operation of the device, or assigning a particular sorting parameter to the output receptacle thereby making the output receptacle a fixed pocket such that during normal operation of the device only documents having the particular sorting parameter may be transported into the output receptacle.

Alternative Embodiment BQ

BQ. A method of assigning a sorting parameter to an output receptacle of a multi-output receptacle document sorting device, the method comprising an operator of the device setting an output receptacle to be either a dynamic pocket, subject to dynamic assignment of a document parameter during normal operation of the device, or assigning one or more particular sorting parameters to the output receptacle thereby making the output receptacle a fixed pocket such that during normal operation of the device only documents having the one or more particular parameters may be transported into the output receptacle.

Alternative Embodiment BR

BR. A method of assigning sorting parameters to output receptacles of a document sorting device comprising a plurality of output receptacles, the method comprising setting each one of the output receptacles to be either a dynamic pocket, subject to dynamic assignment of a sorting parameter during normal operation of the sorting device, or a fixed pocket, the setting of an output receptacle to be fixed pocket comprising assigning a particular parameter to the output receptacle such that during normal operation only documents of the particular parameter may be transported to the fixed output receptacle.

Alternative Embodiment BS

BS. A method of assigning sorting parameters to output receptacles of a document sorting device comprising a plurality of output receptacles, the method comprising setting each one of the output receptacles to be either a dynamic pocket, subject to dynamic assignment of a sorting parameter during normal operation of the sorting device, or a fixed pocket, the setting of an output receptacle to be a fixed pocket comprising assigning one or more particular sorting parameters to the output receptacle such that during normal operation only documents of the one or more particular parameters may be transported to the fixed output receptacle.

Alternative Embodiment BT

BT. The method according to any of embodiments AS–BS further comprising disabling an output receptacle thereby making the output receptacle unavailable to receive documents during normal operation.

Alternative Embodiment BU

BU. The method of embodiment BT wherein the disabling comprises automatically disabling an output receptacle when a problem with the output receptacle is detected.

Alternative Embodiment BV

BV. The method of embodiment BT wherein the disabling comprises an operator to manually designating the output receptacle as unavailable via a user interface.

Alternative Embodiment BW

BW. The method according to any of embodiments AS–BV wherein the documents are currency bills.

Alternative Embodiment BX

BX. The method of embodiment BW wherein a sorting parameter comprises country of origin.

Alternative Embodiment BY

BY. The method of embodiment BW wherein sorting parameters comprise the combination of denomination and country of origin.

Alternative Embodiment BZ

BZ. The method according to any of embodiments AS–BV wherein the documents are currency notes.

Alternative Embodiment CA

CA. The method according to any of embodiments AS–BV wherein the documents are substitute currency notes.

Alternative Embodiment CB

CB. The method according to any of embodiments BZ–CA wherein a sorting parameter comprises issuing entity.

Alternative Embodiment CC

CC. The method according to any of embodiments BW, BZ, or CA wherein a sorting parameter comprises face orientation.

Alternative Embodiment CD

CD. The method according to any of embodiments BW, BZ, or CA wherein a sorting parameter comprises forward/reverse orientation.

Alternative Embodiment CE

CE. The method according to any of embodiments BW, BZ, or CA wherein sorting parameters comprise the combination of denomination and face orientation.

Alternative Embodiment CF

CF. The method according to any of embodiments BW, BZ, or CA wherein sorting parameters comprise the combination of denomination and forward/reverse orientation.

Alternative Embodiment CG

CG. The method according to any of embodiments BW, BZ, or CA wherein sorting parameters comprise the combination of denomination and issuing entity.

Alternative Embodiment CH

CH. The method according to any of embodiments BW, BZ, or CA wherein sorting parameters comprise the combination of denomination, face orientation, and forward/reverse orientation.

Alternative Embodiment CI

CI. The method according to any of embodiments BW, BZ, or CA wherein sorting parameters comprise the combination of denomination, face orientation, and issuing entity.

Alternative Embodiment CJ

CJ. The method according to any of embodiments BW, BZ, or CA wherein sorting parameters comprise the combination of denomination, forward/reverse orientation, and issuing entity.

Alternative Embodiment CK

CK. The method according to any of embodiments BW, BZ, or CA wherein sorting parameters comprise the combination of denomination, face orientation, forward/reverse orientation, and issuing entity.

Alternative Embodiment CL

CL. The method according to any of embodiments BW, BZ, or CA wherein sorting parameters comprise the combination of issuing entity and face orientation.

Alternative Embodiment CM

CM. The method according to any of embodiments BW, BZ, or CA wherein sorting parameters comprise the combination of issuing entity and forward/reverse orientation.

Alternative Embodiment CN

CN. The method according to any of embodiments BW, BZ, or CA wherein sorting parameters comprise the combination of issuing entity, face orientation, and forward/reverse orientation.

Alternative Embodiment CO

CO. The method according to any of embodiments AS-BV wherein the documents are currency documents.

Alternative Embodiment CP

CP. The method according to any of embodiments AS-BV wherein the documents are substitute currency media.

Alternative Embodiment CQ

CQ. A document evaluating device comprising:

an input receptacle adapted to receive a stack of documents, each document having one or more parameters associated therewith, a plurality of output receptacles, a transport mechanism adapted to individually transport documents from the input receptacle to the output receptacles; and a processor adapted to control the operation of the document evaluating device, the processor being programmed to:

determine a sorting parameter of a document;

determine if an output receptacle is associated with the sorting parameter of the document;

if an output receptacle is not associated with the sorting parameter of the document, associate an output receptacle with the sorting parameter of the document; and cause the document to be transported to an output receptacle associated with the sorting parameter of the document.

Alternative Embodiment CR

CR. A document evaluating device adapted to dynamically assign parameters to output receptacles, the document evaluating device comprising:

an input receptacle, a plurality of output receptacles, a transport mechanism adapted to individually transport documents from the input receptacle to the output receptacles and a processor adapted to control of the operation of the device, the processor being programmed to:

(A) cause a document to be transported from the input receptacle past a document parameter sensor;

(B) determine a sorting parameter of the transported document;

(C) determine whether the sorting parameter of the document has been assigned to a non-full output receptacle and (i) if so, transport the document to the assigned non-full output receptacle;

(ii) if not, determine whether there is an open output receptacle and (a) if so, assign the sorting parameter of the document to an open output receptacle and cause the document to be transported to the assigned output receptacle;

(b) if not, stop the operation of the device;

(D) determine whether an output receptacle to which a document has been transported has reached an output receptacle limit and, if so, designate the output receptacle as being full;

(E) determine whether there are any more documents to be processed and if so repeating steps (A)–(E).

Alternative Embodiment CS

CS. The device of embodiment CR wherein the processor is further programmed to:

provide an indication to an operator that an output receptacle is full when an output receptacle is designated as being full;

designate an output receptacle as being open after an operator has removed all documents from the output receptacle.

Alternative Embodiment CT

CT. The device of embodiment CR wherein the processor is further programmed to provide an indication to an operator that an output receptacle is full when an output receptacle is designated as being full.

Alternative Embodiment CU

CU. The device of embodiment CR wherein the device is adapted to permit an operator to remove documents from the output receptacles and wherein the processor is further programmed to:

designate an output receptacle as being open after an operator has removed all documents from the output receptacle, thereby making the output receptacle available to have a sorting parameter re-assigned thereto.

Alternative Embodiment CV

CV. The device of embodiment CR wherein the device is adapted to permit documents to be removed from the output receptacles and wherein the processor is further programmed to:

designate an output receptacle as being open when no documents are contained therein thereby making the output receptacle available to have a sorting parameter dynamically assigned thereto.

Alternative Embodiment CW

CW. A document sorting device comprising:

(a) a plurality of output receptacles; and (b) an operator interface adapted to permit the operator of the device to change the designation of each one of the output receptacles between being a fixed pocket and being a dynamic pocket.

Alternative Embodiment CX

CX. A document sorting device comprising:

(a) a plurality of output receptacles; and (b) an operator interface adapted to permit the operator of the device to change the designation of at least one of the output receptacles between being a fixed pocket and being a dynamic pocket.

Alternative Embodiment CY

CY. A document sorting device adapted to discriminate documents having a plurality of parameters comprising:

(a) a plurality of output receptacles; and (b) an operator interface adapted to permit the operator of the device to change the designation of at least one of the output receptacles among a plurality of fixed parameter designations and a dynamic parameter designation.

Alternative Embodiment CZ

CZ. A document sorting device comprising:

(a) a plurality of output receptacles;

(b) an operator interface adapted to permit the operator of the device to change the designation of at least one of the output receptacles between being a fixed pocket and being a dynamic pocket, wherein a fixed pocket is a pocket assigned to a particular sorting parameter such that during normal operation only documents of the particular sorting parameter may be transported to the fixed output receptacle and wherein a dynamic pocket is a subject to dynamic assignment of a sorting parameter during normal operation of the sorting device.

Alternative Embodiment DA

DA. A document sorting device comprising:

(a) a plurality of output receptacles;

(b) an operator interface adapted to permit the operator of the device to change the designation of at least one of the output receptacles between being a fixed pocket and being a dynamic pocket, wherein a fixed pocket is a pocket assigned to one or more particular sorting parameters such that during normal operation only documents of the one or more particular sorting parameters may be transported to the fixed output receptacle and wherein a dynamic pocket is a subject to dynamic assignment of a sorting parameter during normal operation of the sorting device.

Alternative Embodiment DB

DB. The device according to any of embodiments CQ–DA further comprising means for disabling an output receptacle thereby making the output receptacle unavailable to receive documents during normal operation.

Alternative Embodiment DC

DC. The device of embodiment DB wherein the means for disabling comprises a processor automatically disabling an output receptacle when a problem with the output receptacle is detected.

Alternative Embodiment DD

DD. The device of embodiment DB wherein the means for disabling comprises a user interface permitting an operator to manually designate the output receptacle as unavailable.

Alternative Embodiment DE

DE. The device according to any of embodiments CQ–DD wherein the documents are currency bills.

Alternative Embodiment DF

DF. The device of embodiment DE wherein a sorting parameter comprises country of origin.

Alternative Embodiment DG

DG. The device of embodiment DE wherein sorting parameters comprise the combination of denomination and country of origin.

Alternative Embodiment DH

DH. The device according to any of embodiments CQ–DD wherein the documents are currency notes.

Alternative Embodiment DI

DI. The device according to any of embodiments CQ–DD wherein the documents are substitute currency notes.

Alternative Embodiment DJ

DJ. The device according to any of embodiments DH–DI wherein a sorting parameter comprises issuing entity.

Alternative Embodiment DK

DK. The device according to any of embodiments DE, DH, or DI wherein a sorting parameter comprises face orientation.

Alternative Embodiment DL

DL. The device according to any of embodiments DE, DH, or DI wherein a sorting parameter comprises forward/reverse orientation.

Alternative Embodiment DM

DM. The device according to any of embodiments DE, DH, or DI wherein sorting parameters comprise the combination of denomination and face orientation.

Alternative Embodiment DN

DN. The device according to any of embodiments DE, DH, or DI wherein sorting parameters comprise the combination of denomination and forward/reverse orientation.

Alternative Embodiment DO

DO. The device according to any of embodiments DE, DH, or DI wherein sorting parameters comprise the combination of denomination and issuing entity.

Alternative Embodiment DP

DP. The device according to any of embodiments DE, DH, or DI wherein sorting parameters comprise the combination of denomination, face orientation, and forward/reverse orientation.

Alternative Embodiment DQ

DQ. The device according to any of embodiments DE, DH, or DI wherein sorting parameters comprise the combination of denomination, face orientation, and issuing entity.

Alternative Embodiment DR

DR. The device according to any of embodiments DE, DH, or DI wherein sorting parameters comprise the combination of denomination, forward/reverse orientation, and issuing entity.

Alternative Embodiment DS

DS. The device according to any of embodiments DE, DH, or DI wherein sorting parameters comprise the combination of denomination, face orientation, forward/reverse orientation, and issuing entity.

Alternative Embodiment DT

DT. The device according to any of embodiments DE, DH, or DI wherein sorting parameters comprise the combination of issuing entity and face orientation.

Alternative Embodiment DU

DU. The device according to any of embodiments DE, DH, or DI wherein sorting parameters comprise the combination of issuing entity and forward/reverse orientation.

Alternative Embodiment DV

DV. The device according to any of embodiments DE, DH, or DI wherein sorting parameters comprise the combination of issuing entity, face orientation, and forward/reverse orientation.

Alternative Embodiment DW

DW. The device according to any of embodiments CQ–DD wherein the documents are currency documents.

Alternative Embodiment DX

DX. The device according to any of embodiments CQ–DD wherein the documents are substitute currency media.

Alternative Embodiment DY

DY. A method of sorting currency bills each having an associated denomination, using a currency bill evaluating device adapted to dynamically assign denominations to pockets, the method comprising:

(a) setting each one of the output receptacles to be either a dynamic pocket, subject to dynamic assignment of a bill denomination, or a fixed pocket, subject to fixed assignment of a bill denomination;

(b) receiving a stack of bills in an input receptacle;

(c) evaluating a bill to determine the denomination of the bill;

(d) transporting the bill from the input receptacle to a fixed pocket, based on the denomination of the bill, if the determined bill denomination is associated with the fixed pocket;

(e) transporting the bill from the input receptacle to a dynamic pocket, based on the denomination of the bill, if the determined bill denomination is associated with the dynamic pocket; and (f) stopping if a predetermined condition occurs.

Alternative Embodiment DZ

DZ. The method of Embodiment DY, wherein a predetermined condition comprises:

(a) jamming of the evaluation device;

(b) manually stopping the evaluation device by an operator; and (c) depletion of the currency bill stack received in the input receptacle.

Alternative Embodiment EA

EA. The method of Embodiment DY, further comprising determining a limit for each of a plurality of output receptacles.

Alternative Embodiment EB

EB. The method of Embodiment EA, wherein the predetermined condition comprises a pocket reaching its limit.

Alternative Embodiment EC

EC. A method of sorting currency bills, each having an associated denomination, using a currency bill evaluating device adapted to dynamically assign denominations to output pockets, the method comprising:

(a) receiving a stack of bills in an input receptacle;

(b) evaluating each bill from the input receptacle, one at a time, to determine the denomination of each bill;

(c) if the denomination of a bill has been assigned to a dynamic pocket, transporting the bill to the dynamic pocket to which the denomination of the bill has been assigned; and (d) if the denomination of a bill has not been assigned to a dynamic pocket, assigning automatically the determined denomination of the bill to an available dynamic pocket and transporting the bill to the dynamic pocket to which the denomination of the bill has been assigned.

Alternative Embodiment ED

ED. The method of Embodiment EC further comprising stopping if a predetermined condition occurs.

Alternative Embodiment EE

EE. The method of Embodiment ED, wherein a predetermined condition comprises:

(a) jamming of the evaluation device;

(b) manually stopping the evaluation device by an operator; and (c) depletion of the currency bill stack received in the input receptacle.

Alternative Embodiment EF

EF. The method of Embodiment EC, further comprising setting each one of the output pockets to be dynamic pockets, each dynamic pocket being subject to dynamic assignment of a bill denomination.

Alternative Embodiment EG

EG. A currency evaluating device for receiving a stack of currency bills, each bill having a respective denomination, the device comprising:

(a) an input receptacle for receiving the stack of bills to be evaluated;

(b) a plurality of output receptacles for receiving the evaluated bills;

(c) a transport mechanism adapted to individually transport bills from the input receptacle to the output receptacles;

(d) an evaluating unit for determining the denomination of each bill; and (e) means for dynamically assigning a bill denomination to at least one of the output receptacles.

Alternative Embodiment EH

EH. A currency evaluating device for receiving a stack of currency bills, each bill having a respective denomination, the device comprising:

(a) an input receptacle for receiving the stack of bills to be evaluated;

(b) a plurality of output receptacles for receiving the evaluated bills;

(c) a transport mechanism adapted to individually transport bills from the input receptacle to the output receptacles;

(d) an evaluating unit for determining the denomination of each bill; and (e) means for designating at least one of the output receptacles to be a dynamic pocket.

Alternative Embodiment EI

EI. A computer readable medium for use in a currency evaluator comprising an input receptacle, a plurality of output receptacles, and a transport mechanism positioned to individually transport bills from the input receptacle to the output receptacles, the medium comprising programming steps for:

(a) determining a denomination associated with a bill;

(b) determining if an output receptacle is associated with the bill denomination;

(c) if an output receptacle is not associated with the bill denomination, assigning an output receptacle to the bill denomination; and (d) causing the bill to be transported to an output receptacle assigned to the bill denomination.

Alternative Embodiment EJ

EJ. A computer readable medium as in Embodiment El, further comprising:

(a) determining if an output receptacle has reached its limit if the output receptacle is associated with the bill denomination; and (b) assigning the bill denomination to an empty one of the output receptacles if the output receptacle has reached its limit or if no output receptacle is associated with the bill denomination.

Alternative Embodiment EK

EK. A computer readable medium for use in a currency evaluator comprising a plurality of output pockets, the medium comprising programming steps for:

(a) selecting one or more output pockets to be dynamic pockets; and (b) assigning at least one bill denomination to at least one of the dynamic pockets, wherein the assignment of the bill denomination is based on a denomination evaluation of a bill.

Alternative Embodiment EL

EL. A computer readable medium for use in a currency evaluator comprising a plurality of output pockets, the medium comprising programming steps for:

(a) permitting an operator of the currency evaluator to designate one or more output pockets to be dynamic pockets; and (b) assigning at least one bill denomination to at least one of the dynamic pockets, wherein the assignment of the bill denomination is based on a denomination evaluation of a bill.

Alternative Embodiment EM

EM. A computer readable medium for use in a currency evaluator comprising an input receptacle, a plurality of output receptacles, and a transport mechanism positioned to individually transport bills from the input receptacle to the output receptacles, the medium comprising programming steps for:

(a) choosing a full dynamic mode, a dynamic-fixed mode, or a fixed mode;

(b) if choosing a dynamic-fixed mode or a fixed mode, then assigning at least one of the output receptacles as a fixed output receptacle and assigned a bill parameter to the fixed output receptacle, wherein in normal operation an evaluated bill satisfying the bill parameter is transported to the fixed output receptacle;

(c) evaluating a currency bill according to the bill parameter;

(d) if the bill parameter of the currency bill has been assigned to an output receptacle, then transporting the currency bill to the assigned output receptacle;

(e) if the bill parameter of the currency bill has not been assigned to an output receptacle, assigning the bill parameter of the currency bill to an output receptacle and transporting the currency bill to the assigned output receptacle; and (f) repeating steps (c)–(e) until a stopping condition exists.

Alternative Embodiment EN

EN. The computer readable medium as in Embodiment EM, further comprising determining a limit for each of the output receptacles.

Alternative Embodiment EO

EO. The computer readable medium as in Embodiment EM, further comprising prior to transporting a currency bill to an assigned output receptacle determining whether a limit for the assigned output receptacle has been reached and if so treating the bill parameter of the currency bill as having not been assigned to an output receptacle and proceeding under step (e).

Alternative Embodiment EP

EP. The computer readable medium as in Embodiment EO, wherein the stopping condition comprises in step (e) there being an absence of an available dynamic mode output receptacle to which to assign a bill parameter of the currency bill.

Alternative Embodiment EQ

EQ. The computer readable medium as in Embodiment EM, wherein the stopping condition comprises in step (e) there being an absence of an available dynamic mode output receptacle to which to assign a bill parameter of the currency bill.

Alternative Embodiment ER

ER. The computer readable medium as in Embodiment EM, wherein the stopping condition comprises:

(a) jamming of the evaluation device;

(b) manually stopping the evaluation device by an operator; and (c) depletion of the currency bill stack received in the input receptacle.

Alternative Embodiment ES

ES. A computer readable medium for use in a currency evaluator comprising an input receptacle, a plurality of output receptacles, and a transport mechanism positioned to individually transport currency bills from the input receptacle to the output receptacles, each currency bill having a denomination associated therewith, the medium comprising programming steps for:

(a) choosing a full dynamic mode of operation;

(b) evaluating a currency bill to determine the denomination of the currency bill;

(c) transporting the currency bill to an offsort pocket if the bill denomination is not identified;

(d) transporting the currency bill to an assigned pocket if a non-full pocket has already been assigned for the denomination of the currency bill;

(e) assigning the denomination of the currency bill to an open pocket and transporting the currency bill to the assigned pocket if a non-full pocket has not already been assigned for the denomination of the currency bill and if there is an open pocket;

(f) stopping if a non-full pocket has not already been assigned for the denomination of the currency bill and if there is no open pocket;

(g) setting a pocket full flag if a pocket limit has been reached;

(h) stopping if there are no more currency bills to process; and (i) if stopping has not occurred, repeating steps (b) through (h).

Alternative Embodiment ET

ET. A computer readable medium for use in a currency evaluator comprising an input receptacle, a plurality of output receptacles, and a transport mechanism positioned to individually transport currency bills from the input receptacle to the output receptacles, each currency bill having a denomination associated therewith, the medium comprising programming steps for:

(a) evaluating a currency bill to determine the denomination of the currency bill;

(b) transporting the currency bill to an offsort pocket if the bill denomination is not determined;

(c) transporting the currency bill to an assigned pocket if a non-full pocket has already been assigned for the denomination of the currency bill;

(d) assigning the denomination of the currency bill to an open pocket and transporting the currency bill to the assigned pocket if a non-full pocket has not already been assigned for the denomination of the currency bill and if there is an open pocket;

(e) stopping if a non-full pocket has not already been assigned for the denomination of the currency bill and if there is no open pocket;

(f) setting a pocket full flag if a pocket limit has been reached;

(g) stopping if there are no more currency bills to process; and (h) if stopping has not occurred, repeating steps (a) through (g).

Alternative Embodiment EU

EU. A computer readable medium for use in a currency evaluator comprising an input receptacle, a plurality of output receptacles, and a transport mechanism positioned to individually transport currency bills from the input receptacle to the output receptacles, individual currency bills having one or more parameters associated therewith, the medium comprising programming steps for:

(a) choosing a full dynamic mode of operation;

(b) evaluating a currency bill to determine a parameter of the currency bill;

(c) transporting the currency bill to an offsort pocket if the bill parameter is not determined;

(d) transporting the currency bill to an assigned pocket if a non-full pocket has already been assigned for the parameter of the currency bill;

(e) assigning the parameter of the currency bill to an open pocket and transporting the currency bill to the assigned pocket if a non-full pocket has not already been assigned for the parameter of the currency bill and if there is an open pocket;

(i) stopping if a non-full pocket has not already been assigned for the parameter of the currency bill and if there is no open pocket;

(f) setting a pocket full flag if a pocket limit has been reached;

(g) stopping if there are no more currency bills to process; and (h) if stopping has not occurred, repeating steps (b) through (g).

Alternative Embodiment EV

EV. A computer readable medium for use in a currency evaluator comprising an input receptacle, a plurality of output receptacles, and a transport mechanism positioned to individually transport currency bills from the input receptacle to the output receptacles, individual currency bills having one or more parameters associated therewith, the medium comprising programming steps for:

(a) evaluating a currency bill to determine a parameter of the currency bill;

(b) transporting the currency bill to an offsort pocket if the bill parameter is not determined;

(c) transporting the currency bill to an assigned pocket if a non-full pocket has already been assigned for the parameter of the currency bill;

(d) assigning the parameter of the currency bill to an open pocket and transporting the currency bill to the assigned pocket if a non-full pocket has not already been assigned for the parameter of the currency bill and if there is an open pocket;

(e) stopping if a non-full pocket has not already been assigned for the parameter of the currency bill and if there is no open pocket;

(f) setting a pocket full flag if a pocket limit has been reached;

(g) stopping if there are no more currency bills to process; and (h) if stopping has not occurred, repeating steps (a) through (f).

Alternative Embodiment EW

EW. A method of sorting currency bills, each having an associated denomination, using a currency bill evaluating device comprising an input receptacle, a plurality of output receptacles, and a transport mechanism positioned to transport bills from the input receptacle to the output receptacles, the method comprising:

(A) transporting bills from the input receptacle past a bill denominating sensor;

(B) determining the denomination of a first transported bill;

(C) associating a first denomination with a first one of the output receptacles wherein the first denomination is the denomination of the first transported bill and delivering the first transported bill to the first one of the output receptacles;

(D) determining the denomination of subsequent transported bills;

(E) upon first encountering a transported bill having a denomination other than the first denomination, defining a second denomination as the denomination of the transported bill having a denomination other than the first denomination and associating the second denomination with a second one of the output receptacles;

(F) delivering bills having the first denomination to the first output receptacle;

(G) delivering bills having the second denomination to the second output receptacle;

(H) monitoring whether the first output receptacle has been cleared of bills;

(I) monitoring whether the second output receptacle has been cleared of bills;

(J) upon encountering a transported bill having a denomination other than the first or second denominations, determining whether either the first or second output receptacle has been cleared of bills and if so, (i) redefining the first denomination to be the denomination of the bill having a denomination other than the first or second denominations if the first output receptacle has been cleared and delivering the bill to the first output receptacle;

(ii) redefining the second denomination to be the denomination of the bill having a denomination other than the first or second denominations if the second output receptacle has been cleared and delivering the bill to the second output receptacle;

(K) repeating steps (F)–(J).

Alternative Embodiment EX

EX. The method of embodiment EW further comprising suspending the operation the device if in step (J) neither the first nor the second output receptacles has been cleared of bills upon encountering a transported bill having a denomination other than the first or second denominations.

Alternative Embodiment EY

EY. A method of sorting currency bills, each having an associated denomination, using a currency bill evaluating device comprising an input receptacle, a plurality of output receptacles, and a transport mechanism positioned to transport bills from the input receptacle to the output receptacles, the method comprising:

(A) transporting bills from the input receptacle past a bill denominating sensor;

(B) determining the denomination of the bills;

(C) determining the first denomination of the bills encountered;

(D) determining the second denomination of the bills encountered;

(E) associating the first denomination with a first one of the output receptacles;

(F) associating the second denomination with a second one of the output receptacles;

(G) delivering bills having the first denomination to the first output receptacle;

(H) delivering bills having the second denomination to the second output receptacle;

(I) monitoring whether the first output receptacle has been cleared of bills;

(J) monitoring whether the second output receptacle has been cleared of bills;

(K) upon encountering a bill having a denomination other than the first or second denominations, determining whether either the first or second output receptacle has been cleared of bills and if so, (i) redefining the first denomination to be the denomination of the bill having a denomination other than the first or second denominations if the first output receptacle has been cleared;

(ii) redefining the second denomination to be the denomination of the bill having a denomination other than the first or second denominations if the second output receptacle has been cleared;

(L) repeating steps (E)–(K).

Alternative Embodiment EZ

EZ. A method of sorting currency bills, each having an associated denomination, using a currency bill evaluating device comprising an input receptacle, a plurality of output receptacles, and a transport mechanism positioned to transport bills from the input receptacle to the output receptacles, the method comprising:

(A) transporting bills from the input receptacle past a bill denominating sensor;

(B) determining the denomination of the bills;

(C) determining the first denomination of the bills encountered;

(D) determining the second denomination of the bills encountered;

(E) associating the first denomination with a first one of the output receptacles;

(F) associating the second denomination with a second one of the output receptacles;

(G) delivering bills having the first denomination to the first output receptacle;

(H) delivering bills having the second denomination to the second output receptacle.

Alternative Embodiment FA

FA. A currency bill evaluating device comprising:

an input receptacle, a plurality of output receptacles, a transport mechanism adapted to individually transport bills from the input receptacle to the output receptacles and a processor adapted to control of the operation of the device, the processor being programmed to:

(A) cause bills to be transported from the input receptacle past a bill denominating sensor;

(B) determine the denomination of a first transported bill;

(C) associate a first denomination with a first one of the output receptacles wherein the first denomination is the denomination of the first transported bill and cause the first transported bill to be delivered to the first one of the output receptacles;

(D) determine the denomination of subsequent transported bills;

(E) upon first encountering a transported bill having a denomination other than the first denomination, define a second denomination as the denomination of the transported bill having a denomination other than the first denomination and associate the second denomination with a second one of the output receptacles;

(F) cause bills having the first denomination to be delivered to the first output receptacle;

(G) cause bills having the second denomination to be delivered to the second output receptacle;

(H) monitor whether the first output receptacle has been cleared of bills;

(I) monitor whether the second output receptacle has been cleared of bills;

(J) upon encountering a transported bill having a denomination other than the first or second denominations, determine whether either the first or second output receptacle has been cleared of bills and if so, (i) redefine the first denomination to be the denomination of the bill having a denomination other than the first or second denominations if the first output receptacle has been cleared and cause the bill to be delivered to the first output receptacle;

(ii) redefine the second denomination to be the denomination of the bill having a denomination other than the first or second denominations if the second output receptacle has been cleared and cause the bill to be delivered to the second output receptacle;

(K) repeating steps (F)–(J).

Alternative Embodiment FB

FB. The device of embodiment FA wherein the processor is further programmed to suspend the operation the device if in step (J) neither the first nor the second output receptacles has been cleared of bills upon encountering a transported bill having a denomination other than the first or second denominations.

Alternative Embodiment FC

FC. A currency bill evaluating device comprising:

an input receptacle, a plurality of output receptacles, a transport mechanism adapted to individually transport bills from the input receptacle to the output receptacles and a processor adapted to control of the operation of the device, the processor being programmed to:

(A) cause bills to be transported from the input receptacle past a bill denominating sensor;

(B) determine the denomination of the bills;

(C) determine the first denomination of the bills encountered;

(D) determine the second denomination of the bills encountered;

(E) associate the first denomination with a first one of the output receptacles;

(F) associate the second denomination with a second one of the output receptacles;

(G) cause bills having the firs t denomination t o be delivered to the first output receptacle;

(H) cause bills having the second denomination to be delivered to the second output receptacle;

(I) monitor whether the first output receptacle has been cleared of bills;

(J) monitor whether the second output receptacle has been cleared of bills;

(K) upon encountering a bill having a denomination other than the first or second denominations, determine whether either the first or second output receptacle has been cleared of bills and if so, (i) redefine the first denomination to be the denomination of the bill having a denomination other than the first or second denominations if the first output receptacle has been cleared;

(ii) redefine the second denomination to be the denomination of the bill having a denomination other than the first or second denominations if the second output receptacle has been cleared;

(L) repeating steps (E)–(K).

Alternative Embodiment FD

FD. A currency bill evaluating device comprising:

an input receptacle, a plurality of output receptacles, a transport mechanism adapted to individually transport bills from the input receptacle to the output receptacles and a processor adapted to control of the operation of the device, the processor being programmed to:

(A) cause bills to be transported from the input receptacle past a bill denominating sensor;

(B) determine the denomination of the bills;

(C) determine the first denomination of the bills encountered (D) determine the second denomination of the bills encountered;

(E) associate the first denomination with a first one of the output receptacles;

(F) associate the second denomination with a second one of the output receptacles;

(G) cause bills having the first denomination to be delivered to the first output receptacle;

(H) cause bills having the second denomination to be delivered to the second output receptacle.

Alternative Embodiment FE

FE. A method of evaluating a stack of currency bills using a currency evaluation device comprising:

receiving a stack of bills in an input receptacle of the evaluation device;

transporting the bills, one at a time, from the input receptacle to one of two or more output receptacles of the currency evaluation device, the two output receptacles having at least a first output receptacle and a second output receptacle;

counting and determining the denomination of the bills including bills of a plurality of denominations utilizing a detector positioned along a transport path between the input receptacle and the output receptacles;

monitoring whether any bills are present in the first and second output receptacles;

routing bills having a first target denomination to the first output receptacle;

generating a denomination change error upon first encountering a bill not having the first target denomination;

designating a second target denomination to be the denomination of the bill causing generating the first denomination change error upon the first occurrence of a denomination change error, routing bills having a second target denomination to the second output receptacle;

upon encountering a bill having neither the first target denomination nor the second target denomination, then generating a denomination change error and a) stopping the operation of the device if both the first and the second output receptacles have one or more bills therein; or b) routing the bill having neither the first target denomination nor the second target denomination to an empty one of the first and second output receptacles if one of the output receptacles is empty and resetting the first target denomination to be the denomination of the bill if the bill is routed to the first output receptacle and resetting the second target denomination to be the denomination of the bill if the bill is routed to the second output receptacle.

Alternative Embodiment FF

FF. The method of embodiment FE wherein the counting and determining the denomination of the bills comprises counting and determining United States currency bills of a plurality of denominations.

Alternative Embodiment FG

FG. The method of embodiment FE wherein the counting and determining of the currency bills is performed independent of the size of the bills.

Alternative Embodiment FH

FH. The method of embodiment FE wherein the determining of the denomination of bills includes denominating currency bills of a plurality of denominations, genuine bills of the plurality of denominations having a plurality of images associated therewith, the plurality of images defining the plurality of denominations, and further including scanning the image associated with each of the bills and distinguishing among the plurality of denominations using the scanned image.

While the invention is susceptible to various modifications and alternative forms, specific embodiments thereof have been shown by way of example in the drawings and herein described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

What is claimed is:

1. A method of sorting currency bills, each having an associated denomination, using a currency bill evaluating device adapted to dynamically assign denominations to output receptacles, the currency evaluating device comprising an input receptacle, a plurality of output receptacles, and a transport mechanism positioned to individually transport bills from the input receptacle to the output receptacles, the method comprising the acts of:

(A) transporting a bill from the input receptacle past a bill denominating sensor;

(B) determining the denomination of the transported bill;

(C) determining whether the denomination of the bill has been assigned to a non-full output receptacle and (i) if so, transporting the bill to the assigned non-full output receptacle;

(ii) if not, determining whether there is an open output receptacle and (a) if so, assigning the denomination of the bill to an open output receptacle and transporting the bill to the assigned output receptacle;

(b) if not, stopping the operation of the device;

(D) determining whether an output receptacle to which a bill has been transported has reached an output receptacle limit and, if so, designating the output receptacle as being full;

(E) determining whether there are any more bills to be processed and if so repeating acts (A)–(E).

2. The method of claim 1 further comprising the acts of:

providing an indication to an operator that an output receptacle is full when an output receptacle is designated as being full; and designating an output receptacle as being open after an operator has removed all bills from the output receptacle.

3. The method of claim 1 further comprising the act of:

providing an indication to an operator that an output receptacle is full when an output receptacle is designated as being full.

4. The method of claim 1 further comprising the act of:

designating an output receptacle as being open after all bills have been removed therefrom.

5. The method of claim 1 further comprising the act of:

designating an output receptacle as being open when no bills are contained therein.

6. A method of operating a multi-output receptacle currency evaluating device in a manner employing both one or more fixed output receptacles and one or more dynamic output receptacles wherein the currency evaluation device comprises an input receptacle adapted to receive currency bills, the currency bills each having an associated denomination, a plurality of output receptacles, each of the one or more fixed output receptacles having a denomination assigned thereto and each of the dynamic output receptacles being capable of being dynamically assigned to a denomination, the method comprising the acts of:

(A) determining the denomination of a bill;

(B) determining if the denomination of the bill has been assigned to one or more of the fixed output receptacles, and if so, determining whether one or more of the assigned fixed output receptacles is not full, and, if so, transporting the bill to one of the assigned non-full fixed output receptacles;

(C) determining if the denomination of the bill has been assigned to a non-full dynamic output receptacle, and (i) if so, transporting the bill to the assigned, non-full output receptacle, (ii) otherwise, dynamically assigning the denomination of the bill to an open dynamic output receptacle and transporting the bill to the assigned output receptacle.

7. A method of operating a multi-output receptacle currency evaluating device in a manner employing both one or more fixed output receptacles and one or more dynamic output receptacles wherein the currency evaluation device comprises an input receptacle adapted to receive currency bills, the currency bills each having an associated denomination, a plurality of output receptacles, each of the one or more fixed output receptacles having one or more denominations assigned thereto and each of the dynamic output receptacles being capable of being dynamically assigned to a denomination, the method comprising the acts of:

(A) determining the denomination of a bill;

(B) determining if the denomination of the bill has been assigned to one or more of the fixed output receptacles, and if so, determining whether one or more of the assigned fixed output receptacles is not full, and, if so, transporting the bill to one of the assigned non-full fixed output receptacles;

(C) determining if the denomination of the bill has been assigned to a non-full dynamic output receptacle, and (i) if so, transporting the bill to the assigned, non-full output receptacle, (ii) otherwise, dynamically assigning the denomination of the bill to an open dynamic output receptacle and transporting the bill to the assigned output receptacle.

8. The method of claim 7 further comprising the act of suspending the operation of the device if in (C)(ii) an open dynamic output receptacle is not available.

9. The method of claim 7 wherein the currency evaluating device is operated in a manner employing two or more dynamic output receptacles.

10. The method of claim 7 wherein the currency evaluating device is operated in a manner employing three or more dynamic output receptacles.

11. The method of claim 7 further comprising the act of suspending the operation of the device when the denomination of the bill has been assigned to one or more of the fixed output receptacles but none of the one or more assigned fixed output receptacles are not full.

12. The method of claim 7 further comprising the act of proceeding to (C) when the denomination of the bill has been assigned to one or more of the fixed output receptacles but none of the one or more assigned fixed output receptacles are not full, thereby permitting the denomination of the bill to be assigned to one of the dynamic output receptacles when all associated fixed output receptacles are full.

13. The method of claim 12 further comprising the act of suspending the operation of the device if in (C)(ii) an open dynamic output receptacle is not available.

14. The method of claim 7 further comprising the act of repeating acts (A)–(C) for subsequent bills in the input receptacle until there are no more bills to be processed.

15. A method of assigning denominations to output receptacles of a currency denominating device comprising a plurality of output receptacles, the method comprising the act of setting each one of the output receptacles to be either a dynamic pocket, subject to dynamic assignment of a bill denomination during normal operation of the denominating device, or a fixed pocket, the setting of an output receptacle to be fixed pocket comprising the act of assigning a particular denomination to the output receptacle such that during normal operation only bills of the particular denomination may be transported to the fixed output receptacle.

16. A currency bill evaluating device adapted to dynamically assign denominations to output receptacles, the currency evaluating device comprising:

a currency bill input receptacle, a plurality of currency bill output receptacles, a transport mechanism adapted to individually transport bills from the input receptacle to the output receptacles and a processor adapted to control of the operation of the device, the processor being programmed to:

(A) cause a bill to be transported from the input receptacle past a bill denominating sensor;

(B) determine the denomination of the transported bill;

(C) determine whether the denomination of the bill has been assigned to a non-full output receptacle and (i) if so, transport the bill to the assigned non-full output receptacle;

(ii) if not, determine whether there is an open output receptacle and (a) if so, assign the denomination of the bill to an open output receptacle and cause the bill to be transported to the assigned output receptacle;

(b) if not, stop the operation of the device;

(D) determine whether an output receptacle to which a bill has been transported has reached an output receptacle limit and, if so, designate the output receptacle as being full;

(E) determine whether there are any more bills to be processed and if so repeating acts (A)–(E).

17. The device of claim 16 wherein the processor is further programmed to:

provide an indication to an operator that an output receptacle is full when an output receptacle is designated as being full;

designate an output receptacle as being open after an operator has removed all bills from the output receptacle.

18. The device of claim 16 wherein the processor is further programmed to provide an indication to an operator that an output receptacle is full when an output receptacle is designated as being full.

19. The device of claim 16 wherein the device is adapted to permit an operator to remove bills from the output receptacles and wherein the processor is further programmed to:

designate an output receptacle as being open after an operator has removed all bills from the output receptacle, thereby making the output receptacle available to have a denomination re-assigned thereto.

20. The device of claim 16 wherein the device is adapted to permit bills to be removed from the output receptacles and wherein the processor is further programmed to:

designate an output receptacle as being open when no bills are contained therein thereby making the output receptacle available to have a denomination dynamically assigned thereto.

21. A currency bill denominating device comprising:

(a) a plurality of currency bill output receptacles; and (b) an operator interface adapted to permit the operator of the device to change the designation of each one of the output receptacles between being a fixed pocket and being a dynamic pocket.

22. A currency bill denominating device comprising:

(a) a plurality of currency bill output receptacles; and (b) an operator interface adapted to permit the operator of the device to change the designation of each of the output receptacles between being a fixed pocket and being a dynamic pocket, wherein a fixed pocket is a pocket assigned to a particular denomination such that during normal operation only bills of the particular denomination may be transported to the fixed output receptacle and wherein a dynamic pocket is a subject to dynamic assignment of a bill denomination during normal operation of the denominating device.

23. A method of sorting currency bills, each having an associated denomination, using a currency bill evaluating device comprising an input receptacle, a plurality of output receptacles, and a transport mechanism positioned to transport bills from the input receptacle to the output receptacles, the method comprising the acts of:

(A) transporting currency bills from the input receptacle past a bill denominating sensor;

(B) determining the denomination of a first transported bill;

(C) associating a first denomination with a first one of the output receptacles wherein the first denomination is the denomination of the first transported bill and delivering the first transported bill to the first one of the output receptacles;

(D) determining the denomination of subsequent transported bills;

(E) upon first encountering a transported bill having a denomination other than the first denomination, defining a second denomination as the denomination of the transported bill having a denomination other than the first denomination and associating the second denomination with a second one of the output receptacles;

(F) delivering bills having the first denomination to the first output receptacle;

(G) delivering bills having the second denomination to the second output receptacle;

(H) monitoring whether the first output receptacle has been cleared of bills;

(I) monitoring whether the second output receptacle has been cleared of bills;

(J) upon encountering a transported bill having a denomination other than the first or second denominations, determining whether either the first or second output receptacle has been cleared of bills and if so, (i) redefining the first denomination to be the denomination of the bill having a denomination other than the first or second denominations if the first output receptacle has been cleared and delivering the bill to the first output receptacle;

(ii) redefining the second denomination to be the denomination of the bill having a denomination other than the first or second denominations if the second output receptacle has been cleared and delivering the bill to the second output receptacle;

(K) repeating acts (F)–(J).

24. The method of claim 23 further comprising the act of suspending the operation the device if in (J) neither the first nor the second output receptacles has been cleared of bills upon encountering a transported bill having a denomination other than the first or second denominations.

25. A method of sorting currency bills, each having an associated denomination, using a currency bill evaluating device comprising an input receptacle, a plurality of output receptacles, and a transport mechanism positioned to transport bills from the input receptacle to the output receptacles, the method comprising the acts of:

(A) transporting bills from the input receptacle past a bill denominating sensor;

(B) determining the denomination of the bills;

(C) determining the first denomination of the bills encountered;

(D) determining the second denomination of the bills encountered;

(E) associating the first denomination with a first one of the output receptacles;

(F) associating the second denomination with a second one of the output receptacles;

(G) delivering bills having the first denomination to the first output receptacle;

(H) delivering bills having the second denomination to the second output receptacle;

(I) monitoring whether the first output receptacle has been cleared of bills;

(J) monitoring whether the second output receptacle has been cleared of bills;

(K) upon encountering a bill having a denomination other than the first or second denominations, determining whether either the first or second output receptacle has been cleared of bills and if so, (i) redefining the first denomination to be the denomination of the bill having a denomination other than the first or second denominations if the first output receptacle has been cleared;

(ii) redefining the second denomination to be the denomination of the bill having a denomination other than the first or second denominations if the second output receptacle has been cleared;

(L) repeating acts (E)–(K).

26. A method of sorting currency bills, each having an associated denomination, using a currency bill evaluating device comprising an input receptacle, a plurality of output receptacles, and a transport mechanism positioned to transport bills from the input receptacle to the output receptacles, the method comprising the acts of:

(A) transporting bills from the input receptacle past a bill denominating sensor;

(B) determining the denomination of the bills;

(C) determining the first denomination of the bills encountered;

(D) determining the second denomination of the bills encountered;

(E) associating the first denomination with a first one of the output receptacles;

(F) associating the second denomination with a second one of the output receptacles;

(G) delivering bills having the first denomination to the first output receptacle;

(H) delivering bills having the second denomination to the second output receptacle.

27. A currency bill evaluating device comprising:

a currency bill input receptacle, a plurality of currency bill output receptacles, a transport mechanism adapted to individually transport bills from the input receptacle to the output receptacles and a processor adapted to control of the operation of the device, the processor being programmed to:

(A) cause bills to be transported from the input receptacle past a bill denominating sensor;

(B) determine the denomination of a first transported bill;

(C) associate a first denomination with a first one of the output receptacles wherein the first denomination is the denomination of the first transported bill and cause the first transported bill to be delivered to the first one of the output receptacles;

(D) determine the denomination of subsequent transported bills;

(E) upon first encountering a transported bill having a denomination other than the first denomination, define a second denomination as the denomination of the transported bill having a denomination other than the first denomination and associate the second denomination with a second one of the output receptacles;

(F) cause bills having the first denomination to be delivered to the first output receptacle;

(G) cause bills having the second denomination to be delivered to the second output receptacle;

(H) monitor whether the first output receptacle has been cleared of bills;

(I) monitor whether the second output receptacle has been cleared of bills;

(J) upon encountering a transported bill having a denomination other than the first or second denominations, determine whether either the first or second output receptacle has been cleared of bills and if so, (i) redefine the first denomination to be the denomination of the bill having a denomination other than the first or second denominations if the first output receptacle has been cleared and cause the bill to be delivered to the first output receptacle;

(ii) redefine the second denomination lobe the denomination of the bill having a denomination other than the first or second denominations if the second output receptacle has been cleared and cause the bill to be delivered to the second output receptacle;

(K) repeating acts (F)–(J).

28. The device of claim 27 wherein the processor is further programmed to suspend the operation the device if in (J) neither the first nor the second output receptacles has been cleared of bills upon encountering a transported bill having a denomination other than the first or second denominations.

29. A currency bill evaluating device comprising:

a currency bill input receptacle, a plurality of currency bill output receptacles, a transport mechanism adapted to individually transport bills from the input receptacle to the output receptacles and a processor adapted to control of the operation of the device, the processor being programmed to:

(A) cause bills to be transported from the input receptacle past a bill denominating sensor;

(B) determine the denomination of the bills;

(C) determine the first denomination of the bills encountered;

(D) determine the second denomination of the bills encountered;

(E) associate the first denomination with a first one of the output receptacles;

(F) associate the second denomination with a second one of the output receptacles;

(G) cause bills having the first denomination to be delivered to the first output receptacle;

(H) cause bills having the second denomination to be delivered to the second output receptacle;

(I) monitor whether the first output receptacle has been cleared of bills;

(J) monitor whether the second output receptacle has been cleared of bills;

(K) upon encountering a bill having a denomination other than the first or second denominations, determine whether either the first or second output receptacle has been cleared of bills and if so, (i) redefine the first denomination to be the denomination of the bill having a denomination other than the first or second denominations if the first output receptacle has been cleared;

(ii) redefine the second denomination to be the denomination of the bill having a denomination other than the first or second denominations if the second output receptacle has been cleared;

(L) repeating acts (E)–(K).

30. A currency bill evaluating device comprising:

a currency bill input receptacle, a plurality of currency bill output receptacles, a transport mechanism adapted to individually transport bills from the input receptacle to the output receptacles and a processor adapted to control of the operation of the device, the processor being programmed to:

(A) cause bills to be transported from the input receptacle past a bill denominating sensor;

(B) determine the denomination of the bills;

(C) determine the first denomination of the bills encountered;

(D) determine the second denomination of the bills encountered;

(E) associate the first denomination with a first one of the output receptacles;

(F) associate the second denomination with a second one of the output receptacles;

(G) cause bills having the first denomination to be delivered to the first output receptacle; and (H) cause bills having the second denomination to be delivered to the second output receptacle.

31. A method of evaluating a stack of currency bills using a currency evaluation device comprising the acts of:

receiving a stack of bills in an input receptacle of the evaluation device;

transporting the bills, one at a time, from the input receptacle to one of two or more output receptacles of the currency evaluation device, the two or more output receptacles having at least a first output receptacle and a second output receptacle;

counting and determining the denomination of the bills including bills of a plurality of denominations utilizing a detector positioned along a transport path between the input receptacle and the output receptacles;

monitoring whether any bills are present in the first and second output receptacles;

routing bills having a first target denomination to the first output receptacle;

generating a denomination change error upon first encountering a bill not having the first target denomination;

designating a second target denomination to be the denomination of the bill causing generating the first denomination change error upon the first occurrence of a denomination change error, routing bills having a second target denomination to the second output receptacle;

upon encountering a bill having neither the first target denomination nor the second target denomination, then generating a denomination change error and a) stopping the operation of the device if both the first and the second output receptacles have one or more bills therein; or b) routing the bill having neither the first target denomination nor the second target denomination to an empty one of the first and second output receptacles if one of the output receptacles is empty and resetting the first target denomination to be the denomination of the bill if the bill is routed to the first output receptacle and resetting the second target denomination to be the denomination of the bill if the bill is routed to the second output receptacle.

32. The method of claim 31 wherein the acts of the counting and determining the denomination of the bills comprises the acts of counting and determining United States currency bills of a plurality of denominations.

33. The method of claim 31 wherein the acts of the counting and determining of the currency bills is performed independent of the size of the bills.

34. The method of claim 31 wherein the act of the determining of the denomination of bills includes the act of denominating currency bills of a plurality of denominations, genuine bills of the plurality of denominations having a plurality of images associated therewith, the plurality of images defining the plurality of denominations, and further including the acts of scanning the image associated with each of the bills and distinguishing among the plurality of denominations using the scanned image.

* * * * *

UNITED STATES PATENT AND TRADEMARK OFFICE

CERTIFICATE OF CORRECTION

PATENT NO. : 6,860,375 B2
APPLICATION NO. : 10/068977
DATED : March 1, 2005
INVENTOR(S) : Curtis W. Hallowell et al.

It is certified that error appears in the above-identified patent and that said Letters Patent is hereby corrected as shown below:

In Col. 1, line 11, change "Ser. No. 08/864,432" to -- Ser. No. 08/864,423 -- ;

In Col. 1, line 25, change "Aug. 8" to -- Aug. 10 -- .

In Col. 103, line 33, change "lobe" to -- to be --.

Signed and Sealed this

Third Day of July, 2007

JON W. DUDAS
*Director of the United States Patent and Trademark Office*